US005316479A

United States Patent [19]

Wong et al.

[11] Patent Number: 5,316,479

[45] Date of Patent: May 31, 1994

[54] FIREARM TRAINING SYSTEM AND METHOD

[75] Inventors: John D. E. Wong, Ontario; Curtis C. Tugnum, Alberta; James P. Logan, Ontario, all of Canada

[73] Assignee: National Research Council of Canada, Canada

[21] Appl. No.: 1,442

[22] Filed: Jan. 7, 1993

Related U.S. Application Data

[63] Continuation-in-part of Ser. No. 699,903, May 14, 1991, abandoned.

[51] Int. Cl.[5] ..... F41A 33/00

[52] U.S. Cl. ..... 434/11; 434/16; 434/19; 73/379.02; 128/774

[58] Field of Search ..... 434/11, 16, 18–23, 434/27; 73/379.01, 379.02; 273/311, 313, 348; 340/573; 128/774

[56] References Cited

U.S. PATENT DOCUMENTS

| | | | |
|---|---|---|---|
| 4,457,715 | 7/1984 | Knight et al. | 434/22 |
| 4,619,616 | 10/1986 | Clarke | 434/22 |
| 4,884,445 | 12/1989 | Sarloff et al. | 73/379.02 |
| 4,923,401 | 5/1990 | Marshall et al. | 434/18 X |
| 4,955,812 | 9/1990 | Hill | 434/16 |
| 5,184,628 | 2/1993 | Shah et al. | 73/379.02 X |

OTHER PUBLICATIONS

"Reasonable and Necessary", by David W. Young, 1991, Defense Firearms ownership and use in Canada, RN Roxboro, Quebec, Canada, pp. 96–100.

"The Modern Technique of the Pistol", G. B. Morrison, 1991, Gunsite Press, Paulden, Ariz.

*Primary Examiner*—Richard J. Apley
*Assistant Examiner*—Joe H. Cheng
*Attorney, Agent, or Firm*—Andrus, Sceales, Starke & Sawall

[57] ABSTRACT

A firearm training system is disclosed, which allows the measurement and display as a function of time of the hand grip force pattern applied to the grip of a firearm by a weapon hand of a shooter. This permits the detection of variations in the individual hand grip forces in the pattern during firing of the weapon. This firearm training system preferably also provides for the detection and display as a function of time of the position of the firearm trigger. The system includes separate force transducers for the side and front-to-back grip forces applied to the side surfaces and one of the front and back surfaces of the grip respectively as well as a trigger position sensor. A relative value of the hand grip forces detected by the transducers and a relative trigger position detected by the sensor are graphically displayed by the system as a function of time. Further disclosed is a method of training a shooter by determining the grip pattern of the shooter's weapon hand on a firearm by detecting a front-to-back grip force and a side grip force applied by the weapon hand and graphically displaying as a function of time a relative value of the front-to-back and side grip forces respectively. Thus, the system provides for a more effective training of a shooter, which substantially translates into cost savings in terms of training time and ammunition, especially since the firearm training system and method may effectively be used under both dry and live fire conditions.

21 Claims, 6 Drawing Sheets

FIREARM TRAINING SYSTEM AND METHOD

This is a continuation-in-part application of the pending application Ser. No. 07/699,903, filed May 14, 1991, now abandoned.

BACKGROUND OF THE INVENTION

The invention relates to training systems used to train and analyze the performance of shooters and in particular to a firearm training system which measures and displays appropriately as a function of time, a pattern of grip pressure applied to the firearm by the weapon hand of the shooter.

The equipment used in the training of shooting methods and skills has been traditionally limited to silhouette targets positioned on a supervised shooting range. With such equipment, the assessment of a shooter's competence in basic shooting technique is limited to an examination of the shot groupings on the target relative to the intended point of aim. Improper stance or posture, incorrect aim or "slight picture", improper grip of the firearm, blinking, waver, jerking or flinching due to anticipation of the recoil and loud report of the shot are among the many common problems which lead to shooting inaccuracy or inconsistency.

Proper technique in the basic fundamentals of shooting technique such as visual aim, stance and breathing have proven to be relatively easy for instructors to convey to the shooter, due to their simple nature. The common experience of firearms instructors, however, is that of these various possible problems in individual shooting technique, the most difficult to clearly identify, convey to the shooter and then correct are those problems relating to the gripping of the gun and the manipulation of the trigger, as specifically discussed in two publications respectively entitled "Reasonable and Necessary", (David W. Young, 1991, REASONABLE AND NECESSARY, Defensive Firearms Ownership and use in Canada, RN, Roxboro, Québec, Canada) and "The Modern Technique of The Pistol", (G. B. Morrison, 1991, Gunsite Press, Paulden, Ariz.). Proper exertion of grip and correct trigger movement are relatively complex and unfamiliar physical motor skill actions for shooters to learn, and are accordingly difficult to master. Young states that the trigger must be moved smoothly and consciously to the rear in one motion, without any sympathetic movement of the other fingers. However, learning shooters have the tendency to either unconsciously increase their grip force simultaneously with advancing trigger position, due to the inability to separate the index or trigger finger's action from that of the other fingers, or increase either the trigger pull rate, or the front-to-back grip force in isolation, as Morrison also points out. However, these errors are, due to the subtle nature of the movements involved, difficult or even impossible to visually detect. As a result, instructors are typically forced to resort to costly trial-and-error methods involving repetitive live fire coupled with close one-on-one observation and further "target-reading" by the instructor in order to deduce with more certainty or precision the error in technique being committed; costly additional instructor time and ammunition is inevitably consumed in the course of this approach. Thus, an apparatus is desired which would provide direct, objective and unambiguous feedback as to the shooter's actual performance in the key shooting fundamentals of grip and trigger manipulation.

When grip force is discussed in Morrison as a potential cause of a shooting problem, it is always a specific direction or component of grip pressure which is being referred to rather than just front-to-back or an average overall grip force. For example, if shots in target practice land to the right side of the target area ("3 O'-Clock" shooting) excessive support-hand grip pressure, which would appear solely as a left-grip side force in the case of a right-handed shooter, or as a right-side force in the case of a left-handed shooter, is a possible cause. Thus, it is submitted that shooting problem could only be effectively diagnosed if one is equipped with feedback on both front-to-back as well as side-to-side grip forces, throughout the cycle of the shot. On the other hand, trigger pull problems, for example "mashing" or failure to pull the trigger at the proper rate in a controlled manner are also mentioned as possible causes for shooting inaccuracy either in isolation or in combination with improper grip. Furthermore, "flinch" manifests itself as a jerking action in the hands either in just the grip fingers, or in both the grip and the trigger fingers. Thus, feedback on both grip force and trigger motion is preferable for a more effective diagnosis of shooting problems.

Consequently, a means was therefore desired which would provide shooters and instructors with proper feedback on the grip pattern, i.e. the front-to-back grip forces of the shooter's weapon hand and preferably also trigger pull. Thus, a means was sought which would detect the grip force pattern and preferably the trigger position and display them for visual feedback. This feedback would also be stored to permit later analysis and comparison of individual shooter performance against already stored feedback of previous personal performance, or against known well executed performance by others, so as to provide a clear and highly visually relevant objective for the shooter. These goals should preferably be accomplished under live fire conditions as well as dry-fire conditions, given that some of the common problems mentioned above arise only when the shooter is in anticipation of the loud report and violent recoil of the firearm. In other words, a firearm training system was desired which would permit assessment of a shooter's grip and preferably trigger pull versus time.

Witzig, in his German patent application published Dec. 9, 1976 (DT 2,523,362) teaches an electronic shooting simulator for target and shooting practice with weapons adapted to fire live ammunition. The simulator provides for the detection of especially arm waver and jerk during firing of the weapon. To this end, the simulator includes a receiver shell, which has electronics for detecting a beam of radiation emitted by the target and is placed into the barrel of a regular hand gun or rifle. Thus, the shooting simulator may only be used under "dry-fire" conditions. The beam emitted by the target may only be detected by the receiver shell when the weapon is correctly aimed at the target so that the beam may travel along the barrel of the weapon and impinge onto the forward end of the receiver shell. Although this simulator provides for the detection of problems such as arm waver and jerk, no further resolution or pinpointing of specific errors in basic technique is achieved which would allow the shooter to independently and reliably identify specific wrong movements or errors in basic technique without significant instructor involvement or intervention. No means is taught for the displaying or recording of trigger position or grip force components versus time.

British patent GB 2,013,844 to Knight teaches a training equipment facilitating the training of a marksman. The equipment includes a weapon such as a gun or rifle with pressure transducers mounted on the weapon to detect the pressure applied by the marksman to the butt, the cheek and the hand grips of the gun. A representation of the weapon is shown on a visual display unit and those parts of the representation which correspond to the parts of the weapon that are provided with pressure transducers may be illuminated with different colors representing different levels of applied pressure. The display may constantly indicate the actual pressure applied to the weapon by different colors or may only display the pressure applied at the time of firing, after firing or while firing a burst of shots. However, the training system only provides a visual display of an actual momentary pressure or the difference between the actual momentary pressure and an optimum pressure stored by a computer driving the system. Thus, this system, while providing a momentary display of hand grip forces, does not provide for a display of grip forces throughout the cycle of the shot. Further, the system of Knight renders the detection of variations in hand grip forces during firing, which occupy very short time intervals and which may significantly affect shot accuracy, virtually impossible even for an instructor or observer to detect, let alone the shooter who is presumably visually busy aiming at the time of firing. Furthermore, the system provides no measurement or display of the trigger position versus time along with a display of grip forces, nor any other means of time-wise correlation between these so as to allow more precise isolation of problems in basic shooting technique. Rather, only a means of determining whether or not the trigger is advanced beyond a specific point in its overall travel range is mentioned.

U.S. Pat. No. 4,970,819 to Mayhak describes a firearm safety system, which prevents the firing of a firearm unless the hand grip of the firearm is held with a certain predetermined grip pattern. Mayhak describes in particular a safety system for a revolver, which is equipped in its hand grip with pressure transducers, a grip pattern recognition neural network memory, a microprocessor, a solenoid activated trigger lock and a battery power supply. Thus, Mayhak teaches the use of pressure transducers in the hand grip of a revolver for the sensing of the hand grip pattern of a user. However, no display of the hand grip force levels or of trigger position against time, nor any means of storing for analysis or correlating these two sets of information to deduce and convey to the user errors in shooting technique, are provided.

U.S. Pat. No. 1,494,407 to Beach describes the design of a model of a handgun which is specially equipped so as to offer variance, for practice purposes, of the physical resistance on the frontal area of the grip handle and of the trigger. This design, while of some value in familiarizing the shooter with differing trigger pull loads and in developing, as claimed, increased finger and grip strength, does not teach any visual display or recording whatsoever of grip force components or trigger position versus time so as to permit any assessment or analysis of technique in grip or trigger manipulation. Further, the design described is not seen as intended for, or in any acceptable way applicable to, an operational firearm.

U.S. Pat. No. 4,913,655 to Pinkley et al describes a device for measuring and improving trigger pull technique. This device involves installation inside the handle area of the handgun of a variable slide resistor to convert trigger position to an electrical signal which can then be visually represented on a chart recorder. While this system provides a means of measuring and recording the smoothness and rate of trigger pull, the design requires an internal mechanical installation of the handgun which would, due to the use of the internal space of the handle for the cartridge magazine on all modern pistols, and the inaccessible nature of the trigger mechanism on many guns, not be applicable to an operational handgun for live fire for many of the handgun designs now predominantly used in North America. This design also does not teach or suggest any measurement, recording or display of grip forces, limiting its value for the specific diagnosis of many errors in fundamental technique by the user. Lack of suitability of this design for live fire would suggest that the various errors in technique typically arising only when live fire scenarios are involved could not be exposed by the disclosed design.

Thus, none of these prior art systems provides a satisfactory solution for the detection and display of unwanted variations in the hand grip forces of the weapon hand and for the detection of uneven trigger pull, which may both lead to shooting inaccuracy.

SUMMARY OF THE INVENTION

It is now an object of the present invention to provide a firearm training system which reduces the instructor time and ammunition cost associated with the training of a shooter.

It is another object of the present invention to provide visual feedback to the shooter or the instructor on the grip pattern of the shooter's weapon hand and preferably on the trigger position to permit more rapid, accurate and thorough analysis of basic shooting technique than is possible with established methods or techniques, thereby assisting the shooter to more quickly and progressively develop proper shooting technique which is essential for good shooting accuracy and consistency.

It is yet a further object of the invention to provide a firearm training system, which measures and displays appropriately as a function of time at least one but preferably two distinct components of grip force applied to a weapon by a shooter. In a preferred embodiment, the system simultaneously measures and displays these grip force components and the trigger position as a function of time.

Accordingly, the invention provides a firearm training system for use in combination with a firearm having a grip and a trigger, including force transducing means for detecting a hand grip force pattern applied to the grip of the firearm by a weapon hand of a shooter; and display means for displaying as a function of time a relative value of hand grip forces detected by the transducing means.

The force transducing means preferably separately detects a side and a front-to-back hand grip force applied by the weapon hand to a side surface and one of front and back surfaces of the grip respectively and the display means preferably simultaneously displays as a function of time a relative value of the front-to-back and side forces respectively.

In another preferred embodiment, the firearm training system further includes position sensing means for sensing a relative position of the trigger and display means for displaying as a function of time a relative position of the trigger detected by the position sensing means, which display means preferably simultaneously displays the relative value of the side and front-to-back hand grip forces and the relative trigger position. It is also preferred that the displayed relative forces and position are measured for a corresponding shot cycle which includes a firing of the firearm, this time period being subsequently displayed by the display means.

In a further preferred embodiment, the firearm training system for use in combination with a firearm having a grip and a trigger includes force transducing means having a side force transducer and a front-to-back force transducer for respectively detecting a side grip force applied to a side of the grip and a front-to-back force applied to one of front and back surfaces of the grip by a weapon hand of a shooter; and a display means for displaying as a function of time a relative value of the side and front-to-back forces respectively.

The display means includes a power supply for supplying operating power to the transducers, an analog-to-digital convertor for converting analog signals produced by the transducers to digital signals, a computerized module for storing the digital signals, and a display module for displaying for each of the transducers a graph representing the relative value of the respective hand grip forces as a function of time.

In yet another preferred embodiment, the transducing means further includes a position sensor for sensing a relative position of the trigger, which trigger position sensor receives power from the power supply and provides analog signals to the analog-to-digital convertor. The convertor in turn provides separate digital signals to the computerized module for each of the force transducers and the position sensor and the display module separately displays as a function of time the relative values of the hand grip forces as well as a trigger pull graph representing the relative position of the trigger as a function of time. It is preferred that all the transducers are incorporated into the grip of the firearm and are completely unobtrusive. The analog signals produced by the transducing means may be provided to the analog-to-digital converter, which is preferably located remote from the firearm, by way of a flexible cable. The analog signals may also be transmitted to the analog-to-digital convertor as electromagnetic waves generated by a transmitter incorporated into the grip and received by a receiver incorporated with or connected to the analog-to-digital convertor.

The computerized module preferably provides sufficient data storage capacity that the time period during which the hand grip force(s) and trigger position are measured may include repeated firings of the firearm. It is also preferred that plots of shots fired may be stored for each shooter individually so that the shooter's progress during training may be assessed. The display module may provide for the parallel display of an 'ideal shot' plot of an instructor and a 'bad shot' plot of a shooter in training.

The invention further provides for a method of training a shooter by determining the grip pattern of a weapon hand of the shooter on a firearm having a grip, comprising the steps of measuring a front-to-back grip force and a side grip force applied by the weapon hand to one of front and back surfaces and a side surface of the grip respectively; and graphically displaying as a function of time a relative value of the front force and the side force respectively.

The invention also provides for a method of training a shooter by determining the grip pattern and trigger pull of a weapon hand operating a firearm having a grip and a trigger, during firing of the firearm, comprising the steps of measuring a front-to-back grip force and a side grip force applied by the weapon hand to one of front and back surfaces and a side surface of the grip respectively and simultaneously measuring a relative position of the trigger; and graphically displaying as a function of time a relative value of the front force and the side force respectively and a relative position of the trigger, whereby the displayed time period is a shot cycle including a firing of the firearm.

The method may be used under "dry" or "live" firing conditions.

Thus, the firearm training system and method of the present invention provides a graphic display of "poor" or "ideal" shots in terms of improper variations in the hand grip force or an incorrect hand grip pattern and preferably in terms of uneven trigger motion. Furthermore, the shooter can view plots of these parameters for his shots and compare them with ideal plots generated by an instructor. The shooter may also relate in real time what is being sensed by the weapon hand to quantitative measurements. This provides for a more effective training of the shooter which substantially translates into cost savings in terms of training time and ammunition, especially since a training system in accordance with the present invention may be effectively used under "live" and "dry" firing conditions.

BRIEF DESCRIPTION OF THE DRAWINGS

The invention will now be further described by example only and with reference to the following drawings, wherein.

DETAILED DESCRIPTION OF THE SPECIFIC EMBODIMENT

Figure 1:
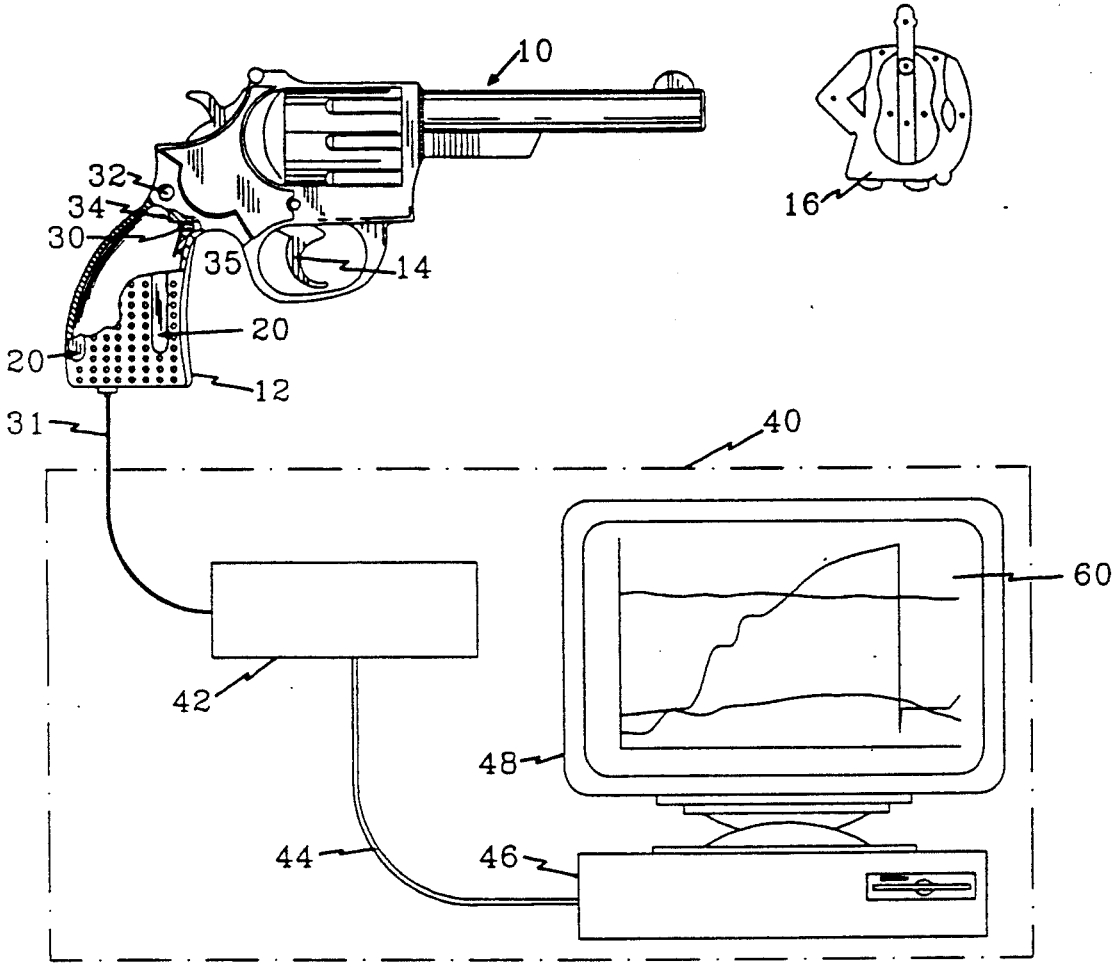
FIG. 1 is a schematic illustration of a preferred embodiment of a firearm training system in accordance with the invention.

In a preferred embodiment of the invention as illustrated in FIG. 1 of the drawings, the training system is used in combination with a revolver 10 (SMITH & WESSON Model 10-10, K-frame, 0.38 caliber), which has a grip 12 and a trigger 14 and may be aimed at a target 16 for shooting practice. The system includes hand grip force transducers 20 and a trigger position sensor 30 for detecting the hand grip force pattern applied to grip 12 by a hand of a shooter (not illustrated) and the relative position of trigger 14 respectively. A display apparatus 40 provides a graphical display 60 of the relative value of the hand grip forces and the relative trigger position as a function of time. Thus, variations in a shooter's hand grip forces during the firing of the firearm and the smoothness of the trigger pull may be easily detected, which substantially facilitates shooter training.

Figure 2A:
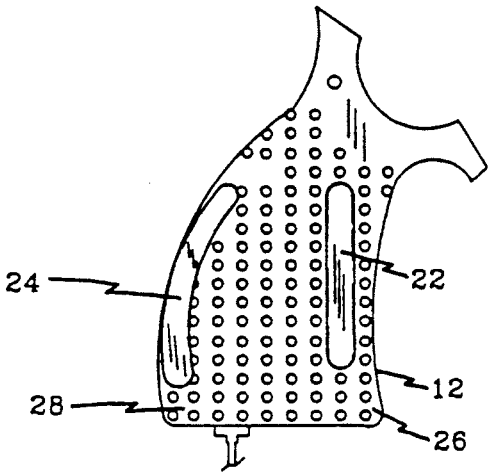
FIG. 2A shows a side view of the grip of the firearm used in the embodiment of FIG. 1.
Figure 2B:
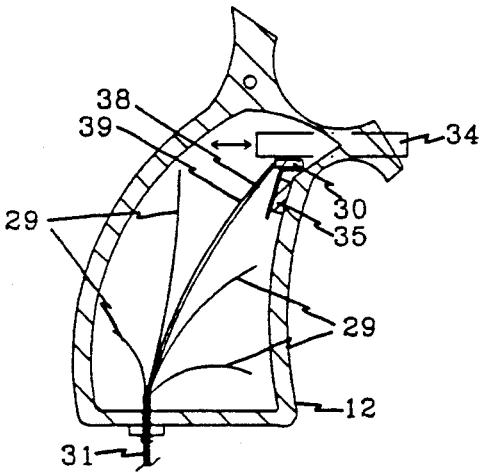
FIG. 2B is a cross-section through the grip of the firearm used in the embodiment of FIG. 1 illustrating the wiring attached to the interior of the firearm grip.
Figure 3:
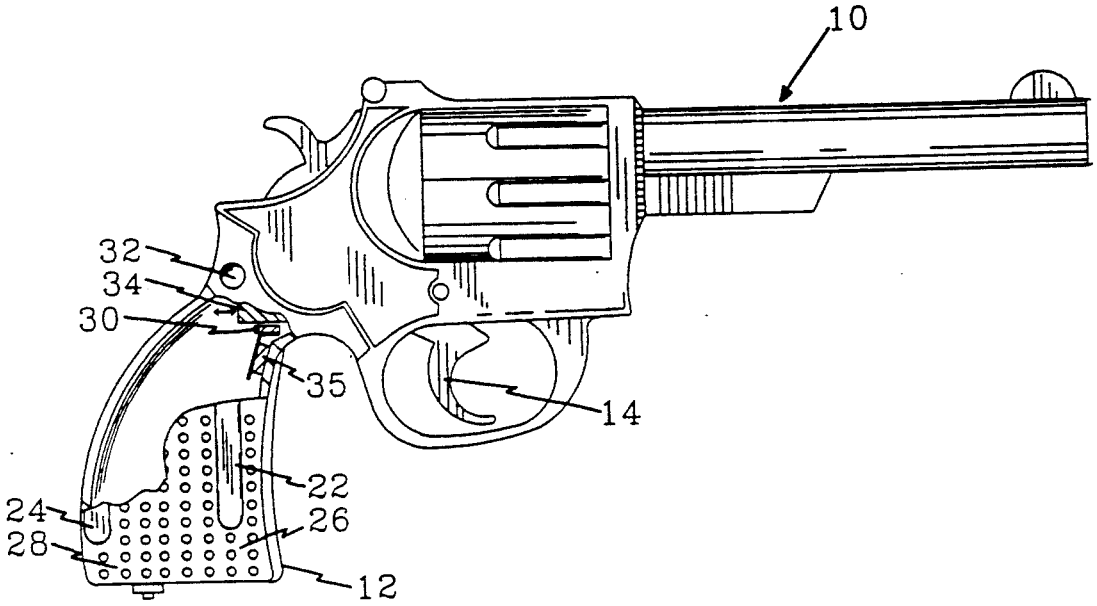
FIG. 3 is an enlarged elevational view and partial cross-section of a preferred firearm used in the embodiment shown in FIG. 1.

Referring now to FIGS. 1, 2A and B and 3, grip 12 includes a pair of side force transducers 22 (only one illustrated) and a front-to-back force transducer 24, which detect the hand grip force pattern applied to opposite side surfaces 26 (only one side visible) and a back surface 28 of grip 12 respectively. As illustrated in FIG. 2A, the front-to-back grip force is detected with the front-to-back force transducers 24 that is inset into the grip 12 at the rear of the grip in this embodiment, but may also be inset into the grip at the front of the grip depending on the construction of the grip of the respective firearm used. If the front-to-back sensor 24 is inset at the front of the grip 12, it detects the front-to-back grip force applied to a front surface of the grip. Only one front-to-back force transducer 24 is included for each revolver 10. The right side grip force transducer 22 is shown in FIG. 2A. This sensor is also inset into the grip 12 and is duplicated on the left side of the grip 12 as a left-side grip force sensor (not shown). The hand grip force transducers 22, 24 and the trigger position sensor 30 are of the non-contact type and there are no mechanical interfaces between the transducers, the sensor and the mechanical components of the revolver 10. The internal details of the grip 12 are illustrated in FIG. 2B. Each of the previously mentioned transducers has a wire 29 running from each of its ends. These wires are inserted through the grip 12 to be connected inside the grip 12 to the interface cable 31 connecting the transducers 22, 24 and the sensor 30 with the display apparatus 40 (see FIG. 1). All of the transducers inset in the handgun grip 12 are covered with a protective rubber coating (not shown). The detailed construction of the force transducers 22, 24 will be described below with reference to FIG. 4. Grip 12 has two half sections which are made of metal with an outer coating of rubber material (partially cut away in FIGS. 1 and 3). The two half sections are held together by a transverse bolt, screw or rivet 32 (see FIGS. 1 and 3). Transducers 22 and 24 are constructed as thin strips, which are mounted onto the outside of the half sections and are completely covered by and embedded within the rubber coating. Position sensor 30 is a magnetic field strength detector or magneto resistor which is mounted in grip 12 sufficiently spaced apart from a part 34 of the firearm which moves with the trigger to allow free movement of the trigger associated part during pulling of the trigger 14 and to not interfere with the operation of the firearm. The trigger associated part 34 may be the trigger spring of a revolver. The movement of the trigger associated part 34 is indicated by a double arrow in FIGS. 1, 2B and 3. A small powerful magnet 35 is mounted on a non-movable part of the firearm close to the trigger associated part 34. In the embodiments shown, the magnet 35 is mounted to the inside of grip 12 to allow removal of the sensor 30, all transducers 22, 24 and the interface cable 31 from the revolver 10. Movement of the trigger related part 34 leads to variations in the magnetic field generated by the magnet 35. These variations which are a function of the trigger position are translated by sensor 30 into changes in electrical resistance. The sensor 30 is connected by wires 38, 39 to the 6-conductor interface cable 31. A grip 12 instrumented in the manner described has substantially the same shape and dimension as a standard grip of revolver 10 so that the difference between an instrumented grip 12 including transducers 22, 24 and sensor 30 and a standard grip is substantially imperceptible and the operating characteristics of revolver 10 are not altered in any way as a result of the installation of transducers 22, 24 and sensor 30.

Display apparatus 40 includes an electric interface unit 42, a computerized module 46 and a display module 48. The electric interface unit 42 supplies operating power to the transducers 20 and the sensor 30. The analog voltage drops produced by the transducers 22, 24, and the sensor 30 are converted by the electric interface unit 42 into digital signals which are fed to computerized module 46 through a 3-conductor cable 44. The computerized module 46 is a personal computer (PC) which stores the digital signals provided by the electric interface unit 42 and uses them together with digital time signals provided by an internal clock (not illustrated) to plot a graph representing as a function of time the relative grip forces and trigger position detected by the transducers 22, 24 and the sensor 30 respectively. Separate graphs are plotted for the side forces, the front force and the trigger position. The graphs are displayed on display module 48 (HERCULES graphics card; monochrome or colour cathode ray tube monitor), which is driven by computerized module 46. In this preferred embodiment, the PC has an Intel 80386 processor (386) and a hard drive, a serial port (RS-232) and a parallel printer port. The PC runs the Microsoft Disk Operating System Version 5.0 (MS-WINDONS 5.0) and Microsoft Windows Version 3.1 (MS-WINDOWS* 3.1). The PC has a color monitor with 640 by 480 pixel resolution (VGA) and has a mouse pointing device (not shown).

Figure 4:
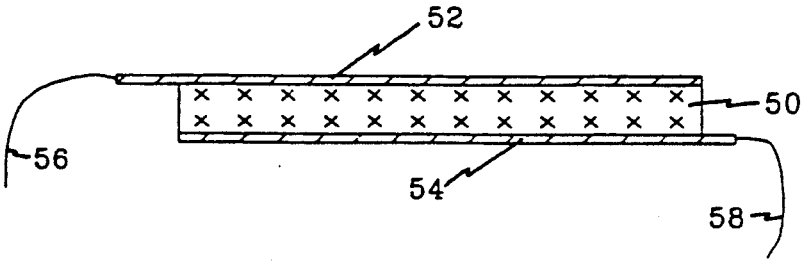
FIG. 4 is a cross-section through a grip force transducer incorporated into the firearm grip shown in FIG. 2.

Turning now to FIG. 4, each of transducers 22 and 24 (see FIG. 1) is a non-contact type variable resistance transducer, which includes a sheet of piezoresistive rubber 50 (available from Gates Rubber Co., Glasgow, Scotland) sandwiched between two pieces of wire mesh 52, 54. This sandwich of metal and rubber is inset in the grip 12. Wires 56, 58 are connected to the respective wire mesh pieces 52, 54 and to interface cable 31 (see FIG. 1) to allow the detection of changes in resistance across the rubber sheet 50. As the shooter compresses the grip 12 the distance between the wire mesh pieces 52, 54 changes as the rubber sheet 50 is compressed. This leads to a change in the resistance of the rubber sheet 50 and, consequently, in the voltage drop thereacross.

Figure 5:
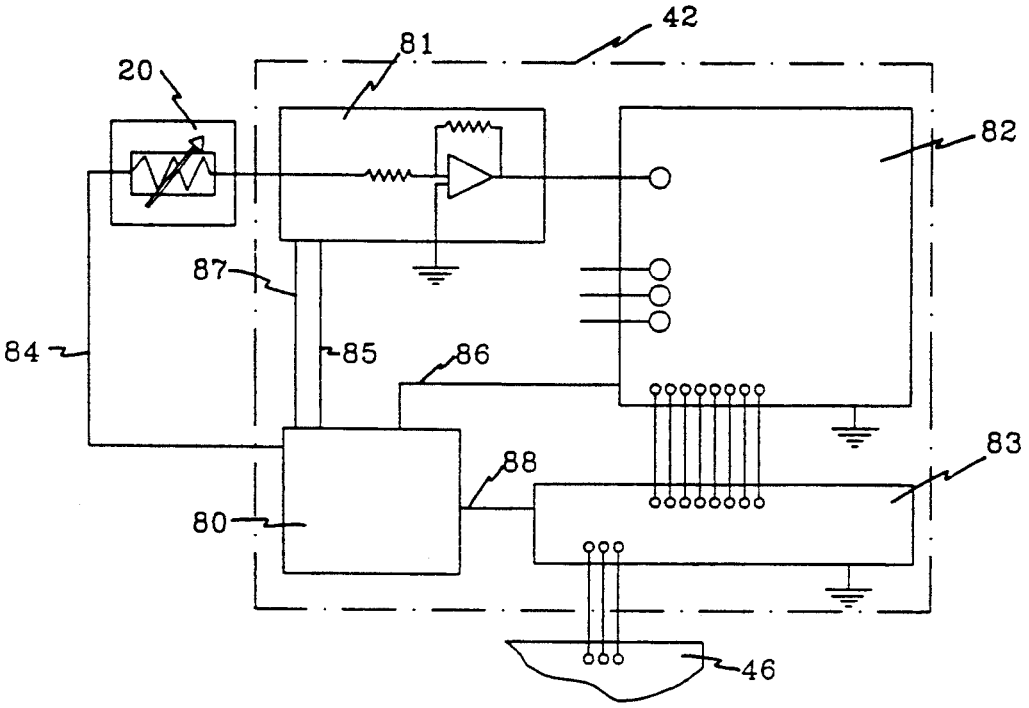
FIG. 5 shows a schematic diagram of the electronic interface unit of the embodiment shown in FIG. 1, for the data collection and signal conditioning of the transducer and sensor data.

FIG. 5 illustrates the detailed composition of the electric interface unit 42 including a power supply 80, a conventional signal amplification circuit 81, a signal conversion unit 82 (in this embodiment a MC68HC11 micro controller, available from Motorolla, Canada), and serial port 83. All of the transducers and sensors used in this embodiment are variable resistance sensors. Their electrical resistance changes with a change in grip force and trigger position. The variable resistance of each of the sensor and transducers is electrically conditioned by a conventional gain and offset circuit 81 known to a person skilled in the art which produces a corresponding variable voltage that is input to one of a set of analog-to-digital converters integrated into the MC68HC11 micro controller 82. For reasons of simplicity and ease of understanding, the application circuit 81 of only one transducer 20 is shown. The data from each transducer or sensor conditioned by the respective gain and offset circuit 81 is converted by the analog-to-digital converter to 8-bit data which is passed to the computerized module 46 (see FIG. 1) through the RS-232 protocol based serial port 83 which includes an RS-232 driver (available from Motorolla Canada) for each sensor or transducer. The data is passed to the computerized module 46 at 200 samples per second (9600 baud on the serial port). The data is packetized in the format #- (flag bytes (#-), trigger position (t), front grip force (f), right grip force (r), left grip force (l)). The resistive transducers 20 or sensor 30 are supplied with five volt operating power from the power supply 80 by conductors 84 (only one shown), conditioning circuit 81 is powered with plus/minus twelve volt by way of conductors 85 and 87 (only one set shown), the drivers 83 and the micro controller 82 are powered with five volt power through conductors 86 and 88 respectively. The data is passed to the computerized module 46 as single byte samples in the range 0–255 with 0 representing minimum scale on the sensor/transducer (0 volts) and 255 representing full scale on the sensor/transducer (5 volts). The corresponding signals are subsequently plotted by the computerized module 46 on display 48 as graphs representing a relative side force, a relative front-to-back force and a relative trigger position as a function of time. the software (see Apendix) used in this embodiment on the computerized module 46 to operate the grip force and trigger position display is available from Davis Engineering Limited, Ottawa, Canada and a copy thereof was appended to this application. The software has two distinct actions that are active at all times. The data being sent to the computerized module 46 by the electrical interface unit 42 are collected in a buffer as a stream of characters in the format specified above. This information is periodically processed (every 100 ms) into an array of sensor readings and given a time stamp to indicate collection time. The second action is the information display. Once the operator activates a display mode, the sensor readings are read from the array and displayed on the screen. When the operator deactivates the display mode the information is left on the screen and no further updates are performed. Sensor readings are brought into the computer at all times, even when the display mode is deactivated. Old sensor readings are constantly overwritten by new values.

Figure 6:
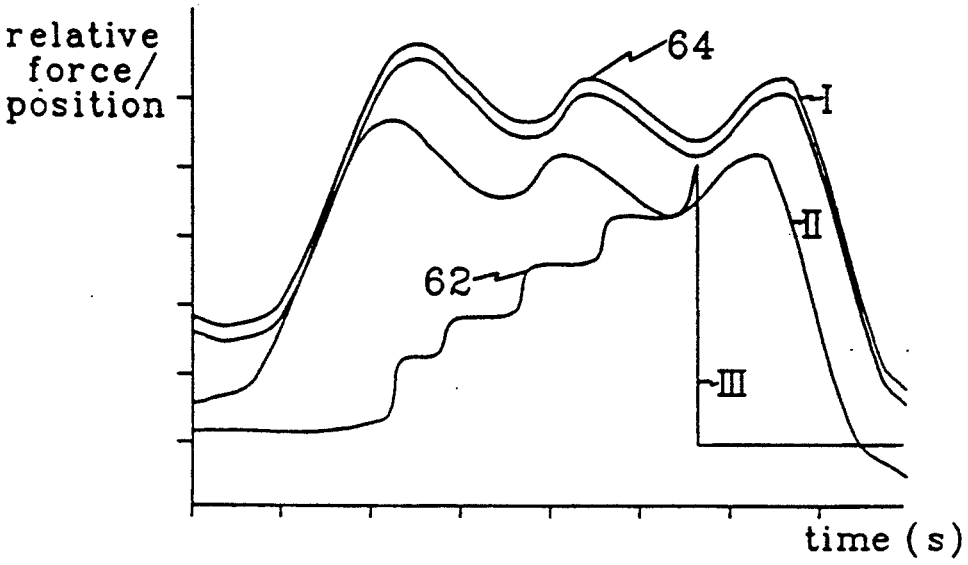
FIG. 6 illustrates a graphical display produced by the system shown in FIG. 1 of a poor shot.
Figure 7:
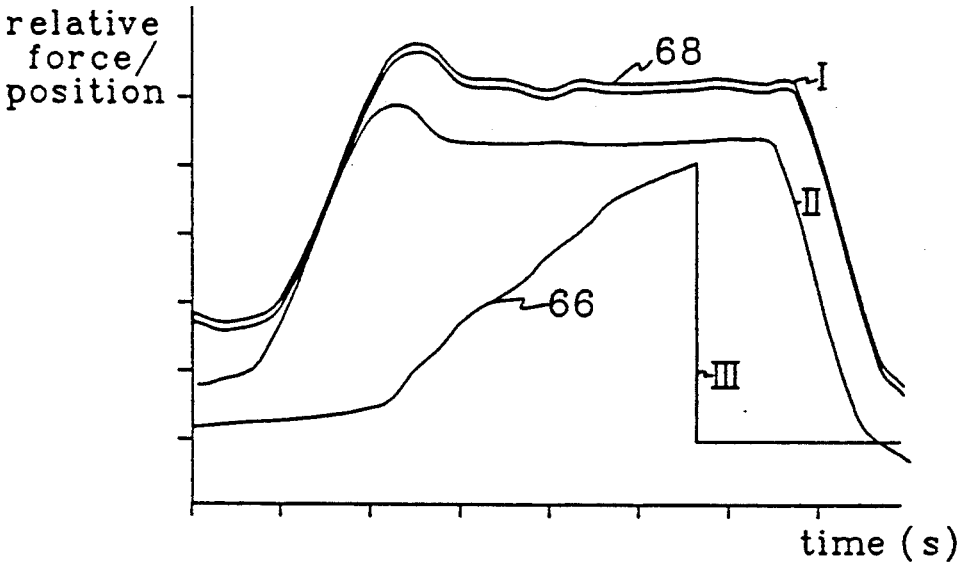
FIG. 7 illustrates a graphical display produced by the system shown in FIG. 1 of an ideal shot.

Turning now to FIGS. 6 and 7, which illustrate examples of graphical displays 60 provided by a firearm instrumentation system in accordance with the invention, force and position graphs of a "poor" shot (FIG. 6) and an "ideal" shot (FIG. 7) are shown. Relative side forces I, a relative front-to-back force II and a relative trigger position III are displayed as a function of time. As it is apparent from FIGS. 6 and 7, a firearm training system in accordance with the invention provides for the detection of a "poor" shot in terms of uneven or staggered trigger pull 62 and excessively variable side and front-to-back forces 64 (see FIG. 6). The system also provides for the graphic display of an "ideal" shot in terms of a smooth trigger pull 66, constant front-to-back force 67 and only marginally varying side forces 68 (see FIG. 7). The system also provides for a comparison between the graphical display of an ideal shot and the simultaneously displayed graph of a poor shot for the correlation of excessive hand grip forces and uneven trigger pull with a usually poor target success during "live" firings. Furthermore, since the transducers 20 and sensor 30 incorporated into the firearm do not interfere with the function of the firearm, a firearm training system in accordance with the invention can be used under both "dry" and "live" fire conditions. Thus, a training system in accordance with the invention permits a shooter using the system to relate in "real time" what is being sensed by his or her weapon hand to quantitative measurements displayed by display module 48 (see FIG. 1). In addition, the system provides a shooting instructor with a physical, quantitative feedback on shooter performance, which can be used to asses the capabilities of a shooting trainee with respect to grip force and trigger control. Finally, it is apparent from the above discussion that a firearm training system in accordance with the present invention may be used for the practice of "dry" firing away from a shooting range and possibly even without a shooting instructor. This may provide for a better training of a shooter before the first firing of a live shot and a substantial reduction in instructor time and ammunition cost.

Figure 8:
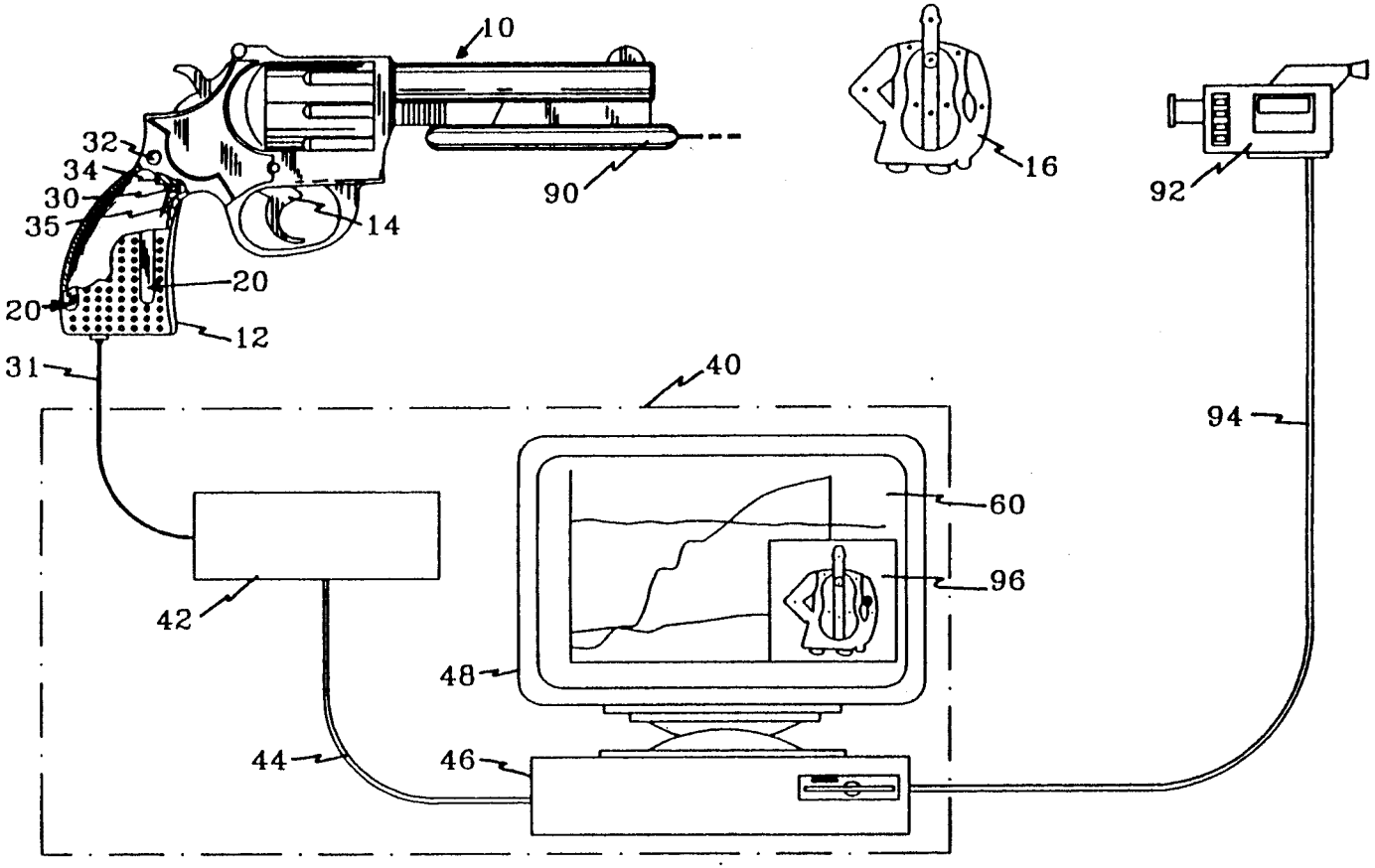
FIG. 8 shows a schematic illustration of an embodiment as shown in FIG. 1, including additional equipment used to provide aiming information in addition to grip force and trigger position.

FIG. 8 illustrates an optional embodiment of the invention including the addition of a laser pointer 90 on the firearm 10. The same electrical interface unit 42 and computerized module 46 are used as in the embodiment of FIG. 1 as well as the same display device 48. A video camera 92 is added to the system which interacts with the display 48 through an interface cable 94 and a commercially available video interface computer board (not shown) integrated into the computerized module 46. A schematic representation 95 of the target 16 at which the firearm 10 is aimed and can be overlaid the grip force and trigger position display 60. The light dot produced by the pointer 90 on the target is captured by the video camera 92 at the firing of the weapon and its position on the target, which represents the approximate point of impact of the shot fired, is calculated by the interface board for display on the target schematic 95 as a point of impact 96. This information can be used to supplement the grip force and trigger position information to provide valuable site picture information to both instructor and shooter.

It will be readily apparent to a person skilled in the art that the firearm training system discussed in connection with FIG. 1 may be used in combination with any firearm such as a revolver, gun or rifle by incorporation of the hand grip force transducers 22, 24 and a trigger position sensor 30 into appropriate parts of the firearm. The system may of course also be used in combination with automatic firearms. Furthermore, a firearm used in the system of the present invention may be provided with hand grip force transducers 22, 24 only, although the further incorporation of the trigger pull sensor 30 is preferred. It is also possible to mount the grip force transducers to the outside of a conventional grip without modification of the grip construction. This would allow trainees to use a training system in accordance with the invention in combination with their own personal firearms, without modification of the weapon.

It will be further apparent to the art skilled person that the grip force transducers 22, 24 and the position sensor 30 may operate on a different principle than the variable resistance transducers and the field strength detector preferably used such as capacitative type transducers. Furthermore, the transducers may be contact type transducers, as long as they provide for the production of an output signal, which is a function of the grip force applied. The trigger position sensor 30 may also be positioned at another location in or on the firearm close to a trigger associated part, however, it should not interfere with the trigger operation.

Although the transducers and sensor incorporated into grip 12 of revolver 10 are in the preferred embodiment connected with the display apparatus 40 through the interface cable 31, appropriate wireless communication system components may be incorporated into the grip 12, space permitting and the electric interface unit 42 for transmission of the resistance data of the transducers/sensor to the interface unit by electromagnetic waves, for example.

The electronic interface unit 42 or any part thereof may be incorporated into computerized module 46 in form of a board which obtains operating power from the module 46. The computerized module may be any appropriate personal computer, which has a monochrome or colour monitor of the cathode ray tube or liquid crystal type or any other appropriate monitor. Furthermore, the 68HC11 micro converter used in the preferred embodiment of a firearm training system in accordance with the invention may be replaced with any other appropriate A/D convertor compatible with the computerized module respectively used. The computerized module 46 is preferably connected to a printer for the storing, plotting and printing of shot sequence data of single or multiple shots of one or more shooters. This is preferably controlled by the above mentioned software, which monitors the instrumented grips and has modes to practice dry firing and live ammunition firing or any other appropriate software.

It will be further apparent to a person skilled in the art that appropriate grips including side and front-to-back force transducers 22, 24 and trigger position sensor 30 may be manufactured separately to be easily interchangeable with a standard grip of a selected firearm. This would also allow a shooter to train on a firearm training system in accordance with the invention using his or her own firearm.

The above mentioned software installed on the computerized module 46 and controlling the firearm training system preferably provides for a simultaneous display of an ideal shot of an instructor and a poor shot of a trainee by way of characteristic line patterns for the different shots when a monochrome monitor is used or by way of different colors for the respective shots when a colour monitor is used.

In the preferred embodiment of the invention as described above, the analog signals produced by the transducers 22, 24 and sensor 30 in combination with the amplifier circuitry 81 are converted to digital data for storage on and display by the computerized module 46. However, a person skilled in the art will readily appreciate that these analog signals may be directly displayed as analog signals on an appropriate analog plotter. This means that a firearm training system in accordance with the invention may be run completely analog without the requirement for a computerized module 46, as long as the hand grip forces and the trigger position may be displayed or printed as a function of time. Although both trigger position and grip forces are preferably displayed on the same display, the use of separate displays is possible.

Thus, the present invention provides a firearm training system and method, which provides for a more effective training of a shooter and for cost savings in terms of training time and ammunition.

Changes and modifications in the specifically described embodiments can be carried out without departing from the scope of the invention which is intended to be limited only by the scope of the appended claims.

RANGE - TUTOR

SOFTWARE MODULE FOR

FIREARM TRAINING SYSTEM

OF

W.R. DAVIS ENGINEERING LIMITED
1260 OLD INNES ROAD
OTTAWA, ONTARIO, CANADA
K1B 3V3
PHONE (613) 748-5500
FAX (613) 748-3972

(C) 1992 W.R. DAVIS ENGINEERING, OTTAWA, CANADA

MAIL ROOM JAN 7 1993 PAT. & TRADEMARK OFF.

```
#include "global.h"

#include <stdio.h>
#include <time.h>

#if _MSC_VER == 700
#include <mmsystem.h>
#endif

#include "dial_exp.h"
#include "func_exp.h"
#include "one_exp.h"
#include "main_exp.h"
#include "real_exp.h"
#include "forc_exp.h"
#include "trig_exp.h"
#include "tool_exp.h"
#include "one_exp.h"

/*************************************************************/
/* GetConfig                                                 */
/*                                                           */
/* FIS System configuration reading routine                  */
/*************************************************************/
void FISRestoreConf( char * nConfFile, BOOL nInitial )
{
unsigned int nRc, i, j;
FILE * nFileID;
unsigned char nTempStr[100];
unsigned char * nOffSet;

if( !nInitial )
{
    nRc = FISMessage( NULL, nConfFile, nRTTitle[nRTLanguage][75],
                      MB_ICONQUESTION, MB_YESNO, MB_TASKMODAL );
    /* check if the guy changed his mind */
    if (nRc == IDNO ) return;

} else {
    /* get the file path information from the windows system ini file */
    nRc = GetProfileString( "RangeTutor", "Path", ".", nDefPath, 50 );
    /* add on the file extension */
    strcpy( nConfFile, nDefPath );
    strcat( nConfFile, "\\rtconfig.cnf" );
}

/* check if the file exists */
if( (nFileID = fopen( nConfFile, "r" )) == NULL )
{
    if( nInitial )
    {
        /* no configuration file, use defaults and create it */
        FISSaveConf( nConfFile, true, false );
    } else {
        /* complain that file is not present */
        FISMessage( NULL, nConfFile, nRTTitle[nRTLanguage][76],
                    MB_ICONEXCLAMATION, MB_OK, MB_TASKMODAL );
    }
}

/* close the file */
if( nFileID != NULL )
{
    /*  read gun type */
    if ( fgets( nTempStr, 100, nFileID ) == NULL ) return;      /*comment*/
    if ( fgets( nTempStr, 100, nFileID ) == NULL ) return;      /*dGunType*/
    if( (nOffSet = strchr( nTempStr, '=' )) == NULL ) return;   /*error!*/
    nOffSet+=1; /* move over the = */
    dGunType = (unsigned char )atoi( nOffSet );

    /*  read sensor information */
    if ( fgets( nTempStr, 100, nFileID ) == NULL ) return;      /*comment*/
    if ( fgets( nTempStr, 100, nFileID ) == NULL ) return;      /*comment*/
    for (i=0;i<nNumSensors;i++)
    {
```

```
    if ( fgets( nTempStr, 100, nFileID ) == NULL ) return;  /*sensors*/
    nOffSet = nTempStr; nOffSet+=3; /* move over sensor number */
    cCollect[i] = (unsigned char)atoi( nOffSet ); nOffSet+=2;
    nInvertY[i] = (unsigned char)atoi( nOffSet ); nOffSet+=2;
    strcpy( cNames[i], nOffSet );
    cNames[i][strlen(cNames[i])-1] = 0;     /* get rid of newline */
}

/* read the sensor thresholds */
if ( fgets( nTempStr, 100, nFileID ) == NULL ) return;      /*comment*/
if ( fgets( nTempStr, 100, nFileID ) == NULL ) return;      /*nStopStart*/
if( (nOffSet = strchr( nTempStr, '=' )) == NULL ) return;   /*error!*/
nOffSet+=1; /* move over the = */
nSenThresh[nTrigSen][1] = (unsigned char)atoi( nOffSet );

if ( fgets( nTempStr, 100, nFileID ) == NULL ) return;      /*nThreshold*/
if( (nOffSet = strchr( nTempStr, '=' )) == NULL ) return;   /*error!*/
nOffSet+=1; /* move over the = */
nSenThresh[nTrigSen][0] = (unsigned char)atoi( nOffSet );

if ( fgets( nTempStr, 100, nFileID ) == NULL ) return;      /*Front nLowLimi
if( (nOffSet = strchr( nTempStr, '=' )) == NULL ) return;   /*error!*/
nOffSet+=1; /* move over the = */
nSenThresh[nFrontSen][0] = (unsigned char)atoi( nOffSet );

if ( fgets( nTempStr, 100, nFileID ) == NULL ) return;      /*Front nHighLim
if( (nOffSet = strchr( nTempStr, '=' )) == NULL ) return;   /*error!*/
nOffSet+=1; /* move over the = */
nSenThresh[nFrontSen][1] = (unsigned char)atoi( nOffSet );

if ( fgets( nTempStr, 100, nFileID ) == NULL ) return;      /*Left nLowLimit
if( (nOffSet = strchr( nTempStr, '=' )) == NULL ) return;   /*error!*/
nOffSet+=1; /* move over the = */
nSenThresh[nLSideSen][0] = (unsigned char)atoi( nOffSet );

if ( fgets( nTempStr, 100, nFileID ) == NULL ) return;      /*Left nHighLimi
if( (nOffSet = strchr( nTempStr, '=' )) == NULL ) return;   /*error!*/
nOffSet+=1; /* move over the = */
nSenThresh[nLSideSen][1] = (unsigned char)atoi( nOffSet );

if ( fgets( nTempStr, 100, nFileID ) == NULL ) return;      /*Right nLowLimi
if( (nOffSet = strchr( nTempStr, '=' )) == NULL ) return;   /*error!*/
nOffSet+=1; /* move over the = */
nSenThresh[nRSideSen][0] = (unsigned char)atoi( nOffSet );
if ( fgets( nTempStr, 100, nFileID ) == NULL ) return;      /*Right nHighLim
if( (nOffSet = strchr( nTempStr, '=' )) == NULL ) return;   /*error!*/
nOffSet+=1; /* move over the = */
nSenThresh[nRSideSen][1] = (unsigned char)atoi( nOffSet );

/* read the display options */
if ( fgets( nTempStr, 100, nFileID ) == NULL ) return;      /*comment*/
if ( fgets( nTempStr, 100, nFileID ) == NULL ) return;      /*nDrawShot*/
if( (nOffSet = strchr( nTempStr, '=' )) == NULL ) return;   /*error!*/
nOffSet+=1; /* move over the = */
nDrawShot = (unsigned char)atoi( nOffSet );

if ( fgets( nTempStr, 100, nFileID ) == NULL ) return;      /*nTemplateShot*
if( (nOffSet = strchr( nTempStr, '=' )) == NULL ) return;   /*error!*/
nOffSet+=1; /* move over the = */
nTemplateShot = (unsigned char)atoi( nOffSet );

if ( fgets( nTempStr, 100, nFileID ) == NULL ) return;      /*nShotStats*/
if( (nOffSet = strchr( nTempStr, '=' )) == NULL ) return;   /*error!*/
nOffSet+=1; /* move over the = */
nShotStats = (unsigned char)atoi( nOffSet );

/* read the admin options */
if ( fgets( nTempStr, 100, nFileID ) == NULL ) return;      /*comment*/

if ( fgets( nTempStr, 100, nFileID ) == NULL ) return;      /*nLogEnable*/
if( (nOffSet = strchr( nTempStr, '=' )) == NULL ) return;   /*error!*/
nOffSet+=1; /* move over the = */
nLogEnable = (unsigned char)atoi( nOffSet );
```

```
    if ( fgets( nTempStr, 100, nFileID ) == NULL ) return;      /*nPassEnable*/
    if( (nOffSet = strchr( nTempStr, '=' )) == NULL ) return;   /*error!*/
    nOffSet+=1; /* move over the = */
    nPassEnable = (unsigned char)atoi( nOffSet );

    if ( fgets( nTempStr, 100, nFileID ) == NULL ) return;      /*nFileProt*/
    if( (nOffSet = strchr( nTempStr, '=' )) == NULL ) return;   /*error!*/
    nOffSet+=1; /* move over the = */
    nFileProt = (unsigned char)atoi( nOffSet );

    if ( fgets( nTempStr, 100, nFileID ) == NULL ) return;      /*nLangFile*/
    if( (nOffSet = strchr( nTempStr, '=' )) == NULL ) return;   /*error!*/
    nOffSet+=1; /* move over the = */
    strcpy( nLangFile, nOffSet );
    nLangFile[strlen(nLangFile)-1] = 0;

    fclose( nFileID );
}

/* get language information */
nNumLang = 0;
if( (nFileID = fopen( nLangFile, "r" )) != NULL )
{
    while ( true )
    {
        if( nNumLang == 5 ) break;      /* only 5 languages allowed */
        /* get the name of the language */
        if ( fgets( nTempStr, 100, nFileID ) == NULL ) break;
        nTempStr[strlen(nTempStr)-1] = 0;       /* get rid of newline */
        strcpy( nLangs[nNumLang].cLang, nTempStr );
        /* get the welcome text file name */
        if ( fgets( nTempStr, 100, nFileID ) == NULL ) break;
        nTempStr[strlen(nTempStr)-1] = 0;       /* get rid of newline */
        strcpy( nLangs[nNumLang].cWelcome, nTempStr );
        /* get the titles text file name */
        if ( fgets( nTempStr, 100, nFileID ) == NULL ) break;
        nTempStr[strlen(nTempStr)-1] = 0;       /* get rid of newline */
        strcpy( nLangs[nNumLang++].cText, nTempStr );
        /* get the comment line */
        if ( fgets( nTempStr, 100, nFileID ) == NULL ) break;
    }
    fclose( nFileID );

}

/* zero all of the title information */
memset( nRTTitle, 0, sizeof(nRTTitle) );

/* read all of the title information */
for( i=0;i<=nNumLang;i++)
{
    if( (nFileID = fopen( nLangs[i].cText, "r" )) != NULL )
    {
        for( j=0;j<500;j++)
        {
            /* get the name of the language */
            if ( fgets( nTempStr, 100, nFileID ) == NULL ) break;
            nTempStr[strlen(nTempStr)-1] = 0;   /* get rid of newline */
            strcpy( nRTTitle[i][j], nTempStr );
        }
        fclose( nFileID );

    }
}

return;
}


/*********************************************************/
/* SaveConfig                                            */
/*                                                       */
/* FIS System configuration saving routine               */
/*********************************************************/
void FISSaveConf( char * nConfFile, BOOL nInitial, BOOL nStudent )
```

```
{
unsigned int nRc, i, j;
FILE * nFileID;
unsigned char nTempStr[32] = {"not available"};

if( !nInitial )
{
    FISMessage(  NULL, nConfFile, nRTTitle[nRTLanguage][77],
                 MB_ICONQUESTION, MB_YESNO, MB_TASKMODAL );
}

/* check if the file exists */
if( (nFileID = fopen( nConfFile, "r" )) != NULL )
{
    if( !nInitial )
    {
        /* complain that file is exists present */
        nRc = FISMessage( NULL, nConfFile, nRTTitle[nRTLanguage][78],
                          MB_ICONQUESTION, MB_YESNO, MB_TASKMODAL );
        if( nRc == IDYES )
        {
            /* check if file overwrite if allowed */
            if( nFileProt )
            {
                /* re-open file for overwrite */
                nFileID = freopen( nConfFile, "w", nFileID );
            } else {
                nRc = FISMessage( NULL, nConfFile, nRTTitle[nRTLanguage][79],
                                  MB_ICONEXCLAMATION, MB_OK, MB_TASKMODAL );
            }
        } else {
            /* file exists, close it and return */
            fclose( nFileID );
            nFileID = NULL;
        }
    } else {
        /* if this is a student request then overwrite the file */
        if( nStudent )
        {
            /* re-open file for overwrite */
            nFileID = freopen( nConfFile, "w", nFileID );
        } else {
            /* file exists, close it and return */
            fclose( nFileID );
            nFileID = NULL;
        }
    }
} else {
    nFileID = fopen( nConfFile, "w" );
}

/* write the config info to the file */
if( nFileID != NULL )
{
    /* write out gun type */
    fprintf( nFileID, "## Gun Type : 00=SWM10, 01=SIG, 02=GLOCK, 03=Browning\n"
    fprintf( nFileID, "Gun Type=%02d\n", dGunType );
    /* write out sensor information */
    fprintf( nFileID, "## Sensor Information\n" );
    fprintf( nFileID, "## num, name, enabled(1=true), scale, invert, max Value\n
    for (i=0;i<nNumSensors;i++)
    {
        fprintf( nFileID, "%02d,%1d,%1d,%-s\n", i,
             cCollect[i], nInvertY[i], cNames[i] );
    }

    /* write out the sensor thresholds */
    fprintf( nFileID, "## Sensor Thresholds\n" );
    fprintf( nFileID, "Shot Start=%02d\n", nSenThresh[nTrigSen][1] );
    fprintf( nFileID, "Shot Detect=%02d\n", nSenThresh[nTrigSen][0] );
    fprintf( nFileID, "Front Grip Force Minimum=%02d\n", nSenThresh[nFrontSen][0
    fprintf( nFileID, "Front Grip Force Maximum=%02d\n", nSenThresh[nFrontSen][1
    fprintf( nFileID, "Left Grip Force Minimum=%02d\n", nSenThresh[nLSideSen][0]
    fprintf( nFileID, "Left Grip Force Maximum=%02d\n", nSenThresh[nLSideSen][1]
    fprintf( nFileID, "Right Grip Force Minimum=%02d\n", nSenThresh[nRSideSen][0
```

```
    fprintf( nFileID, "Right Grip Force Maximum=%02d\n", nSenThresh[nRSideSen][1

    /* write out the display options */
    fprintf( nFileID, "## Display Options\n" );
    fprintf( nFileID, "Draw Shot Location=%01d\n", nDrawShot );
    fprintf( nFileID, "Draw Shot Template=%01d\n", nTemplateShot );
    fprintf( nFileID, "Display Shot Statistics=%01d\n", nShotStats );

    /* write out the admin options */
    fprintf( nFileID, " ## Login  and Admin Options\n" );
    fprintf( nFileID, "Login Enabled=%01d\n", nLogEnable );
    fprintf( nFileID, "Password Enabled=%01d\n", nPassEnable );
    fprintf( nFileID, "File Overwrite Protection=%01d\n", nFileProt );
    fprintf( nFileID, "Languge Filename=%s\n", nLangFile );

    /* close the configuration file */
    fclose( nFileID );
}


return;
}


/*************************************************************/
/* RestoreData                                               */
/*                                                           */
/* FIS System shot information reading routing               */
/*************************************************************/
void FISRestoreData( char * nOpenFile )
{
unsigned int i, j, nSamples;
time_t nTimePtr;
unsigned long nTempOffSet;
unsigned char nTempStr[100];
unsigned char * nOffSet;
FILE * nFileID;
HCURSOR hHourCur, hTempCur;
unsigned char nSensor, nSetSize;

/* check if the data has been discarded properly */
if( nCurData != NULL )
{
    FISFreeSet( nCurData );
    nCurData = NULL;
    nCurSet = NULL;
    nCurOffSet = 0;
    nGroupSet = NULL;
}

/* check to make sure this file is correct */
FISMessage( NULL, nOpenFile, nRTTitle[nRTLanguage][80],
            MB_ICONQUESTION, MB_YESNO, MB_TASKMODAL );

/* check if the file exists */
if( (nFileID = fopen( nOpenFile, "rb" )) == NULL )
{
    /* complain that file doesn't exist */
    FISMessage( NULL, nOpenFile, nRTTitle[nRTLanguage][81],
                MB_ICONEXCLAMATION, MB_YESNO, MB_TASKMODAL );
    return;
}

/* set the save indicator to true */
nPlotSaved = true;

/* set the cursor to an hour glass */
hHourCur = LoadCursor( NULL, IDC_WAIT );
hTempCur = SetCursor( hHourCur );

/* read version info */
fread( (char*)&nFISVersion, sizeof(float), 1, nFileID );
/* read date information */
fread( (char*)&nTimePtr, sizeof(time_t), 1, nFileID );
nCollectTime = nTimePtr;
```

```
/* read the student information */
fread( (char*)&nStudRecord.nInstID, sizeof(unsigned char), 33, nFileID );
fread( (char*)&nStudRecord.nStudName, sizeof(unsigned char), 33, nFileID );
fread( (char*)&nStudRecord.nStudInst, sizeof(unsigned char), 33, nFileID );

/* read the number of sensors */
fread( (char*)&nSensor, sizeof(unsigned char), 1, nFileID );
if( nSensor > nNumSensors ) nSensor = nNumSensors;

/* read the size of each set */
fread( (char*)&nSetSize, sizeof(unsigned char), 1, nFileID );
if( nSetSize > dSetSize ) nSetSize = dSetSize;

/* get the first pointer */
nSamples = 0;
fread( (char*)&nSamples, sizeof(unsigned long), 1, nFileID );
if( nSamples > 0 )
{
    nCurSet = FISGetSet();
    nCurSet->pPrevSet = NULL;
    nCurSet->pPrevGroup = NULL;
    nGroupSet = nCurData = nCurSet;
    nGroupSet->nSamples = nSamples;
    nCurGroup = 1;
    nGroups = 1;
}

/* read the data */
while ( nSamples > 0 )
{
    /* zero the sample counter */
    nTempOffSet = 0;

    while( nTempOffSet < nSamples )
    {
        fread( (char*)&nCurSet->sShots[nTempOffSet%dSetSize].nTimeStamp,
                sizeof(unsigned long), 1, nFileID );
        fread( (char*)nCurSet->sShots[nTempOffSet%dSetSize].nSensors,
                sizeof(unsigned char), nSensor, nFileID );

        /* increment offset and get new data set */
        nTempOffSet++;
        if( ((nTempOffSet%dSetSize) == 0) &&
             (nTempOffSet < nSamples) )

        {
            nCurSet->pNextSet = FISGetSet();
            nCurSet->pNextSet->pPrevSet = nCurSet;
            nCurSet = nCurSet->pNextSet;
        }
    }
    nCurSet->pNextSet = NULL;
    /* get the next group size */
    nSamples = 0;
    fread( (char*)&nSamples, sizeof(unsigned long), 1, nFileID );
    if( nSamples > 0 )
    {
        nCurSet = FISGetSet();
        nCurSet->pPrevSet = NULL;
        nGroupSet->pNextGroup = nCurSet;
        nGroupSet->pNextGroup->pPrevGroup = nGroupSet;
        nGroupSet = nCurSet;
        nGroupSet->nSamples = nSamples;
        nCurGroup++;
        nGroups++;
    } else {
        break;
    }
}

/* initialize the collection variables */
nCurOffSet = nCurData->nSamples;
nGroupSet = nCurData;
nCurSet = nCurData;
nCurGroup = 1;
```

```
/* close the file */
fclose( nFileID );

/* restore the cursor shape */
SetCursor( hTempCur );


return;
}


/*************************************************************/
/* SaveData                                                  */
/*                                                           */
/* FIS System shot information saving routine                */
/*************************************************************/
void FISSaveData( char * nOpenFile )
{
unsigned char * nTimeStr;
unsigned int nRc,i,j;
unsigned long nTempOffSet;
FILE * nFileID;
struct tShotSet * nTempPtr;
struct tShotSet * nGroupPtr;
HCURSOR hTempCur, hHourCur;
unsigned char nSensor;

/* check if there if any data to save */
if( nCurData == NULL )
{
    FISMessage( NULL, nOpenFile, nRTTitle[nRTLanguage][52],
                MB_ICONEXCLAMATION, MB_OK, MB_TASKMODAL );
    return;
}

/* confirm file name */
nRc = FISMessage( NULL, nOpenFile, nRTTitle[nRTLanguage][82],
                  MB_ICONQUESTION, MB_YESNO, MB_TASKMODAL );
if( nRc == IDNO ) return;

/* check if the file exists */
if( (nFileID = fopen( nOpenFile, "rb" )) != NULL )
{
    /* complain that file is exists present */
    nRc = FISMessage( NULL, nOpenFile, nRTTitle[nRTLanguage][78],
                      MB_ICONQUESTION, MB_YESNO, MB_TASKMODAL );
    if( nRc == IDYES )
    {
        /* check if file overwrite is allowed */
        if( nFileProt )
        {
            /* re-open file for overwrite */
            nFileID = freopen( nOpenFile, "wb", nFileID );
        } else {
            nRc = FISMessage( NULL, nOpenFile, nRTTitle[nRTLanguage][79],
                              MB_ICONEXCLAMATION, MB_YESNO, MB_TASKMODAL );
        }
    } else {
        /* file exists, close it and return */
        fclose( nFileID );
        nFileID = NULL;
    }
} else {
    nFileID = fopen( nOpenFile, "wb" );
}

/* check if file opened correctly */
if( nFileID == NULL )
{
    FISMessage( NULL, nOpenFile, nRTTitle[nRTLanguage][76],
                MB_ICONEXCLAMATION, MB_OK, MB_TASKMODAL );
    return;
}

/* set the save indicator to true */
```

```
nPlotSaved = true;

/* set the cursor to an hour glass */
hHourCur = LoadCursor( NULL, IDC_WAIT );
hTempCur = SetCursor( hHourCur );

/* write out version info */
fwrite( (char*)&nFISVersion, sizeof(float), 1, nFileID );
/* write out date information */
fwrite( (char*)&nCollectTime, sizeof(time_t), 1, nFileID );
/* write out the student information */
fwrite( (char*)&nStudRecord.nInstID, sizeof(unsigned char), 33, nFileID );
fwrite( (char*)&nStudRecord.nStudName, sizeof(unsigned char), 33, nFileID );
fwrite( (char*)&nStudRecord.nStudInst, sizeof(unsigned char), 33, nFileID );
/* write out the number of sensors */
nSensor = nNumSensors;
fwrite( (char*)&nSensor, sizeof(unsigned char), 1, nFileID );
/* write out the size of each set */
nSensor = dSetSize;
fwrite( (char*)&nSensor, sizeof(unsigned char), 1, nFileID );

/* write out the data */
nGroupPtr = nCurData;
nTempPtr = nGroupPtr;

while( nGroupPtr != NULL )
{
    nTempOffSet = 0;
    /* indicate the size of the group */
    fwrite( (char*)&nGroupPtr->nSamples, sizeof(unsigned long), 1, nFileID );
    nTempPtr = nGroupPtr;

    while( nTempPtr != NULL )
    {
        for(i=0;i<dSetSize;i++)
        {
            fwrite( (char*)&nTempPtr->sShots[i].nTimeStamp,
                    sizeof(unsigned long), 1, nFileID );
            fwrite( (char*)nTempPtr->sShots[i].nSensors,
                    sizeof(unsigned char), nNumSensors, nFileID );

            /* check if this is the last sample */
            nTempOffSet++;
            if( nTempOffSet >= nGroupPtr->nSamples ) break;
        }

        /* jump to the next location */
        nTempPtr = nTempPtr->pNextSet;
    }
    /* get the next group */
    nGroupPtr = nGroupPtr->pNextGroup;
}

/* close the file */
fclose( nFileID );

/* restore the cursor shape */
SetCursor( hTempCur );

return;
}


/*********************************************************/
/* FISCreateRes                                          */
/*                                                       */
/* Create the FIS system resources                       */
/*********************************************************/
void FISCreateRes( void )
{
int i;

/* initialize the FIS font */
```

```
lFisFont.lfHeight = 12;
lFisFont.lfWidth = 0;
lFisFont.lfEscapement = 0;
lFisFont.lfOrientation = 0;
lFisFont.lfWeight = 400;
lFisFont.lfItalic = 0;
lFisFont.lfUnderline = 0;
lFisFont.lfStrikeOut = 0;
lFisFont.lfCharSet = ANSI_CHARSET;
lFisFont.lfOutPrecision = OUT_DEFAULT_PRECIS;
lFisFont.lfClipPrecision = CLIP_DEFAULT_PRECIS;
lFisFont.lfQuality = PROOF_QUALITY;
lFisFont.lfPitchAndFamily = (DEFAULT_PITCH | FF_DONTCARE);

/* initialize the brushes */
lBlackBrush.lbStyle = BS_SOLID;
lBlackBrush.lbColor = rBlack;
lBlackBrush.lbHatch = 0;

lWhiteBrush.lbStyle = BS_SOLID;
lWhiteBrush.lbColor = rWhite;
lWhiteBrush.lbHatch = 0;

lRedBrush.lbStyle = BS_SOLID;
lRedBrush.lbColor = rRed;
lRedBrush.lbHatch = 0;

lGreenBrush.lbStyle = BS_SOLID;
lGreenBrush.lbColor = rGreen;
lGreenBrush.lbHatch = 0;

lBlueBrush.lbStyle = BS_SOLID;
lBlueBrush.lbColor = rBlue;
lBlueBrush.lbHatch = 0;

lYellowBrush.lbStyle = BS_SOLID;
lYellowBrush.lbColor = rYellow;
lYellowBrush.lbHatch = 0;

/* create and select the appropriate pens */
hPenRed = CreatePen( PS_SOLID, 2, rRed );
hPenGreen = CreatePen( PS_SOLID, 2, rGreen );
hPenYellow = CreatePen( PS_SOLID, 2, rYellow );
hPenBlue = CreatePen( PS_SOLID, 2,  rBlue );
hPenBlack = CreatePen( PS_SOLID, 2, rBlack );
hPenWhite = CreatePen( PS_SOLID, 2, rWhite );

/* create any select the appropriate brushes */
hBrushBlack = CreateBrushIndirect( lpBlackBrush );
hBrushWhite = CreateBrushIndirect( lpWhiteBrush );
hBrushRed = CreateBrushIndirect( lpRedBrush );
hBrushBlue = CreateBrushIndirect( lpBlueBrush );
hBrushGreen = CreateBrushIndirect( lpGreenBrush );
hBrushYellow = CreateBrushIndirect( lpYellowBrush );

/* create a font to label the axes */
lFisFont.lfEscapement = 0;       /* re-create the normal font for the X-axis */
lFisFont.lfOrientation = 0;
hFontX = CreateFontIndirect( lpFisFont );
/* select the original objects */
hOrgFont = SelectObject( hDCMain, hFontX );
hOrgPen = SelectObject( hDCMain, hPenBlue );
hOrgBrush = SelectObject( hDCMain, hBrushWhite );

/* create the pens for plotting */
for (i=0;i<nNumSensors;i++ )
{
    pSensor[i][0] = CreatePen( PS_SOLID, 1, cSensor[i] );
    pSensor[i][1] = CreatePen( PS_DOT, 1, cSensor[i] );
    pSensor[i][2] = CreatePen( PS_DASH, 1, cSensor[i] );
}

return;
}
```

```
/*********************************************************/
/* FISDeleteRes                                          */
/*                                                       */
/* delete the system resources                           */
/*********************************************************/
void FISDeleteRes( void )
{
int i;

/* deselect the created and selected pens */
SelectObject( hDCMain, hOrgPen );
SelectObject( hDCMain, hOrgFont );
SelectObject(hDCMain, hOrgBrush );

/* delete the objects */
DeleteObject( hFontX );
DeleteObject( hFontY );
DeleteObject( hPenBlue );
DeleteObject( hPenGreen );
DeleteObject( hBrushBlack );
DeleteObject( hBrushWhite );

/* delete the sensor pens */
for (i=0;i<nNumSensors;i++ )
{
    DeleteObject( pSensor[i][0] );
    DeleteObject( pSensor[i][1] );
    DeleteObject( pSensor[i][2] );
}

return;
}


/*********************************************************/
/* Check Accelerators                                    */
/*                                                       */
/* looks at all accelerator keys for all windows         */
/*********************************************************/
unsigned char CheckAccelerators( MSG msg )
{
/* check for real time window hotkeys */
if( msg.hwnd == hWndReal )
{
    if(TranslateAccelerator(hWndReal, hAccReal, &msg)) return true;
}

/* check for shot analysis hot keys */
if( msg.hwnd == hWndSingle )
{
    if(TranslateAccelerator(hWndSingle, hAccSingle, &msg)) return true;
}

/* check for grip force hot keys */
if( msg.hwnd == hWndForce )
{
    if(TranslateAccelerator(hWndForce, hAccForce, &msg)) return true;
}

/* check for trigger timing hot keys */
if( msg.hwnd == hWndTrigger )
{
    if(TranslateAccelerator(hWndTrigger, hAccTrigger, &msg)) return true;
}

/* check in the main window for others */
if(TranslateAccelerator(hWndMain, hAccel, &msg)) return true;

return false;
}
```

```
/*****************************************************/
/* RotateWindow                                      */
/*                                                   */
/* changes the focus to the next window in the order */
/* order is : main, realtime, one shot, sensor pos.  */
/*            grip force, shot info, trigger timing  */
/*****************************************************/
void RotateWindow( BOOL nDir )
{
HWND hTempWin;
HWND hActive[7];
int i, nWin, nActive;

i = 0;  /* initialize index */

/* determine which windows are active */
if( cReal ) hActive[i++] = hWndReal;
if( cSingle ) hActive[i++] = hWndSingle;
if( cForce ) hActive[i++] = hWndForce;
if( cTrigger ) hActive[i++] = hWndTrigger;

nWin = i;

/* get the current active window */
hTempWin = GetFocus();

for (i=0;i<nWin;i++)
{
    if( hActive[i] == hTempWin ) nActive = i;
}

/* rotate in the correct direction */

switch ( nDir )
{
    case true:  /* rotate forward */
        if( ++nActive == nWin ) nActive = 0;
        break;

    case false: /* rotate backwards */
        if( --nActive < 0 ) nActive = nWin -1;
        break;

    default:
        break;
}

/* set the new focus */
if( IsIconic( hActive[nActive] ) )
{
    ShowWindow( hActive[nActive], SW_RESTORE );
}

/* set the focus to this window */
SetFocus( hActive[nActive] );
SetCursorPos( 0,0 );

return;
}


/*******************************************************/
/* ShowChildren                                        */
/*                                                     */
/* display child windows                               */
/*******************************************************/
void FISShowChildren( void )
{
int     nRc,i;
RECT    nRect;
HWND hOwnWnd, hTempWnd, hChildren[20];

/* get the current window rectangle */
GetClientRect( hWndMain, &nRect );
```

```
/* check if the tool box is active */
if( IsWindow( hWndToolBox ) )
{
    MoveWindow( hWndToolBox, nRect.left, (nRect.bottom-34),
                             (nRect.right-nRect.left), 34, true );
    nRect.bottom -= 34;
}

/* determine how many children there are currently active */
nRc = 0;
hTempWnd = GetWindow( hWndMain, GW_CHILD );    /* first child */

while( true )
{
    if( hTempWnd == NULL ) return;                    /* no children */

    if( !IsWindow( hTempWnd) )
    {
        DestroyWindow( hTempWnd );
    } else {
        if( (hOwnWnd = GetParent( hTempWnd )) == hWndMain )
        {
            break;
        }
    }
    /* get the next window */
    hTempWnd = GetWindow( hWndMain, GW_HWNDNEXT );      /* first child */
}

while ( true )
{
    /* last child */
    if( hTempWnd == NULL ) break;

    if( !IsWindow( hTempWnd) )
    {
        DestroyWindow( hTempWnd );
    } else {
        /* make sure it isn't the tool box */
        if( !IsWindow( hWndToolBox) || (hTempWnd != hWndToolBox) )
        {
        /* make sure it isn't the legend */
        if( !IsWindow( hWndLegend) || (hTempWnd != hWndLegend) )
        {
            if( (hOwnWnd = GetParent( hTempWnd )) == hWndMain )
            {
                hChildren[nRc++] = hTempWnd;
            }
        }
        }
    }

    /* get the next one */
    hTempWnd = GetWindow( hTempWnd, GW_HWNDNEXT );
}

switch (nRc)
{
    case 1:
    case 2:
        /* set the focus to the last window in the list */
        SetFocus( hChildren[nRc-1] );
        /* move the windows around */
        for (i=0;i<nRc;i++)
        {
            if( !IsIconic( hChildren[i] ) )
            {
                MoveWindow( hChildren[i],
                        nRect.left,
                      ( nRect.top + ((nRect.bottom-nRect.top)*i/nRc) ),
                      ( nRect.right-nRect.left),
                      ((nRect.bottom-nRect.top)/nRc),
                        true );
            }
        }
```

```
        break;

    case 3:

    case 4:
        /* set the focus to the last window in the list */
        SetFocus( hChildren[nRc-1] );
        /* move the windows around */
        for (i=0;i<nRc;i++)
        {
            if( !IsIconic( hChildren[i] ) )
            {
                MoveWindow( hChildren[i],
                        ( nRect.left + ((nRect.right-nRect.left)*(i%2)/2) ),
                        ( nRect.top + ((nRect.bottom-nRect.top)*(i/2)/2) ),
                        ((nRect.right-nRect.left)/2),
                        ((nRect.bottom-nRect.top)/2),
                          true );
            }
        }
        break;

    case 0:
    default:
        /* set the focus to the main window */
        PostMessage( hWndToolBox, WM_CLOSE, NULL, NULL );
        SetFocus( hWndMain );
        break;

}

/* arrange any iconic windows */
ArrangeIconicWindows( hWndMain );

return;

}


/*****************************************************************/
/* CheckLogin                                                    */
/*                                                               */
/* routine to check the login information and setup the student */
/* record structure                                              */
/*****************************************************************/
BOOL CheckLogin( unsigned char * nID, unsigned char * nPass )
{
struct tUserLog nTempUser;
unsigned char nFound;
unsigned int nCount, nRc;

nFound = false;

/* check the default login */
if( (nRc = strcmp( nID, "0403,0001,SD" )) == 0 )
{
    /* check the password */
    if( (nRc = strcmp( nPass, "kaylee" )) == 0 )
    {
        nStudRecord.nInstructor = true;
        nStudRecord.nFileOver = true;
        nStudRecord.nLanguage = 0;
        nRTLanguage = 0;
        return (true);

    } else {
        /* user ID matched but not the password */
        return (false);
    }
}

/* open the password file */
if( OpenPassFile() )
{
    /* locate the input ID */
    if( FindPassEntry( nID, ID_Search, &nTempUser ) )
```

```
    {
        /* see if password checking is enabled */
        if( nPassEnable )
        {
            /* check the password */
            nCount = strlen( nTempUser.nPass );
            if( (nRc = strcmp( nPass, nTempUser.nPass )) == 0 )
            {
                nFound = true;
                nStudRecord = nTempUser;
                nRTLanguage = nStudRecord.nLanguage;
            }
        } else {
            nFound = true;
            nStudRecord = nTempUser;
            nRTLanguage = nStudRecord.nLanguage;
        }
    }
}

/* close the password file */
ClosePassFile();

return ( nFound );
}


/*****************************************************************/
/* OpenPassFile                                                  */
/*                                                               */
/* routine to open password file and position pointer at start   */
/*****************************************************************/
int nPassID = -1;               /* password file identifier */

BOOL OpenPassFile( void )
{

strcpy( nFilePath, nDefPath );
strcat( nFilePath, "\\syslogin.ini" );

if( (nPassID = _lopen( nFilePath, OF_READWRITE  )) == -1 )
{
    if( (nPassID = _lcreat( nFilePath, 2 )) == -1 )
    {
        return (FALSE);
    }
}
return( TRUE );
}

/*****************************************************************/
/* ClosePassFile                                                 */
/*                                                               */
/* routine to close password file                                */
/*****************************************************************/
void ClosePassFile( void )
{

/* close the file */
if( nPassID != -1 ) _lclose( nPassID );

}


/*****************************************************************/
/* FindPassEntry                                                 */
/*                                                               */
/* routine to return information for requested ID                */
/*****************************************************************/
BOOL FindPassEntry( unsigned char * nID, unsigned char nNextPrev,
                    struct tUserLog * nTempUser )
{
struct tUserLog nPassUser;
unsigned int nCount, nRc;
LONG nCurPos;
```

```
/* check if the password file is even open */
if( nPassID == -1 ) return (FALSE);

/* check for search request */
if( nID == NULL )        /* positional search */
{
    switch (nNextPrev)
    {
        case NextPass:
            /* get the next entry */
            nCurPos = _llseek( nPassID, 0L, 1 );
            nCount = _lread( nPassID, (LPSTR)&nPassUser, sizeof(struct tUserLog)
            if( nCount != 0 )
            {
                /* return this record */
                *nTempUser = nPassUser;
                return (TRUE);
            } else {
                /* return the last entry in the file */
                 nCurPos = _llseek( nPassID, (LONG)sizeof(struct tUserLog), 2 );
                nCount = _lread( nPassID, (LPSTR)&nPassUser, sizeof(struct tUser
                if( nCount != 0 )
                {
                    /* return this record */
                    *nTempUser = nPassUser;
                    return (TRUE);
                }
            }
            break;

        case PrevPass:
            /* get the previous entry */
            nCurPos = _llseek( nPassID, (-1L*(LONG)sizeof(struct tUserLog)), 1 )
            nCount = _lread( nPassID, (LPSTR)&nPassUser, sizeof(struct tUserLog)
            if( nCount != 0 )
            {
                /* return this record */
                *nTempUser = nPassUser;
                return (TRUE);
            } else {
                /* return the first entry */
                nCurPos = _llseek( nPassID, 0L, 0 );
                nCount = _lread( nPassID, (LPSTR)&nPassUser, sizeof(struct tUser
                if( nCount != 0 )
                {
                    /* return this record */
                    *nTempUser = nPassUser;
                    return (TRUE);
                }
            }
            break;

        case FirstPass:
            /* get the first entry */
            nCurPos = _llseek( nPassID, 0L, 0 );
            nCount = _lread( nPassID, (LPSTR)&nPassUser, sizeof(struct tUserLog)
            if( nCount != 0 )
            {
                /* return this record */
                *nTempUser = nPassUser;
                return (TRUE);
            } else {
                return (FALSE);
            }
            break;

        case LastPass:
            /* get the last entry */
            nCurPos = _llseek( nPassID, (LONG)sizeof(struct tUserLog), 2 );
            nCount = _lread( nPassID, (LPSTR)&nPassUser, sizeof(struct tUserLog)
            if( nCount != 0 )
            {
                /* return this record */
                *nTempUser = nPassUser;
                return (TRUE);
```

```
            } else {
                return (FALSE);
            }
            break;

        default:
            break;
    }
} else {
    /* start at the top and look for specific entry */
    nCurPos = _llseek( nPassID, 0L, 0 );
    while( true )
    {
        /* read the next record */
        nCount = _lread( nPassID, (LPSTR)&nPassUser, sizeof(struct tUserLog) );
        if( nCount == 0 ) break;
        /* compare the ID */
        nCount = strlen( nPassUser.nID );
        /* skip over any empty entries */
        if( nCount == 0 ) continue;

        if( (nRc = strcmp( nID, nPassUser.nID )) == 0 )
        {
            /* return this record */
            *nTempUser = nPassUser;
            return (TRUE);
        }
    }
}

return (FALSE);
}


/*****************************************************************/
/* SavePassEntry                                                 */
/*                                                               */
/* routine to save or delete information in password file        */
/*****************************************************************/
BOOL SavePassEntry( struct tUserLog * nTempUser, unsigned char nSaveDel )
{
struct tUserLog nPassUser;
unsigned int nCount, nRc;
LONG nCurPos;

/* check if file is open */
if( nPassID == -1 ) return (FALSE);

if( nSaveDel )
{
    /* save the current entry */
    /* start at the top and check if entry exists */
    nCurPos = _llseek( nPassID, 0L, 0 );
    while( true )
    {
        /* read the next record */
        nCount = _lread( nPassID, (LPSTR)&nPassUser, sizeof(struct tUserLog) );

        /* we are at the end of the file check for blank entries */
        if( nCount == 0 )
        {
            nCurPos = _llseek( nPassID, 0L, 0 );
            while( true )
            {
                /* read the next record */
                nCount = _lread( nPassID, (LPSTR)&nPassUser, sizeof(struct tUser
                /* check for end-of-file again */
                if( nCount == 0 )
                {
                    nCurPos = _llseek( nPassID, 0L, 2 );
                    break;
                }
                /* if this is a blank record write it here */
                nCount = strlen( nPassUser.nID );
                if( nCount == 0 )
                {
```

```
                    nCurPos = _llseek( nPassID, (-1L*(LONG)sizeof( struct tUserL
                    break;
                }
            }
            break;
        }

        /* compare the ID */
        nCount = strlen( nPassUser.nID );
        if( nCount == 0 ) continue;     /* don't compare blank entries */

        if( (nRc = strcmp( nTempUser->nID, nPassUser.nID )) == 0 )
        {
            /* entry already exists for this guy overwrite it */
            nCurPos = _llseek( nPassID, (-1L*(LONG)sizeof( struct tUserLog)), 1
            break;
        }
    }
    /* write out the record */
    nCount = _lwrite( nPassID, (LPSTR)nTempUser, sizeof( struct tUserLog) );
    if( nCount == 0 )
    {
        return (FALSE);
    }

} else {
    /* delete the specified entry */
    /* start at the top and look for the entry */
    nCurPos = _llseek( nPassID, 0L, 0 );
    while( true )
    {
        /* read the next record */
        nCount = _lread( nPassID, (LPSTR)&nPassUser, sizeof(struct tUserLog) );

        /* we are at the end of the file - entry was not found */
        if( nCount == 0 ) return (FALSE);

        /* compare the ID */
        nCount = strlen( nPassUser.nID );
        if( nCount == 0 ) continue;     /* ignore blank entries */

        if( (nRc = strcmp( nTempUser->nID, nPassUser.nID )) == 0 )
        {
            /* entry already exists so delete it */
            nCurPos = _llseek( nPassID, (-1L*(LONG)sizeof(struct tUserLog)), 1 )
            break;
        }
    }
    /* zero the record */
    nPassUser.nID[0] = 0;
    /* write out the record */
    nCount = _lwrite( nPassID, (LPSTR)&nPassUser, sizeof( struct tUserLog) );
    if( nCount == 0 )
    {
        return (FALSE);
    }
}
return (TRUE);
}

/*****************************************************************/
/* OpenStageFile                                                 */
/*                                                               */
/* routine to open stage file and position pointer at start      */
/*****************************************************************/
int nStageID = -1;              /* stage file identifier */

BOOL OpenStageFile( void )
{

strcpy( nFilePath, nDefPath );
strcat( nFilePath, nStageFile );

if( (nStageID = _lopen( nFilePath, OF_READWRITE  )) == -1 )
{
```

```
    if( (nStageID = _lcreat( nFilePath, 0 )) == -1 )
    {
        return (FALSE);
    }
}
return( TRUE );
}


/*****************************************************************/
/* CloseStageFile                                                */
/*                                                               */
/* routine to close Stage file                                   */
/*****************************************************************/
void CloseStageFile( void )
{

/* close the file */
if( nStageID != -1 ) _lclose( nStageID );

}


/*****************************************************************/
/* SaveStageEntry                                                */
/*                                                               */
/* routine to save or delete information in Stage file           */
/*****************************************************************/
BOOL SaveStageEntry( struct tStage * nTempStage, unsigned char nSaveDel )
{
struct tStage nStage;
unsigned int nCount, nRc;
LONG nCurPos;

/* check if file is open */
if( nStageID == -1 ) return (FALSE);

if( nSaveDel )
{
    /* save the current entry */
    /* start at the top and check if entry exists */
    nCurPos = _llseek( nStageID, 0L, 0 );
    while( true )
    {
    /* read the next record */
    nCount = _lread( nStageID, (LPSTR)&nStage, sizeof(struct tStage) );

    /* we are at the end of the file check for blank entries */
    if( nCount == 0 )
    {
        nCurPos = _llseek( nStageID, 0L, 0 );
        while( true )
        {
            /* read the next record */
            nCount = _lread( nStageID, (LPSTR)&nStage, sizeof(struct tStage)
            /* check for end-of-file again */
            if( nCount == 0 )
            {
                nCurPos = _llseek( nStageID, 0L, 2 );
                break;
            }
            /* if this is a blank record write it here */
            nCount = strlen( nStage.nName );
            if( nCount == 0 )
            {
                nCurPos = _llseek( nStageID, (-1L*(LONG)sizeof( struct tStag
                break;
            }
        }
        break;
    }

    /* compare the ID */
    nCount = strlen( nStage.nName );
    if( nCount == 0 ) continue;     /* don't compare blank entries */
```

```
        if( (nRc = strcmp( nTempStage->nName, nStage.nName )) == 0 )
        {
            /* entry already exists for this stage overwrite it */
            nCurPos = _llseek( nStageID, (-1L*(LONG)sizeof( struct tStage)), 1 )
            break;
        }
    }
    /* write out the record */
    nCount = _lwrite( nStageID, (LPSTR)nTempStage, sizeof( struct tStage) );
    if( nCount == 0 )
    {
        return (FALSE);
    }

} else {
    /* delete the specified entry */
    /* start at the top and look for the entry */
    nCurPos = _llseek( nStageID, 0L, 0 );
    while( true )
    {
        /* read the next record */
        nCount = _lread( nStageID, (LPSTR)&nStage, sizeof(struct tStage) );

        /* we are at the end of the file - entry was not found */
        if( nCount == 0 ) return (FALSE);

        /* compare the ID */
        nCount = strlen( nStage.nName );
        if( nCount == 0 ) continue;     /* ignore blank entries */

        if( (nRc = strcmp( nTempStage->nName, nStage.nName )) == 0 )
        {
            /* entry already exists so delete it */
            nCurPos = _llseek( nStageID, (-1L*(LONG)sizeof(struct tStage)), 1 );
            break;
        }
    }
    /* zero the record */
    nStage.nName[0] = 0;
    /* write out the record */
    nCount = _lwrite( nStageID, (LPSTR)&nStage, sizeof( struct tStage) );
    if( nCount == 0 )
    {
        return (FALSE);
    }
}
return (TRUE);
}


/*****************************************************************/
/* FindStageEntry                                                */
/*                                                               */
/* routine to return information for requested ID                */
/*****************************************************************/
BOOL FindStageEntry( unsigned char * nName, unsigned char nNextPrev,
                     struct tStage * nTempStage )
{
struct tStage nStage;
unsigned int nCount, nRc;
LONG nCurPos;

/* check if the password file is even open */
if( nStageID == -1 ) return (FALSE);

/* check for search request */
if( nName == NULL )     /* positional search */
{
    switch (nNextPrev)
    {
        case NextStage:
            /* get the next entry */
            nCurPos = _llseek( nStageID, 0L, 1 );
            nCount = _lread( nStageID, (LPSTR)&nStage, sizeof(struct tStage) );
            if( nCount != 0 )
```

```
        {
            /* return this record */
            *nTempStage = nStage;
            return (TRUE);
        } else {
            /* return the last entry in the file */
             nCurPos = _llseek( nStageID, (LONG)sizeof(struct tStage), 2 );
            nCount = _lread( nStageID, (LPSTR)&nStage, sizeof(struct tStage)
            if( nCount != 0 )
            {
                /* return this record */
                *nTempStage = nStage;
                return (TRUE);
                }
            }
            break;

        case PrevStage:
            /* get the previous entry */
            nCurPos = _llseek( nStageID, (-1L*(LONG)sizeof(struct tStage)), 1 );
            nCount = _lread( nStageID, (LPSTR)&nStage, sizeof(struct tStage) );
            if( nCount != 0 )
            {
                /* return this record */
                *nTempStage = nStage;
                return (TRUE);
            } else {
                /* return the first entry */
                nCurPos = _llseek( nStageID, 0L, 0 );
                nCount = _lread( nStageID, (LPSTR)&nStage, sizeof(struct tStage)
                if( nCount != 0 )
                {
                    /* return this record */
                    *nTempStage = nStage;
                    return (TRUE);
                }
            }
            break;

        case FirstStage:
            /* get the first entry */
            nCurPos = _llseek( nStageID, 0L, 0 );
            nCount = _lread( nStageID, (LPSTR)&nStage, sizeof(struct tStage) );
            if( nCount != 0 )
            {
                /* return this record */
                *nTempStage = nStage;
                return (TRUE);
            } else {
                return (FALSE);
            }
            break;

        case LastStage:
            /* get the last entry */
            nCurPos = _llseek( nStageID, (LONG)sizeof(struct tStage), 2 );
            nCount = _lread( nStageID, (LPSTR)&nStage, sizeof(struct tStage) );
            if( nCount != 0 )
            {
                /* return this record */
                *nTempStage = nStage;
                return (TRUE);
            } else {
                return (FALSE);
            }
            break;

        default:
            break;
    }
} else {
    /* start at the top and look for specific entry */
    nCurPos = _llseek( nStageID, 0L, 0 );
```

```
    while( true )
    {
        /* read the next record */
        nCount = _lread( nStageID, (LPSTR)&nStage, sizeof(struct tStage) );
        if( nCount == 0 ) break;

        /* compare the ID */
        nCount = strlen( nStage.nName );
        /* skip over any empty entries */
        if( nCount == 0 ) continue;

        if( (nRc = strcmp( nName, nStage.nName )) == 0 )
        {
            /* return this record */
            *nTempStage = nStage;
            return (TRUE);
        }
    }
}

return (FALSE);
}


/*****************************************************************/
/* OpenCourseFile                                                */
/*                                                               */
/* routine to open Course file and position pointer at start     */
/*****************************************************************/
int nCourseID = -1;             /* Course file identifier */

BOOL OpenCourseFile( void )
{

strcpy( nFilePath, nDefPath );
strcat( nFilePath, nCourseFile );

if( (nCourseID = _lopen( nFilePath, OF_READWRITE  )) == -1 )
{
    if( (nCourseID = _lcreat( nFilePath, 0 )) == -1 )
    {
        return (FALSE);
    }
}
return( TRUE );
}


/*****************************************************************/
/* CloseCourseFile                                               */
/*                                                               */
/* routine to close Course file                                  */
/*****************************************************************/
void CloseCourseFile( void )
{

/* close the file */
if( nCourseID != -1 ) _lclose( nCourseID );

}

/*****************************************************************/
/* SaveCourseEntry                                               */
/*                                                               */
/* routine to save or delete information in Course file          */
/*****************************************************************/
BOOL SaveCourseEntry( struct tCourse * nTempCourse, unsigned char nSaveDel )
{
struct tCourse nCourse;
unsigned int nCount, nRc;
LONG nCurPos;

/* check if file is open */
if( nCourseID == -1 ) return (FALSE);

if( nSaveDel )
```

```
{
    /* save the current entry */
    /* start at the top and check if entry exists */
    nCurPos = _llseek( nCourseID, 0L, 0 );
    while( true )
    {
        /* read the next record */
        nCount = _lread( nCourseID, (LPSTR)&nCourse, sizeof(struct tCourse) );

        /* we are at the end of the file check for blank entries */
        if( nCount == 0 )
        {
            nCurPos = _llseek( nCourseID, 0L, 0 );
            while( true )
            {
                /* read the next record */
                nCount = _lread( nCourseID, (LPSTR)&nCourse, sizeof(struct tCour
                /* check for end-of-file again */
                if( nCount == 0 )
                {
                    nCurPos = _llseek( nCourseID, 0L, 2 );
                    break;
                }
                /* if this is a blank record write it here */
                nCount = strlen( nCourse.nName );
                if( nCount == 0 )
                {
                    nCurPos = _llseek( nCourseID, (-1L*(LONG)sizeof( struct tCou
                    break;
                }
            }
            break;
        }

        /* compare the ID */
        nCount = strlen( nCourse.nName );
        if( nCount == 0 ) continue;     /* don't compare blank entries */

        if( (nRc = strcmp( nTempCourse->nName, nCourse.nName )) == 0 )
        {
            /* entry already exists for this Course overwrite it */
            nCurPos = _llseek( nCourseID, (-1L*(LONG)sizeof( struct tCourse)), 1
            break;
        }
    }
    /* write out the record */
    nCount = _lwrite( nCourseID, (LPSTR)nTempCourse, sizeof( struct tCourse) );
    if( nCount == 0 )
    {
        return (FALSE);
    }

} else {
    /* delete the specified entry */
    /* start at the top and look for the entry */
    nCurPos = _llseek( nCourseID, 0L, 0 );
    while( true )
    {
        /* read the next record */
        nCount = _lread( nCourseID, (LPSTR)&nCourse, sizeof(struct tCourse) );

        /* we are at the end of the file - entry was not found */
        if( nCount == 0 ) return (FALSE);

        /* compare the ID */
        nCount = strlen( nCourse.nName );
        if( nCount == 0 ) continue;     /* ignore blank entries */

        if( (nRc = strcmp( nTempCourse->nName, nCourse.nName )) == 0 )
        {
            /* entry already exists so delete it */
            nCurPos = _llseek( nCourseID, (-1L*(LONG)sizeof(struct tCourse)), 1
            break;
        }
    }
```

```
    /* zero the record */
    nCourse.nName[0] = 0;
    /* write out the record */
    nCount = _lwrite( nCourseID, (LPSTR)&nCourse, sizeof( struct tCourse) );
    if( nCount == 0 )
    {
        return (FALSE);
    }
}
return (TRUE);
}


/*****************************************************************/
/* FindCourseEntry                                               */
/*                                                               */
/* routine to return information for requested ID                */
/*****************************************************************/
BOOL FindCourseEntry( unsigned char * nName, unsigned char nNextPrev,
                      struct tCourse * nTempCourse )
{
struct tCourse nCourse;
unsigned int nCount, nRc;
LONG nCurPos;

/* check if the password file is even open */
if( nCourseID == -1 ) return (FALSE);
/* check for search request */
if( nName == NULL )     /* positional search */
{
    switch (nNextPrev)
    {
        case NextCourse:
            /* get the next entry */
            nCurPos = _llseek( nCourseID, 0L, 1 );
            nCount = _lread( nCourseID, (LPSTR)&nCourse, sizeof(struct tCourse)
            if( nCount != 0 )
            {
                /* return this record */
                *nTempCourse = nCourse;
                return (TRUE);
            } else {
                /* return the last entry in the file */
                 nCurPos = _llseek( nCourseID, (LONG)sizeof(struct tCourse), 2 )
                nCount = _lread( nCourseID, (LPSTR)&nCourse, sizeof(struct tCour
                if( nCount != 0 )
                {
                    /* return this record */
                    *nTempCourse = nCourse;
                    return (TRUE);
                }
            }
            break;

        case PrevCourse:
            /* get the previous entry */
            nCurPos = _llseek( nCourseID, (-1L*(LONG)sizeof(struct tCourse)), 1
            nCount = _lread( nCourseID, (LPSTR)&nCourse, sizeof(struct tCourse)
            if( nCount != 0 )
            {
                /* return this record */
                *nTempCourse = nCourse;
                return (TRUE);
            } else {
                /* return the first entry */
                nCurPos = _llseek( nCourseID, 0L, 0 );
                nCount = _lread( nCourseID, (LPSTR)&nCourse, sizeof(struct tCour
                if( nCount != 0 )
                {
                    /* return this record */
                    *nTempCourse = nCourse;
                    return (TRUE);
                }
            }
            break;
```

```
        case FirstCourse:
            /* get the first entry */
            nCurPos = _llseek( nCourseID, 0L, 0 );
            nCount = _lread( nCourseID, (LPSTR)&nCourse, sizeof(struct tCourse)
            if( nCount != 0 )
            {
                /* return this record */
                *nTempCourse = nCourse;
                return (TRUE);
            } else {
                return (FALSE);
            }
            break;

        case LastCourse:
            /* get the last entry */
            nCurPos = _llseek( nCourseID, (LONG)sizeof(struct tCourse), 2 );
            nCount = _lread( nCourseID, (LPSTR)&nCourse, sizeof(struct tCourse)
            if( nCount != 0 )
            {
                /* return this record */
                *nTempCourse = nCourse;
                return (TRUE);
            } else {
                return (FALSE);
            }
            break;

        default:
            break;
    }
} else {
    /* start at the top and look for specific entry */
    nCurPos = _llseek( nCourseID, 0L, 0 );
    while( true )
    {
        /* read the next record */
        nCount = _lread( nCourseID, (LPSTR)&nCourse, sizeof(struct tCourse) );
        if( nCount == 0 ) break;

        /* compare the ID */
        nCount = strlen( nCourse.nName );
        /* skip over any empty entries */
        if( nCount == 0 ) continue;

        if( (nRc = strcmp( nName, nCourse.nName )) == 0 )
        {
            /* return this record */
            *nTempCourse = nCourse;
            return (TRUE);
        }
    }
}

return (FALSE);
}


/*****************************************************************/
/* FISMessage                                                    */
/*                                                               */
/* routine to display a message, or play a sound                 */
/*****************************************************************/
int FISMessage( HWND hWndParent, LPSTR hText, LPSTR hLabel,
                unsigned int hIcon, unsigned int hButton,
                unsigned int hStyle )
{
int nRc;
HWND hWndFocus;

/* get the current focus */
```

```
hWndFocus = GetFocus();

if( hLabel != NULL )
{
    /* play the sound associated with this icon */
    MessageBeep( hIcon );
    /* call message box with the appropriate messages */
    nRc = MessageBox( hWndParent, hText, hLabel,
                      hIcon | hButton | hStyle );

} else {
    /* call play sound using the hText string as the
       [sound] identifier */
   nRc = IDOK;
   #if _MSC_VER == 700
   sndPlaySound( hText, SND_SYNC );
   #else
   MessageBeep( 0 );
   #endif
}

/* return the previous focus */
SetFocus( hWndFocus );
return( nRc );
}


/*****************************************************************/
/* FISChangeMenu                                                 */
/*                                                               */
/* routine to change the menu items dependent on the current     */
/* language                                                      */
/*****************************************************************/
void FISChangeMenu( void )
{
HMENU hOneMenu, hTwoMenu;       /* plase holder for popup menus */

/* check if the title are available for the menu */
if( strlen( nRTTitle[nRTLanguage][0] ) == 0 ) return;

/* brute force modification of the menu items */
/* Exit */
hOneMenu = GetSubMenu( hMainMenu, 0 );
ModifyMenu( hMainMenu, 0, MF_BYPOSITION | MF_POPUP,
            hOneMenu, (LPSTR)nRTTitle[nRTLanguage][1] );

/* Exit Items */
ModifyMenu( hMainMenu, IDM_R_EXIT, MF_BYCOMMAND | MF_STRING,
            IDM_R_EXIT, (LPSTR)nRTTitle[nRTLanguage][4] );
if( FISLogged )
{
    ModifyMenu( hMainMenu, IDM_O_LOGIN, MF_BYCOMMAND | MF_STRING,
                IDM_O_LOGIN, (LPSTR)nRTTitle[nRTLanguage][3] );
    ModifyMenu( hMainMenu, IDM_R_EXIT, MF_BYCOMMAND | MF_STRING | MF_GRAYED,
                IDM_R_EXIT, (LPSTR)nRTTitle[nRTLanguage][4] );
} else {
    ModifyMenu( hMainMenu, IDM_O_LOGIN, MF_BYCOMMAND | MF_STRING,
                IDM_O_LOGIN, (LPSTR)nRTTitle[nRTLanguage][2] );
    ModifyMenu( hMainMenu, IDM_R_EXIT, MF_BYCOMMAND | MF_STRING | MF_ENABLED,
                IDM_R_EXIT, (LPSTR)nRTTitle[nRTLanguage][4] );
}

/* Activities */
hOneMenu = GetSubMenu( hMainMenu, 1 );
ModifyMenu( hMainMenu, 1, MF_BYPOSITION | MF_POPUP,
            hOneMenu, (LPSTR)nRTTitle[nRTLanguage][6] );
/* Activities Items*/
hTwoMenu = GetSubMenu( hOneMenu, 0 );
ModifyMenu( hOneMenu, 0, MF_BYPOSITION | MF_POPUP,
            hTwoMenu, (LPSTR)nRTTitle[nRTLanguage][7] );
hTwoMenu = GetSubMenu( hOneMenu, 1 );
ModifyMenu( hOneMenu, 1, MF_BYPOSITION | MF_POPUP,
            hTwoMenu, (LPSTR)nRTTitle[nRTLanguage][16] );
```

```
/* Practice Items*/
ModifyMenu( hMainMenu, IDM_S_GRIPFORCE, MF_BYCOMMAND | MF_STRING,
            IDM_S_GRIPFORCE, (LPSTR)nRTTitle[nRTLanguage][8] );
ModifyMenu( hMainMenu, IDM_S_TRIGGER, MF_BYCOMMAND | MF_STRING,
            IDM_S_TRIGGER, (LPSTR)nRTTitle[nRTLanguage][9] );
ModifyMenu( hMainMenu, IDM_O_REALTIME, MF_BYCOMMAND | MF_STRING,
            IDM_O_REALTIME, (LPSTR)nRTTitle[nRTLanguage][10] );
ModifyMenu( hMainMenu, IDM_O_ONESHOT, MF_BYCOMMAND | MF_STRING,
            IDM_O_ONESHOT, (LPSTR)nRTTitle[nRTLanguage][11] );
/* Course of Fire Items */
ModifyMenu( hMainMenu, IDM_O_INSTRUCT, MF_BYCOMMAND | MF_STRING,
            IDM_O_INSTRUCT, (LPSTR)nRTTitle[nRTLanguage][17] );
ModifyMenu( hMainMenu, IDM_O_SEQUENCE, MF_BYCOMMAND | MF_STRING,
            IDM_O_SEQUENCE, (LPSTR)nRTTitle[nRTLanguage][18] );

/* Help */
hOneMenu = GetSubMenu( hMainMenu, 4 );
nRTTitle[nRTLanguage][21][0] = 8;
ModifyMenu( hMainMenu, 4, MF_BYPOSITION | MF_STRING,
            IDM_H_CONTENTS, (LPSTR)nRTTitle[nRTLanguage][21] );

/* Setup */
hOneMenu = GetSubMenu( hMainMenu, 2 );
ModifyMenu( hMainMenu, 2, MF_BYPOSITION | MF_POPUP,
            hOneMenu, (LPSTR)nRTTitle[nRTLanguage][26] );
/* Setup Items*/
ModifyMenu( hMainMenu, IDM_O_STUDENT, MF_BYCOMMAND | MF_STRING,
            IDM_O_STUDENT, (LPSTR)nRTTitle[nRTLanguage][27] );
ModifyMenu( hMainMenu, IDM_R_LEGEND, MF_BYCOMMAND | MF_STRING,
            IDM_R_LEGEND, (LPSTR)nRTTitle[nRTLanguage][30] );

/* Administration */
hOneMenu = GetSubMenu( hMainMenu, 3 );
ModifyMenu( hMainMenu, 3, MF_BYPOSITION | MF_POPUP,
            hOneMenu, (LPSTR)nRTTitle[nRTLanguage][22] );
/* Setup Items*/
ModifyMenu( hMainMenu, IDM_O_ACTIVITY, MF_BYCOMMAND | MF_STRING,
            IDM_O_ACTIVITY, (LPSTR)nRTTitle[nRTLanguage][23] );
ModifyMenu( hMainMenu, IDM_O_ADVANCED, MF_BYCOMMAND | MF_STRING,
            IDM_O_ADVANCED, (LPSTR)nRTTitle[nRTLanguage][28] );
ModifyMenu( hMainMenu, IDM_C_SAVE, MF_BYCOMMAND | MF_STRING,
            IDM_C_SAVE, (LPSTR)nRTTitle[nRTLanguage][31] );
ModifyMenu( hMainMenu, IDM_C_OPEN, MF_BYCOMMAND | MF_STRING,
            IDM_C_OPEN, (LPSTR)nRTTitle[nRTLanguage][32] );

DrawMenuBar( hWndMain );

return;
}


/*************************************************************/
/* FISDrawInstruct                                           */
/*                                                           */
/* routine to display a default instruction message on the main*/
/* screen background                                         */
/*************************************************************/
void FISDrawInstruct( HWND hWndFunc, HDC hDCFunc )
{
LOGFONT lDrawFont;
HPEN hTempPen;
HFONT hDrawFont, hTempFont;
RECT nTempRect;
unsigned int nVSize, nHSize;
int nRc;

/* get the current size of the window */
GetClientRect( hWndFunc, &nTempRect );
nHSize = nTempRect.right - nTempRect.left;
nVSize = nTempRect.bottom - nTempRect.top;

/* create a large font */
lDrawFont.lfHeight = nVSize/10;
lDrawFont.lfWidth = nHSize/30;
lDrawFont.lfEscapement = 0;
lDrawFont.lfOrientation = 0;
```

```
lDrawFont.lfWeight = 400;
lDrawFont.lfItalic = 0;
lDrawFont.lfUnderline = 0;
lDrawFont.lfStrikeOut = 0;
lDrawFont.lfCharSet = ANSI_CHARSET;
lDrawFont.lfOutPrecision = OUT_DEFAULT_PRECIS;
lDrawFont.lfClipPrecision = CLIP_DEFAULT_PRECIS;
lDrawFont.lfQuality = PROOF_QUALITY;
lDrawFont.lfPitchAndFamily = (DEFAULT_PITCH | FF_DONTCARE);

/* create the font and select it into the device context */
hDrawFont = CreateFontIndirect( &lDrawFont );
if( hDrawFont != NULL )
{
    hTempFont = SelectObject( hDCFunc, hDrawFont );
}

/* display the message */
SetTextColor( hDCFunc, rBlue );
nTempRect.top = 0; nTempRect.bottom = nVSize/4;
nTempRect.left = 0; nTempRect.right = nHSize;
nRc = DrawText( hDCFunc, nRTTitle[nRTLanguage][41], -1, &nTempRect, DT_CENTER );

SetTextColor( hDCFunc, rRed );
nTempRect.top = nVSize/3; nTempRect.bottom = (nVSize/3)+(nVSize/10);
nRc = DrawText( hDCFunc, nRTTitle[nRTLanguage][42], -1, &nTempRect, DT_CENTER );
nTempRect.top = nTempRect.bottom; nTempRect.bottom = (nVSize/3)+(nVSize*2/10);
nRc = DrawText( hDCFunc, nRTTitle[nRTLanguage][43], -1, &nTempRect, DT_CENTER );

SetTextColor( hDCFunc, rWhite );

nTempRect.top = nVSize*3/4; nTempRect.bottom = (nVSize*3/4) + (nVSize/10);
nRc = DrawText( hDCFunc, nRTTitle[nRTLanguage][44], -1, &nTempRect, DT_CENTER );
nTempRect.top = nTempRect.bottom; nTempRect.bottom = (nVSize*3/4) + (nVSize*2/10
if( FISLogged )
{
    nRc = DrawText( hDCFunc, nRTTitle[nRTLanguage][40], -1, &nTempRect, DT_CENTE
} else {
    nRc = DrawText( hDCFunc, nRTTitle[nRTLanguage][45], -1, &nTempRect, DT_CENTE
}

/* return the display to the original state */
SelectObject( hDCFunc, hTempFont );
DeleteObject( hDrawFont );


return;
}
#include "global.h"

#include "real_exp.h"
#include "main_exp.h"
#include "dial_exp.h"
#include "one_exp.h"
#include "func_exp.h"
#include "gforce.h"

int FAR CreateForce( HANDLE hInst, HWND hParentInst )
{
 /*********************************************************************/
 /* HANDLE hInst;          handle for this instance                   */
 /* HANDLE hParentInst;  handle for possible previous instances      */
 /* int    nCmdShow;       Show code for main window display          */
 /*********************************************************************/

 MSG        msg;          /* MSG structure to store your messages        */
 int        nRc;          /* return value from Register Classes          */

strcpy(szForceName, "GRIPFORCE");
hInstForce = hInst;

/* register window classes if first instance of application         */
if ((nRc = nCwRegForceClasses()) == -1)
{
```

```
    /* registering one of the windows failed                          */
    LoadString(hInstForce, IDS_ERR_REGISTER_CLASS, szForceString, sizeof(szForce
    FISMessage(NULL, szForceString, NULL, MB_ICONEXCLAMATION, MB_OK, NULL );
    return nRc;
}

 /* create application's Main window                                  */
 hWndForce = CreateWindow(
                szForceName,                /* Window class name          */
                nRTTitle[nRTLanguage][46],        /* Window's title
                WS_CLIPSIBLINGS |
                WS_CHILDWINDOW  |
                WS_CAPTION      |
                WS_THICKFRAME   |
                WS_MINIMIZEBOX  |
                WS_MAXIMIZEBOX,
                0, 0,     /* X, Y                          */
                50, 50, /* Width, Height of window     */
                hParentInst,              /* Parent window's handle      */
                NULL,                     /* Default to Class Menu       */
                hInstForce,              /* Instance of window          */
                NULL);                    /* Create struct for WM_CREATE */


 if(hWndForce == NULL)
   {
    LoadString(hInstForce, IDS_ERR_CREATE_WINDOW, szForceString, sizeof(szForceS
    FISMessage(NULL, szForceString, NULL, MB_ICONEXCLAMATION, MB_OK, NULL);
    return IDS_ERR_CREATE_WINDOW;
   }

 ShowWindow(hWndForce, SW_SHOWNORMAL);            /* display main window      */

 hAccForce = LoadAccelerators(hInstForce, szForceName);

 return msg.wParam;
} /*  End of WinMain                                                    */
/*********************************************************************/
/*                                                                   */
/* Main Window Procedure                                             */
/*                                                                   */
/* This procedure provides service routines for the Windows events   */
/* (messages) that Windows sends to the window, as well as the user  */
/* initiated events (messages) that are generated when the user selects */
/* the action bar and pulldown menu controls or the corresponding    */
/* keyboard accelerators.                                            */
/*                                                                   */
/*********************************************************************/

LONG FAR PASCAL ForceWndProc(HWND hWnd, WORD Message, WORD wParam, LONG lParam)
{
HMENU      hMenu=0;            /* handle for the menu                 */
HBITMAP    hBitmap=0;          /* handle for bitmaps                  */
HDC        hDCPaint;                /* handle for the display device       */
int     nRc;
PAINTSTRUCT ps;                /* holds PAINT information             */

 switch (Message)
   {
    case WM_TIMER:
        /* draw the grip force measurements */
        if( !IsIconic(hWnd) ) FISDrawForce( hDCForce, nForceRect );
        break;

    case WM_COMMAND:
        switch( wParam)
        {
            case IDM_R_START:
                SetWindowText( hWnd, nRTTitle[nRTLanguage][47] );
                nPrevFront = 0;
                nPrevLSide = 0;
                nPrevRSide = 0;
                /* clear the window and redraw the gauge */
                if( !IsIconic( hWnd ) )
                {
```

```
                FISClearWindow( hWndForce, hDCForce );
                FISDrawGauge( hWndForce, hDCForce, hInstForce );
            }

            /* set up the Grip Force Timer */
            KillTimer( hWnd, n100mil );
            nRc = SetTimer( hWnd, n100mil, n100milTicks, NULL );
            break;

        case IDM_R_STOP:
            /* kill the timer for grip force */
            nRc = KillTimer( hWnd, n100mil );
            SetWindowText( hWnd, nRTTitle[nRTLanguage][46] );
            break;

        case IDM_R_CLEAR:
            /* clear the window and redraw the axes */
            if( !IsIconic( hWnd ) )
            {
                FISClearWindow( hWndForce, hDCForce );
                FISDrawGauge( hWndForce, hDCForce, hInstForce );
            }
            break;

        case IDM_R_CALIBRATE:
            if( !IsIconic( hWnd) )
            {
                HandleDialog( hWndForce, hInstMain, ID_CALIB,
                              (FARPROC)FISCALIBRATEMsgProc, NULL );
            }
            break;

        case IDM_HELP:
            if( !nPlotOn ) HandleHelp( hWndForce, 2 );
            break;

        case IDM_R_EXIT:
            PostMessage( hWnd, WM_CLOSE, NULL, NULL );
            break;

        case IDM_S_ABOUT:
            if( !nPlotOn ) HandleAbout( hWnd, hInstForce, ID_GRIPFORCE );
            break;

        default:
            return DefWindowProc(hWnd, Message, wParam, lParam);
            break;
    }
    break;

case WM_CREATE:
    /* load the device context and the cursor */
    cForce = true;
    hDCForce = GetDC( hWnd );
    break;

case WM_SETFOCUS:
    FlashWindow( hWndForce, true );
    BringWindowToTop( hWndForce );
    HandleToolTemplate( tGForce );
    break;

case WM_KILLFOCUS:
    FlashWindow( hWndForce, true );
    break;

case WM_MOUSEACTIVATE:
    if( GetFocus() != hWnd ) SetFocus( hWnd );
    break;

case WM_MOUSEMOVE:
    HandleMouseMove( hWnd, hInstForce, (LPSTR)"FORCEWIN" );
    break;
```

```
    case WM_MOVE:
        break;

    case WM_SIZE:
        break;

#if _MSC_VER == 700
    case WM_WINDOWPOSCHANGING:
        {
            /* get the new dimensions */
            WINDOWPOS FAR * pwp;
            float fRatio;
            pwp = (WINDOWPOS FAR *)lParam;

            if( pwp->cx > 0 )
            {
                fRatio = (float)pwp->cy / (float)pwp->cx;
                /* check aspect ratio */
                if( (fRatio < (float)0.70) || (fRatio > (float)0.80) )
                {
                    /* give 3/4 aspect ratio */
                    pwp->cx = 4 * pwp->cy / 3;
                }
            }
            return DefWindowProc(hWnd, Message, wParam, lParam);
        }
        break;
#endif

    case IDM_PAINT:
        if( !IsIconic( hWnd ) )
        {
            FISClearWindow( hWndForce, hDCForce );
            FISDrawGauge( hWndForce, hDCForce, hInstForce );
        }
        break;

    case WM_PAINT:
        /* refresh the window */
        memset(&ps, 0x00, sizeof(PAINTSTRUCT));
        hDCPaint = BeginPaint(hWnd, &ps);
        SetBkMode(hDCPaint, TRANSPARENT);

        /* get the size of the window  and fill in window */
        GetClientRect( hWnd, &nForceRect );
        FISDrawGauge( hWnd, hDCPaint, hInstForce );

        EndPaint(hWnd, &ps);
        break;

    case WM_CLOSE:  /* close the window */
        /* get rid of unneeded system resources */
        ReleaseDC( hWnd, hDCForce );
        KillTimer( hWnd, n100mil );

        /* destroy the window */
        HandleHelp( hWndForce, 0 );
        DestroyWindow(hWnd);

        /* expand the other windows */
        PostMessage( hWndMain, WM_COMMAND, IDM_H_REPAINT, NULL );

        cForce = false;
        hWndForce = NULL;
        break;

    case WM_DESTROY:
        /* get rid of unneeded system resources */
        ReleaseDC( hWndForce, hDCForce );
        KillTimer( hWndForce, n100mil );
        HandleHelp( hWndForce, 0 );

        cForce = false;
        hWndForce = NULL;
        break;
```

```
    default:
         return DefWindowProc(hWnd, Message, wParam, lParam);
         break;
   }
 return 0L;
}     /* End of WndProc                                          */

/*********************************************************************/
/*                                                                   */
/* nCwRegisterClasses Function                                       */
/*                                                                   */
/* The following function registers all the classes of all the windows  */
/* associated with this application. The function returns an error code */
/* if unsuccessful, otherwise it returns 0.                          */
/*                                                                   */
/*********************************************************************/

int nCwRegForceClasses(void)
{
 WNDCLASS   wndclass;    /* struct to define a window class          */
 memset(&wndclass, 0x00, sizeof(WNDCLASS));


 /* load WNDCLASS with window's characteristics                      */
 wndclass.style = CS_OWNDC | CS_HREDRAW | CS_VREDRAW | CS_BYTEALIGNWINDOW;
 wndclass.lpfnWndProc = ForceWndProc;
 /* Extra storage for Class and Window objects                       */
 wndclass.cbClsExtra = 0;
 wndclass.cbWndExtra = 0;
 wndclass.hInstance = hInstForce;
 wndclass.hIcon = LoadIcon(hInstForce, "GRIPFORCE");
 wndclass.hCursor = NULL;        /* so cursor may be changed         */
 /* Create brush for erasing background                              */
 wndclass.hbrBackground = CreateSolidBrush(RGB(255, 255, 255));
 wndclass.lpszMenuName = szForceName;   /* Menu Name is App Name */
 wndclass.lpszClassName = szForceName; /* Class Name is App Name */

 /* first attempt to deregister the class */
 UnregisterClass( szForceName, hInstForce );

 if(RegisterClass(&wndclass) == 0)
   return -1;

 return(0);
} /* End of nCwRegisterClasses                                       */

#include "global.h"

#include <conio.h>
#include <math.h>
#include <time.h>

#include "func_exp.h"
#include "main_exp.h"
#include "real_exp.h"
#include "one_exp.h"
#include "forc_exp.h"

/*********************************************************************/
/* FISMovePlot                                                       */
/*                                                                   */
/* used to move plot any number of seconds to the left or the        */
/* right to allow continued plotting, amount of movement should be   */
/* less than the total duration displayed on the screen              */
/*********************************************************************/
void FISMovePlot( HDC hDCFunc, RECT nDrawSize, int * nPlotStart,
                  int nPlotDur, int nMove)
{
int nRc;        /* return parameter */
int nBits;
RECT nTempRect;

/* check if the move length is greater than the plot duration */
if (nMove > nPlotDur) return;   /* don't do it */
if ((*nPlotStart + nMove) <= 0)
{
```

```
    nMove = 0 - *nPlotStart;
}
if (nMove == 0) return;          /* that was easy !!! */

/* determine amount to move - round up */
nBits = 1 + (abs(nMove) * (nDrawSize.right-nDrawSize.left) / nPlotDur);

/* if nMove is positive move the plot left (increase nPlotStart) */
if( nMove > 0 )
{
nRc = BitBlt( hDCFunc, (nDrawSize.left+2), nDrawSize.top,
              (nDrawSize.right-nDrawSize.left-nBits),
              (nDrawSize.bottom-nDrawSize.top),
              hDCFunc, (nDrawSize.left+2+nBits), nDrawSize.top,
              SRCCOPY );

/* clear the area we just freed up */
nTempRect.top = nDrawSize.top;
nTempRect.bottom = nDrawSize.bottom;
nTempRect.left = nDrawSize.right-nBits;
nTempRect.right = nDrawSize.right+20;          /* clear off the edge */

} else {
/* if nMove is negative move the plot right (decrease nPlotStart) */
nRc = BitBlt( hDCFunc, (nDrawSize.left+2+nBits), nDrawSize.top,
              (nDrawSize.right-nDrawSize.left-nBits),
              (nDrawSize.bottom-nDrawSize.top),
              hDCFunc, (nDrawSize.left+2), nDrawSize.top,
              SRCCOPY );

/* clear the area we just freed up */
nTempRect.top = nDrawSize.top;
nTempRect.bottom = nDrawSize.bottom;
nTempRect.left = nDrawSize.left;
nTempRect.right = nDrawSize.left+nBits;
}

*nPlotStart+=nMove;

FISClearArea( hDCFunc, nTempRect );

return;
}


/*************************************************************************/
/* FISClearArea                                                          */
/*                                                                       */
/* clear the display area of the indicated display                       */
/*************************************************************************/
void FISClearArea( HDC hDCFunc, RECT nDrawSize )
{
int nRc;        /* return code */
DWORD nBKColor;
HPEN nTempPen, nBKPen;
HBRUSH nTempBrush, nBKBrush;

/* get the current background color */
nBKColor = GetBkColor( hDCFunc );
nBKPen = CreatePen( PS_SOLID, 1, nBKColor );
nTempPen = SelectObject( hDCFunc, nBKPen );
nBKBrush = CreateSolidBrush( nBKColor );
nTempBrush = SelectObject( hDCFunc, nBKBrush );

/* clear the area */
Rectangle( hDCFunc, nDrawSize.left+2, nDrawSize.top,
                    nDrawSize.right+2, nDrawSize.bottom );

/* delete the objects */
SelectObject( hDCFunc, nTempPen );
SelectObject( hDCFunc, nTempBrush );
DeleteObject( nBKPen );
DeleteObject( nBKBrush );

return;
}
```

```
/*********************************************************************/
/* FISClearWindow                                                    */
/*                                                                   */
/* clear the entire window area of the indicated display             */
/*********************************************************************/
void FISClearWindow( HWND hWndFunc, HDC hDCFunc )
{
RECT nTempRect;
DWORD nBKColor;
HPEN nTempPen, nBKPen;
HBRUSH nTempBrush, nBKBrush;

/* get the current window rectangle */
GetClientRect( hWndFunc, &nTempRect );

/* get the current background color */
nBKColor = GetBkColor( hDCFunc );
nBKPen = CreatePen( PS_SOLID, 1, nBKColor );
nTempPen = SelectObject( hDCFunc, nBKPen );
nBKBrush = CreateSolidBrush( nBKColor );
nTempBrush = SelectObject( hDCFunc, nBKBrush );

/* clear the area */
Rectangle( hDCFunc, nTempRect.left, nTempRect.top,
                    nTempRect.right, nTempRect.bottom );

/* delete the objects */
SelectObject( hDCFunc, nTempPen );
SelectObject( hDCFunc, nTempBrush );
DeleteObject( nBKPen );
DeleteObject( nBKBrush );

return;
}


/*********************************************************************/
/* FISPlotReal                                                       */
/*                                                                   */
/* plot data points present in global data area, realtime !!         */
/*********************************************************************/
BOOL FISPlotReal( HDC hDCFunc, struct tRealData * nSaveData, RECT nDrawSize,
                  int nStart, int nDur)
{
static unsigned char nPrevShot;

unsigned int i, j;
unsigned int nTempAD, nTempScale, nShotValue;
unsigned int nPlotStart, nPlotDur;
unsigned long nPixWidth, nPixHieght;
unsigned long rawStart;

/* get the last point to plot */
if( nADHead == 0 )
{ nTempAD = (dSampleSize-1);            }
else { nTempAD = nADHead - 1;   }

/* check if we are allowed to plot */
if( !nPlotShot )
{
    /* check if data has exceeded the shot threshold */
    if( ((rawSamples[nTrigSen][nTempAD]) >= nSenThresh[nTrigSen][1]) &&
        ((nPrevShot) < nSenThresh[nTrigSen][1]) )
    {
        /* move back 1/4 second */
        if( nTempAD > 50 )
        {
            nRealTail = nTempAD - 50;
        } else {
            nRealTail = dSampleSize - 50;
        }
        nSysStart = rawTime[nRealTail];
```

```
        nPlotShot = true;

        /* set up the screen */
        nSaveData->nNum = 0;
        nRealStart = 0;
        FISClearArea( hDCFunc, nDrawSize );
    } else {
        nPrevShot = rawSamples[nTrigSen][nTempAD];
    }
} else {

    /* check if there is data to plot */
    if( nRealTail == nADHead ) return(true);
    if( ((nRealTail+1)%dSampleSize) == nADHead ) return(true);
    if( ((nRealTail+2)%dSampleSize) == nADHead ) return(true);

    /* determine the width of the screen in pixels */
    nPixWidth = nDrawSize.right - nDrawSize.left;
    nPixHieght = nDrawSize.bottom - nDrawSize.top;

    /* get the start time in raw units */
    rawStart = (unsigned long)nStart * 1000;

    /* determine the time duration of this plot in pixels */
    nPlotDur = (unsigned int) (nPixWidth
             * (rawTime[nTempAD] - rawTime[nRealTail])
             / nDur / 1000);

    /* determine where in time the plot starts */
    nPlotStart = (unsigned int) (nPixWidth
               * ((rawTime[nRealTail]-nSysStart) - rawStart)
               / nDur / 1000);

    for (j=0;j<nNumSensors;j++)
    {
        if ( cCollect[j] )
        {
            cSamples[j][0] = nDrawSize.left + nPlotStart;
            cSamples[j][1] = nDrawSize.bottom
                           - (unsigned int)(rawSamples[j][nRealTail] * nPixHiegh
                           / nMaxValue);

            SelectObject( hDCFunc, pSensor[j][0] );
            MoveTo( hDCFunc, cSamples[j][0], cSamples[j][1] );

            for ( i=((nRealTail+1)%dSampleSize);i!=nADHead;i=((i+1)%dSampleSize)
            {
                /* check if value is invalid */
                if( rawSamples[i] == 0 ) continue;

                /* determine the x-offset */
                cSamples[j][2] = nDrawSize.left
                               + (unsigned int) (nPixWidth
                               * ((rawTime[i]-nSysStart) - rawStart)
                               / nDur / 1000);

                /* determine the Y offset */
                cSamples[j][3] = nDrawSize.bottom
                               - (unsigned int)(rawSamples[j][i] * nPixHieght
                               / nMaxValue);
                /* plot the resulting value */
                LineTo( hDCFunc, cSamples[j][2], cSamples[j][3] );

                /* move to the next point */
                cSamples[j][0] = cSamples[j][2];
                cSamples[j][1] = cSamples[j][3];
            }
        }
    }

    /* save the plotted data in the shot array */
    nPrevShot = rawSamples[nTrigSen][nRealTail];
    for ( i=((nRealTail+1)%dSampleSize);i!=nADHead;i=((i+1)%dSampleSize) )
    {
```

```
        /* get the time stamp */
        nSaveData->nNum++;
        nSaveData->nData[nSaveData->nNum].nTimeStamp = rawTime[i]-nSysStart;
        for (j=0;j<nNumSensors;j++)
        {
            if ( cCollect[j] )
            {
                nSaveData->nData[nSaveData->nNum].nSensors[j] = rawSamples[j][i]
            }
        }
        /* check if the saved data has dropped below the shot threshold */
        if( (nPrevShot > nSenThresh[nTrigSen][1])
         && (rawSamples[nTrigSen][i] <= nSenThresh[nTrigSen][1]) )
        {
            nPlotShot = false;
            nPrevShot = 0;
            nRealTail = nTempAD;
            return(false);
        }
        nPrevShot = rawSamples[nTrigSen][i];
    }

    nRealTail = nTempAD;

    /* check if plot is about to wrap and stop */
    if( ((rawTime[nTempAD]-nSysStart)/1000) >= (unsigned long)(nStart+nDur) )
    {
        nPlotShot = false;
        nPrevShot = 0;
        return(false);
    }
}

return(true);
}


/*******************************************************************/
/* FISPlotShot                                                     */
/*                                                                 */
/* plot data points representing a single shot                     */
/*******************************************************************/
void FISPlotShot( HDC hDCFunc, RECT nDrawSize,
                  struct tRealData * nSaveData, int nStart, int nDur)
{
unsigned int i, j;
unsigned long nPixWidth, nPixHigh;
unsigned long nStartTime;

/* check if any data is available */
if( nSaveData->nNum == 0 ) return;

/* determine scaling factor for length and width of screen */
nPixWidth = nDrawSize.right - nDrawSize.left;
nPixHigh = nDrawSize.bottom - nDrawSize.top;

for (j=0;j<nNumSensors;j++)
{
    if ( cCollect[j] )
    {
        cSamples[j][0] = nDrawSize.left;
        cSamples[j][1] = nDrawSize.bottom
                       - (unsigned int)(nSaveData->nData[0].nSensors[j]
                       * nPixHigh / nMaxValue);

        SelectObject( hDCFunc, pSensor[j][0] );
        MoveTo( hDCFunc, cSamples[j][0], cSamples[j][1] );
        nStartTime = nSaveData->nData[0].nTimeStamp;

        for ( i=0;i<nSaveData->nNum;i++ )
        {
            /* determine the x-offset */
            cSamples[j][2] = nDrawSize.left
                           + (unsigned int) (nPixWidth
                           * (nSaveData->nData[i].nTimeStamp-nStartTime)
                           / nDur / 1000);
```

```
            /* determine the Y offset */
            cSamples[j][3] = nDrawSize.bottom
                           - (unsigned int)(nSaveData->nData[i].nSensors[j]
                           * nPixHigh / nMaxValue);

            /* plot the resulting value */
            LineTo( hDCFunc, cSamples[j][2], cSamples[j][3] );

            /* move to the next point */
            cSamples[j][0] = cSamples[j][2];
            cSamples[j][1] = cSamples[j][3];
        }
    }
}

return;
}


/*********************************************************************/
/* FISGetPlotArea                                                    */
/*                                                                   */
/* determines the size of the drawing area for a window              */
/*********************************************************************/
int FISGetPlotArea( HWND hWnd, RECT * nDrawSize )
{

/* get the current window rectangle */

GetClientRect( hWnd, nDrawSize );

/* adjust to compensate for the axes and labels */
nDrawSize->left += 30;
nDrawSize->right -= 10;
nDrawSize->bottom -= 35;
nDrawSize->top += 5;

return( true );
}


/*********************************************************************/
/* FISDrawAxes                                                       */
/*                                                                   */
/* draws the axes and color codes for the realtime display           */
/*********************************************************************/
int FISDrawAxes( HDC hDCFunc, int nStartTime, int nTimeDur, RECT nDrawSize )
{
int i;                  /* loop counter */
char s[150];
RECT nRect;
DWORD nBKColor;
char * nTimeStr;

/* determine current background color*/
SetBkColor( hDCFunc, rPlotBack );
nBKColor = GetBkColor( hDCFunc );

/* set the screen colors */
SelectObject( hDCFunc, hPenBlue );

/* draw the axes */
MoveTo( hDCFunc, nDrawSize.left, nDrawSize.bottom );
LineTo( hDCFunc, nDrawSize.right, nDrawSize.bottom );
MoveTo( hDCFunc, nDrawSize.left, nDrawSize.top );
LineTo( hDCFunc, nDrawSize.left, nDrawSize.bottom );

/* place tick marks equidistant along the two axes in GREEN*/
SelectObject( hDCFunc, hPenGreen );     /* ticks in green */
SetTextColor( hDCFunc, rRed );          /* text in red */
SelectObject( hDCFunc, hFontX );        /* do the X-axis first */

/* label the X-axis */
for (i=0; i<=nTimeDur; i++)
```

```
{
    nRect.top = nDrawSize.bottom+4;
    nRect.bottom = nDrawSize.bottom + 16;
    nRect.left = (nDrawSize.left-10)
                + (i*(nDrawSize.right-nDrawSize.left))/nTimeDur;
    nRect.right = nRect.left+20;
    FISClearArea( hDCFunc, nRect );
    wsprintf( s, "%3d", (nStartTime+i) );
    DrawText( hDCFunc, s, -1, &nRect, DT_CENTER );
    MoveTo( hDCFunc, (nRect.left+10), (nDrawSize.bottom+1) );
    LineTo( hDCFunc, (nRect.left+10), (nDrawSize.bottom+5 ) );
}

/* put a title on the X-axis */
SetTextColor( hDCFunc, rBlue );

nRect.top = nDrawSize.bottom + 12;
nRect.bottom = nDrawSize.bottom + 24;
nRect.left = ((nDrawSize.right-nDrawSize.left)/2 ) - 80;
nRect.right = ((nDrawSize.right-nDrawSize.left)/2 ) + 80;
DrawText( hDCFunc, nRTTitle[nRTLanguage][85], -1, &nRect, DT_CENTER );

/* select the font and colors for the Y-axis */
SetTextColor( hDCFunc, rRed );          /* text in red */
SelectObject( hDCFunc, hFontX );        /* do the Y-axis now */

for (i=0; i<=100; i+=25 )
{
    nRect.top = (nDrawSize.bottom-6)
              - (int)((long)i
              * (long)(nDrawSize.bottom-nDrawSize.top)
              / (long)100);
    nRect.bottom = nRect.top + 12;
    nRect.left = nDrawSize.left-24;
    nRect.right = nDrawSize.left-4;
    wsprintf( s, "%-3d", i );
    DrawText( hDCFunc, s, -1, &nRect, DT_RIGHT);
    MoveTo( hDCFunc, (nDrawSize.left-1), (nRect.top+6) );
    LineTo( hDCFunc, (nDrawSize.left-5 ), (nRect.top+6) );
}

/* set the text color */
SetTextColor( hDCFunc, rBlack );
/* set the area to display the information */
nRect.right = nDrawSize.left + 200;
nRect.left = nDrawSize.left - 30;
nRect.top = nDrawSize.bottom + 14;
nRect.bottom = nDrawSize.bottom + 24;
/* write out the student information */
FISClearArea( hDCFunc, nRect );
wsprintf( s,"Name: %s,%s", nStudRecord.nStudName, nStudRecord.nInstID );
DrawText( hDCFunc, s, -1, &nRect, DT_LEFT );
nRect.top = nDrawSize.bottom + 24;
nRect.bottom = nDrawSize.bottom + 34;
wsprintf( s,"Location : %s", nStudRecord.nStudInst );
DrawText( hDCFunc, s, -1, &nRect, DT_LEFT );

/* write out the date and time */
nTimeStr = ctime(&nCollectTime);
/* set the area to display the information */
nRect.top = nDrawSize.bottom + 14;
nRect.bottom = nDrawSize.bottom + 24;
nRect.right = nDrawSize.right;
nRect.left = nDrawSize.right - 160;
FISClearArea( hDCFunc, nRect );
DrawText( hDCFunc, nTimeStr, -1, &nRect, DT_RIGHT );

/* include the group count and location */
nRect.top = nDrawSize.bottom + 24;
nRect.bottom = nDrawSize.bottom + 34;
wsprintf( s, "Group Current/Total : %03d/%03d",
          nCurGroup, nGroups );
DrawText( hDCFunc, s, -1, &nRect, DT_RIGHT );

/* return the previous background color */
SetBkColor( hDCFunc, nBKColor );
```

```
/* draw the shot and detection levels */
FISSetThreshold( hDCFunc, nDrawSize, true );

return ( true );
}


/*****************************************************************/
/* FISSetThreshold                                               */
/* Draw indicator where threshold current set                    */
/*****************************************************************/
void FISSetThreshold( HDC hDCFunc, RECT nDrawSize, BOOL nVisible )
{
HPEN hDashPen;
HPEN hTempPen;
unsigned long nPos1, nPos2;
unsigned int nPos3, nPos4;
unsigned int i;

for (i=0;i<nNumSensors;i++)
{
    if( i == nTrigSen )
    {
        hDashPen = CreatePen( PS_DOT, 1, cSensor[i] );
        hTempPen = SelectObject( hDCFunc, hDashPen );
        nPos3 = nDrawSize.left;
        nPos4 = nDrawSize.right;
    } else {
        hDashPen = CreatePen( PS_SOLID, 3, cSensor[i] );
        hTempPen = SelectObject( hDCFunc, hDashPen );
        nPos3 = nDrawSize.left - 15 - (3*i+2);
        nPos4 = nDrawSize.left - 15 - (3*i);
    }


    /* determine where to draw the lower bounds*/
    nPos1 = (unsigned long)(nDrawSize.bottom-nDrawSize.top);
    nPos1 = nPos1 * (unsigned long)nSenThresh[i][0];
    nPos1 = nPos1 / nMaxValue;
    nPos1 = (unsigned long)nDrawSize.bottom - nPos1;

    MoveTo( hDCFunc, nPos3, (unsigned int)nPos1 );
    if( i == nTrigSen )
    {
        LineTo( hDCFunc, nPos4, (unsigned int)nPos1 );
    }

    /* determine where to draw the upper threshold*/
    nPos2 = (unsigned long)(nDrawSize.bottom-nDrawSize.top);
    nPos2 = nPos2 * (unsigned long)nSenThresh[i][1];
    nPos2 = nPos2 / nMaxValue;
    nPos2 = (unsigned long)nDrawSize.bottom - nPos2;

    if( i == nTrigSen )
    {
        MoveTo( hDCFunc, nPos4, (unsigned int)nPos2 );
    }
    LineTo( hDCFunc, nPos3, (unsigned int)nPos2 );
    /* get rid of the objects */
    SelectObject( hDCFunc, hTempPen );
    DeleteObject( hDashPen );
}

return;
}

#include "global.h"

#include "realtime.h"
#include "main_exp.h"
#include "dial_exp.h"
#include "one_exp.h"
#include "func_exp.h"

int FAR CreateRealtime( HANDLE hInst, HWND hParentInst )
{
```

```
/*********************************************************************/
/* HANDLE hInst;          handle for this instance                   */
/* HANDLE hParentInst;   handle for possible previous instances      */
/* int    nCmdShow;       Show code for main window display          */
/*********************************************************************/

MSG        msg;          /* MSG structure to store your messages       */
int        nRc;          /* return value from Register Classes         */

strcpy(szRealName, "REALTIME");
hInstReal = hInst;

/* register window classes if first instance of application        */
if ((nRc = nCwRegRealClass()) == -1)
{
       /* registering one of the windows failed                        */
       LoadString(hInstReal, IDS_ERR_REGISTER_CLASS, szRealString, sizeof(szRea
       FISMessage(NULL, szRealString, NULL, MB_ICONEXCLAMATION, MB_OK, NULL );
       return nRc;
}

/* create application's Main window                                  */
hWndReal = CreateWindow(
               szRealName,                /* Window class name          */
               nRTTitle[nRTLanguage][55], /* Window's title        */
               WS_CLIPSIBLINGS |
               WS_CHILDWINDOW  |
               WS_CAPTION      |
               WS_THICKFRAME   |
               WS_MINIMIZEBOX  |
               WS_MAXIMIZEBOX,
               0, 0,     /* X, Y                          */
               50, 50, /* Width, Height of window     */
               hParentInst,             /* Parent window's handle      */
               NULL,                    /* Default to Class Menu       */
               hInstReal,               /* Instance of window          */
               NULL);           /* Create struct for WM_CREATE */


if(hWndReal == NULL)
  {
   LoadString(hInstReal, IDS_ERR_CREATE_WINDOW, szRealString, sizeof(szRealStri
   FISMessage(NULL, szRealString, NULL, MB_ICONEXCLAMATION, MB_OK, NULL);
   return IDS_ERR_CREATE_WINDOW;
  }

hAccReal = LoadAccelerators(hInstReal, szRealName);
ShowWindow( hWndReal, SW_SHOWNORMAL );

return (msg.wParam);

} /*  End of WinMain
                                                          */
/*********************************************************************/
/*                                                                   */
/* Main Window Procedure                                             */
/*                                                                   */
/* This procedure provides service routines for the Windows events   */
/* (messages) that Windows sends to the window, as well as the user  */
/* initiated events (messages) that are generated when the user selects */
/* the action bar and pulldown menu controls or the corresponding    */
/* keyboard accelerators.                                            */
/*                                                                   */
/*********************************************************************/

LONG FAR PASCAL RealTimeWndProc(HWND hWnd, WORD Message, WORD wParam, LONG lPara
{
 HMENU      hMenu=0;    /* handle for the menu */
 HBITMAP    hBitmap=0;  /* handle for bitmaps */
 PAINTSTRUCT ps;        /* holds PAINT information */
 int        nRc=0;      /* return code */
 int            i;      /* loop counter */
 HDC   hDCPaint;

switch (Message)
{
```

```
case WM_TIMER :
    if( !IsIconic( hWnd ) )
    {
        /* plot the data */
        if ( !FISPlotReal( hDCReal, &nRealData, nRealSize, nRealStart, nReal
        {
            nRc = KillTimer( hWnd, n100mil );
            PostMessage( hWnd, WM_COMMAND, IDM_R_STOP, NULL );
        }
    }
break;

case WM_COMMAND:
    switch (wParam)
    {
        /* post data collection display routines */
        case IDM_R_HOME:
            if( !IsWindow( hWndSingle ) ) break;
            if( !nRealOn )
            {
                HandleFindShot( &nRealStart, &nRealDur, FirstShot );
                /* redraw the axes */
                FISClearWindow( hWndReal, hDCReal );
                nRc = FISDrawAxes( hDCReal, nRealStart, nRealDur, nRealSize
                /* display the shot */
                FISPlotShot( hDCReal, nRealSize, &nRealData, nRealStart, nRe
                /* display the shot statistics */
                FISPlotTemplate( hDCReal, nRealSize, &nRealData, nRealStart,
            }
            break;
        case IDM_R_END:
            if( !IsWindow( hWndSingle ) ) break;
            if( !nRealOn )
            {
                HandleFindShot( &nRealStart, &nRealDur, LastShot );
                /* redraw the axes */
                FISClearWindow( hWndReal, hDCReal );
                nRc = FISDrawAxes( hDCReal, nRealStart, nRealDur, nRealSize
                /* display the shot */
                FISPlotShot( hDCReal, nRealSize, &nRealData, nRealStart, nRe
                /* display the shot statistics */
                FISPlotTemplate( hDCReal, nRealSize, &nRealData, nRealStart,
            }
            break;

        case IDM_R_BACK:
            if( !IsWindow( hWndSingle ) ) break;
            if( !nRealOn )
            {
                HandleFindShot( &nRealStart, &nRealDur, PrevShot );
                /* redraw the axes */
                FISClearWindow( hWndReal, hDCReal );
                nRc = FISDrawAxes( hDCReal, nRealStart, nRealDur, nRealSize
                /* display the shot */
                FISPlotShot( hDCReal, nRealSize, &nRealData, nRealStart, nRe
                /* display the shot statistics */
                FISPlotTemplate( hDCReal, nRealSize, &nRealData, nRealStart,
            }
            break;

        case IDM_R_NEXT:
            if( !IsWindow( hWndSingle ) ) break;
            if( !nRealOn )
            {
                HandleFindShot( &nRealStart, &nRealDur, NextShot );
                /* redraw the axes */
                FISClearWindow( hWndReal, hDCReal );
                nRc = FISDrawAxes( hDCReal, nRealStart, nRealDur, nRealSize
                /* display the shot */
                FISPlotShot( hDCReal, nRealSize, &nRealData, nRealStart, nRe
                /* display the shot statistics */
                FISPlotTemplate( hDCReal, nRealSize, &nRealData, nRealStart,
            }
            break;
```

```
/* realtime data display routines */
case IDM_S_INC:
    if( IsWindow( hWndSingle ) ) break;
    if( !nRealOn )
    {
        /* increment the duration */
        nRealDur++;
        /* redraw the axes */
        FISClearWindow( hWndReal, hDCReal );
        nRc = FISDrawAxes( hDCReal, nRealStart,
                           nRealDur, nRealSize );
        /* display the shot */
        FISPlotShot( hDCReal, nRealSize, &nRealData, nRealStart, nRe
        /* display the shot statistics */
        FISPlotTemplate( hDCReal, nRealSize, &nRealData, nRealStart,
    }
    break;

case IDM_S_DEC:
    if( IsWindow( hWndSingle ) ) break;
    if( !nRealOn )
    {
        /* decrement the duration and zero axes */
        if( nRealDur > 1 ) nRealDur--;
        /* redraw the axes */
        FISClearWindow( hWndReal, hDCReal );
        nRc = FISDrawAxes( hDCReal, nRealStart,
                           nRealDur, nRealSize );
        /* display the shot */
        FISPlotShot( hDCReal, nRealSize, &nRealData, nRealStart, nRe
        /* display the shot statistics */
        FISPlotTemplate( hDCReal, nRealSize, &nRealData, nRealStart,
    }
    break;

case IDM_R_START:
    if( IsWindow( hWndSingle ) ) break;
    if( !nRealOn )
    {
        /* initialize the data */
        SetWindowText( hWnd, nRTTitle[nRTLanguage][56] );
        /* then set up plotting parameters */
        nRealStart = 0;             /* zero start offset */
        nRealOn = true;             /* single shot plotting */
        nPlotShot = false;          /* shot start detected */
        nRealData.nNum = 0;         /* set no data collected */

        /* redraw the axes before you start */
        FISClearArea( hDCReal, nRealSize );
        nRc = FISDrawAxes( hDCReal, nRealStart, nRealDur, nRealSize

        /* set up the Real Time window timer */
        KillTimer( hWnd, n100mil );
        nRealTimer = SetTimer( hWnd, n100mil, n100milTicks,
                               NULL );
    }
    break;

case IDM_R_STOP:
    if( IsWindow( hWndSingle ) ) break;
    nPlotShot = false;
    nRealOn = false;
    nRc = KillTimer( hWnd, n100mil );
    /* display the shot statistics */
    FISPlotTemplate( hDCReal, nRealSize, &nRealData, nRealStart, nRe

    /* indicate that collection has stopped */
    SetWindowText( hWnd, nRTTitle[nRTLanguage][55] );
    break;

case IDM_R_CLEAR:
    if( IsWindow( hWndSingle ) ) break;
    if( !nRealOn )
    {
```

```
                /* clear the window  and zero and redraw the axes */
                FISClearWindow( hWndReal, hDCReal );
                nRealStart = 0;
                nRealData.nNum = 0;
                nRc = FISDrawAxes( hDCReal, nRealStart,
                                   nRealDur, nRealSize );
            }
            break;

        case IDM_HELP:
            if( !nRealOn ) HandleHelp( hWndReal, 4 );
            break;

        case IDM_R_EXIT:
            if( !nRealOn ) PostMessage( hWnd, WM_CLOSE, NULL, NULL );
            break;

        case IDM_S_ABOUT:
            if( !nRealOn ) HandleAbout( hWnd, hInstReal, ID_ABOUT_REAL );
            break;

        default:
            return DefWindowProc(hWnd, Message, wParam, lParam);
    }
    break;

case WM_CREATE:
    cReal = true;
    nRealStart = 0; /* start at 0 seconds */
    nRealDur = 5;   /* go for 5 seconds */
    nRealData.nNum = 0;
    nRealOn = false;

    /* create the device context */
    hDCReal = GetDC( hWnd );
    hOrgFont = SelectObject( hDCReal, hFontX );
    hOrgPen = SelectObject( hDCReal, hPenBlue );
    hRealMenu = GetMenu( hWnd );
    break;

case WM_SETFOCUS:
    FlashWindow( hWndReal, true );
    BringWindowToTop( hWndReal );
    HandleToolTemplate( tReal );
    break;

case WM_KILLFOCUS:
    FlashWindow( hWndReal, true );
    break;

case WM_MOUSEACTIVATE:
    if( GetFocus() != hWnd ) SetFocus( hWnd );
    break;

case WM_MOUSEMOVE:
    HandleMouseMove( hWndReal, hInstReal, (LPSTR)"REAL_CUR" );
    break;

case WM_MOVE:
    break;

case WM_SIZE:
    break;

case IDM_PAINT:
    FISClearWindow( hWndReal, hDCReal );
    nRc = FISDrawAxes( hDCReal, nRealStart, nRealDur, nRealSize );
    if ( !nRealOn )
    {
        /* display the shot */
        FISPlotShot( hDCReal, nRealSize, &nRealData, nRealStart, nRealDur );
        /* display the shot statistics */
        FISPlotTemplate( hDCReal, nRealSize, &nRealData, nRealStart, nRealDu
    }
    break;
```

```
    case WM_PAINT:
        memset(&ps, 0x00, sizeof(PAINTSTRUCT));
        hDCPaint = BeginPaint(hWnd, &ps);
        SetBkMode(hDCPaint, TRANSPARENT);

        /* determine the size of the plot area */
        FISGetPlotArea( hWnd, &nRealSize );
        nRc = FISDrawAxes( hDCPaint, nRealStart, nRealDur, nRealSize );

        if ( !nRealOn )
        {
            /* display the shot */
            FISPlotShot( hDCReal, nRealSize, &nRealData, nRealStart, nRealDur );
            /* display the shot statistics */
            FISPlotTemplate( hDCReal, nRealSize, &nRealData, nRealStart, nRealDu
        }

        EndPaint(hWnd, &ps);
        break;

    case WM_CLOSE:
        /* close the window */
        KillTimer( hWnd, n100mil );
        ReleaseDC( hWnd, hDCReal );
        /* shut down the help feature */
        HandleHelp( hWndReal, 0 );

        DestroyWindow(hWnd);
        cReal = false;
        hWndReal = NULL;

        /* expand the other windows */
        PostMessage( hWndMain, WM_COMMAND, IDM_H_REPAINT, NULL );
        break;

    case WM_DESTROY:
        /* close the window */
        KillTimer( hWndReal, n100mil );
        ReleaseDC( hWndReal, hDCReal );
        /* shut down the help feature */
        HandleHelp( hWndReal, 0 );

        cReal = false;
        hWndReal = NULL;
        break;

    default:
         return DefWindowProc(hWnd, Message, wParam, lParam);
   }
return 0L;
}     /* End of WndProc                                          */

/*************************************************************************/
/*                                                                       */
/* nCwRegRealClass Function                                          */
/*                                                                       */
/* The following function registers all the classes of all the windows  */
/* associated with this application. The function returns an error code */
/* if unsuccessful, otherwise it returns 0.                              */
/*                                                                       */
/*************************************************************************/

int nCwRegRealClass(void)
{
 WNDCLASS   wndclass;    /* struct to define a window class              */
 int nRc;
 memset(&wndclass, 0x00, sizeof(WNDCLASS));


 /* load WNDCLASS with window's characteristics                          */
 wndclass.style = CS_OWNDC | CS_HREDRAW | CS_VREDRAW | CS_BYTEALIGNWINDOW;
 wndclass.lpfnWndProc = RealTimeWndProc;
 /* Extra storage for Class and Window objects                           */
 wndclass.cbClsExtra = 0;
 wndclass.cbWndExtra = 0;
```

```
wndclass.hInstance = hInstReal;
wndclass.hIcon = LoadIcon(hInstReal, "REALTIME");
wndclass.hCursor = NULL;        /* so cursor may be changed            */
/* Create brush for erasing background                                  */
wndclass.hbrBackground = CreateSolidBrush( rPlotBack );
wndclass.lpszMenuName = szRealName;   /* Menu Name is App Name */
wndclass.lpszClassName = szRealName; /* Class Name is App Name */

/* first attempt to deregister the class */
UnregisterClass( szRealName, hInstReal );

if( (nRc = RegisterClass(&wndclass)) == 0 )
  return -1;


return(0);
} /* End of nCwRegisterClasses                                          */

#include "global.h"

#include "real_exp.h"
#include "main_exp.h"
#include "dial_exp.h"
#include "one_exp.h"
#include "func_exp.h"
#include "toolbox.h"
#include "trig_exp.h"

int FAR CreateToolBox( HANDLE hInst, HWND hParentInst )
{
 /*********************************************************************/
 /* HANDLE hInst;           handle for this instance                  */
 /* HANDLE hParentInst;   handle for possible previous instances     */
 /* int    nCmdShow;        Show code for main window display         */
 /*********************************************************************/

 MSG        msg;           /* MSG structure to store your messages       */
 int        nRc;           /* return value from Register Classes         */

/* check if this window is already created */
if( IsWindow( hWndToolBox) )
{
    return(0);
}

/* create the toolbox */
strcpy(szToolBoxName, "ToolBox");
hInstToolBox = hInst;

/* register window classes if first instance of application        */
if ((nRc = nCwRegToolBoxClasses()) == -1)
{
    /* registering one of the windows failed                       */
    LoadString(hInstToolBox, IDS_ERR_REGISTER_CLASS, szToolBoxString, sizeof(szT
    FISMessage(NULL, szToolBoxString, NULL, MB_ICONEXCLAMATION, MB_OK, NULL);
    return nRc;
}

 /* create application's Main window                                  */
 hWndToolBox = CreateWindow(
                szToolBoxName,              /* Window class name          */
                "Tool Box",       /* Window's title              */
                WS_BORDER
                WS_CLIPSIBLINGS |
                WS_CHILDWINDOW,
                0, 0,                  /* X, Y                       */
                640, 34,          /* Width, Height of window     */
                hParentInst,            /* Parent window's handle      */
                NULL,                   /* Default to Class Menu       */
                hInstToolBox,            /* Instance of window          */
                NULL);                  /* Create struct for WM_CREATE */


 if(hWndToolBox == NULL)
   {
```

```
    LoadString(hInstToolBox, IDS_ERR_CREATE_WINDOW, szToolBoxString, sizeof(szTo
    FISMessage(NULL, szToolBoxString, NULL, MB_ICONEXCLAMATION, MB_OK, NULL);
    return IDS_ERR_CREATE_WINDOW;

    }

 ShowWindow(hWndToolBox, SW_SHOWNORMAL);            /* display main window

 return msg.wParam;
} /*  End of WinMain                                                        */
/*************************************************************************/
/*                                                                       */
/* Main Window Procedure                                                 */
/*                                                                       */
/* This procedure provides service routines for the Windows events      */
/* (messages) that Windows sends to the window, as well as the user     */
/* initiated events (messages) that are generated when the user selects */
/* the action bar and pulldown menu controls or the corresponding       */
/* keyboard accelerators.                                                */
/*                                                                       */
/*************************************************************************/

LONG FAR PASCAL ToolBoxWndProc(HWND hWnd, WORD Message, WORD wParam, LONG lParam
{
 HMENU      hMenu=0;            /* handle for the menu                  */
 HBITMAP    hBitmap=0;          /* handle for bitmaps                   */
 HDC        hDCPaint;               /* handle for the display device        */
 PAINTSTRUCT ps;                /* holds PAINT information              */
 int        nRc=0;              /* return code                          */

 switch (Message)
   {
    case WM_CREATE:
        hDCToolBox = GetDC( hWnd );
        /* remove the main window menu */
        SetMenu( hWndMain, NULL );
        DrawMenuBar( hWndMain );
        break;

    case WM_LBUTTONDOWN:
    case WM_LBUTTONUP:
        nRc = HandleToolPress( hDCToolBox, Message, lParam, nToolSize );
        if( nRc > 0 )
        {
            /* check for special case of auxillary window activation */
            if( (nRc == IDM_S_GRIPFORCE) ||
                (nRc == IDM_S_TRIGGER) ||
                (nRc == IDM_O_REALTIME) ||
                (nRc == IDM_PRINT) ||
                (nRc == IDM_H_REPAINT) ||
                (nRc == IDM_H_ROTDOWN) ||
                (nRc == IDM_O_ONESHOT) )
            {
                /* send the command to the main window */
                PostMessage( hWndMain, WM_COMMAND, nRc, NULL );
            } else {
                /* get the current focus window */
                hPrevTool = GetFocus();
                if ( IsWindow( hPrevTool ) )
                {
                    /* send the command to this window */
                    PostMessage( hPrevTool, WM_COMMAND, nRc, NULL );
                }
            }

        }
        break;

    case WM_MOUSEMOVE:
        HandleMouseMove( hWndToolBox, hInstToolBox, (LPSTR)"TOOLCUR" );
        break;

    case WM_PAINT:
        memset(&ps, 0x00, sizeof(PAINTSTRUCT));
        hDCPaint = BeginPaint(hWnd, &ps);
        SetBkMode(hDCPaint, TRANSPARENT);
```

```
        GetClientRect( hWnd, &nToolSize );
        HandlePaintTools( hDCPaint, nToolSize );
        EndPaint(hWnd, &ps);
        break;

    case WM_CLOSE:
        /* release some of the resources */
        ReleaseDC( hWnd, hDCToolBox );
        DestroyWindow(hWnd);
        PostMessage( hWndMain, WM_COMMAND, IDM_H_REPAINT, NULL );
        hWndToolBox = NULL;
        SetMenu( hWndMain, hMainMenu );
        DrawMenuBar( hWndMain );
        break;

    case WM_DESTROY:
        /* release some of the resources */
        CheckMenuItem( hMainMenu, IDM_O_TOOLS, MF_UNCHECKED | MF_BYCOMMAND );
        ReleaseDC( hWndToolBox, hDCToolBox );
        hWndToolBox = NULL;
        SetMenu( hWndMain, hMainMenu );
        DrawMenuBar( hWndMain );
        break;

    default:
         return DefWindowProc(hWnd, Message, wParam, lParam);
         break;
   }
 return 0L;
}     /* End of WndProc                                                    */

/*********************************************************************/
/*                                                                   */
/* nCwRegisterClasses Function                                       */
/*                                                                   */
/* The following function registers all the classes of all the windows  */
/* associated with this application. The function returns an error code */
/* if unsuccessful, otherwise it returns 0.                          */
/*                                                                   */
/*********************************************************************/

int nCwRegToolBoxClasses(void)
{
 WNDCLASS   wndclass;    /* struct to define a window class              */
 memset(&wndclass, 0x00, sizeof(WNDCLASS));


 /* load WNDCLASS with window's characteristics                          */
 wndclass.style = CS_OWNDC | CS_HREDRAW | CS_VREDRAW | CS_BYTEALIGNWINDOW;
 wndclass.lpfnWndProc = ToolBoxWndProc;
 /* Extra storage for Class and Window objects                           */
 wndclass.cbClsExtra = 0;
 wndclass.cbWndExtra = 0;
 wndclass.hInstance = hInstToolBox;
 wndclass.hIcon = LoadIcon(hInstMain, "TOOLBOX");
 wndclass.hCursor = NULL;        /* so cursor may be changed             */
 /* Create brush for erasing background                                  */
 wndclass.hbrBackground = CreateSolidBrush(RGB(0, 0, 0));
 wndclass.lpszMenuName = szToolBoxName;   /* Menu Name is App Name */
 wndclass.lpszClassName = szToolBoxName; /* Class Name is App Name */

 /* first attempt to deregister the class */
 UnregisterClass( szToolBoxName, hInstToolBox );

 if(RegisterClass(&wndclass) == 0)
   return -1;

 return(0);
} /* End of nCwRegisterClasses                                           */

#include "global.h"

#include "real_exp.h"
#include "main_exp.h"
#include "dial_exp.h"
#include "one_exp.h"
```

```
#include "func_exp.h"
#include "legend.h"
#include "trig_exp.h"

int FAR CreateLegend( HANDLE hInst, HWND hParentInst )
{
 /*********************************************************************/
 /* HANDLE hInst;          handle for this instance                   */
 /* HANDLE hParentInst;   handle for possible previous instances      */
 /* int    nCmdShow;       Show code for main window display          */
 /*********************************************************************/

 MSG        msg;          /* MSG structure to store your messages       */
 int        nRc;          /* return value from Register Classes         */

strcpy(szLegendName, "Legend");
hInstLegend = hInst;

/* register window classes if first instance of application        */
if ((nRc = nCwRegLegendClasses()) == -1)
{
    /* registering one of the windows failed                        */
    LoadString(hInstLegend, IDS_ERR_REGISTER_CLASS, szLegendString, sizeof(szLeg
    FISMessage(NULL, szLegendString, NULL, MB_ICONEXCLAMATION, MB_OK, NULL);
    return nRc;
}

 /* create application's Main window                                  */
 hWndLegend = CreateWindow(
                szLegendName,              /* Window class name          */
                nRTTitle[nRTLanguage][59],       /* Window's title
                WS_CLIPSIBLINGS |
                WS_CHILDWINDOW  |
                WS_CAPTION      |
                WS_MINIMIZEBOX,
                0, 0,                  /* X, Y                          */
                145, 95,               /* Width, Height of window       */
                hParentInst,             /* Parent window's handle      */
                NULL,                    /* Default to Class Menu       */
                hInstLegend,             /* Instance of window          */
                NULL);                   /* Create struct for WM_CREATE */


 if(hWndLegend == NULL)
   {
    LoadString(hInstLegend, IDS_ERR_CREATE_WINDOW, szLegendString, sizeof(szLege
    FISMessage(NULL, szLegendString, NULL, MB_ICONEXCLAMATION, MB_OK, NULL);
    return IDS_ERR_CREATE_WINDOW;
   }

 ShowWindow(hWndLegend, SW_SHOWNORMAL);            /* display main window      *

 return msg.wParam;
} /*  End of WinMain                                                   */

/*********************************************************************/
/*                                                                   */
/* Main Window Procedure                                             */
/*                                                                   */
/* This procedure provides service routines for the Windows events   */
/* (messages) that Windows sends to the window, as well as the user  */
/* initiated events (messages) that are generated when the user selects */
/* the action bar and pulldown menu controls or the corresponding    */
/* keyboard accelerators.                                            */
/*                                                                   */
/*********************************************************************/

LONG FAR PASCAL LegendWndProc(HWND hWnd, WORD Message, WORD wParam, LONG lParam)
{
 HMENU      hMenu=0;            /* handle for the menu                */
 HBITMAP    hBitmap=0;          /* handle for bitmaps                 */
 HDC        hDCPaint;             /* handle for the display device      */
 PAINTSTRUCT ps;                /* holds PAINT information            */
 int        nRc=0,i;              /* return code                        */
 RECT nRect;
 unsigned char sString[200];
```

```
switch (Message)
  {
   case WM_TIMER:
       if( !IsIconic( hWnd ) )
       {
           BringWindowToTop( hWnd );
       }
       break;

   case WM_CREATE:
       hDCLegend = GetDC( hWnd );
       CheckMenuItem( hMainMenu, IDM_R_LEGEND, MF_CHECKED | MF_BYCOMMAND );
       /* set up timer to allow legend to always bring itself to the top */
       SetTimer( hWnd, 1000, 1000, NULL );     /* one second */
       break;

   case WM_PAINT:
       memset(&ps, 0x00, sizeof(PAINTSTRUCT));
       hDCPaint = BeginPaint(hWnd, &ps);
       GetClientRect( hWnd, &nLegendSize );
       /* display the sensor names */
       nRc = SetBkMode( hDCPaint, OPAQUE );
       nRect = nLegendSize;
       nRect.bottom = (nLegendSize.bottom - nLegendSize.top)/4;
       SetTextColor( hDCPaint, RGB(255,255,255) );
       for (i=0;i<4;i++)
       {
           SetBkColor( hDCPaint, cSensor[i] );
           nRc = DrawText( hDCPaint, cNames[i],-1, &nRect, DT_NOCLIP );
           nRect.top = nRect.bottom;
           nRect.bottom += (nLegendSize.bottom - nLegendSize.top)/4;
       }
       nRc = SetBkMode( hDCPaint, TRANSPARENT );
       EndPaint(hWnd, &ps);
       break;

   case WM_CLOSE:
       /* release some of the resources */
       KillTimer( hWnd, 1000 );
       CheckMenuItem( hMainMenu, IDM_R_LEGEND, MF_UNCHECKED | MF_BYCOMMAND );
       ReleaseDC( hWnd, hDCLegend );
       DestroyWindow( hWnd );
       hWndLegend = NULL;
       break;

   case WM_DESTROY:
       /* release some of the resources */
       KillTimer( hWnd, 1000 );
       CheckMenuItem( hMainMenu, IDM_R_LEGEND, MF_UNCHECKED | MF_BYCOMMAND );
       ReleaseDC( hWndLegend, hDCLegend );
       hWndLegend = NULL;
       break;

   default:
        return DefWindowProc(hWnd, Message, wParam, lParam);
        break;
  }
 return 0L;
}     /* End of WndProc                                          */

/*********************************************************************/
/*                                                                   */
/* nCwRegisterClasses Function                                       */
/*                                                                   */
/* The following function registers all the classes of all the windows */
/* associated with this application. The function returns an error code */
/* if unsuccessful, otherwise it returns 0.                          */
/*                                                                   */
/*********************************************************************/

int nCwRegLegendClasses(void)
{
 WNDCLASS   wndclass;    /* struct to define a window class          */
 memset(&wndclass, 0x00, sizeof(WNDCLASS));
```

```
/* load WNDCLASS with window's characteristics                          */
wndclass.style = CS_OWNDC | CS_HREDRAW | CS_VREDRAW | CS_BYTEALIGNWINDOW;
wndclass.lpfnWndProc = LegendWndProc;
/* Extra storage for Class and Window objects                           */
wndclass.cbClsExtra = 0;
wndclass.cbWndExtra = 0;
wndclass.hInstance = hInstLegend;
wndclass.hIcon = LoadIcon(hInstMain, "LEGEND");
wndclass.hCursor = NULL;        /* so cursor may be changed             */
/* Create brush for erasing background                                  */
wndclass.hbrBackground = CreateSolidBrush( rPlotBack );
wndclass.lpszMenuName = szLegendName;   /* Menu Name is App Name */
wndclass.lpszClassName = szLegendName; /* Class Name is App Name */

/* first attempt to deregister the class */
UnregisterClass( szLegendName, hInstLegend );

if(RegisterClass(&wndclass) == 0)
  return -1;

return(0);
} /* End of nCwRegisterClasses                                          */

#include "global.h"

#include "oneshot.h"
#include "main_exp.h"
#include "real_exp.h"
#include "func_exp.h"
#include "dial_exp.h"
#include "forc_exp.h"
#include "trig_exp.h"

int FAR CreateOneShot( HANDLE hInst, HWND hParentInst )
{
 /*********************************************************************/
 /* HANDLE hInst;           handle for this instance                  */
 /* HANDLE hParentInst;   handle for possible previous instances     */
 /* int    nCmdShow;        Show code for main window display         */
 /*********************************************************************/

 MSG        msg;           /* MSG structure to store your messages      */
 int        nRc;           /* return value from Register Classes        */

 strcpy(szSingleName, "ONESHOT");
 hInstSingle = hInst;

 /* register window classes if first instance of application        */
 if ((nRc = nCwRegSingleClass()) == -1)
 {
        /* registering one of the windows failed                      */
        LoadString(hInstSingle, IDS_ERR_REGISTER_CLASS, szSingleString, sizeof(s
        FISMessage(NULL, szSingleString, NULL, MB_ICONEXCLAMATION, MB_OK, NULL);
        return nRc;
 }

/* create application's Main window                                    */
 hWndSingle = CreateWindow(
                szSingleName,                /* Window class name          */
                nRTTitle[nRTLanguage][48],         /* Window's title       */
                WS_CLIPSIBLINGS |
                WS_CHILDWINDOW  |
                WS_CAPTION      |
                WS_THICKFRAME   |
                WS_MINIMIZEBOX  |
                WS_MAXIMIZEBOX,
                0, 0,                        /* X, Y                       */
                50,50, /* Width, Height of window     */
                hParentInst,             /* Parent window's handle      */
                NULL,                    /* Default to Class Menu       */
                hInstSingle,               /* Instance of window          */
                NULL);           /* Create struct for WM_CREATE */


 if(hWndSingle == NULL)
   {
```

```
    LoadString(hInstSingle, IDS_ERR_CREATE_WINDOW, szSingleString, sizeof(szSing
    FISMessage(NULL, szSingleString, NULL, MB_ICONEXCLAMATION, MB_OK, NULL);
    return IDS_ERR_CREATE_WINDOW;
   }

hAccSingle = LoadAccelerators(hInstSingle, szSingleName);
ShowWindow( hWndSingle, SW_SHOWNORMAL );

 return (msg.wParam);
} /*  End of WinMain
                                                        */
/*********************************************************************/
/*                                                                   */
/* Main Window Procedure                                             */
/*                                                                   */
/* This procedure provides service routines for the Windows events   */
/* (messages) that Windows sends to the window, as well as the user  */
/* initiated events (messages) that are generated when the user selects */
/* the action bar and pulldown menu controls or the corresponding    */
/* keyboard accelerators.                                            */
/*                                                                   */
/*********************************************************************/

LONG FAR PASCAL OneShotWndProc(HWND hWnd, WORD Message, WORD wParam, LONG lParam
{
 HMENU      hMenu=0;     /* handle for the menu */
 PAINTSTRUCT ps;         /* holds PAINT information */
 int        nRc=0;       /* return code */
 int i;
 HDC   hDCPaint;

 static unsigned char nTReady[100];
 static unsigned char nTMonitor[100];

switch (Message)
{
    case WM_TIMER :
        if( !IsIconic( hWnd ) )
        {
            /* plot the data */
            FISPlotSingle( hDCSingle, nOneSize, nOneStart, nOneDur );
        }
        break;

    case WM_COMMAND:
        switch (wParam)
        {
            case IDM_R_NEXTGROUP:
                if( !nPlotOn )
                {
                    /* set the group pointer to the next group */
                    if ( nGroupSet->pNextGroup != NULL )
                    {
                        nGroupSet = nGroupSet->pNextGroup;
                        nCurSet = nGroupSet;
                        nCurOffSet = nGroupSet->nSamples;
                        nCurGroup++;
                    }
                    nOneStart = 0;
                    /* redraw the axes */
                    FISClearWindow( hWndSingle, hDCSingle );
                    nRc = FISDrawAxes( hDCSingle, nOneStart,
                                       nOneDur, nOneSize );
                    /* replot the data */
                    FISPlotData( hDCSingle, nOneSize, nOneStart,
                                 nOneDur, 0, nOneDur );
                    /* tell the single shot analysis to adjust to new set */

         if( IsWindow( hWndReal ) )
         {
             PostMessage( hWndReal, WM_COMMAND, IDM_R_HOME, NULL );
         }
     }
     break;
```

```
case IDM_R_PREVGROUP:
    if( !nPlotOn )
    {
        /* set the group pointer to the previous group */
        if ( nGroupSet->pPrevGroup != NULL )
        {
            nGroupSet = nGroupSet->pPrevGroup;
            nCurSet = nGroupSet;
            nCurOffSet = nGroupSet->nSamples;
            nCurGroup--;
        }
        nOneStart = 0;
        /* redraw the axes */
        FISClearWindow( hWndSingle, hDCSingle );
        nRc = FISDrawAxes( hDCSingle, nOneStart,
                           nOneDur, nOneSize );
        /* replot the data */
        FISPlotData( hDCSingle, nOneSize, nOneStart,
                     nOneDur, 0, nOneDur );
        /* tell the single shot analysis to adjust to new set */
        if( IsWindow( hWndReal ) )
        {
            PostMessage( hWndReal, WM_COMMAND, IDM_R_HOME, NULL );
        }
    }
    break;

case IDM_R_HOME:
    if( !nPlotOn )
    {
        nOneStart = 0;
        /* redraw the axes */
        FISClearWindow( hWndSingle, hDCSingle );
        nRc = FISDrawAxes( hDCSingle, nOneStart,
                           nOneDur, nOneSize );
        /* replot the data */
        FISPlotData( hDCSingle, nOneSize, nOneStart,
                     nOneDur, 0, nOneDur );
    }
    break;

case IDM_R_END:
    if( !nPlotOn )
    {
        if( (unsigned int)((nCurOffSet*nSerialDelta)/1000) > nOneDur
        {
            nOneStart = (unsigned int)((nCurOffSet*nSerialDelta)/100
        } else {
            nOneStart = 0;
        }
        /* redraw the axes */
        FISClearWindow( hWndSingle, hDCSingle );
        nRc = FISDrawAxes( hDCSingle, nOneStart,
                           nOneDur, nOneSize );
        /* replot the data */
        FISPlotData( hDCSingle, nOneSize, nOneStart,
                     nOneDur, 0, nOneDur );
    }
    break;
case IDM_R_WAYBACK:
    if( !nPlotOn )
    {
        if( nOneStart < nOneDur )
        {
            nOneStart = 0;
        } else {
        nOneStart -= nOneDur;
        }
        FISClearArea( hDCSingle, nOneSize );
        FISDrawAxes( hDCSingle, nOneStart, nOneDur, nOneSize );
        FISPlotData( hDCSingle, nOneSize, nOneStart,
                     nOneDur, 0, nOneDur );
    }
    break;
```

```
case IDM_R_BACK:
    if( !nPlotOn )
    {
        HandleMove( -1 );
        FISPlotData( hDCSingle, nOneSize, nOneStart,
                     nOneDur, 0, 1 );
    }
    break;

case IDM_R_WAYNEXT:
    if( !nPlotOn )
    {
        nOneStart += nOneDur;
        FISClearArea( hDCSingle, nOneSize );
        FISDrawAxes( hDCSingle, nOneStart, nOneDur, nOneSize );
        FISPlotData( hDCSingle, nOneSize, nOneStart,
                     nOneDur, 0, nOneDur );
    }
    break;

case IDM_R_NEXT:
    if( !nPlotOn )
    {
        HandleMove( 1 );
        FISPlotData( hDCSingle, nOneSize, nOneStart,
                     nOneDur, (nOneDur-1), 1 );
    }
    break;

case IDM_R_START:
    /* Plotting is in progress */
    if( nPlotOn ) break;
    FISMessage( NULL, "RTStart", NULL, NULL, NULL, NULL );

    SetWindowText( hWnd, nTMonitor );
    /* initialize the data */
    for (i=0;i<nNumSensors;i++ )
    {
    sSamples[i][0] = nOneSize.left+1;
    sSamples[i][1] = 0;
    sSamples[i][2] = nOneSize.left+1;
    sSamples[i][3] = 0;
}

/* set up new plotting parameters */
nPlotOn = true;
nPlotSaved = false;

/* set up the collection variables */
nCurSet = FISGetSet();          /* get the first element */
if( nCurData == NULL )
{
    /* no data is currently collected */
    nCollectTime = time(NULL);
    /* initialize top pointers */
    nCurData = nCurSet;         /* set */
    nGroupSet = nCurSet;        /* group */
    /* initialize back pointers */
    nCurData->pPrevGroup = NULL;
    nCurData->pPrevSet = NULL;
    /* initialize counters */
    nCurGroup = 1;
    nGroups = 1;
} else {
    /* this is another group, do not change nCurData (top pointe
    /* set up pointer to the next group */
    nGroupSet->pNextGroup = nCurSet;
    /* set up link in new group the reference this group */
    nGroupSet->pNextGroup->pPrevGroup = nGroupSet;
    /* change pointer to new group */
    nGroupSet = nCurSet;
    /* increment group count */
    nCurGroup++;
    nGroups++;
}
nCurOffSet = 0;
```

```
/* redraw the axes before you start */
nOneStart = 0;          /* zero start offset */
FISClearWindow( hWndSingle, hDCSingle );
nRc = FISDrawAxes( hDCSingle, nOneStart,
                   nOneDur, nOneSize );

/* activate the accessory displays */
if( cTrigger ) PostMessage( hWndTrigger, WM_COMMAND, IDM_R_START
if( cForce ) PostMessage( hWndForce, WM_COMMAND, IDM_R_START, NU

/* set up the Shot Analysis window timer */
KillTimer( hWnd, n100mil );
nRc = SetTimer( hWnd, n100mil, n100milTicks, NULL );

/* initialize the realtime variables */
nOnePoints = 0;
nOneShots = 0;
nOneTail = nADHead;
nSysSingle = GetCurrentTime();
nSerTime = 0;
    break;

case IDM_R_STOP:
    if( nPlotOn )
    {
        FISMessage( NULL, "RTStop", NULL, NULL, NULL, NULL );
        nRc = KillTimer( hWnd, n100mil );

        /* stop the plotting */
        nPlotOn = false;

        /* stop the accessory displays */
        if( IsWindow( hWndTrigger) ) PostMessage( hWndTrigger, WM_CO
        if( IsWindow( hWndForce) ) PostMessage( hWndForce, WM_COMMAN

        /* redraw this window displaying the last bit of data */
        PostMessage( hWnd, WM_COMMAND, IDM_R_END, NULL );
        SetWindowText( hWnd, nTReady );

        /* record the size of the sample set */
        if( nGroupSet != NULL )
        {
            nGroupSet->nSamples = nCurOffSet;
        }
        /* tell the single shot analysis to adjust to new set */
        if( IsWindow( hWndReal ) )
        {
            PostMessage( hWndReal, WM_COMMAND, IDM_R_HOME, NULL );
        }
    }
    break;

case IDM_R_CLEAR:
    /* Plotting is in progress */
    if( nPlotOn ) break;
    if( !nPlotSaved )
    {
        if( FISAskSave( hWnd, hInstMain ) == IDCANCEL )
        {
            break;
        }
    }
    /* free the collection points */
    FISFreeSet( nCurData );
    nCurData = NULL;
    nGroupSet = NULL;
    nCurSet = NULL;
    /* zero counters */
    nCurGroup = 0;
    nGroups = 0;
    nCurOffSet = 0;
    nOneShots = 0;
    nOnePoints = 0;
    /* reset the plot saved flag */
    nPlotSaved = true;
```

```
    /* clear the window  and zero and redraw the axes */
    FISClearWindow( hWndSingle, hDCSingle );
    /* redraw the axes */
    nRc = FISDrawAxes( hDCSingle, nOneStart,
                       nOneDur, nOneSize );

     /* clear the accessory displays */
     if( IsWindow(hWndTrigger) ) PostMessage( hWndTrigger, WM_COMMAND
     if( IsWindow(hWndForce) ) PostMessage( hWndForce, WM_COMMAND, ID

     /* tell the single shot analysis to adjust to new set */
     if( IsWindow( hWndReal ) )
     {
         PostMessage( hWndReal, WM_COMMAND, IDM_R_HOME, NULL );
     }
     break;

case IDM_R_OPEN:
     if( nPlotOn ) break;
     if( !nPlotSaved )
     {
         if( FISAskSave( hWnd, hInstMain ) != IDCANCEL )
         {
             /* free the collection points */
             FISFreeSet( nCurData );
             nCurData = NULL;
             nGroupSet = NULL;
             nCurSet = NULL;
             /* zero counters */
             nCurGroup = 0;
             nGroups = 0;
             nCurOffSet = 0;
             nOneShots = 0;
             nOnePoints = 0;
             /* reset the plot saved flag */
             nPlotSaved = true;
         } else {
             break;
         }
     }


     if( HandleDialog( hWnd, hInstMain, ID_SAVEREST,
                       (FARPROC)FISSAVERESTMsgProc, (DWORD)ID_LOPEN )
     {
         /* open the data file */
         FISRestoreData( nFilePath );
     }
     /* redraw the axes */
     nOneStart = 0;
     FISClearWindow( hWndSingle, hDCSingle );
     nRc = FISDrawAxes( hDCSingle, nOneStart,
                        nOneDur, nOneSize );
     /* replot the data */
     FISPlotData( hDCSingle, nOneSize, nOneStart,
                  nOneDur, 0, nOneDur );
     /* tell the single shot analysis to adjust to new set */
     if( IsWindow( hWndReal ) )
     {
         PostMessage( hWndReal, WM_COMMAND, IDM_R_HOME, NULL );
     }
     break;

case IDM_R_SAVE:
     if( nPlotOn ) break;
     if( nCurData != NULL )
     {
         if( HandleDialog( hWnd, hInstMain, ID_SAVEREST,
                           (FARPROC)FISSAVERESTMsgProc, (DWORD)ID_LSA
         {
             FISSaveData( nFilePath );
         }
     } else {
```

```
                FISMessage( NULL, nRTTitle[nRTLanguage][52], nRTTitle[nRTLan
                            MB_ICONEXCLAMATION, MB_OK, MB_TASKMODAL );
                SetFocus( hWndSingle );
            }
            break;

        case IDM_S_INC:
            if( nPlotOn ) break;
            /* increment the duration and zero axes */
            nOneDur++;

            /* redraw the axes */
            FISClearWindow( hWndSingle, hDCSingle );
            nRc = FISDrawAxes( hDCSingle, nOneStart,
                               nOneDur, nOneSize );
            FISPlotData( hDCSingle, nOneSize, nOneStart,
                         nOneDur, 0, nOneDur );
            break;

        case IDM_S_DEC:
            if( nPlotOn ) break;
            /* decrement the duration and zero axes */
            if( nOneDur > 1 ) nOneDur--;

            /* redraw the axes */
            FISClearWindow( hWndSingle, hDCSingle );
            nRc = FISDrawAxes( hDCSingle, nOneStart,
                               nOneDur, nOneSize );
            FISPlotData( hDCSingle, nOneSize, nOneStart,
                         nOneDur, 0, nOneDur );
            break;

        case IDM_HELP:
            if( !nPlotOn ) HandleHelp( hWndSingle, 3 );
            break;

        case IDM_R_EXIT:
            if( !nPlotOn ) PostMessage( hWnd, WM_CLOSE, NULL, NULL );
            break;

        case IDM_S_ABOUT:
            /* Plotting is in progress */
            if( !nPlotOn ) HandleAbout( hWnd, hInstSingle, ID_ABOUT_SINGLE )
            break;

    default:
        return DefWindowProc(hWnd, Message, wParam, lParam);
}
break;

case WM_CREATE:
     /* set up the plotting variables */
     nSerTime = 0;
     nOneTail = nADHead;
     nOnePoints = 0;
     nOneShots = 0;
     cSingle = true;
     nOneStart = 0;  nOneDur = 10;
     nPlotOn = false;

     /* now set up the collection pointers */
     nCurData = NULL;
     nCurSet = NULL;
     nCurOffSet = 0;
     nGroupSet = NULL;
     nCurGroup = 0;
     nGroups = 0;

     /* create the device context and application objects */
     hDCSingle = GetDC( hWnd );
     hMenuSingle = GetMenu( hWnd );
     hOrgFont = SelectObject( hDCSingle, hFontX );
     hOrgPen = SelectObject( hDCSingle, hPenBlue );
```

```
    /* set up the window title */
    strcpy( nTReady, nRTTitle[nRTLanguage][48] );
    strcpy( nTMonitor, nRTTitle[nRTLanguage][49] );
    if( strlen( nCurCourse.nName ) > 0 )
    {
        strcpy( nTReady, nCurCourse.nName );
        strcpy( nTMonitor, nCurCourse.nName );
        if( strlen( nCurStage.nName ) > 0 )
        {
            strcat( nTReady, ", " );
            strcat( nTReady, nCurStage.nName );
            strcat( nTMonitor, ", " );
            strcat( nTMonitor, nCurStage.nName );
        }
        strcat( nTMonitor, nRTTitle[nRTLanguage][50] );
        strcat( nTReady, nRTTitle[nRTLanguage][51] );
    } else {
        if( strlen( nCurStage.nName ) > 0 )
        {
            strcpy( nTReady, nCurStage.nName );
            strcpy( nTMonitor, nCurStage.nName );
            strcat( nTMonitor, nRTTitle[nRTLanguage][50] );
            strcat( nTReady, nRTTitle[nRTLanguage][51] );
        }
    }
    SetWindowText( hWnd, nTReady );

    break;

case WM_SETFOCUS:
    FlashWindow( hWndSingle, true );
    BringWindowToTop( hWndSingle );
    HandleToolTemplate( tSingle );
    break;

case WM_KILLFOCUS:
    FlashWindow( hWndSingle, true );
    break;

case WM_MOUSEACTIVATE:
    if( GetFocus() != hWnd ) SetFocus( hWnd );
    break;

case WM_MOUSEMOVE:
    HandleMouseMove( hWndSingle, hInstSingle, (LPSTR)"SINGLE_CUR" );
    break;

case WM_MOVE:
    break;

case IDM_PAINT:
    /* refresh the data */
    FISClearWindow( hWndSingle, hDCSingle );

    nRc = FISDrawAxes( hDCSingle, nOneStart, nOneDur, nOneSize );
    if( !nPlotOn ) FISPlotData( hDCSingle, nOneSize, nOneStart,
                                nOneDur, 0, nOneDur );
    break;          /* continue on thru on paint the screen */

case WM_PAINT:
    memset(&ps, 0x00, sizeof(PAINTSTRUCT));
    hDCPaint = BeginPaint(hWnd, &ps);
    SetBkMode(hDCPaint, TRANSPARENT);

    /* get the plot dimensions */
    FISGetPlotArea( hWnd, &nOneSize );
    nRc = FISDrawAxes( hDCPaint, nOneStart, nOneDur, nOneSize );

    /* refresh the data */
    if( !nPlotOn ) FISPlotData( hDCPaint, nOneSize, nOneStart,
                                nOneDur, 0, nOneDur );

    /* done repainting */
    EndPaint(hWnd, &ps);
    break;
```

```
case WM_CLOSE:  /* close the window                                    */
    /* check if data is saved */
    if( !nPlotSaved )
    {
        if( FISAskSave( hWnd, hInstSingle ) == IDCANCEL ) break;
    }
    /* kill all of the timers */
    KillTimer( hWnd, n100mil );
    ReleaseDC( hWnd, hDCSingle );

    /* get rid of any data remaining in the memory */
    FISFreeSet( nCurData );
    nCurData = NULL;
    nCurSet = NULL;
    nCurOffSet = 0;
    nCurGroup = 0;
    nGroupSet = NULL;
    nGroups = 0;

    /* Destroy child windows, modeless dialogs, then, this window  */
    HandleHelp( hWndSingle, 0 );
        DestroyWindow(hWnd);
        cSingle = false;        /* allow main to restart */

        /* move the other window around */
        PostMessage( hWndMain, WM_COMMAND, IDM_H_REPAINT, NULL );
        /* tell the single shot analysis to reset data */
        if( IsWindow( hWndReal ) )
        {
            PostMessage( hWndReal, WM_COMMAND, IDM_R_CLEAR, NULL );
        }
        break;

    case WM_DESTROY:
        /* kill all of the timers */
        KillTimer( hWndSingle, n100mil );
        ReleaseDC( hWndSingle, hDCSingle );

        /* get rid of any data remaining in the memory */
        FISFreeSet( nCurData );
        nCurData = NULL;
        nCurSet = NULL;
        nCurOffSet = 0;
        nCurGroup = 0;
        nGroupSet = NULL;
        nGroups = 0;

        HandleHelp( hWndSingle, 0 );
        cSingle = false;
        hWndSingle = NULL;
        break;

    default:
        return DefWindowProc(hWnd, Message, wParam, lParam);
}
return 0L;
}

/*************************************************************************/
/*                                                                       */
/* nCwRegSingleClass Function                                           */
/*                                                                       */
/* The following function registers all the classes of all the windows  */
/* associated with this application. The function returns an error code */
/* if unsuccessful, otherwise it returns 0.                              */
/*                                                                       */
/*************************************************************************/

int nCwRegSingleClass(void)
{
 WNDCLASS   wndclass;    /* struct to define a window class             */
 int nRc;
 memset(&wndclass, 0x00, sizeof(WNDCLASS));
```

```
/* load WNDCLASS with window's characteristics                          */
wndclass.style = CS_OWNDC | CS_HREDRAW | CS_VREDRAW | CS_BYTEALIGNWINDOW;
wndclass.lpfnWndProc = OneShotWndProc;
/* Extra storage for Class and Window objects                           */
wndclass.cbClsExtra = 0;
wndclass.cbWndExtra = 0;
wndclass.hInstance = hInstSingle;
wndclass.hIcon = LoadIcon(hInstSingle, "ONESHOT");
wndclass.hCursor = NULL;        /* so cursor may be changed             */
/* Create brush for erasing background                                  */
wndclass.hbrBackground = CreateSolidBrush( rPlotBack );
wndclass.lpszMenuName = szSingleName;   /* Menu Name is App Name */
wndclass.lpszClassName = szSingleName; /* Class Name is App Name */

/* first attempt to deregister the class */
UnregisterClass( szSingleName, hInstSingle );

if( (nRc = RegisterClass(&wndclass)) == 0 )
  return -1;


return(0);
} /* End of nCwRegisterClasses                                          */
#include "global.h"

#include "real_exp.h"
#include "main_exp.h"
#include "dial_exp.h"
#include "one_exp.h"
#include "func_exp.h"
#include "trigger.h"

int FAR CreateTrigger( HANDLE hInst, HWND hParentInst )
{
 /*********************************************************************/
 /* HANDLE hInst;           handle for this instance                  */
 /* HANDLE hParentInst;   handle for possible previous instances     */
 /* int    nCmdShow;        Show code for main window display         */
 /*********************************************************************/

 MSG        msg;           /* MSG structure to store your messages      */
 int        nRc;           /* return value from Register Classes        */

strcpy(szTriggerName, "TRIGGER");
hInstTrigger = hInst;

/* register window classes if first instance of application        */
if ((nRc = nCwRegTriggerClasses()) == -1)
{
    /* registering one of the windows failed                        */
    LoadString(hInstTrigger, IDS_ERR_REGISTER_CLASS, szTriggerString, sizeof(szT
    FISMessage(NULL, szTriggerString, NULL, MB_ICONEXCLAMATION, MB_OK, NULL);
    return nRc;
}

 /* create application's Main window                                  */
 hWndTrigger = CreateWindow(
                szTriggerName,              /* Window class name          */
                nRTTitle[nRTLanguage][57],      /* Window's title
                WS_CLIPSIBLINGS |
                WS_CHILDWINDOW  |
                WS_CAPTION      |
                WS_THICKFRAME   |
                WS_MINIMIZEBOX  |
                WS_MAXIMIZEBOX,
                0,0,                    /* X, Y                         */
                50,50,          /* Width, Height of window     */
                hParentInst,            /* Parent window's handle      */
                NULL,                   /* Default to Class Menu       */
                hInstTrigger,            /* Instance of window          */
                NULL);                  /* Create struct for WM_CREATE */
```

```
if(hWndTrigger == NULL)
  {
   LoadString(hInstTrigger, IDS_ERR_CREATE_WINDOW, szTriggerString, sizeof(szTr
   FISMessage(NULL, szTriggerString, NULL, MB_ICONEXCLAMATION, MB_OK, NULL);
   return IDS_ERR_CREATE_WINDOW;
  }

ShowWindow(hWndTrigger, SW_SHOWNORMAL);            /* display main window

hAccTrigger = LoadAccelerators(hInstTrigger, szTriggerName);
   return msg.wParam;
  } /*  End of WinMain                                                    */
  /*********************************************************************/
  /*                                                                   */
  /* Main Window Procedure                                             */
  /*                                                                   */
  /* This procedure provides service routines for the Windows events   */
  /* (messages) that Windows sends to the window, as well as the user  */
  /* initiated events (messages) that are generated when the user selects */
  /* the action bar and pulldown menu controls or the corresponding    */
  /* keyboard accelerators.                                            */
  /*                                                                   */
  /*********************************************************************/

  LONG FAR PASCAL TriggerWndProc(HWND hWnd, WORD Message, WORD wParam, LONG lParam
  {
   HMENU      hMenu=0;            /* handle for the menu                 */
   HBITMAP    hBitmap=0;          /* handle for bitmaps                  */
   HDC        hDCPaint;                /* handle for the display device       */
   PAINTSTRUCT ps;                /* holds PAINT information             */
   int        nRc=0;              /* return code                         */
   BOOL    nRet;

   switch (Message)
     {
      case WM_TIMER:
          if( !IsIconic( hWnd ) )
          {
              nRet = FISDrawTrigger( hDCTrigger, nTriggerRect );
              if( !nRet )
              {
                  nRc = KillTimer( hWnd, n100mil );
                  SetWindowText( hWnd, nRTTitle[nRTLanguage][57] );
              }
          }
          break;

      case WM_COMMAND:
          switch( wParam)
          {
              case IDM_R_START:
                  SetWindowText( hWnd, nRTTitle[nRTLanguage][58] );
                  /* clear the window */
                  if (!IsIconic( hWnd ) ) FISClearWindow( hWndTrigger, hDCTrigger
                  if( !IsIconic( hWnd ) ) FISDrawShotLines( hDCTrigger, nTriggerRe
                  /* set up the Grip Trigger Timer */
                  KillTimer( hWnd, n100mil );
                  nRc = SetTimer( hWnd, n100mil, n100milTicks, NULL );
                  nTrigStart = nTriggerRect.top + 15;
                  break;

              case IDM_R_STOP:
                  nRc = KillTimer( hWnd, n100mil );
                  SetWindowText( hWnd, nRTTitle[nRTLanguage][57] );
                  break;

              case IDM_R_CLEAR:
                  /* clear the window */
                  if( !IsIconic( hWnd ) ) FISClearWindow( hWndTrigger, hDCTrigger
              if( !IsIconic( hWnd ) ) FISDrawShotLines( hDCTrigger, nTriggerRe
              break;

          case IDM_HELP:
              if( !nPlotOn ) HandleHelp( hWndTrigger, 6 );
              break;
```

```
        case IDM_R_EXIT:
            PostMessage( hWnd, WM_CLOSE, NULL, NULL );
            break;

        case IDM_S_ABOUT:
            if( !nPlotOn ) HandleAbout( hWnd, hInstTrigger, ID_TRIGGER );
            break;

        default:
            return DefWindowProc(hWnd, Message, wParam, lParam);
            break;
    }
    break;

case WM_CREATE:
    cTrigger = true;
    hDCTrigger = GetDC( hWnd );
    break;

case WM_SETFOCUS:
    FlashWindow( hWndTrigger, true );
    BringWindowToTop( hWndTrigger );
    HandleToolTemplate( tTrigger );
    break;

case WM_KILLFOCUS:
    FlashWindow( hWndTrigger, true );
    break;

case WM_MOUSEACTIVATE:
    if( GetFocus() != hWnd ) SetFocus( hWnd );
    break;

case WM_MOUSEMOVE:
    HandleMouseMove( hWndTrigger, hInstTrigger, (LPSTR)"TRIGWIN" );
    break;

case WM_MOVE:
     break;

case WM_SIZE:
     break;

case IDM_PAINT:
    if( !IsIconic( hWnd ) ) FISClearWindow( hWndTrigger, hDCTrigger );
    if( !IsIconic( hWnd ) ) FISDrawShotLines( hDCTrigger, nTriggerRect );
    break;

case WM_PAINT:
    memset(&ps, 0x00, sizeof(PAINTSTRUCT));
    hDCPaint = BeginPaint(hWnd, &ps);
    SetBkMode(hDCPaint, TRANSPARENT);

    /* get the size of the window  and fill in window */
    GetClientRect( hWnd, &nTriggerRect );
    if( !IsIconic( hWnd ) ) FISDrawShotLines( hDCTrigger, nTriggerRect );

    EndPaint(hWnd, &ps);
    break;

case WM_CLOSE:
    HandleHelp( hWndTrigger, 0 );
    /* close the window */
    KillTimer( hWnd, n100mil );
    ReleaseDC( hWnd, hDCTrigger );
    DestroyWindow(hWnd);

    cTrigger = false;
    hWndTrigger = NULL;

    /* expand other windows */
    PostMessage( hWndMain, WM_COMMAND, IDM_H_REPAINT, NULL );
    break;
```

```
    case WM_DESTROY:
        /* close the window */
        KillTimer( hWndTrigger, n100mil );
        ReleaseDC( hWndTrigger, hDCTrigger );

        HandleHelp( hWndTrigger, 0 );
        cTrigger = false;
        hWndTrigger = NULL;
        break;

    default:
         return DefWindowProc(hWnd, Message, wParam, lParam);
         break;
   }
 return 0L;
}     /* End of WndProc                                                    */

/*************************************************************************/
/*                                                                       */
/* nCwRegisterClasses Function                                           */
/*                                                                       */
/* The following function registers all the classes of all the windows  */
/* associated with this application. The function returns an error code */
/* if unsuccessful, otherwise it returns 0.                              */
/*                                                                       */
/*************************************************************************/

int nCwRegTriggerClasses(void)
{
 WNDCLASS   wndclass;    /* struct to define a window class              */
 memset(&wndclass, 0x00, sizeof(WNDCLASS));


 /* load WNDCLASS with window's characteristics                          */
 wndclass.style = CS_OWNDC | CS_HREDRAW | CS_VREDRAW | CS_BYTEALIGNWINDOW;
 wndclass.lpfnWndProc = TriggerWndProc;
 /* Extra storage for Class and Window objects                           */
 wndclass.cbClsExtra = 0;
 wndclass.cbWndExtra = 0;
 wndclass.hInstance = hInstTrigger;
 wndclass.hIcon = LoadIcon(hInstTrigger, "TRIGGER");
 wndclass.hCursor = NULL;        /* so cursor may be changed             */
 /* Create brush for erasing background                                  */
 wndclass.hbrBackground = CreateSolidBrush(RGB(255, 255, 255));
 wndclass.lpszMenuName = szTriggerName;   /* Menu Name is App Name */
 wndclass.lpszClassName = szTriggerName; /* Class Name is App Name */

 /* first attempt to deregister the class */
 UnregisterClass( szTriggerName, hInstTrigger );

 if(RegisterClass(&wndclass) == 0)
   return -1;

 return(0);
} /* End of nCwRegisterClasses                                           */

#include "global.h"

#include <stdio.h>
#include <time.h>

#include "dial_exp.h"
#include "func_exp.h"
#include "one_exp.h"
#include "main_exp.h"
#include "real_exp.h"
#include "forc_exp.h"
#include "trig_exp.h"
#include "tool_exp.h"
#include "one_exp.h"

/*********************************************************/
/* HandleHelp                                            */
/*                                                       */
/* FIS System exit handler                               */
/*********************************************************/
```

```
void HandleHelp( HWND hWndHelp, DWORD nHelpContext )
{

strcpy( nFilePath, nDefPath );
strcat( nFilePath, "\\rthelp.hlp" );

switch( nHelpContext )
{
    case 0:
        WinHelp( hWndHelp, nFilePath, HELP_QUIT, NULL );
        break;

    case FIS_HELPONHELP:
        WinHelp( hWndHelp, NULL, HELP_HELPONHELP, NULL );
        break;

    default:
        WinHelp( hWndHelp, nFilePath, HELP_CONTEXT, nHelpContext );
        break;
}

return;
}
/*********************************************************/
/* HandleExit                                            */
/*                                                       */
/* FIS System exit handler                               */
/*********************************************************/
void HandleExit( HWND hWnd, HWND hInst, int nExit )
{
/* bring up the dialog box */
if ( HandleDialog( hWnd, hInst, nExit,
                   (FARPROC)FISEXITMsgProc, NULL ) == ID_EXIT )
{
    PostMessage( hWnd, WM_CLOSE, NULL, NULL );
}
return;
}
/*********************************************************/
/* HandleAbout                                           */
/*                                                       */
/* FIS System about box handler                          */
/*********************************************************/
int HandleAbout( HWND hWnd, HWND hInst, int nAbout )
{

return(HandleDialog( hWnd, hInst, nAbout, (FARPROC)FISABOUTMsgProc, NULL ));

}


/*********************************************************/
/* HandleDialog                                          */
/*                                                       */
/* FIS System dialog handler                             */
/* Note : use only if not return values are required     */
/*********************************************************/
int HandleDialog( HWND hWnd, HWND hInst, int nDial,
                  FARPROC lpDialog, DWORD nParam )
{
FARPROC lpfnFISOPTIONMsgProc;
int nRc;
HWND hPrevWnd;

/* get the current focus */
hPrevWnd = GetFocus();

/* bring up the dialog box */
lpfnFISOPTIONMsgProc = MakeProcInstance(lpDialog, hInst);
nRc = DialogBoxParam(hInst, MAKEINTRESOURCE(nDial), hWnd,
                     lpfnFISOPTIONMsgProc, nParam);
FreeProcInstance(lpfnFISOPTIONMsgProc);

/* return the focus */
SetFocus( hPrevWnd );
```

```
return (nRc);
}


/*********************************************************/
/* HandleMove                                            */
/*                                                       */
/* move one shot plot around                             */
/*********************************************************/
void HandleMove( int nWhere )
{

FISMovePlot( hDCSingle, nOneSize, &nOneStart, nOneDur, nWhere );
FISDrawAxes( hDCSingle, nOneStart, nOneDur, nOneSize );

return;
}


/*********************************************************/
/* HandleMouseMove                                       */
/*                                                       */
/* assigns cursors and setfocus for windows              */
/*********************************************************/
void HandleMouseMove( HWND hWnd, HWND hInst, LPSTR sCursor )
{
HCURSOR hTempCur;

/* load a application cursor */
hTempCur = LoadCursor(hInst, sCursor );

/* set the cursor */
SetCursor(hTempCur);

return;
}


/*************************************************************************/
/* HandleFindShot                                                        */
/* routine to find the next/previous shot given a current starting       */
/* location                                                              */
/*************************************************************************/
void HandleFindShot( unsigned int * nStart, unsigned int * nDur, int nDistance )
{
struct tShotSet * nSaveData;
unsigned int nNewOffset;
unsigned char nPrevShot;
BOOL nShotFound;
unsigned int i,j,nCount;

/* ensure that there is data */
if( nGroupSet != NULL )
{
    /* initialize the variables */
    if( nRealPtr == NULL )
    {
        nRealPtr = nGroupSet;
        nRealOff = 0;
    }
    nSaveData = nRealPtr;
    nNewOffset = nRealOff;
    nShotFound = false;

    /* search depending on the request */
    switch (nDistance)
    {
        case FirstShot:
            /* go to the beginning */
            nNewOffset = 0;
            nSaveData = nGroupSet;
        case NextShot:
            nPrevShot = nSaveData->sShots[nNewOffset].nSensors[nTrigSen];
            /* search for the next shot */
            while( true )
            {
```

```
            for (i=nNewOffset;i<dSetSize;i++)
            {
                if( (nPrevShot < nSenThresh[nTrigSen][1])
                &&  (nSaveData->sShots[i].nSensors[nTrigSen] >= nSenThresh[n
                {
                    nShotFound = true;
                    nNewOffset = i;
                    break;
                }
                nPrevShot = nSaveData->sShots[i].nSensors[nTrigSen];
            }
            /* check if we found another shot */
            if( nShotFound ) break;
            /* jump to the next set */
            nNewOffset = 0;
            nSaveData = nSaveData->pNextSet;
            if( nSaveData == NULL )
            {
                break;
            }
        }
        /* if shot is not found then reset to existing information */
        if( !nShotFound )
        {
            nSaveData = nRealPtr;
            nNewOffset = nRealOff;
        }
        break;

    case LastShot:
        /* find the last set */
        while ( nSaveData->pNextSet != NULL )
        {
            nSaveData = nSaveData->pNextSet;
        }
        /* point to the last data item */
        nNewOffset = (unsigned int)(nSaveData->nSamples % dSetSize );
    case PrevShot:
        /* move back a single item */
        if( nNewOffset > 0  )
        {
            nNewOffset--;
        } else {
            nNewOffset = dSetSize-1;
            nSaveData = nSaveData->pPrevSet;
            if( nSaveData == NULL )
            {
                /* no data in this set */
                nNewOffset = 0;
                nSaveData = nGroupSet;
            }
        }
        /* get the first sample */
        nPrevShot = nSaveData->sShots[nNewOffset].nSensors[nTrigSen];
        /* search for the previous shot */
        while( true )
        {
            for (i=nNewOffset;i>0;i--)
            {
                if( (nPrevShot >= nSenThresh[nTrigSen][1])
                &&  (nSaveData->sShots[i].nSensors[nTrigSen] < nSenThresh[nT
                {
                    nShotFound = true;
                    nNewOffset = i+1;
                    break;
                }
                    nPrevShot = nSaveData->sShots[i].nSensors[nTrigSen];
                }
                /* check if we found another shot */
                if( nShotFound ) break;
                /* jump to the previous set */
                nNewOffset = dSetSize-1;
                nSaveData = nSaveData->pPrevSet;
                if( nSaveData == NULL )
                {
```

```
                break;
            }
        }
        /* if shot is not found then reset to existing information */
        if( !nShotFound )
        {
            nSaveData = nRealPtr;
            nNewOffset = nRealOff;
        }
        break;

    default:
        break;
}

    /* save the shot information */
    nRealPtr = nSaveData;
    nRealOff = nNewOffset;

    /* copy the data into the single shot display buffer */
    if( nSaveData == NULL )
    {
        /* no data collected */
        nRealData.nNum = 0;
    } else {
        /* copy the data */
        nCount = 0;
        nShotFound = false;
        while( true )
        {
            for( i=nNewOffset;i<dSetSize;i++ )
            {
                for( j=0;j<nNumSensors;j++ )
                {
                    nRealData.nData[nCount].nSensors[j] =
                    nSaveData->sShots[i].nSensors[j];
                }
                nRealData.nData[nCount].nTimeStamp =
                   nSaveData->sShots[i].nTimeStamp;
                nCount++;
                /* check if we found the end of the shot */
                if( nSaveData->sShots[i].nSensors[nTrigSen] <
                    nSenThresh[nTrigSen][1] )
                {
                    nRealData.nNum = nCount;
                    nShotFound = true;
                    /* adjust the plot duration */
                    *nDur = (unsigned int)((nRealData.nData[nCount-1].nTimeS
                          - nRealData.nData[0].nTimeStamp) / 1000 )
                          + 1;
                    break;
                    }
                    /* check if shot took to long */
                    if( nCount >= 2000 )
                    {
                        nRealData.nNum = nCount;
                        nShotFound = true;
                        /* adjust the plot duration */
                        *nDur = (unsigned int)((nRealData.nData[nCount-1].nTimeS
                              - nRealData.nData[0].nTimeStamp) / 1000 )
                              + 1;
                    }
                }
                /* get the next data set */
                if( nShotFound ) break;
                nSaveData = nSaveData->pNextSet;
                nNewOffset=0;
                if( nSaveData == NULL ) break;
            }
        }
}

return;
}
```

```
/*************************************************************************/
/* HandlePrintWindow                                                     */
/* routine to print contents of current screen on the printer            */
/*************************************************************************/
void HandlePrintWindow( HDC hDCFunc, HWND hWndFunc, unsigned int nType )
{
HDC hScreenDC, hMemDC, hPrintDC;
HBITMAP hBitmap, hOldBitmap;
HPALETTE hPalette;
LPSTR lpBits;
LPBITMAPINFOHEADER lpDIBHdr;
HANDLE hDIB;
RECT rScreen, nPrnRect, rPrintRect;
BANDINFOSTRUCT biBandInfo;
unsigned int nRc;
int nTemp;
unsigned char * nPart, * nPart2;
unsigned char nPrinter[100], nTemp1[50],nTemp2[50],nTemp3[50];

/* check to make sure that this is still required */
if( (nRc = FISMessage( NULL, nRTTitle[nRTLanguage][83], nRTTitle[nRTLanguage][84
                       MB_ICONQUESTION, MB_YESNO, MB_TASKMODAL ) ) == IDNO )
{
    return;
}
/* create the printer device context */
/* win.ini contents
[windows]
device=HP LaserJet Series II,HPPCL,FILE:
*/
/* get the win.ini contents */
nRc = GetProfileString( "windows", "device",
                        "HP LaserJet Series II,HPPCL,FILE:",
                        nPrinter, 100 );
/* find the parts of the string */
nPart = strchr( nPrinter, ',' );
nPart[0] = 0;            /* put a null in the string */
strcpy( nTemp1, nPrinter );
nPart++;

nPart2 = strchr( nPart, ',' );
nPart2[0] = 0;                  /* put a null in the string */
strcpy( nTemp2, nPart );
nPart2++;

strcpy( nTemp3, nPart2 );

/* create printer device context */
hPrintDC = CreateDC( nTemp2, nTemp1, nTemp3, (LPSTR)NULL );
if( hPrintDC == NULL ) return;

hScreenDC = CreateDC("DISPLAY", NULL, NULL, NULL);
rScreen.left = rScreen.top = 0;
rScreen.right = GetDeviceCaps(hScreenDC, HORZRES);
rScreen.bottom = GetDeviceCaps(hScreenDC, VERTRES);

hMemDC = CreateCompatibleDC(hScreenDC);

/* create a bitmap compatible with the screen DC */
hBitmap = CreateCompatibleBitmap(hScreenDC, rScreen.right,
                                            rScreen.bottom );

/* select new bitmap into memory DC */
hOldBitmap = SelectObject(hMemDC, hBitmap);

/* bitblt screen DC to memory DC */
BitBlt(hMemDC, 0, 0, rScreen.right, rScreen.bottom,
       hScreenDC, 0, 0, SRCCOPY);

hBitmap = SelectObject(hMemDC, hOldBitmap);

/* clean up */
DeleteDC(hScreenDC);
DeleteDC(hMemDC);
```

```
/* get the current palette */
hPalette = GetSystemPalette();

/* convert the bitmap to a DIB */
hDIB = BitmapToDIB(hBitmap, hPalette);

/* clean up */
DeleteObject(hBitmap);
/* get the size of the print rectangle */
lpDIBHdr = (LPBITMAPINFOHEADER)GlobalLock(hDIB);

lpBits = (LPSTR)lpDIBHdr + *(LPDWORD)(LPSTR)lpDIBHdr
         + (DIBNumColors((LPSTR)lpDIBHdr) * sizeof(RGBQUAD));

rPrintRect.top = 0;
rPrintRect.left = 0;
rPrintRect.bottom = GetDeviceCaps(hPrintDC, VERTRES);
rPrintRect.right = GetDeviceCaps(hPrintDC, HORZRES);

/* set up the print device */
SetStretchBltMode(hPrintDC, COLORONCOLOR);
biBandInfo.bGraphics = TRUE;
biBandInfo.bText = TRUE;
biBandInfo.GraphicsRect = rPrintRect;

if (Escape(hPrintDC, STARTDOC, 7, (LPSTR)"RTPrint", NULL) < 0)

    nTemp = NEXTBAND;
    if (Escape(hPrintDC, QUERYESCSUPPORT, sizeof(int),
                        (LPSTR)&nTemp, NULL))
    {
        BOOL bBandInfoDevice;


        /* Check if device supports the BANDINFO escape */
        nTemp = BANDINFO;
        bBandInfoDevice = Escape(hPrintDC, QUERYESCSUPPORT, sizeof(int),
                                 (LPSTR)&nTemp, NULL);
        /* Do each band -- Call Escape() with NEXTBAND, then the
        * rect structure returned is the area where we are to
        * print in.  This loop exits when the rect area is empty.
        */
        while (Escape(hPrintDC, NEXTBAND, NULL, NULL, (LPSTR)&nPrnRect) &&
               !IsRectEmpty(&nPrnRect))
        {
            char szTmpBuf[100];

            /* Do the BANDINFO, if needed */
            if (bBandInfoDevice)
            {
                Escape(hPrintDC, BANDINFO, sizeof(BANDINFOSTRUCT), (LPSTR)&
                       biBandInfo, (LPSTR)&biBandInfo);

                PrintBand(hPrintDC, &rPrintRect, &nPrnRect,
                          biBandInfo.bText, biBandInfo.bGraphics,
                          lpDIBHdr, lpBits);
            }
        }
    } else {

        /* Print the whole page -- non-banding device */
        nPrnRect = rPrintRect;
        PrintBand(hPrintDC, &rPrintRect, &nPrnRect,
                  TRUE, TRUE, lpDIBHdr, lpBits);
        Escape(hPrintDC, NEWFRAME, NULL, NULL, NULL);
    }

Escape(hPrintDC, ENDDOC, NULL, NULL, NULL);
DeleteDC(hPrintDC);
GlobalUnlock(hDIB);

/* return to the calling routine */
return;
}
```

```
/*************************************************************************
* DIBNumColors()
* Parameter:
*     LPSTR lpbi        - pointer to packed-DIB memory block
* Return Value:
*     WORD              - number of colors in the color table
* Description:
*     This function calculates the number of colors in the DIB's color table
*     by finding the bits per pixel for the DIB (whether Win3.0 or OS/2-style
*     DIB). If bits per pixel is 1: colors=2, if 4: colors=16, if 8: colors=256,
*     if 24, no colors in color table.
*************************************************************************/
WORD DIBNumColors(LPSTR lpbi)
{
WORD wBitCount;
DWORD dwClrUsed;

dwClrUsed = ((LPBITMAPINFOHEADER)lpbi)->biClrUsed;
if (dwClrUsed) return (WORD)dwClrUsed;

wBitCount = ((LPBITMAPINFOHEADER)lpbi)->biBitCount;

switch (wBitCount)
{
    case 1:
        return 2;
    case 4:
        return 16;
    case 8:
        return 256;
    default:
        return 0;
}
}

/*************************************************************************
Get System Palette
*************************************************************************/
HPALETTE GetSystemPalette(void)
{
   HDC hDC;                  // handle to a DC
   HPALETTE hPal = NULL;     // handle to a palette
   HANDLE hLogPal;           // handle to a logical palette
   LPLOGPALETTE lpLogPal;    // pointer to a logical palette
   int i, nColors;           // loop index, number of colors

   /* Find out how many palette entries we want. */

   hDC = GetDC(NULL);
   if (!hDC)
      return NULL;

   nColors = GetDeviceCaps(hDC, SIZEPALETTE);
   /*  For non-palette devices, we'll use the # of system
    *  colors for our palette size.
    */
   if (!nColors)
      nColors = GetDeviceCaps(hDC, NUMCOLORS);

   ReleaseDC(NULL, hDC);

   /* Allocate room for the palette and lock it. */
   hLogPal = GlobalAlloc(GHND, sizeof(LOGPALETTE) + nColors * sizeof(
                         PALETTEENTRY));
  /* if we didn't get a logical palette, return NULL */
  if (!hLogPal)
     return NULL;

  /* get a pointer to the logical palette */
  lpLogPal = (LPLOGPALETTE)GlobalLock(hLogPal);

  /* set some important fields */
  lpLogPal->palVersion = 0x300;
  lpLogPal->palNumEntries = nColors;
  for (i = 0; i < nColors; i++)
  {
```

```
      lpLogPal->palPalEntry[i].peBlue = 0;
      *((LPWORD)(&lpLogPal->palPalEntry[i].peRed)) = i;
      lpLogPal->palPalEntry[i].peFlags = PC_EXPLICIT;
   }

   /*  Go ahead and create the palette.  Once it's created,
    *  we no longer need the LOGPALETTE, so free it.
    */
   hPal = CreatePalette(lpLogPal);

   /* clean up */
   GlobalUnlock(hLogPal);
   GlobalFree(hLogPal);
   return hPal;
}

/*************************************************************************
*
* BitmapToDIB()
*
* Parameters:
*
* HBITMAP hBitmap  - specifies the bitmap to convert
*
* HPALETTE hPal    - specifies the palette to use with the bitmap
*
* Return Value:
*
* HDIB             - identifies the device-dependent bitmap
*
* Description:
*
* This function creates a DIB from a bitmap using the specified palette.
*
*************************************************************************/
HANDLE BitmapToDIB(HBITMAP hBitmap, HPALETTE hPal)
{
   BITMAP bm;                    // bitmap structure
   BITMAPINFOHEADER bi;          // bitmap header
   BITMAPINFOHEADER FAR *lpbi;   // pointer to BITMAPINFOHEADER
   DWORD dwLen;                  // size of memory block
   HANDLE hDIB, h;               // handle to DIB, temp handle
   HDC hDC;                      // handle to DC
   WORD biBits;                  // bits per pixel

   /* check if bitmap handle is valid */

   if (!hBitmap)
      return NULL;

   /* if no palette is specified, use default palette */
   if (hPal == NULL)
      hPal = GetStockObject(DEFAULT_PALETTE);

   /* fill in BITMAP structure */
   GetObject(hBitmap, sizeof(bm), (LPSTR)&bm);

   /* calculate bits per pixel */
   biBits = bm.bmPlanes * bm.bmBitsPixel;

   /* initialize BITMAPINFOHEADER */
   bi.biSize = sizeof(BITMAPINFOHEADER);
   bi.biWidth = bm.bmWidth;
   bi.biHeight = bm.bmHeight;
   bi.biPlanes = 1;
   bi.biBitCount = biBits;
   bi.biCompression = DIB_RGB_COLORS;
   bi.biSizeImage = 0;
   bi.biXPelsPerMeter = 0;
   bi.biYPelsPerMeter = 0;
   bi.biClrUsed = 0;
   bi.biClrImportant = 0;

   /* calculate size of memory block required to store BITMAPINFO */
   dwLen = bi.biSize + (DIBNumColors((LPSTR)&bi) * sizeof(RGBQUAD));
```

```
/* get a DC */
hDC = GetDC(NULL);

/* select and realize our palette */
hPal = SelectPalette(hDC, hPal, FALSE);
RealizePalette(hDC);

/* alloc memory block to store our bitmap */
hDIB = GlobalAlloc(GHND, dwLen);

/* if we couldn't get memory block */
if (!hDIB)
{
   /* clean up and return NULL */
   SelectPalette(hDC, hPal, TRUE);
   RealizePalette(hDC);
   ReleaseDC(NULL, hDC);
   return NULL;
}

/* lock memory and get pointer to it */
lpbi = (VOID FAR *)GlobalLock(hDIB);

/* use our bitmap info. to fill BITMAPINFOHEADER */
*lpbi = bi;

/*  call GetDIBits with a NULL lpBits param, so it will calculate the
 *  biSizeImage field for us
 */
GetDIBits(hDC, hBitmap, 0, (WORD)bi.biHeight, NULL, (LPBITMAPINFO)lpbi,
          DIB_RGB_COLORS);
/* get the info. returned by GetDIBits and unlock memory block */
bi = *lpbi;
GlobalUnlock(hDIB);

/* if the driver did not fill in the biSizeImage field, make one up */
if (bi.biSizeImage == 0)
   bi.biSizeImage = WIDTHBYTES((DWORD)bm.bmWidth * biBits) * bm.bmHeight;

/* realloc the buffer big enough to hold all the bits */
dwLen = bi.biSize + (DIBNumColors((LPSTR)&bi) * sizeof(RGBQUAD))
                  + bi.biSizeImage;
if (h = GlobalReAlloc(hDIB, dwLen, 0))
   hDIB = h;
else
{
   /* clean up and return NULL */
   GlobalFree(hDIB);
   hDIB = NULL;
   SelectPalette(hDC, hPal, TRUE);
   RealizePalette(hDC);
   ReleaseDC(NULL, hDC);
   return NULL;
}

/* lock memory block and get pointer to it */
lpbi = (VOID FAR *)GlobalLock(hDIB);

/*  call GetDIBits with a NON-NULL lpBits param, and actualy get the
 *  bits this time
 */
if (GetDIBits(hDC, hBitmap, 0, (WORD)bi.biHeight,
              (LPSTR)lpbi + (WORD)lpbi->biSize + (DIBNumColors((LPSTR)lpbi) *
              (LPBITMAPINFO)lpbi, DIB_RGB_COLORS) == 0)
{
   /* clean up and return NULL */
   GlobalUnlock(hDIB);
   hDIB = NULL;
   SelectPalette(hDC, hPal, TRUE);
   RealizePalette(hDC);
   ReleaseDC(NULL, hDC);
   return NULL;
}
bi = *lpbi;
```

```
   /* clean up */
   GlobalUnlock(hDIB);
   SelectPalette(hDC, hPal, TRUE);
   RealizePalette(hDC);
   ReleaseDC(NULL, hDC);

   /* return handle to the DIB */
   return hDIB;
}

/*********************************************************************/
/* PrintBand                                                         */
/*                                                                   */
/*********************************************************************/
WORD PrintBand(HDC hDC,            // Handle to the Printer DC
               LPRECT lpRectOut,   // Rect where entire DIB is to go
               LPRECT lpRectClip,  // Clippping rect where this portion goes
               BOOL fDoText,       // TRUE if this band is for text
               BOOL fDoGraphics,   // TRUE if this band is for graphics
               LPBITMAPINFOHEADER lpDIBHdr,   // Pointer to DIB header
               LPSTR lpDIBBits)    // Pointer to DIB bits
{
   RECT rect;                      // Temporary rectangle
   double dblXScaling,             // X and Y scaling factors
          dblYScaling;
   WORD wReturn = 0;               // Return code

   if (fDoGraphics)
   {
      dblXScaling = ((double)lpRectOut->right - lpRectOut->left) / (double)
                    lpDIBHdr->biWidth;
      dblYScaling = ((double)lpRectOut->bottom - lpRectOut->top) / (double)
                    lpDIBHdr->biHeight;
      /*
       * Now we set up a temporary rectangle -- this rectangle
       *  holds the coordinates on the paper where our bitmap
       *  WILL be output.  We can intersect this rectangle with
       *  the lpClipRect to see what we NEED to output to this
       *  band.  Then, we determine the coordinates in the DIB
       *  to which this rectangle corresponds (using dbl?Scaling).
       */
      IntersectRect(&rect, lpRectOut, lpRectClip);
      if (!IsRectEmpty(&rect))
      {
         RECT rectIn;

         rectIn.left = (int)((rect.left - lpRectOut->left) / dblXScaling + 0.5
                       );
         rectIn.top = (int)((rect.top - lpRectOut->top) / dblYScaling + 0.5);
         rectIn.right = (int)(rectIn.left + (rect.right - rect.left) /
                        dblXScaling + 0.5);
         rectIn.bottom = (int)(rectIn.top + (rect.bottom - rect.top) /
                         dblYScaling + 0.5);
         if (!StretchDIBits(hDC,                                  // DestDC
                            rect.left,                            // DestX
                            rect.top,                             // DestY
                            rect.right - rect.left,               // DestWidth
                            rect.bottom - rect.top,               // DestHeight
                            rectIn.left,                          // SrcX
                            (int)(lpDIBHdr->biHeight) -           // SrcY
                            rectIn.top - (rectIn.bottom - rectIn.top),
                            rectIn.right - rectIn.left,           // SrcWidth
                            rectIn.bottom - rectIn.top,           // SrcHeight
                            lpDIBBits,                            // lpBits
                            (LPBITMAPINFO)lpDIBHdr,               // lpBitInfo
                            DIB_RGB_COLORS,                       // wUsage
                            SRCCOPY))                             // dwROP
            wReturn = FALSE; // StretchDIBits() failed!
      }
   }
   return wReturn;
}
```

```
/*********************************************************************/
/* Handle Login                                                      */
/*                                                                   */
/* routine to set up system after login information has been verifed */
/*********************************************************************/
void HandleLogIn( void )
{
FISLogged = true;

/* initialize the global variables from the student information*/
if( !nLogEnable )
{
    /* initalize some variables */
    memset( &nStudRecord, 0, sizeof( struct tUserLog ));
    strcpy( nStudRecord.nFileDir, "." );
    strcpy( nStudRecord.nID, "RangeTutor" );
    strcpy( nStudRecord.nStudName, "User" );
    nStudRecord.nInstructor = true;
    nStudRecord.nFileOver = true;
    nStudRecord.nLanguage = 0;
}

nFileProt = nStudRecord.nFileOver;
nRTLanguage = nStudRecord.nLanguage;

/* set the enu to the selected language */
FISChangeMenu();

/* modify the login menu item to logout*/
ModifyMenu( hMainMenu, IDM_O_LOGIN, MF_BYCOMMAND | MF_STRING,
            IDM_O_LOGIN, nRTTitle[nRTLanguage][3] );

/* now enable all of the disabled menu items */
EnableMenuItem( hMainMenu, IDM_R_NEW, MF_BYCOMMAND | MF_ENABLED );
EnableMenuItem( hMainMenu, IDM_R_OPEN, MF_BYCOMMAND | MF_ENABLED );
EnableMenuItem( hMainMenu, IDM_R_SAVE, MF_BYCOMMAND | MF_ENABLED );
EnableMenuItem( hMainMenu, IDM_S_GRIPFORCE, MF_BYCOMMAND | MF_ENABLED );
EnableMenuItem( hMainMenu, IDM_S_TRIGGER, MF_BYCOMMAND | MF_ENABLED );
EnableMenuItem( hMainMenu, IDM_O_REALTIME, MF_BYCOMMAND | MF_ENABLED );
EnableMenuItem( hMainMenu, IDM_O_ONESHOT, MF_BYCOMMAND | MF_ENABLED );
EnableMenuItem( hMainMenu, IDM_O_INSTRUCT, MF_BYCOMMAND | MF_ENABLED );
EnableMenuItem( hMainMenu, IDM_O_SEQUENCE, MF_BYCOMMAND | MF_ENABLED );

EnableMenuItem( hMainMenu, IDM_O_STUDENT, MF_BYCOMMAND | MF_ENABLED );
EnableMenuItem( hMainMenu, IDM_R_LEGEND, MF_BYCOMMAND | MF_ENABLED );

if( nStudRecord.nInstructor )
{
    /* only enable these for the instructor */
    EnableMenuItem( hMainMenu, IDM_O_ADVANCED, MF_BYCOMMAND | MF_ENABLED );
    EnableMenuItem( hMainMenu, IDM_O_ACTIVITY, MF_BYCOMMAND | MF_ENABLED );

    EnableMenuItem( hMainMenu, IDM_C_SAVE, MF_BYCOMMAND | MF_ENABLED );
    EnableMenuItem( hMainMenu, IDM_C_OPEN, MF_BYCOMMAND | MF_ENABLED );
} else {
    EnableMenuItem( hMainMenu, 3, MF_BYPOSITION | MF_DISABLED | MF_GRAYED );
}

/* disable the exit request */
EnableMenuItem( hMainMenu, IDM_R_EXIT, MF_BYCOMMAND | MF_DISABLED | MF_GRAYED );

/* redraw the menu */
DrawMenuBar( hWndMain );

return;
}


/*********************************************************************/
/* Handle LogOut                                                     */
/*                                                                   */
/* routine to reset system after session is completed                */
/*********************************************************************/
void HandleLogOut( void )
{
```

```
/* clear the login flag and the student information */
FISLogged = false;
nRTLanguage = 0;
memset( &nStudRecord, 0, sizeof( struct tUserLog ));

/* reset the menu items */
FISChangeMenu();

/* change the logout menu item to login*/
ModifyMenu( hMainMenu, IDM_O_LOGIN, MF_BYCOMMAND | MF_STRING,
           IDM_O_LOGIN, nRTTitle[nRTLanguage][2] );

/* now disable all of the enabled menu items */
EnableMenuItem( hMainMenu, IDM_R_NEW, MF_BYCOMMAND | MF_DISABLED | MF_GRAYED );
EnableMenuItem( hMainMenu, IDM_R_OPEN, MF_BYCOMMAND | MF_DISABLED | MF_GRAYED );
EnableMenuItem( hMainMenu, IDM_R_SAVE, MF_BYCOMMAND | MF_DISABLED | MF_GRAYED );
EnableMenuItem( hMainMenu, IDM_S_GRIPFORCE, MF_BYCOMMAND | MF_DISABLED | MF_GRAY
EnableMenuItem( hMainMenu, IDM_S_TRIGGER, MF_BYCOMMAND | MF_DISABLED | MF_GRAYED
EnableMenuItem( hMainMenu, IDM_O_REALTIME, MF_BYCOMMAND | MF_DISABLED | MF_GRAYE
EnableMenuItem( hMainMenu, IDM_O_ONESHOT, MF_BYCOMMAND | MF_DISABLED | MF_GRAYED
EnableMenuItem( hMainMenu, IDM_O_INSTRUCT, MF_BYCOMMAND | MF_DISABLED | MF_GRAYE
EnableMenuItem( hMainMenu, IDM_O_SEQUENCE, MF_BYCOMMAND | MF_DISABLED | MF_GRAYE
EnableMenuItem( hMainMenu, IDM_O_STUDENT, MF_BYCOMMAND | MF_DISABLED | MF_GRAYED
EnableMenuItem( hMainMenu, IDM_O_ADVANCED, MF_BYCOMMAND | MF_DISABLED | MF_GRAYE
EnableMenuItem( hMainMenu, IDM_O_ACTIVITY, MF_BYCOMMAND | MF_DISABLED | MF_GRAYE
EnableMenuItem( hMainMenu, IDM_R_LEGEND, MF_BYCOMMAND | MF_DISABLED | MF_GRAYED
EnableMenuItem( hMainMenu, IDM_C_SAVE, MF_BYCOMMAND | MF_DISABLED | MF_GRAYED );
EnableMenuItem( hMainMenu, IDM_C_OPEN, MF_BYCOMMAND | MF_DISABLED | MF_GRAYED );

EnableMenuItem( hMainMenu, 3, MF_BYPOSITION | MF_ENABLED );    /* setup*/

/* enable the exit request */
EnableMenuItem( hMainMenu, IDM_R_EXIT, MF_BYCOMMAND | MF_ENABLED );

/* redraw the menu */
DrawMenuBar( hWndMain );

return;
/*
/* routine to paint the toolbox when it needs painting                    */
/*************************************************************************/
/* global key declarations */
char * cNormTemplate[16] = {"START_F1", "STOP_F2", "CLEAR_F3", "CLOSE_F4",
                    "SAVE_F5", "RECALL_F6", "PRINT_F7", "DRAW_F8",
                    "NEXT_F9", "HELP_F10", "NULL_KEY", "NULL_KEY",
                    "GRIP_1","TRIG_2", "SINGLE_3", "MULTI_4" };
char * cPushTemplate[16] = {"PUSH_F1", "PUSH_F2", "PUSH_F3", "PUSH_F4",
                    "PUSH_F5", "PUSH_F6", "PUSH_F7", "PUSH_F8",
                    "PUSH_F9", "PUSH_F10", "NULL_KEY", "NULL_KEY",
                    "PUSH_1","PUSH_2", "PUSH_3", "PUSH_4" };
unsigned int nKeyTemplate[16] = {IDM_R_START, IDM_R_STOP, IDM_R_CLEAR, IDM_R_EXI
                            IDM_R_SAVE, IDM_R_OPEN, IDM_PRINT, IDM_H_REPAINT,
                            IDM_H_ROTDOWN, IDM_HELP, NULL, NULL,
                            IDM_S_GRIPFORCE, IDM_S_TRIGGER,
                            IDM_O_REALTIME, IDM_O_ONESHOT };
char * cPush[16];
char * cNorm[16];
unsigned int nVirtKey[16];
char * cNull = "NULL_KEY";


void HandleToolTemplate( unsigned int nKeyMask )
{
unsigned int i, nTempMask;

for (i=0;i<16;i++)
{
    nTempMask = 1<<i;
    /* check if bit is set */
    if( (nTempMask&nKeyMask) > 0 )
    {
        cPush[i] = cPushTemplate[i];
        cNorm[i] = cNormTemplate[i];
        nVirtKey[i] = nKeyTemplate[i];
    } else {
```

```
        cPush[i] = cNull;
        cNorm[i] = cNull;
        nVirtKey[i] = 0;
    }
}
if( IsWindow( hWndToolBox ) )
{
    InvalidateRect( hWndToolBox, NULL, true );
    PostMessage( hWndToolBox, WM_PAINT, NULL, NULL );
}

return;
}

/*********************************************************************/
/* Handle PaintTools                                                 */
/*                                                                   */
/* routine to paint the toolbox when it needs painting               */
/*********************************************************************/
void HandlePaintTools( HDC hDCFunc, RECT nRect )
{
HBITMAP hTempBit, hFuncBit;
HDC hMemDC;
unsigned int nPos, nRc, i;
unsigned int nWidth;
BOOL nRet;

/* determine how mush room we have */
nWidth = nRect.right - nRect.left;

/* create compatible device context */
hMemDC = CreateCompatibleDC( hDCFunc );
/* copy the bitmap to the tool box */
nPos=0;

for( i=0; i<16; i++ )
{
    hFuncBit = LoadBitmap( hInstMain, cNorm[i] );
    hTempBit = SelectObject( hMemDC, hFuncBit );
    nRc = StretchBlt( hDCFunc, nPos,0, (nWidth/16) ,32,
                      hMemDC, 0,0, 32,32, SRCCOPY );
    SelectObject( hMemDC, hTempBit );
    DeleteObject( hFuncBit );
    nPos+=(nWidth/16);
}

/* delete compatible device context */
nRet = DeleteDC( hMemDC );

return;
}

/*********************************************************************/
/* HandleToolPress                                                   */
/*                                                                   */
/* routine to change the look of the presses button                  */
/* returns the appropriate */
/*********************************************************************/
unsigned int nPrevPress=0;
WORD HandleToolPress( HDC hDCFunc, WORD nUpDown, LONG nXY, RECT nRect )
{
unsigned int nX, nY;
unsigned int nFuncOffset;
HBITMAP hTempBit, hFuncBit, hPushBit;
HDC hMemDC;
unsigned int nPos, nRc;
unsigned int nWidth;
BOOL nRet;

/* determine the available screen width */
nWidth = nRect.right-nRect.left;

/* get the X and Y co-ordinate of the mouse press */
nX = LOWORD( nXY );
nY = HIWORD( nXY );
```

```
/* determine which key was pressed F1 = 1 */
nFuncOffset = (nX/(nWidth/16)) + 1;
if( nFuncOffset > 16 ) return(0);

/* adjust the nX and nY coordinates */
nY = 1;
nX = (nX/(nWidth/16))*(nWidth/16);      /* round down to the nearest 45 */
/* create the memory device context */
hMemDC = CreateCompatibleDC( hDCFunc );

/* check what just happened */
if( nUpDown == WM_LBUTTONDOWN )
{
    hPushBit = LoadBitmap( hInstMain, cPush[nFuncOffset-1] );
    hTempBit = SelectObject( hMemDC, hPushBit );
    nRc = StretchBlt( hDCFunc, nX, 0, (nWidth/16), 32,
                      hMemDC, 0, 0, 32, 32, SRCCOPY );
    SelectObject( hMemDC, hTempBit );
    DeleteObject( hPushBit );
    /* check if there is an other button currently pressed */
    if( nPrevPress != 0 )
    {
        /* reset the previous button */
        hFuncBit = LoadBitmap( hInstMain, cNorm[nPrevPress-1] );
        hTempBit = SelectObject( hMemDC, hFuncBit );
        nX = (nPrevPress-1)*(nWidth/16);
        nRc = StretchBlt( hDCFunc, nX, 0, (nWidth/16), 32,
                          hMemDC, 0, 0, 32, 32, SRCCOPY );
        SelectObject( hMemDC, hTempBit );
        DeleteObject( hFuncBit );
    }
    nPrevPress = nFuncOffset;
}

if( nUpDown == WM_LBUTTONUP )
{
    if( nFuncOffset == nPrevPress )
    {
        hFuncBit = LoadBitmap( hInstMain, cNorm[nFuncOffset-1] );
    } else {
        hFuncBit = LoadBitmap( hInstMain, cNorm[nPrevPress-1] );
        nX = (nPrevPress-1)*(nWidth/16);
    }
    hTempBit = SelectObject( hMemDC, hFuncBit );

    nRc = StretchBlt( hDCFunc, nX, 0, (nWidth/16), 32,
                      hMemDC, 0, 0, 32, 32, SRCCOPY );
    SelectObject( hMemDC, hTempBit );
    DeleteObject( hFuncBit );
    /* someone just released the mouse button on the tool box */
    if( nPrevPress == nFuncOffset )
    {
        nPrevPress = 0;
        nRet = DeleteDC( hMemDC );
        return( nVirtKey[nFuncOffset-1] );
    } else {
        nPrevPress = 0;
    }
}

/* delete compatible device context */
nRet = DeleteDC( hMemDC );

return(0);
}
#include "global.h"

#include <time.h>
#include <conio.h>
#include <math.h>
#include <stdio.h>

#include "func_exp.h"
#include "dial_exp.h"
#include "forc_exp.h"
```

```
#include "real_exp.h"
#include "one_exp.h"
#include "main_exp.h"
#include "trig_exp.h"

/*********************************************************/
/* FISGetSet                                             */
/* Retrieves memory for next set of data points          */
/*********************************************************/
struct tShotSet * FISGetSet( void )
{
struct tShotSet * nTempPtr;
HANDLE nTempHand;

/* allocate some memory */
nTempHand = GlobalAlloc( GMEM_FIXED | GMEM_ZEROINIT,
                         sizeof(struct tShotSet) );
if( nTempHand != NULL )
{
    /* assign the pointer */
    nTempPtr = (struct tShotSet *)GlobalLock( nTempHand );
} else {
    nTempPtr = NULL;
}

/* return the pointer */
if( nTempPtr == NULL )
{
    /* out of memory stop the display */
    FISMessage( NULL, nRTTitle[nRTLanguage][86], nRTTitle[nRTLanguage][87],
                MB_TASKMODAL, MB_OK, MB_ICONEXCLAMATION );
    PostMessage( hWndSingle, WM_COMMAND, IDM_R_STOP, NULL );
}

/* set the next pointer properly */
nTempPtr->hSetHand = nTempHand;
nTempPtr->pNextSet = NULL;
nTempPtr->pNextGroup = NULL;
nTempPtr->nSamples = 0;

return( nTempPtr );
}


/*********************************************************/
/* FISFreeSet                                            */
/* Frees memory for entire list of data points           */
/*********************************************************/
void FISFreeSet( struct tShotSet * nTopSet )
{
HANDLE nTempHand;
struct tShotSet * nNextGroup;

if( nTopSet == NULL ) return;   /* initialization by calling routine */

nNextGroup = nTopSet;

while( nNextGroup != NULL )
{
    /* get the pointer to the next group before deleteing this one */
    nNextGroup = nNextGroup->pNextGroup;

    /* free by pointers until none are left */
    while( nTopSet != NULL )
    {
        /* get the memory handle */
        nTempHand = nTopSet->hSetHand;
        nTopSet = (void *)nTopSet->pNextSet;

        /* unlock and free the memory */
        GlobalUnlock( nTempHand );
        nTempHand = GlobalFree( nTempHand );
    }

    /* get the next set of pointers */
    nTopSet = nNextGroup;
```

```
}
return;
}

/*********************************************************/
/* FISPlotTemplate                                       */
/* displays trigger movement template                    */
/*********************************************************/
void FISPlotTemplate( HDC hDCFunc, RECT nDrawSize,
                      struct tRealData * nSaveData,
                      int nStart, int nDur )
{
HPEN hTempPen, hShotPen;
HDC hDCCompat;
unsigned int i, nLastSample;
float fShotDur, fPullDur, fStopTime, fRelDur;
float fShotOff;
RECT nRect;
unsigned char s[100];

/* check if any data is available */
if( nSaveData->nNum == 0 ) return;

/* create pen in the selected thickness */
hShotPen = CreatePen( PS_SOLID, 8, RGB( 100,100,100 ) );
hTempPen = SelectObject( hDCFunc, hShotPen );

/* check if templates are turned off */
if (nTemplateShot )
{
}

/* check if shot stats are turned off */
if ( nShotStats )
{
    /* find the last sample */
    nLastSample = nSaveData->nNum - 1;
    /* set the display text color and location */
    SetTextColor( hDCFunc, rBlack );
    nRect.top = nDrawSize.top;
    nRect.bottom = nDrawSize.top + 10;
    nRect.left = nDrawSize.right-150;
    nRect.right = nDrawSize.right;

    /* initialize the variable */
    fShotDur=fPullDur=fStopTime=fRelDur=fShotOff=0;
    /* get the shot offset */
    fShotOff = (float)nSaveData->nData[0].nTimeStamp
             / 1000.;
    /* get the shot duration */
    fShotDur = ((float)nSaveData->nData[nLastSample].nTimeStamp
             - (float)nSaveData->nData[0].nTimeStamp)
             / 1000.;
    /* find the shot threshold and reset point */
    for( i=0;i<=nLastSample;i++)
    {
        /* check for shot release */
        if( (nSaveData->nData[i].nSensors[nTrigSen] < nSenThresh[nTrigSen][0])
          &&(nSaveData->nData[i+1].nSensors[nTrigSen] >= nSenThresh[nTrigSen][0]
        {
            fPullDur = ((float)nSaveData->nData[i].nTimeStamp
                     - (float)nSaveData->nData[0].nTimeStamp)
                     / 1000.;
        }
        /* check for shot reset */
        if( (nSaveData->nData[i].nSensors[nTrigSen] > nSenThresh[nTrigSen][0])
          &&(nSaveData->nData[i+1].nSensors[nTrigSen] <= nSenThresh[nTrigSen][0]
        {
            fRelDur = ((float)nSaveData->nData[nLastSample].nTimeStamp
                     - (float)nSaveData->nData[i].nTimeStamp)
                     / 1000.;
            break;
        }
    }
```

```
  /* get the dead time */
  fStopTime = fShotDur - fPullDur - fRelDur;

  /* display the information */
  sprintf( s, "Shot Offset : %6.3f", fShotOff );
  DrawText( hDCFunc, s, -1, &nRect, DT_LEFT );
  nRect.top = nRect.bottom;
  nRect.bottom = nRect.top + 10;
  sprintf( s, "Shot Duration : %6.3f", fShotDur );
  DrawText( hDCFunc, s, -1, &nRect, DT_LEFT );
  nRect.top = nRect.bottom;
  nRect.bottom = nRect.top + 10;
  sprintf( s, "Pull Duration : %6.3f", fPullDur );
  DrawText( hDCFunc, s, -1, &nRect, DT_LEFT );
  nRect.top = nRect.bottom;
  nRect.bottom = nRect.top + 10;
  sprintf( s, "Tirgger Stop Time : %6.3f", fStopTime );
  DrawText( hDCFunc, s, -1, &nRect, DT_LEFT );
    nRect.top = nRect.bottom;
    nRect.bottom = nRect.top + 10;
    sprintf( s, "Release Duration : %6.3f", fRelDur );
    DrawText( hDCFunc, s, -1, &nRect, DT_LEFT );

}

/* return everything else to normal */
SelectObject( hDCFunc, hTempPen );
DeleteObject( hShotPen );

return;
}


/*********************************************************/
/* FISAskSave                                            */
/* function used to save the collected data              */
/*********************************************************/
unsigned int FISAskSave( HWND hWndFunc, HWND hInstFunc)
{
int nRc;

nRc = HandleDialog( hWndFunc, hInstFunc, ID_ASKSAVE,
                    (FARPROC)FISASKSAVEMsgProc, NULL );

if( nRc != IDCANCEL )
{
    /* then save the data */
    if( nRc == IDOK )
    {
        if( HandleDialog( hWndFunc, hInstFunc, ID_SAVEREST,
            (FARPROC)FISSAVERESTMsgProc, (DWORD)ID_LSAVE ) )
        {
            FISSaveData( nFilePath );
        } else {
            return( IDCANCEL );
        }
    }
}

return( nRc );
}


/*********************************************************/
/* FISDrawTrigger                                        */
/*                                                       */
/* function used to draw trigger timing information      */
/*********************************************************/
static unsigned char nPrevTrig=0;
static unsigned char nUpDown=true;
BOOL FISDrawTrigger( HDC hDCFunc, RECT nDrawSize )
{
unsigned long nTempHead;
unsigned int nX1;
unsigned char nTrigPos;
```

```
  /* determine the latest raw Samples */
  if( nADHead > 0 )
{
    nTempHead = nADHead - 1;
} else {
    nTempHead = dSampleSize;
}

/* get the raw samples */
nTrigPos = rawSamples[nTrigSen][nTempHead];

/* check if we are greater than the limit */
    /* check if we are going up or down */
    if( nUpDown )                /* going up */
    {
        if( nTrigPos >= nPrevTrig )              /* still going up */
        {
            nPrevTrig = nTrigPos;
        } else {
            nUpDown = false;             /* now going down */
            nPrevTrig = nTrigPos;
            nTrigStart+=5;
        }
    } else {             /* going down */
        if( nTrigPos <= nPrevTrig )              /* still going down */
        {
            nPrevTrig = nTrigPos;
        } else {                                 /* now going up */
            if( nTrigPos <= nSenThresh[0][1] )
            {
                nUpDown = true;
                nPrevTrig = nTrigPos;
                nTrigStart+=5;
            }
        }
    }
/* print the dot */
nX1 = (unsigned int)((float)nTrigPos * (float)(nDrawSize.right - nDrawSize.left)
                    / (float)nMaxValue);          /* high value */
SetPixel( hDCFunc, nX1, nTrigStart, RGB( 0,0,0 ) );

/* get for wrap around */
if( nTrigStart >= (unsigned int)(nDrawSize.bottom-10) )
{
    nTrigStart = nDrawSize.top + 5;
    FISClearWindow( hWndTrigger, hDCTrigger );
    FISDrawShotLines( hDCTrigger, nDrawSize );
}

return( TRUE );
}

/*********************************************************/
/* FISDrawShotLines                                      */
/*                                                       */
/* function used to draw trigger scale and limit info    */
/*********************************************************/
void FISDrawShotLines( HDC hDCFunc, RECT nDrawSize )
{
HPEN nTempPen;
unsigned int nX1, nX2;
HBITMAP hTempBit, hSetBit;
HDC hDCCompat;
BOOL nRet;

/* draw a line at the shot detect and the shot start */
nTempPen = SelectObject( hDCFunc, hPenBlack );

/* determine screen co-ordinates */
nX1 = (unsigned int)((float)nSenThresh[0][0] * (float)(nDrawSize.right - nDrawSi
                  / (float)nMaxValue);          /* high value */
nX2 = (unsigned int)((float)nSenThresh[0][1] * (float)(nDrawSize.right - nDrawSi
                  / (float)nMaxValue);          /* high value */
/* draw the lines */
MoveTo( hDCFunc, nX1, nDrawSize.top );
```

```
LineTo( hDCFunc, nX1, nDrawSize.bottom );
MoveTo( hDCFunc, nX2, nDrawSize.top );
LineTo( hDCFunc, nX2, nDrawSize.bottom );

/* draw the start sign */
/* create a memory device context */
hDCCompat = CreateCompatibleDC( hDCFunc );
/* load the bitmap into the DC */
hSetBit = LoadBitmap( hInstMain, "START_SIGN" );
hTempBit = SelectObject( hDCCompat, hSetBit );
/* copy the bitmap */
nRet = BitBlt( hDCFunc, nX2-20, nDrawSize.top, 20, 20,
            hDCCompat, 0,0, SRCCOPY );
/* remove traces of memory device context */
SelectObject( hDCCompat, hTempBit );
DeleteObject( hSetBit );
DeleteDC( hDCCompat );

return;
}


/*****************************************************************/
/* FISDrawForce                                                  */
/*                                                               */
/* function used to draw grip force values on gauge              */
/* three guages on the diagram (320x240)                         */
/* (20,100)-(40,200), (60,100)-(80,200) and (100,100)-(120,200) */
/*****************************************************************/
void FISDrawForce( HDC hDCFunc, RECT nDrawSize )
{
unsigned int X1, X2, Y1, Y2, nWide, nHigh;
unsigned int nFrontPos, nSidePos, nPrevPos, nLowPos, nHighPos;
unsigned int nLSideGrip, nRSideGrip, nFrontGrip;
HPEN nTempPen;
HBRUSH nTempBrush;
unsigned int nTempHead;
RECT nDispRect;
unsigned char s[10];

/* determine the latest raw Samples */
if( nADHead > 0 )
{
    nTempHead = nADHead - 1;
} else {
    nTempHead = dSampleSize;
}
/* get the raw samples */
nFrontGrip = (unsigned int)rawSamples[nFrontSen][nTempHead];
nLSideGrip = (unsigned int)rawSamples[nLSideSen][nTempHead];
nRSideGrip = (unsigned int)rawSamples[nRSideSen][nTempHead];

/* plot the FRONT GRIP FORCE first */
/* get the rectangle co-ordinates */
nWide = nDrawSize.right - nDrawSize.left;
nHigh = nDrawSize.bottom - nDrawSize.top;

X1 = (unsigned int)((float)nWide / 320. * 60.);
Y1 = (unsigned int)((float)nHigh / 240. * 100.);
X2 = (unsigned int)((float)nWide / 320. * 80.);
Y2 = (unsigned int)((float)nHigh / 240. * 200.);

/* determine the screen co-ordinates */
nFrontPos = Y2 - ((Y2-Y1) * nFrontGrip / nMaxValue);
nPrevPos = Y2 - ((Y2-Y1) * nPrevFront / nMaxValue);
nHighPos = Y2 - ((Y2-Y1) * nSenThresh[nFrontSen][1] / nMaxValue);
nLowPos = Y2 - ((Y2-Y1) * nSenThresh[nFrontSen][0] / nMaxValue);

nTempPen = SelectObject( hDCFunc, hPenWhite );
nTempBrush = SelectObject( hDCFunc, hBrushWhite );

/* erase if graph has decreased */
if( nFrontGrip < nPrevFront )
{
    Rectangle( hDCFunc, X1, nPrevPos, X2, nFrontPos );
}
```

```
/* get ready to plot the point */
SelectObject( hDCFunc, hBrushYellow );
if( nFrontGrip < nSenThresh[nFrontSen][0] )
{
    Rectangle( hDCFunc, X1, nFrontPos, X2, Y2 );
} else {
    if( nFrontGrip > nSenThresh[nFrontSen][1] )
    {
        Rectangle( hDCFunc, X1, nLowPos, X2, Y2 );
        SelectObject( hDCFunc, hBrushGreen );
        Rectangle( hDCFunc, X1, nHighPos, X2, nLowPos );
        SelectObject( hDCFunc, hBrushRed );
        Rectangle( hDCFunc, X1, nFrontPos, X2, nHighPos );
    } else {
        Rectangle( hDCFunc, X1, nLowPos, X2, Y2 );
        SelectObject( hDCFunc, hBrushGreen );
        Rectangle( hDCFunc, X1, nFrontPos, X2, nLowPos );
    }
}

/* now do the Left SIDE GRIP FORCE */
/* get the rectangle co-ordinates */
X1 = (unsigned int)((float)nWide / 320. * 20.);
Y1 = (unsigned int)((float)nHigh / 240. * 100.);
X2 = (unsigned int)((float)nWide / 320. * 40.);
Y2 = (unsigned int)((float)nHigh / 240. * 200.);

/* erase the previous line */
nSidePos = Y2 - ((Y2-Y1) * nLSideGrip / nMaxValue);
nPrevPos = Y2 - ((Y2-Y1) * nPrevLSide / nMaxValue);
nHighPos = Y2 - ((Y2-Y1) * nSenThresh[nLSideSen][1] / nMaxValue);
nLowPos = Y2 - ((Y2-Y1) * nSenThresh[nLSideSen][0] / nMaxValue);

SelectObject( hDCFunc, hBrushWhite );
/* erase if graph has decreased */
if( nLSideGrip < nPrevLSide )
{
    Rectangle( hDCFunc, X1, nPrevPos, X2, nSidePos );
}

/* draw the side grip force line */
SelectObject( hDCFunc, hBrushYellow );
if( nLSideGrip < nSenThresh[nLSideSen][0] )
{
    Rectangle( hDCFunc, X1, nSidePos, X2, Y2 );
} else {
    if( nLSideGrip > nSenThresh[nLSideSen][1] )
    {
        Rectangle( hDCFunc, X1, nLowPos, X2, Y2 );
        SelectObject( hDCFunc, hBrushGreen );
        Rectangle( hDCFunc, X1, nHighPos, X2, nLowPos );
        SelectObject( hDCFunc, hBrushRed );
        Rectangle( hDCFunc, X1, nSidePos, X2, nHighPos );
    } else {
        Rectangle( hDCFunc, X1, nLowPos, X2, Y2 );
        SelectObject( hDCFunc, hBrushGreen );
        Rectangle( hDCFunc, X1, nSidePos, X2, nLowPos );
    }
}

/* now do the Right SIDE GRIP FORCE */
/* get the rectangle co-ordinates */
X1 = (unsigned int)((float)nWide / 320. * 100.);
Y1 = (unsigned int)((float)nHigh / 240. * 100.);
X2 = (unsigned int)((float)nWide / 320. * 120.);
Y2 = (unsigned int)((float)nHigh / 240. * 200.);

/* erase the previous line */
nSidePos = Y2 - ((Y2-Y1) * nRSideGrip / nMaxValue);
nPrevPos = Y2 - ((Y2-Y1) * nPrevRSide / nMaxValue);
nHighPos = Y2 - ((Y2-Y1) * nSenThresh[nRSideSen][1] / nMaxValue);
nLowPos = Y2 - ((Y2-Y1) * nSenThresh[nRSideSen][0] / nMaxValue);

SelectObject( hDCFunc, hBrushWhite );
```

```
/* erase if graph has decreased */
if( nRSideGrip < nPrevRSide )
{
    Rectangle( hDCFunc, X1, nPrevPos, X2, nSidePos );
}

/* draw the side grip force line */
SelectObject( hDCFunc, hBrushYellow );
if( nRSideGrip < nSenThresh[nRSideSen][0] )
{
    Rectangle( hDCFunc, X1, nSidePos, X2, Y2 );
} else {
    if( nRSideGrip > nSenThresh[nRSideSen][1] )
    {
        Rectangle( hDCFunc, X1, nLowPos, X2, Y2 );
        SelectObject( hDCFunc, hBrushGreen );
        Rectangle( hDCFunc, X1, nHighPos, X2, nLowPos );
        SelectObject( hDCFunc, hBrushRed );
        Rectangle( hDCFunc, X1, nSidePos, X2, nHighPos );
    } else {
        Rectangle( hDCFunc, X1, nLowPos, X2, Y2 );
        SelectObject( hDCFunc, hBrushGreen );
        Rectangle( hDCFunc, X1, nSidePos, X2, nLowPos );
    }
}
/* return the system to normal */
SelectObject( hDCFunc, nTempPen );
SelectObject( hDCFunc, nTempBrush );

/* save the previous positions */
nPrevFront = nFrontGrip;
nPrevLSide = nLSideGrip;
nPrevRSide = nRSideGrip;

return;
}


/*********************************************************/
/* FISDrawGauge                                          */
/*                                                       */
/* function used to set up grip force gauges after a paint*/
/*********************************************************/
void FISDrawGauge( HWND hWndFunc, HDC hDCFunc, HWND hInstFunc )
{
HBITMAP hTempBit, hSetBit;
HDC hDCCompat;
RECT nTempRect;

/* get the current window rectangle */
GetClientRect( hWndFunc, &nTempRect );

/* create a memory device context */
hDCCompat = CreateCompatibleDC( hDCFunc );

/* load the bitmap into the DC */
switch ( dGunType )
{
    case dGunSig:
        hSetBit = LoadBitmap( hInstFunc, "GUN_SIG" );
        break;

    case dGunSW10:
        hSetBit = LoadBitmap( hInstFunc, "GUN_SW10" );
        break;

    case dGunGlock:
        hSetBit = LoadBitmap( hInstFunc, "GUN_GLOCK" );
        break;

    case dGunBHI:
        hSetBit = LoadBitmap( hInstFunc, "GUN_BHI" );
        break;
}
hTempBit = SelectObject( hDCCompat, hSetBit );
```

```
/* copy the bitmap */
StretchBlt( hDCFunc, nTempRect.left, nTempRect.top,
            (nTempRect.right-nTempRect.left),
            (nTempRect.bottom-nTempRect.top),
            hDCCompat, 0,0, 320, 240, SRCCOPY );

/* remove traces of memory device context */
SelectObject( hDCCompat, hTempBit );
DeleteObject( hSetBit );
DeleteDC( hDCCompat );

return;
}


/*************************************************************/
/* FISCollectSerial                                          */
/*                                                           */
/* collection routine to service serial port for AD data     */
/*************************************************************/
BOOL FAR PASCAL FISCollectSerial(HWND hWndDlg, WORD Message, WORD wParam, LONG l
{
int nSize, nPos, CommErr;
unsigned char nChars[1000], nGunID;
COMSTAT CommStat;

/* get all of the available characters */
nSize = ReadComm( nFISComm, &nChars[nSerialPos], (1000-nSerialPos) );
if( nSize <= 0 )
{
    CommErr = GetCommError( nFISComm, &CommStat );
    FlushComm( nFISComm, 1 );
    nOneSync++;
    return(FALSE);
}

if ( (nSize+nSerialPos) < 7 )
{
    nSerialPos += nSize;
    return(FALSE);
}

/* update the number of available characters */
nSize+=nSerialPos;

nPos = 0;
while( nPos < (nSize-7) )
{
    /* find the first sync character */
    if( nChars[nPos++] != '#' ) continue;

    /* get the second sync character */
    if( nChars[nPos++] != '-' ) continue;       /* look again for sync character

    /* get the next three characters trigger, front, side*/
    /* invert 0 */
    if( nInvertY[nTrigSen] )
    {
        rawSamples[nTrigSen][nADHead] = (unsigned char)0xff - nChars[nPos++];
    } else {
        rawSamples[nTrigSen][nADHead] = nChars[nPos++];
    }

    /* invert 1 */
    if( nInvertY[nFrontSen] )
    {
        rawSamples[nFrontSen][nADHead] = (unsigned char)0xff - nChars[nPos++];
    } else {
        rawSamples[nFrontSen][nADHead] = nChars[nPos++];
    }

    /* invert 2 */
    if( nInvertY[nLSideSen] )
    {
```

```
        rawSamples[nLSideSen][nADHead] = (unsigned char)0xff - nChars[nPos++];
    } else {
        rawSamples[nLSideSen][nADHead] = nChars[nPos++];
    }

    /* invert 3 */
    if( nInvertY[nRSideSen] )
    {
        rawSamples[nRSideSen][nADHead] = (unsigned char)0xff - nChars[nPos++];
    } else {
        rawSamples[nRSideSen][nADHead] = nChars[nPos++];
    }

    rawTime[nADHead] = nSerTime+=nSerialDelta;
    nADHead = (nADHead+1)%dSampleSize;
}
memcpy( nChars, &nChars[nPos], (nSize-nPos) );
nSerialPos = nSize-nPos;


return(TRUE);
}


/*********************************************************/
/* FISSetupComm                                          */
/*                                                       */
/* routine to initialize the comm port                   */
/*********************************************************/
BOOL FISSetupComm( void )
{
int nRc;        /* return code */
DCB lDCB;

/* open the communication port */
nFISComm = OpenComm( "COM1", 1000, 1000 );
if( nFISComm < 0 ) return (false);

/* get the current state of the comm port */
nRc = GetCommState( nFISComm, &lDCB );
if( nRc < 0 ) return (false);

/* adjust the DCB stucture */
lDCB.BaudRate = 9600;
lDCB.ByteSize = 8;
lDCB.Parity = NOPARITY;
lDCB.StopBits = ONESTOPBIT;
lDCB.fParity = 0;
lDCB.fInX = 0;
lDCB.fOutX = 0;

/* set the state of the communication port */
nRc = SetCommState( &lDCB );
if( nRc < 0 ) return (false);

/* write a character to the comm port to start the data collection */
nRc = FlushComm( nFISComm, 0 );         /* transmit queue */
nRc = FlushComm( nFISComm, 1 );         /* receive queue */

return(true);
}


/*******************************************************************/
/* FISPlotSingle                                                   */
/*                                                                 */
/* plot data points present in global data area, realtime !!       */
/*******************************************************************/
unsigned long FISPlotSingle( HDC hDCFunc, RECT nDrawSize, int nStart, int nDur)
{
unsigned int i, j;
unsigned int nTempAD, nTempScale;
unsigned int nPlotStart, nPlotDur;
unsigned int nPixWidth, nPixHieght;
unsigned int nShotValue;
```

```
unsigned long nSample, rawStart;
RECT nTempRect;
HPEN nGrayPen, nTempPen;

/* check if there is data to plot */
if( nOneTail == nADHead ) return (0);
if( ((nOneTail+1)%dSampleSize) == nADHead ) return (0);
if( ((nOneTail+2)%dSampleSize) == nADHead ) return (0);

/* get the last point to plot */
if( nADHead == 0 )
{       nTempAD = 999;          }
else {  nTempAD = nADHead - 1;  }

/* determine the width of the screen in pixels */
nPixWidth = nDrawSize.right - nDrawSize.left;
nPixHieght = nDrawSize.bottom - nDrawSize.top;

/* get the start time in raw units */
rawStart = (unsigned long)nStart * 1000;

/* determine the time duration of this plot in pixels */
nPlotDur = (unsigned int) (nPixWidth
         * (rawTime[nTempAD] - rawTime[nOneTail])
         / nDur / 1000);

/* determine where in time the plot starts */
nPlotStart = (unsigned int) ( (unsigned long)nPixWidth
           * (rawTime[nOneTail] - rawStart)

           / nDur / 1000);
if( (nPlotStart > nPixWidth) || (nPixWidth < (unsigned int)nDrawSize.left) )
{
    nPlotStart = nDrawSize.left;
}

/* clear the area before we plot into it */
nTempRect.top = nDrawSize.top;
nTempRect.bottom = nDrawSize.bottom-1;
nTempRect.left = nDrawSize.left + nPlotStart;
nTempRect.right = nDrawSize.left + nPlotStart + nPlotDur + 40;
FISClearArea( hDCFunc, nTempRect );


for (j=0;j<nNumSensors;j++)
{
    if ( cCollect[j] )
    {
        sSamples[j][0] = nDrawSize.left + nPlotStart;

        nSample = (unsigned long)rawSamples[j][nOneTail];
        sSamples[j][1] = nDrawSize.bottom -
          (unsigned int)(nSample * nPixHieght / nMaxValue);
        nShotValue = (unsigned int)nSample;

        SelectObject( hDCFunc, pSensor[j][0] );
        MoveTo( hDCFunc, sSamples[j][0], sSamples[j][1] );

        for ( i=((nOneTail+1)%dSampleSize);i!=nADHead;i=((i+1)%dSampleSize) )
        {
            /* determine the x-offset */
            sSamples[j][2] = nDrawSize.left
                           + (unsigned int) (nPixWidth
                           * (rawTime[i] - rawStart)
                           / nDur / 1000);

            /* determine the Y offset */
            nSample = (unsigned long)rawSamples[j][i];
            sSamples[j][3] = nDrawSize.bottom -
                   (unsigned int)(nSample * nPixHieght / nMaxValue);

            /* check if shot was fired */
            if( ((nShotValue) < nSenThresh[nTrigSen][0]) &&
                ((nSample) >= nSenThresh[nTrigSen][0]) &&
                (j == nTrigSen) )
            {
```

```
            FISMessage( NULL, "RTShot", NULL, NULL, NULL, NULL );
            nOneShots++;
        }

        /* plot the resulting value */
        LineTo( hDCFunc, sSamples[j][2], sSamples[j][3] );

        nShotValue = (unsigned int)nSample;
        /* move to the next point */
        sSamples[j][0] = sSamples[j][2];
        sSamples[j][1] = sSamples[j][3];

    }
}
}

/* save the data in the collection arrays */
for ( i=((nOneTail)%dSampleSize);i!=nADHead;i=((i+1)%dSampleSize) )
{
    nCurSet->sShots[nCurOffSet%dSetSize].nTimeStamp = rawTime[i];
    nGroupSet->nSamples++;
    for( j=0;j<nNumSensors;j++ )
    {
        nCurSet->sShots[nCurOffSet%dSetSize].nSensors[j] = rawSamples[j][i];
    }

    /* update the data pointer */
    nCurOffSet++;

    if( (nCurOffSet%dSetSize) == 0 )
    {
        /* get the next set */
        nCurSet->pNextSet = FISGetSet();
        /* save the previous pointer */
        nCurSet->pNextSet->pPrevSet = nCurSet;
        /* reposition the pointer */
        nCurSet = nCurSet->pNextSet;
    }
}

/* update the pointers */
nOnePoints+=(nTempAD+dSampleSize-nOneTail)%dSampleSize;
nOneTail = nTempAD;

/* check if plot is about to wrap */
if ( (rawTime[nTempAD]/1000) >= (unsigned long)(nOneStart+nOneDur) )
{
    /* clear the beginning area of the plot */
    nTempRect.top = nDrawSize.top;
    nTempRect.bottom = nDrawSize.bottom-1;
    nTempRect.left = nDrawSize.left;
    nTempRect.right = nDrawSize.left +
                    ((nDrawSize.right-nDrawSize.left)/(nDur*10));
    FISClearArea( hDCFunc, nTempRect );

    /* redraw the axes */
    nOneStart+= nDur;
    nStart+=nDur;
    FISDrawAxes( hDCFunc, nStart, nDur, nDrawSize );
}


return(0);
}


/*********************************************************************/
/* FISPlotData                                                       */
/*                                                                   */
/* plot data on screen after portion of screen has been cleared      */
/*   - uses stored data from nCurData area                           */
/*********************************************************************/
void FISPlotData( HDC hDCFunc, RECT nDrawSize, int nStart, int nDur,
                  int nStartOff, int nLength )
```

```
{
struct tShotSet * nTempSet;
struct tShotSet * nStartSet;
unsigned int j;
unsigned long nTempAD;
unsigned long nStartAD;
unsigned long nPixWidth, nPixHieght;
unsigned int nShotValue;
unsigned long rawStart, nSamTime;
unsigned char nSample;
unsigned int dSamples[nNumSensors][4];
HPEN nGrayPen, nTempPen;

/* check if there is data to plot */
if( nGroupSet == NULL ) return;          /* no data area */
if( nCurOffSet == 0 ) return;            /* no data */
if( nStartOff > nDur ) return;           /* invalid operands */

/* get the start time in raw units */
rawStart = (unsigned long)(nStart) * 1000;

/* find the start of the data in the stored area */
nStartSet = nGroupSet;
nStartAD = 0;
while ( nStartSet != NULL )
{
    if( nStartSet->sShots[(nStartAD%dSetSize)].nTimeStamp >=
        ((unsigned long)(nStart+nStartOff)*1000) )
    {
        break;
    }
    /* check the next one */
    nStartAD++;
    if( nStartAD > nCurOffSet ) return;          /* start out of range */
    if( (nStartAD%dSetSize) == 0 )
    {
        /* time to move to next location */
        nStartSet = nStartSet->pNextSet;
    }
}

/* determine the width of the screen in pixels */
nPixWidth = nDrawSize.right - nDrawSize.left;
nPixHieght = nDrawSize.bottom - nDrawSize.top;

for (j=0;j<nNumSensors;j++)
{
    /* initialize the temp pointers */
    nTempAD = nStartAD;
    nTempSet = nStartSet;

    /* plot all of the sensors */
    if ( cCollect[j] )
    {
        nSample = nTempSet->sShots[(nTempAD%dSetSize)].nSensors[j];
        nSamTime = nTempSet->sShots[(nTempAD%dSetSize)].nTimeStamp;

        dSamples[j][0] = nDrawSize.left
                       + (unsigned int) (nPixWidth
                       * (nSamTime - rawStart) / nDur / 1000);
dSamples[j][1] = nDrawSize.bottom -
   (unsigned int)(nSample * nPixHieght / nMaxValue);

SelectObject( hDCFunc, pSensor[j][0] );
MoveTo( hDCFunc, dSamples[j][0], dSamples[j][1] );

/* plot the sensor data, plot 50 ms extra to smooth graph */
while( nSamTime < ((unsigned long)(nStart+nStartOff+nLength)*1000)+50 )
{
    nSample = nTempSet->sShots[(nTempAD%dSetSize)].nSensors[j];
    nSamTime = nTempSet->sShots[(nTempAD%dSetSize)].nTimeStamp;

    /* check if value is invalid */
    if( nSample != 0 )
    {
```

```
                /* determine the x-offset */
                dSamples[j][2] = nDrawSize.left
                            + (unsigned int) (nPixWidth
                            * (nSamTime - rawStart)
                            / nDur / 1000);

                /* determine the Y offset */
                dSamples[j][3] = nDrawSize.bottom -
                   (unsigned int)(nSample * nPixHieght / nMaxValue);
                /* plot the resulting value */
                LineTo( hDCFunc, dSamples[j][2], dSamples[j][3] );

                /* move to the next point */
                dSamples[j][0] = dSamples[j][2];
                dSamples[j][1] = dSamples[j][3];
            }

            nTempAD++;
            if( nTempAD > nCurOffSet ) break;
            if( (nTempAD%dSetSize) == 0 )
            {
                nTempSet = nTempSet->pNextSet;
                if( nTempSet == NULL ) break;
            }
        }
    }
}
/* draw the threshold lines */
FISSetThreshold( hDCFunc, nDrawSize, true );
return;
}

#include "global.h"
#include "rtmain.h"

int PASCAL WinMain(HANDLE hInstance, HANDLE hPrevInstance, LPSTR lpszCmdLine, in
{
 /*********************************************************************/
 /* HANDLE hInstance;       handle for this instance                  */
 /* HANDLE hPrevInstance;   handle for possible previous instances    */
 /* LPSTR  lpszCmdLine;     long pointer to exec command line         */
 /* int    nCmdShow;        Show code for main window display         */
 /*********************************************************************/

 MSG        msg;            /* MSG structure to store your messages      */
 int        nRc;            /* return value from Register Classes        */
 HMENU      hSysMenu;

 strcpy(szAppName, "RTMAIN");
 hInstMain = hInstance;
 if(!hPrevInstance)
   {
    /* register window classes if first instance of application        */
    if ((nRc = nCwRegMainClass()) == -1)
      {
       /* registering one of the windows failed                        */
       LoadString(hInstMain, IDS_ERR_REGISTER_CLASS, szString, sizeof(szString))
       FISMessage(NULL, szString, NULL, MB_ICONEXCLAMATION, MB_OK, NULL );
       return nRc;
      }
   }


 /* create application's Main window                                  */
 hWndMain = CreateWindow(
                szAppName,              /* Window class name           */
                "Range Tutor", /* Window's title       */
                WS_CLIPCHILDREN |        /* don't draw in child windows areas *
                WS_OVERLAPPED |
                WS_SYSMENU,
                CW_USEDEFAULT, 0,       /* Use default X, Y            */
                CW_USEDEFAULT, 0,       /* Use default X, Y            */
                NULL,                   /* Parent window's handle      */
                NULL,                   /* Default to Class Menu       */
                hInstMain,                  /* Instance of window          */
                NULL);                  /* Create struct for WM_CREATE */
```

```
if(hWndMain == NULL)
  {
   LoadString(hInstMain, IDS_ERR_CREATE_WINDOW, szString, sizeof(szString));
   FISMessage(NULL, szString, NULL, MB_ICONEXCLAMATION, MB_OK, NULL);
   return IDS_ERR_CREATE_WINDOW;
  }

ShowWindow(hWndMain, SW_SHOWMAXIMIZED);    /* display main window      */

hAccel = LoadAccelerators(hInstMain, szAppName);

/* set up timer to call FISCollectSerial */
if( !FISSetupComm() )
{
    /* setup failed try clearing comm and trying again */
    CloseComm( nFISComm );
    if( !FISSetupComm() )
    {
        FISMessage( NULL, "Unable to Setup Data Collection (COMM PORT)",
                    "Range-Tutur - Error", MB_ICONHAND, MB_OK, MB_TASKMODAL );
    }
}

lpSerialFunc = MakeProcInstance((FARPROC)FISCollectSerial, hInstMain);
nSerialTimer = SetTimer( NULL, n10mil, n10milTicks, lpSerialFunc );

/* check if data collection setup failed */
if( nSerialTimer == 0 )
{
    FISMessage( NULL,
                "Unable to Setup Data Collection (TIMER)",
                "Range-Tutor - Error", MB_ICONHAND, MB_OK, MB_TASKMODAL );
}

/* get the configuration information */
FISRestoreConf( nFilePath, true );

/* change the system menu */
hSysMenu = GetSystemMenu( hWndMain, FALSE );
DeleteMenu( hSysMenu, SC_MINIMIZE, MF_BYCOMMAND );
DeleteMenu( hSysMenu, SC_MAXIMIZE, MF_BYCOMMAND );
DeleteMenu( hSysMenu, SC_RESTORE, MF_BYCOMMAND );
DeleteMenu( hSysMenu, SC_CLOSE, MF_BYCOMMAND );
DeleteMenu( hSysMenu, SC_MOVE, MF_BYCOMMAND );
DeleteMenu( hSysMenu, SC_SIZE, MF_BYCOMMAND );
InsertMenu( hSysMenu, 0, MF_BYPOSITION | MF_STRING, IDM_PRINTSETUP, "Print Setup
InsertMenu( hSysMenu, 0, MF_BYPOSITION | MF_STRING, IDM_SYS_COLOR, "Change Colou
InsertMenu( hSysMenu, 3, MF_BYPOSITION | MF_STRING, IDM_SYS_ABOUT, "About Range-


while(true)
{
    if((nRc = PeekMessage(&msg, NULL, 0, 0, PM_REMOVE)) != 0)        /* Until WM
    {
        if( msg.message == WM_QUIT )
        {
            break;
        } else {
            if( CheckAccelerators( msg ) ) continue;

            /* if there was no hot key translate normally */
            TranslateMessage(&msg);
            DispatchMessage(&msg);
        }
    }
}

/* clean up the serial port */
CloseComm( nFISComm );
KillTimer( NULL, nSerialTimer );
FreeProcInstance(lpSerialFunc);

/* Do clean up before exiting from the application*/
CwUnRegisterClasses();
```

```
return msg.wParam;
}

/*************************************************************************/
/*                                                                       */
/* Main Window Procedure                                                 */
/*                                                                       */
/* This procedure provides service routines for the Windows events      */
/* (messages) that Windows sends to the window, as well as the user     */
/* initiated events (messages) that are generated when the user selects */
/* the action bar and pulldown menu controls or the corresponding       */
/* keyboard accelerators.                                                */
/*                                                                       */
/*************************************************************************/

LONG FAR PASCAL FISMAINWndProc(HWND hWnd, WORD Message, WORD wParam, LONG lParam
{
 HMENU      hMenu=0;            /* handle for the menu                 */
 HDC            hDCPaint;
 HBITMAP    hBitmap=0;          /* handle for bitmaps                  */
 PAINTSTRUCT ps;                /* holds PAINT information             */
 int        nRc=0;              /* return code                         */

#if _MSC_VER == 700
 PRINTDLG pd;
 CHOOSECOLOR cc;
 COLORREF clr;
 COLORREF aclrCust[16];
#endif

 switch (Message)
   {
    case WM_SYSCOMMAND:
        switch( wParam & 0xfff0 )
        {
            case IDM_PRINTSETUP:
#if _MSC_VER == 700
                memset( &pd, 0, sizeof(PRINTDLG) );
                pd.lStructSize = sizeof(PRINTDLG);
                pd.hwndOwner = NULL;
                pd.Flags = PD_PRINTSETUP;
                PrintDlg(&pd);
#endif
                break;

            case IDM_SYS_ABOUT:
                if( HandleAbout( hWnd, hInstMain, ID_ABOUT ) == IDM_HELP )
                {
                    HandleHelp( hWndMain, 1 );
                }
                break;

            case IDM_SYS_COLOR:
#if _MSC_VER == 700
                /* set the custon colors to white */
                for( nRc=0;nRc<16;nRc++ )
                {
                    aclrCust[nRc] = RGB(16*nRc,16*nRc,16*nRc);
                }
                /* initialize clr to black */
                clr = RGB(0,0,0);
                /* clear the choose color structure */
                memset( &cc, 0, sizeof(CHOOSECOLOR) );
                /* initialize the structure */
                cc.lStructSize = sizeof(CHOOSECOLOR);
                cc.hwndOwner = hWnd;
                cc.hInstance = NULL;
                cc.rgbResult = clr;
                cc.lpCustColors = aclrCust;
                cc.Flags = CC_FULLOPEN;
                cc.lCustData = 0L;
                cc.lpfnHook = (FARPROC)NULL;
                cc.lpTemplateName = (LPSTR)NULL;
                ChooseColor(&cc);
#endif
                break;
```

```
        case SC_RESTORE:
            break;

        default:
            return DefWindowProc(hWnd, Message, wParam, lParam);
    }
    break;


case WM_COMMAND:
     switch (wParam)
       {
        case IDM_O_LOGIN:
            if( !FISLogged )
            {
                /* check if logins are enabled */
                if( nLogEnable )
                {
                    if( (nRc = HandleDialog( hWnd, hInstMain, ID_LOGIN,
                            (FARPROC)FISLOGINMsgProc, NULL )) == IDOK )
                    {
                        FISMessage( NULL, "RTHello", NULL, NULL, NULL, NULL
                        HandleLogIn();
                        /* display the welcome message */
                        HandleDialog( hWnd, hInstMain, ID_WELCOME, (FARPROC)
                        FISChangeMenu();
                    } else {
                        if( nRc == IDNO ) PostMessage( hWndMain, WM_COMMAND,
                        if( nRc == IDCANCEL ) PostMessage( hWndMain, WM_COMM
                    }
                } else {
                    FISMessage( NULL, "RTHello", NULL, NULL, NULL, NULL );
                    HandleLogIn();
                    /* display the welcome message */
                    HandleDialog( hWnd, hInstMain, ID_WELCOME, (FARPROC)FISW
                    FISChangeMenu();
                }
            } else {
                /* check if data is saved */
                if( !nPlotSaved )
                {
                    if( FISAskSave( hWnd, hInstSingle ) == IDCANCEL ) break;
                }
                /* clear any saved data */
                FISFreeSet( nCurData );
                nCurData = NULL;
                nGroupSet = NULL;
                nCurSet = NULL;
                /* reset the plot saved flag */
                nPlotSaved = true;
                /* log out user */
                HandleLogOut();
                /* close all of the child windows */
                if( IsWindow( hWndReal ) ) PostMessage( hWndReal, WM_CLOSE,
                if( IsWindow( hWndSingle ) ) PostMessage( hWndSingle, WM_CLO
                if( IsWindow( hWndTrigger ) ) PostMessage( hWndTrigger, WM_C
                if( IsWindow( hWndForce ) ) PostMessage( hWndForce, WM_CLOSE
                if( IsWindow( hWndToolBox ) ) PostMessage( hWndToolBox, WM_C
                if( IsWindow( hWndLegend ) ) DestroyWindow( hWndLegend );

                FISMessage( NULL, "RTBye", NULL, NULL, NULL, NULL );
                InvalidateRect( hWnd, NULL, true );
                if( nLogEnable )
                {
                    /* bring up the login box again if logins are enabled */
                    PostMessage( hWndMain, WM_COMMAND, IDM_O_LOGIN, NULL );
                }
            }
            FISDrawInstruct( hWnd, hDCMain );
            break;

        case IDM_O_REALTIME:
            if( !IsWindow( hWndReal ) )
            {
```

```
            nRc = CreateRealTime( hInstMain, hWndMain );
            CreateToolBox( hInstMain, hWndMain );
            FISShowChildren();
        }
        break;

    case IDM_O_ONESHOT:
        if( !IsWindow( hWndSingle ) )
        {
            /* zero the current course and stage */
            memset( &nCurCourse, 0, sizeof( struct tCourse) );
            memset( &nCurStage, 0, sizeof( struct tStage) );
            /* run the window */
            nRc = CreateOneShot( hInstMain, hWndMain );
            CreateToolBox( hInstMain, hWndMain );
            FISShowChildren();
        }
        break;

    case IDM_S_TRIGGER:
        if( !IsWindow( hWndTrigger ) )
        {
            nRc = CreateTrigger( hInstMain, hWndMain );
            CreateToolBox( hInstMain, hWndMain );
            FISShowChildren();
        }
        break;

    case IDM_S_GRIPFORCE:
        if( !IsWindow( hWndForce ) )
        {
            nRc = CreateForce( hInstMain, hWndMain );
            CreateToolBox( hInstMain, hWndMain );
            FISShowChildren();
        }
        break;

    case IDM_R_LEGEND:
        if( !IsWindow( hWndLegend ) )
        {
            CreateLegend( hInstMain, hWndMain );
            FISShowChildren();
        } else {
            PostMessage( hWndLegend, WM_CLOSE, NULL, NULL );
        }
        break;

    case IDM_O_INSTRUCT:
        /* zero the current course and stage */
        memset( &nCurCourse, 0, sizeof( struct tCourse) );
        memset( &nCurStage, 0, sizeof( struct tStage) );
        /* show the available stages */
        if( HandleDialog( hWnd, hInstMain, ID_INSTRUCT,
                    (FARPROC)FISINSTStageMsgProc, NULL ) )
        {
            /* user has requested a stage to be activated */
            nRc = CreateOneShot( hInstMain, hWndMain );
            FISShowChildren();
        }
        break;

    case IDM_PRINT:
        HandlePrintWindow( hDCMain, hWndMain, 0 );
        break;

    case IDM_O_SEQUENCE:
        /* zero the current course and stage */
        memset( &nCurCourse, 0, sizeof( struct tCourse) );
        memset( &nCurStage, 0, sizeof( struct tStage) );
        /* show the available courses */
        if( HandleDialog( hWnd, hInstMain, ID_SEQUENCE,
                    (FARPROC)FISINSTCourseMsgProc, NULL ) )
        {
            /* user has requested a course to be activated */
            nRc = CreateOneShot( hInstMain, hWndMain );
            FISShowChildren();
```

```
            }
            break;

        case IDM_O_ADVANCED:
            if( HandleDialog( hWnd, hInstMain, ID_ADVANCED,
                              (FARPROC)FISSYSADVANCEMsgProc, (DWORD)ID_ADVANC
            {
                /* if data was changed - ask for save */
                if( HandleDialog( hWnd, hInstMain, ID_SAVECONF,
                                  (FARPROC)FISSAVECONFMsgProc, (DWORD)ID_LSA
                {
                    FISSaveConf( nFilePath, false, false );
                }
                PostMessage( hWnd, WM_COMMAND, IDM_H_REPAINT, NULL );
            }
            break;

        case IDM_O_STUDENT:
            HandleDialog( hWnd, hInstMain, ID_STUDENT,
                          (FARPROC)FISSTUDENTINFOMsgProc, NULL );
            PostMessage( hWndMain, WM_COMMAND, IDM_H_REPAINT, NULL );
            break;

        case IDM_C_SAVE:
            if( HandleDialog( hWnd, hInstMain, ID_SAVECONF,
                (FARPROC)FISSAVECONFMsgProc, (DWORD)ID_LSAVE ) )
            {
                FISSaveConf( nFilePath, false, false );
            }
            break;

        case IDM_C_OPEN:
            if( HandleDialog( hWnd, hInstMain, ID_SAVECONF,
                              (FARPROC)FISSAVECONFMsgProc, (DWORD)ID_LOPEN )
            {
                FISRestoreConf( nFilePath, false );
                PostMessage( hWndMain, WM_COMMAND, IDM_H_REPAINT, NULL );
            }
            break;

        case IDM_H_CONTENTS:
            HandleHelp( hWndMain, 0x1000 );
            break;

        case IDM_H_REPAINT:
            FISShowChildren();
            if( cReal ) PostMessage( hWndReal, IDM_PAINT, NULL, NULL );
            if( cSingle ) PostMessage( hWndSingle, IDM_PAINT, NULL, NULL );
            if( cTrigger ) PostMessage( hWndTrigger, IDM_PAINT, NULL, NULL )
            if( cForce ) PostMessage( hWndForce, IDM_PAINT, NULL, NULL );
            break;

        case IDM_H_ROTDOWN:
            RotateWindow( false );
            break;

        case IDM_R_EXIT:
            HandleExit( hWnd, hInstMain, ID_EXIT );
            break;

        default:
            return DefWindowProc(hWnd, Message, wParam, lParam);
        }
    break;

case WM_CREATE:
    /* create the device context */
    hDCMain = GetDC( hWnd );
    hMainMenu = GetMenu( hWnd );
    /* create the global resources */
    FISCreateRes();
    /* set the collection time */
    nCollectTime = time( NULL );
```

```
        FISMessage( NULL, "RTLoad", NULL, NULL, NULL, NULL );
        break;

    case WM_MOUSEMOVE:
        HandleMouseMove( hWndMain, hInstMain, (LPSTR)"RT_CUR" );
        break;

    case WM_SIZE:
        FISShowChildren();
        break;

    case WM_PAINT:
        memset(&ps, 0x00, sizeof(PAINTSTRUCT));
        hDCPaint = BeginPaint(hWnd, &ps);
        SetBkMode(hDCPaint, TRANSPARENT);
        /* redraw the instruction */
        FISDrawInstruct( hWnd, hDCPaint );
        EndPaint(hWnd, &ps);
        break;

    case WM_CLOSE:
        /* close all of the child windows */
        if( cReal ) PostMessage( hWndReal, WM_CLOSE, NULL, NULL );
        if( cSingle ) PostMessage( hWndSingle, WM_CLOSE, NULL, NULL );
        if( cTrigger ) PostMessage( hWndTrigger, WM_CLOSE, NULL, NULL );
        if( cForce ) PostMessage( hWndForce, WM_CLOSE, NULL, NULL );
        if( IsWindow( hWndToolBox ) ) DestroyWindow( hWndToolBox );
        if( IsWindow( hWndLegend ) ) DestroyWindow( hWndLegend );
        /* free the data */
        FISFreeSet( nCurData );
        nCurData = NULL;
        nCurSet = NULL;
        nCurOffSet = 0;
        /* close the help file */
        HandleHelp( hWndMain, 0 );
        /* delete the device context and destroy window */
        FISDeleteRes();
        FISMessage( NULL, "RTUnload", NULL, NULL, NULL, NULL );
        nRc = ReleaseDC( hWnd, hDCMain );
        DestroyWindow(hWnd);
        PostQuitMessage(0);  /* Quit the application */
        break;

    default:
        return DefWindowProc(hWnd, Message, wParam, lParam);
    }
 return 0L;
}     /* End of WndProc                                          */

/*********************************************************************/
/*                                                                   */
/* nCwRegMainClass Function                                          */
/*                                                                   */
/* The following function registers all the classes of all the windows  */
/* associated with this application. The function returns an error code */
/* if unsuccessful, otherwise it returns 0.                          */
/*                                                                   */
/*********************************************************************/

int nCwRegMainClass(void)

{
 WNDCLASS   wndclass;    /* struct to define a window class          */
 memset(&wndclass, 0x00, sizeof(WNDCLASS));


 /* load WNDCLASS with window's characteristics                      */
 wndclass.style = CS_OWNDC | CS_HREDRAW | CS_VREDRAW | CS_BYTEALIGNWINDOW;
 wndclass.lpfnWndProc = FISMAINWndProc;
 /* Extra storage for Class and Window objects                       */
 wndclass.cbClsExtra = 0;
 wndclass.cbWndExtra = 0;
 wndclass.hInstance = hInstMain;
 wndclass.hIcon = LoadIcon(hInstMain, "RTMAIN");
 wndclass.hCursor = NULL;
 /* Create brush for erasing background                              */
```

```
 wndclass.hbrBackground = (HBRUSH)(COLOR_BACKGROUND+1);
 wndclass.lpszMenuName = szAppName;   /* Menu Name is App Name */
 wndclass.lpszClassName = szAppName; /* Class Name is App Name */

 /* first attempt to deregister the class */
 UnregisterClass( szAppName, hInstMain );

 if(RegisterClass(&wndclass) == 0)
   return -1;

 return(0);
} /* End of nCwRegisterClasses */

/*************************************************************************/
/*  CwUnRegisterClasses Function                                         */
/*                                                                       */
/*  Deletes any refrences to windows resources created for this          */
/*  application, frees memory, deletes instance, handles and does        */
/*  clean up prior to exiting the window                                 */
/*                                                                       */
/*************************************************************************/

void CwUnRegisterClasses(void)
{
 WNDCLASS   wndclass;    /* struct to define a window class              */
 memset(&wndclass, 0x00, sizeof(WNDCLASS));

 UnregisterClass(szAppName, hInstMain);
 UnregisterClass( szRealName, hInstReal );
 UnregisterClass( szForceName, hInstForce );
 UnregisterClass( szSingleName, hInstSingle );
 UnregisterClass( szTriggerName, hInstTrigger );
 UnregisterClass( szToolBoxName, hInstToolBox );
 UnregisterClass( szLegendName, hInstLegend );

}    /* End of CwUnRegisterClasses */

/*************************************************************************/
/*  cwCenter Function                                                    */
/*                                                                       */
/*  centers a window based on the client area of its parent              */
/*                                                                       */
/*************************************************************************/

void cwCenter(hWnd, top)

HWND hWnd;
int top;
{
 POINT      pt;
 RECT       swp;
 RECT       rParent;
 int        iwidth;
 int        iheight;

 /* get the rectangles for the parent and the child                     */
 GetWindowRect(hWnd, &swp);
 GetClientRect(hWndMain, &rParent);

 /* calculate the height and width for MoveWindow                       */
 iwidth = swp.right - swp.left;
 iheight = swp.bottom - swp.top;

 /* find the center point and convert to screen coordinates             */
 pt.x = (rParent.right - rParent.left) / 2;
 pt.y = (rParent.bottom - rParent.top) / 2;
 ClientToScreen(hWndMain, &pt);

 /* calculate the new x, y starting point                               */
 pt.x = pt.x - (iwidth / 2);
 pt.y = pt.y - (iheight / 2);

 /* top will adjust the window position, up or down                     */
 if(top)
   pt.y = pt.y + top;
```

```
/* move the window                                                    */
MoveWindow(hWnd, pt.x, pt.y, iwidth, iheight, FALSE);
}
#include "global.h"
#include "rt_exp.h"

/*************************************************************************/
/*                                                                       */
/* Dialog Window Procedure                                               */
/*                                                                       */
/*************************************************************************/

BOOL FAR PASCAL FISABOUTMsgProc(HWND hWndDlg, WORD Message, WORD wParam, LONG lP
{
switch(Message)
{
    case WM_INITDIALOG:
        cwCenter(hWndDlg, 0);
        LoadCursor(  NULL, IDC_ARROW );
        break;

    case WM_CLOSE:
        PostMessage(hWndDlg, WM_COMMAND, IDCANCEL, 0L);
        break;

    case WM_COMMAND:
        switch(wParam)
        {
            case IDOK:
            case IDCANCEL:
                EndDialog(hWndDlg, IDOK);
                break;
            case IDM_HELP:
                EndDialog( hWndDlg, IDM_HELP );
                break;
        }
        break;    /* End of WM_COMMAND                                 */

    default:
        return FALSE;
}
return TRUE;
}


/*************************************************************************/
/*                                                                       */
/* Dialog Window Procedure                                               */
/*                                                                       */
/*************************************************************************/

BOOL FAR PASCAL FISEXITMsgProc(HWND hWndDlg, WORD Message, WORD wParam, LONG lPa
{

 switch(Message)
   {
    case WM_INITDIALOG:
        cwCenter(hWndDlg, 0);
        LoadCursor( NULL, IDC_ARROW );
        break;

    case WM_CLOSE:
        PostMessage(hWndDlg, WM_COMMAND, IDCANCEL, 0L);
        break;

    case WM_COMMAND:
        switch(wParam)
          {
           case IDOK:
                EndDialog(hWndDlg, ID_EXIT);
                break;
           case IDCANCEL:
                EndDialog(hWndDlg, FALSE);
                break;
          }
```

```
        break;

    default:
        return FALSE;
    }
 return TRUE;
}


/*************************************************************************/
/*                                                                       */
/* Dialog Window Procedure                                               */
/*                                                                       */
/*************************************************************************/

BOOL FAR PASCAL FISASKSAVEMsgProc(HWND hWndDlg, WORD Message, WORD wParam, LONG
{

switch(Message)
    {
    case WM_INITDIALOG:
        LoadCursor( NULL, IDC_ARROW );
        SetDlgItemText( hWndDlg, ID_TEXT0, nRTTitle[nRTLanguage][116] );
        SetDlgItemText( hWndDlg, ID_TEXT1, nRTTitle[nRTLanguage][117] );
        SetDlgItemText( hWndDlg, ID_TEXT2, nRTTitle[nRTLanguage][118] );
        SetDlgItemText( hWndDlg, IDOK, nRTTitle[nRTLanguage][112] );
        SetDlgItemText( hWndDlg, IDNO, nRTTitle[nRTLanguage][115] );
        SetDlgItemText( hWndDlg, IDCANCEL, nRTTitle[nRTLanguage][105] );
        SetWindowText( hWndDlg, nRTTitle[nRTLanguage][170] );

        break;

    case WM_COMMAND:
        switch(wParam)
        {
            case IDOK:
                EndDialog( hWndDlg, IDOK );
                break;
            case IDNO:
                EndDialog( hWndDlg, IDNO );
                break;
            case IDCANCEL:
                EndDialog( hWndDlg, IDCANCEL );
                break;
            default:
                return FALSE;
        }
        break;
    default:
        return FALSE;
}
return TRUE;
}


/*************************************************************************/
/*                                                                       */
/* Dialog Window Procedure                                               */
/*                                                                       */
/*************************************************************************/

BOOL FAR PASCAL FISSAVERESTMsgProc(HWND hWndDlg, WORD Message, WORD wParam, LONG
{
unsigned int nFileAccess;

switch(Message)
    {
    case WM_INITDIALOG:
        LoadCursor( NULL, IDC_ARROW );
        SetDlgItemText( hWndDlg, ID_TEXT0, nRTTitle[nRTLanguage][151] );
        SetDlgItemText( hWndDlg, ID_TEXT1, nRTTitle[nRTLanguage][152] );
        SetDlgItemText( hWndDlg, IDCANCEL, nRTTitle[nRTLanguage][105] );
        SetWindowText( hWndDlg, nRTTitle[nRTLanguage][171] );
        if( lParam == ID_LOPEN )
        {
```

```
        SetDlgItemText( hWndDlg, IDOK, nRTTitle[nRTLanguage][70] );
    } else {
        SetDlgItemText( hWndDlg, IDOK, nRTTitle[nRTLanguage][71] );
    }
    /* display the dir list */
    #define cbs_dirs 0x0010
    #define cbs_read 0x0001
    #define cbs_drive 0x4000
    #define cbs_rwa 0x0000
    nFileAccess = cbs_rwa;
    if( nStudRecord.nInstructor )
    {
        nFileAccess = cbs_dirs | cbs_read | cbs_drive | cbs_rwa ;
    }

    /* assenble the path information */
    strcpy( nFilePath, nStudRecord.nFileDir );
    strcat( nFilePath, "\\*.sht" );
    DlgDirListComboBox( hWndDlg, nFilePath, ID_FID, ID_DIR,
                        nFileAccess );
    SetDlgItemText( hWndDlg, ID_FID, nFilePath );
    break;

case WM_CLOSE:
    PostMessage(hWndDlg, WM_COMMAND, IDCANCEL, 0L);
    break;

case WM_COMMAND:
    switch(wParam)
    {
        case IDOK:
            if (DlgDirSelectComboBox( hWndDlg, nFilePath, ID_FID ) != 0)
            {
                /* then this is a directory name */
                DlgDirListComboBox( hWndDlg, nFilePath, ID_FID, ID_DIR,
                        nFileAccess );
                if( strlen( nFilePath ) == 0 )
                { strcpy( nFilePath, "*.sht" ); }
                SetDlgItemText( hWndDlg, ID_FID, nFilePath );
            } else {
                /* check if there are still wild cards in the name */
                GetDlgItemText( hWndDlg, ID_FID, nFilePath, 100 );
                if( (strchr( nFilePath, '*' ) != NULL) ||
                    (strchr( nFilePath, '?' ) != NULL) )
                {
                    DlgDirListComboBox( hWndDlg, nFilePath, ID_FID, ID_DIR,
                        nFileAccess );
                    SetDlgItemText( hWndDlg, ID_FID, nFilePath );
                } else {
                    if (strlen( nFilePath ) > 0 )
                    {
                        if ( DlgDirListComboBox( hWndDlg, nFilePath, ID_FID,
                             nFileAccess ) == 0 )
                        {
                            /* save the selected path */
                            GetDlgItemText( hWndDlg, ID_DIR, nDefPath, 100 )
                            /* maybe this is a filename */
                            EndDialog( hWndDlg, TRUE );
                        } else {
                            /* then maybe this was a directory */
                            SetDlgItemText( hWndDlg, ID_FID, nFilePath );
                        }
                    }
                }
            }
            break;

        case ID_FID:
            if( HIWORD( lParam ) == LBN_DBLCLK )
            {
                PostMessage( hWndDlg, WM_COMMAND, IDOK, NULL );
            } else {
                return FALSE;
            }
            break;
```

```
            case IDCANCEL:
                EndDialog( hWndDlg, FALSE );
                break;

            default:
                return FALSE;
        }
        break;

    default:
        return FALSE;
}
return TRUE;
}

/*************************************************************************/
/*                                                                       */
/* Dialog Window Procedure                                               */
/*                                                                       */
/*************************************************************************/

BOOL FAR PASCAL FISSAVECONFMsgProc(HWND hWndDlg, WORD Message, WORD wParam, LONG
{
unsigned int nFileAccess;

switch(Message)
    {
    case WM_INITDIALOG:
        LoadCursor( NULL, IDC_ARROW );
        SetDlgItemText( hWndDlg, ID_TEXT0, nRTTitle[nRTLanguage][151] );
        SetDlgItemText( hWndDlg, ID_TEXT1, nRTTitle[nRTLanguage][152] );
        SetDlgItemText( hWndDlg, IDCANCEL, nRTTitle[nRTLanguage][105] );
        SetWindowText( hWndDlg, nRTTitle[nRTLanguage][172] );
        if( lParam == ID_LOPEN )
        {
            SetDlgItemText( hWndDlg, IDOK, nRTTitle[nRTLanguage][70] );
        } else {
            if( lParam == ID_LSAVE )
            {
                SetDlgItemText( hWndDlg, IDOK, nRTTitle[nRTLanguage][71] );
            } else {
                SetDlgItemText( hWndDlg, IDOK, nRTTitle[nRTLanguage][72] );
            }
        }
        /* display the dir list */
        #define cbs_dirs 0x0010
        #define cbs_read 0x0001
        #define cbs_drive 0x4000
        #define cbs_rwa 0x0000
        nFileAccess = cbs_rwa;
        if( nStudRecord.nInstructor )
        {
            nFileAccess = cbs_dirs | cbs_read | cbs_drive | cbs_rwa;
        }

        /* append the file name info to the path */
        strcpy( nFilePath, nStudRecord.nFileDir );
        strcat( nFilePath, "\\*.cnf" );
        DlgDirListComboBox( hWndDlg, nFilePath, ID_FID, ID_DIR, nFileAccess );
        SetDlgItemText( hWndDlg, ID_FID, nFilePath );
        break;

    case WM_CLOSE:
        PostMessage(hWndDlg, WM_COMMAND, IDCANCEL, 0L);
        break;

    case WM_COMMAND:
        switch(wParam)
        {
            case IDOK:
                if (DlgDirSelectComboBox( hWndDlg, nFilePath, ID_FID ) != 0)
                {
                    /* then this is a directory name */
                    DlgDirListComboBox( hWndDlg, nFilePath, ID_FID, ID_DIR,
```

```
                                nFileAccess );
                if( strlen( nFilePath ) == 0 )
                { strcpy( nFilePath, "*.cnf" ); }
                SetDlgItemText( hWndDlg, ID_FID, nFilePath );
            } else {
                /* check if there are still wild cards in the name */
                GetDlgItemText( hWndDlg, ID_FID, nFilePath, 100 );
                if( (strchr( nFilePath, '*' ) != NULL) ||
                    (strchr( nFilePath, '?' ) != NULL) )
                {
                    DlgDirListComboBox( hWndDlg, nFilePath, ID_FID, ID_DIR,
                                        nFileAccess );
                    SetDlgItemText( hWndDlg, ID_FID, nFilePath );
                } else {
                    if (strlen( nFilePath ) > 0 )
                    {
                        if ( DlgDirListComboBox( hWndDlg, nFilePath, ID_FID,
                             nFileAccess ) == 0 )
                        {
                            /* save the path for next time */
                            GetDlgItemText( hWndDlg, ID_DIR, nDefPath, 100 )
                            /* maybe this is a filename */
                            EndDialog( hWndDlg, TRUE );
                        } else {
                            /* then maybe this was a directory */
                            SetDlgItemText( hWndDlg, ID_FID, nFilePath );
                        }
                    }
                }
            }
            break;

        case ID_FID:
            if( HIWORD( lParam ) == LBN_DBLCLK )
            {
                PostMessage( hWndDlg, WM_COMMAND, IDOK, NULL );
            } else {
                return FALSE;
            }
            break;


        case IDCANCEL:
            EndDialog( hWndDlg, FALSE );
            break;

        default:
            return FALSE;
        }
        break;

    default:
        return FALSE;
}
return TRUE;
}


/*********************************************************************/
/*                                                                   */
/* Dialog Window Procedure                                           */
/*                                                                   */
/*********************************************************************/
BOOL FAR PASCAL FISSTUDENTINFOMsgProc(HWND hWndDlg, WORD Message, WORD wParam, L
{
unsigned char i;
BOOL nFile;
struct tUserLog nStudInfo;
unsigned char nTempID[13];
DWORD nSendRet;
static unsigned char nCurrent;  /* current selected language */

switch(Message)
    {
```

```
case WM_INITDIALOG:
    LoadCursor( NULL, IDC_ARROW );
    /* set up the labels */
    SetDlgItemText( hWndDlg, ID_TEXT0, nRTTitle[nRTLanguage][155] );
    SetDlgItemText( hWndDlg, ID_TEXT1, nRTTitle[nRTLanguage][156] );
    SetDlgItemText( hWndDlg, ID_TEXT2, nRTTitle[nRTLanguage][157] );
    SetDlgItemText( hWndDlg, ID_TEXT3, nRTTitle[nRTLanguage][158] );
    SetDlgItemText( hWndDlg, ID_TEXT4, nRTTitle[nRTLanguage][159] );
    SetDlgItemText( hWndDlg, ID_TEXT5, nRTTitle[nRTLanguage][160] );
    SetDlgItemText( hWndDlg, ID_TEXT6, nRTTitle[nRTLanguage][161] );
    SetDlgItemText( hWndDlg, ID_STUDINST, nRTTitle[nRTLanguage][162] );
    SetDlgItemText( hWndDlg, ID_FID, nRTTitle[nRTLanguage][163] );
    SetDlgItemText( hWndDlg, ID_NEW, nRTTitle[nRTLanguage][136] );
    SetDlgItemText( hWndDlg, ID_DELETE, nRTTitle[nRTLanguage][137] );
    SetDlgItemText( hWndDlg, IDOK, nRTTitle[nRTLanguage][164] );
    SetDlgItemText( hWndDlg, IDCANCEL, nRTTitle[nRTLanguage][105] );
    SetDlgItemText( hWndDlg, IDYES, nRTTitle[nRTLanguage][165] );
    SetWindowText( hWndDlg, nRTTitle[nRTLanguage][173] );
    /* display the current student record */
    SetDlgItemText( hWndDlg, ID_TEMPLATE, nStudRecord.nID );
    SetDlgItemText( hWndDlg, ID_PASSWORD, nStudRecord.nPass );
    SetDlgItemText( hWndDlg, ID_STUDNAME, nStudRecord.nStudName );
    SetDlgItemText( hWndDlg, ID_STUDFORC, nStudRecord.nStudInst );
    SetDlgItemText( hWndDlg, ID_DIR, nStudRecord.nFileDir );
    SetDlgItemText( hWndDlg, ID_STUDNUM, nStudRecord.nInstID );
    CheckDlgButton( hWndDlg, (ID_LANG+nStudRecord.nLanguage), true );
    nCurrent = nStudRecord.nLanguage;
    CheckDlgButton( hWndDlg, ID_FID, nStudRecord.nFileOver );
    CheckDlgButton( hWndDlg, ID_STUDINST, nStudRecord.nInstructor );

    /* get all of the IDs from the password file, only for Instructors */
    nFile = OpenPassFile();
    if( nStudRecord.nInstructor )
    {
        nFile = FindPassEntry( NULL, FirstPass, &nStudInfo );
        while( nFile )
        {
            /* don't include the blank entries */
            if( strlen( nStudInfo.nID) != 0)
            {
                nSendRet = SendDlgItemMessage( hWndDlg, ID_TEMPLATE, CB_ADDS
                                               NULL, (LONG)(LPSTR)nStudInfo.
            }
            /* get the next entry */
            nFile = FindPassEntry( NULL, NextPass, &nStudInfo );
        }
    }
    /* display all of the various language options */
    if( nNumLang == 0 ) break;      /* no language options */
    for (i=0;i<nNumLang;i++)
    {
        SetDlgItemText( hWndDlg, (ID_LANG+i), nLangs[i].cLang );
    }
    /* position the active field back at the id */
    PostMessage( hWndDlg, WM_NEXTDLGCTL,
                 GetDlgItem( hWndDlg, ID_TEMPLATE ), 1 );
    break;

case WM_CLOSE:
    PostMessage(hWndDlg, WM_COMMAND, IDCANCEL, 0L);
    break;

case WM_COMMAND:
    switch(wParam)
    {
        case ID_LANG:
        case ID_LANG+1:
        case ID_LANG+2:
        case ID_LANG+3:
        case ID_LANG+4:
        case ID_LANG+5:
            /* check if a language without a name was selected */
            if( HIWORD( lParam) == BN_CLICKED )
            {
```

```
        if( (wParam-ID_LANG) >= nNumLang )
        {
            CheckDlgButton( hWndDlg, ID_LANG, true );
            CheckDlgButton( hWndDlg, wParam, false );
            nCurrent = 0;
        } else {
            CheckDlgButton( hWndDlg, (ID_LANG+nCurrent), false );
            CheckDlgButton( hWndDlg, wParam, true );
            nCurrent = (unsigned char)(wParam - ID_LANG);
        }
    } else {
        return (FALSE);
    }
    break;

case ID_TEMPLATE:
    /* combobox selected */
    if( HIWORD(lParam) == CBN_SELCHANGE )
    {
        /* clear out the template */
        memset( &nStudInfo, 0, sizeof(struct tUserLog) );
        /* get the selected entry */
        nSendRet = SendDlgItemMessage( hWndDlg, ID_TEMPLATE, CB_GETC
        if( nSendRet != CB_ERR )
        {
            nSendRet = SendDlgItemMessage( hWndDlg, ID_TEMPLATE, CB_
                                        (WORD)nSendRet, (LONG)(LPS
        }
        /* find the information */
        if( nSendRet != CB_ERR )
        {
            nStudInfo.nID[12] = 0;
            nFile = FindPassEntry( nTempID, ID_Search, &nStudInfo );
            if( !nFile )
            {
                /* clear out the template */
                memset( &nStudInfo, 0, sizeof(struct tUserLog) );
            }
        }
        /* display the new information */
        SetDlgItemText( hWndDlg, ID_TEMPLATE, nStudInfo.nID );
        SetDlgItemText( hWndDlg, ID_PASSWORD, nStudInfo.nPass );
        SetDlgItemText( hWndDlg, ID_STUDNAME, nStudInfo.nStudName );
        SetDlgItemText( hWndDlg, ID_STUDFORC, nStudInfo.nStudInst );
        SetDlgItemText( hWndDlg, ID_DIR, nStudInfo.nFileDir );
        SetDlgItemText( hWndDlg, ID_STUDNUM, nStudInfo.nInstID );
        CheckDlgButton( hWndDlg, (ID_LANG+nCurrent), false );
        CheckDlgButton( hWndDlg, (ID_LANG+nStudInfo.nLanguage), true
        nCurrent = nStudInfo.nLanguage;
        CheckDlgButton( hWndDlg, ID_FID, nStudInfo.nFileOver );
        CheckDlgButton( hWndDlg, ID_STUDINST, nStudInfo.nInstructor
    } else {
        return (FALSE);
    }
    break;

case IDOK:
    /* get the original information */
    nStudInfo = nStudRecord;
    /* get any changes */
    GetDlgItemText( hWndDlg, ID_PASSWORD, nStudInfo.nPass, 13 );
    nStudInfo.nPass[12] = 0;
    /* check for blank password */
    if( strlen( nStudInfo.nPass) == 0 )
    {
        break;
    }
    /* get the preferred language */
    for (i=0;i<6;i++)
    {
        if( IsDlgButtonChecked( hWndDlg, (ID_LANG+i) ) )
        {
            if( i < nNumLang ) nStudInfo.nLanguage = i;
        }
    }
```

```
    /* only change the following items if the instructuor mode is se
    if( nStudRecord.nInstructor )
    {
        GetDlgItemText( hWndDlg, ID_TEMPLATE, nStudInfo.nID, 13 );
        nStudInfo.nID[12] = 0;
        /* check for blank entry */
        if( strlen( nStudInfo.nID ) == 0 )
        {
            break;
        }
        GetDlgItemText( hWndDlg, ID_STUDNAME, nStudInfo.nStudName, 3
        nStudInfo.nStudName[32] = 0;
        GetDlgItemText( hWndDlg, ID_STUDFORC, nStudInfo.nStudInst, 3
        nStudInfo.nStudInst[32] = 0;
        GetDlgItemText( hWndDlg, ID_DIR, nStudInfo.nFileDir, 51 );
        nStudInfo.nFileDir[50] = 0;
        GetDlgItemText( hWndDlg, ID_STUDNUM, nStudInfo.nInstID, 33 )
        nStudInfo.nInstID[32] = 0;
        nStudInfo.nFileOver = (unsigned char)IsDlgButtonChecked( hWn
        nStudInfo.nInstructor = (unsigned char)IsDlgButtonChecked( h
    }
    /* save the information */
    nFile = SavePassEntry( &nStudInfo, true );
    if( nFile )
    {
        /* find the info in the list */
        nSendRet = SendDlgItemMessage( hWndDlg, ID_TEMPLATE, CB_FIND
                                        -1, (LONG)(LPSTR)nStudInfo.nID
        if( nSendRet == CB_ERR )
        {
            nSendRet = SendDlgItemMessage( hWndDlg, ID_TEMPLATE, CB_
                                            NULL, (LONG)(LPSTR)nStudIn
        }
    }
    break;

case ID_DELETE:
    if( nStudRecord.nInstructor )
    {
        GetDlgItemText( hWndDlg, ID_TEMPLATE, nStudInfo.nID, 13 );
        nStudInfo.nID[12] = 0;
        /* delete the information */
        nFile = SavePassEntry( &nStudInfo, false );
        /* remove the entry from the list box */
        if( nFile )
        {
            /* find the info in the list */
            nSendRet = SendDlgItemMessage( hWndDlg, ID_TEMPLATE, CB_
                                            -1, (LONG)(LPSTR)nStudInfo
            if( nSendRet != CB_ERR )
            {
                nSendRet = SendDlgItemMessage( hWndDlg, ID_TEMPLATE,
                                                (WORD)nSendRet, NULL )
            }
            /* clear the info */
            memset( &nStudInfo, 0, sizeof(struct tUserLog) );
            SetDlgItemText( hWndDlg, ID_TEMPLATE, nStudInfo.nID );
            SetDlgItemText( hWndDlg, ID_PASSWORD, nStudInfo.nPass );
            SetDlgItemText( hWndDlg, ID_STUDNAME, nStudInfo.nStudNam
            SetDlgItemText( hWndDlg, ID_STUDFORC, nStudInfo.nStudIns
            SetDlgItemText( hWndDlg, ID_DIR, nStudInfo.nFileDir );
            SetDlgItemText( hWndDlg, ID_STUDNUM, nStudInfo.nInstID )
            CheckDlgButton( hWndDlg, (ID_LANG+nCurrent), false );
            nCurrent = 0;
            CheckDlgButton( hWndDlg, (ID_LANG+nStudInfo.nLanguage),
            CheckDlgButton( hWndDlg, ID_FID, nStudInfo.nFileOver );
            CheckDlgButton( hWndDlg, ID_STUDINST, nStudInfo.nInstruc
        }
    }
    /* position the active field back at the id */
    PostMessage( hWndDlg, WM_NEXTDLGCTL,
                 GetDlgItem( hWndDlg, ID_TEMPLATE ), 1 );
    break;
```

```
            case ID_NEW:
                /* clear the info */
                memset( &nStudInfo, 0, sizeof(struct tUserLog) );

                SetDlgItemText( hWndDlg, ID_TEMPLATE, nStudInfo.nID );
                SetDlgItemText( hWndDlg, ID_PASSWORD, nStudInfo.nPass );
                SetDlgItemText( hWndDlg, ID_STUDNAME, nStudInfo.nStudName );
                SetDlgItemText( hWndDlg, ID_STUDFORC, nStudInfo.nStudInst );
                SetDlgItemText( hWndDlg, ID_DIR, nStudInfo.nFileDir );
                SetDlgItemText( hWndDlg, ID_STUDNUM, nStudInfo.nInstID );
                CheckDlgButton( hWndDlg, (ID_LANG+nStudInfo.nLanguage), true );
                CheckDlgButton( hWndDlg, ID_FID, nStudInfo.nFileOver );
                CheckDlgButton( hWndDlg, ID_STUDINST, nStudInfo.nInstructor );
                /* position the active field back at the id */
                PostMessage( hWndDlg, WM_NEXTDLGCTL,
                             GetDlgItem( hWndDlg, ID_TEMPLATE ), 1 );
                break;

            case IDYES:
                HandleDialog( hWndDlg, hInstMain, ID_ADVANCED,
                              (FARPROC)FISSYSADVANCEMsgProc, (DWORD)ID_STUDENT )
                break;

            case IDCANCEL:
                ClosePassFile();
                EndDialog( hWndDlg, FALSE );
                break;

            default:
                return FALSE;
                break;
        }
        break;

    default:
        return FALSE;
}
return TRUE;
}


/*************************************************************************/
/*                                                                       */
/* Dialog Window Procedure                                               */
/*                                                                       */
/*************************************************************************/

BOOL FAR PASCAL FISCALIBRATEMsgProc(HWND hWndDlg, WORD Message, WORD wParam, LON
{
unsigned int i;
unsigned int nTempHead;
unsigned char nCollect[3];
unsigned char nTempGrip[3][2];
int nTemp;

switch(Message)
    {
    case WM_INITDIALOG:
        /* determine the latest raw Samples */
        if( nADHead > 0 )
        {
            nTempHead = nADHead - 1;
        } else {
            nTempHead = dSampleSize;
        }
        /* get the raw samples */
        nCollect[0] = rawSamples[nFrontSen][nTempHead]; /* front grip */
        nCollect[1] = rawSamples[nLSideSen][nTempHead]; /* left side grip */
        nCollect[2] = rawSamples[nRSideSen][nTempHead]; /* right side grip */
        /* set up the correct cursor */
        LoadCursor( NULL, IDC_ARROW );
        SetDlgItemText( hWndDlg, ID_TEXT0, nRTTitle[nRTLanguage][120] );
        SetDlgItemText( hWndDlg, ID_TEXT1, nRTTitle[nRTLanguage][121] );
        SetDlgItemText( hWndDlg, ID_TEXT2, nRTTitle[nRTLanguage][122] );
        SetDlgItemText( hWndDlg, ID_TEXT3, nRTTitle[nRTLanguage][123] );
        SetDlgItemText( hWndDlg, ID_TEXT4, nRTTitle[nRTLanguage][124] );
```

```
        SetDlgItemText( hWndDlg, ID_TEXT5, nRTTitle[nRTLanguage][125] );

        SetDlgItemText( hWndDlg, IDOK, nRTTitle[nRTLanguage][104] );
        SetDlgItemText( hWndDlg, IDCANCEL, nRTTitle[nRTLanguage][105] );
        SetWindowText( hWndDlg, nRTTitle[nRTLanguage][174] );

        /* display the collected values */
        for (i=0;i<3;i++)
        {
            SetDlgItemInt( hWndDlg, (ID_THRESH+i), ((unsigned int)nCollect[i]*10
        }
        /* and the high and low calculations */
        for ( i=0;i<3;i++ )
        {
            /* decrease by 20 % for low level */
            nTempGrip[i][0] = (unsigned char)((float)nCollect[i] * 0.80);
            /* increase by 20 % for high level */
            nTempGrip[i][1] = (unsigned char)((float)nCollect[i] * 1.20);
            SetDlgItemInt( hWndDlg, (ID_GRIPLOW+i), ((unsigned int)nTempGrip[i][
            SetDlgItemInt( hWndDlg, (ID_GRIPHIGH+i), ((unsigned int)nTempGrip[i]
        }
        break;

    case WM_CLOSE:
        PostMessage(hWndDlg, WM_COMMAND, IDCANCEL, 0L);
        break;

    case WM_COMMAND:
        switch(wParam)
        {
            case IDOK:
                /* get the selectd values */
                for( i=1;i<4;i++)
                {
                    nSenThresh[i][0] = (unsigned char)(GetDlgItemInt( hWndDlg, (
                                        *nMaxValue/100);
                    nSenThresh[i][1] = (unsigned char)(GetDlgItemInt( hWndDlg, (
                                        *nMaxValue/100);
                }
                EndDialog( hWndDlg, TRUE );
                break;

            case IDCANCEL:
                EndDialog( hWndDlg, FALSE );
                break;

            default:
                break;
        }
        break;

    default:
        return FALSE;
}
return TRUE;
}


/*********************************************************************/
/*                                                                   */
/* Dialog Window Procedure                                           */
/*                                                                   */
/*********************************************************************/

BOOL FAR PASCAL FISINSTStageMsgProc(HWND hWndDlg, WORD Message, WORD wParam, LON
{
unsigned int i;
DWORD nSendRet;
BOOL nFile;
static struct tStage nStageInfo;
unsigned char nTempName[21];

 switch(Message)
   {
```

```
case WM_INITDIALOG:
    cwCenter(hWndDlg, 0);
    LoadCursor( NULL, IDC_ARROW );
    SetDlgItemText( hWndDlg, ID_TEXT0, nRTTitle[nRTLanguage][128] );
    SetDlgItemText( hWndDlg, ID_TEXT1, nRTTitle[nRTLanguage][129] );
    SetDlgItemText( hWndDlg, ID_TEXT2, nRTTitle[nRTLanguage][130] );
    SetDlgItemText( hWndDlg, ID_TEXT3, nRTTitle[nRTLanguage][131] );
    SetDlgItemText( hWndDlg, ID_TEXT4, nRTTitle[nRTLanguage][132] );
    SetDlgItemText( hWndDlg, ID_TEXT5, nRTTitle[nRTLanguage][133] );
    SetDlgItemText( hWndDlg, ID_TEXT6, nRTTitle[nRTLanguage][134] );

    SetDlgItemText( hWndDlg, IDOK, nRTTitle[nRTLanguage][135] );
    SetDlgItemText( hWndDlg, IDCANCEL, nRTTitle[nRTLanguage][105] );
    SetDlgItemText( hWndDlg, ID_NEW, nRTTitle[nRTLanguage][136] );
    SetDlgItemText( hWndDlg, ID_DELETE, nRTTitle[nRTLanguage][137] );
    SetDlgItemText( hWndDlg, IDYES, nRTTitle[nRTLanguage][112] );
    SetWindowText( hWndDlg, nRTTitle[nRTLanguage][175] );
    /* load the sound names */
    memset( &nStageInfo, 0, sizeof(struct tStage) );
    for (i=0;i<nNumSounds;i++)
    {
        nSendRet = SendDlgItemMessage( hWndDlg, ID_STARTVOICE, CB_ADDSTRING,
                                       NULL, (LONG)(LPSTR)cSound[i] );
        nSendRet = SendDlgItemMessage( hWndDlg, ID_STOPVOICE, CB_ADDSTRING,
                                       NULL, (LONG)(LPSTR)cSound[i] );
    }
    SendDlgItemMessage( hWndDlg, ID_STARTVOICE, CB_SETCURSEL,
                        nStageInfo.nBVoice, NULL);
    SendDlgItemMessage( hWndDlg, ID_STOPVOICE, CB_SETCURSEL,
                        nStageInfo.nEVoice, NULL);
    /* initialize the rest of the variables */
    nStageInfo.nDur = 10;
    nStageInfo.nShots = 1;
    nStageInfo.nSDelay = 0;
    SetDlgItemInt( hWndDlg, ID_DUR, nStageInfo.nDur, false );
    SetDlgItemInt( hWndDlg, ID_SHOTS, nStageInfo.nShots, false );
    SetDlgItemInt( hWndDlg, ID_STAGEDELAY, nStageInfo.nSDelay, false );
    SetDlgItemText( hWndDlg, ID_STAGEDESC, nStageInfo.nDescrip );
    /* list all of the available stages */
    nFile = OpenStageFile();
    nFile = FindStageEntry( NULL, FirstStage, &nStageInfo );
    while( nFile )
    {
        /* don't include the blank entries */
        if( strlen( nStageInfo.nName) != 0)
        {
            nSendRet = SendDlgItemMessage( hWndDlg, ID_STAGE, CB_ADDSTRING,
                                           NULL, (LONG)(LPSTR)nStageInfo.nNa
        }
        /* get the next entry */
        nFile = FindStageEntry( NULL, NextStage, &nStageInfo );
    }

    /* position the active field back at the id */
    PostMessage( hWndDlg, WM_NEXTDLGCTL,
                 GetDlgItem( hWndDlg, ID_STAGE ), 1 );
    break;

case WM_CLOSE:
     PostMessage(hWndDlg, WM_COMMAND, IDCANCEL, 0L);
     break;

case WM_COMMAND:
    switch(wParam)
    {
        case ID_DELETE:
            if( nStudRecord.nInstructor )
            {
                GetDlgItemText( hWndDlg, ID_STAGE, nStageInfo.nName, 21 );
                nStageInfo.nName[20] = 0;
                /* delete the information */
                nFile = SaveStageEntry( &nStageInfo, false );
                /* remove the entry from the list box */
                if( nFile )
                {
```

```
            /* find the info in the list */
            nSendRet = SendDlgItemMessage( hWndDlg, ID_STAGE, CB_FIN
                                        -1, (LONG)(LPSTR)nStageInf
            if( nSendRet != CB_ERR )
            {
                nSendRet = SendDlgItemMessage( hWndDlg, ID_STAGE, CB
                                        (WORD)nSendRet, NULL )
            }
            /* clear the info */
            memset( &nStageInfo, 0, sizeof(struct tStage) );
            SendDlgItemMessage( hWndDlg, ID_STARTVOICE, CB_SETCURSEL
                                nStageInfo.nBVoice, NULL);
            SendDlgItemMessage( hWndDlg, ID_STOPVOICE, CB_SETCURSEL,
                                nStageInfo.nEVoice, NULL);
            SetDlgItemText( hWndDlg, ID_STAGE, nStageInfo.nName );
            SetDlgItemText( hWndDlg, ID_STAGEDESC, nStageInfo.nDescr
            nStageInfo.nDur = 10;
            nStageInfo.nShots = 1;
            nStageInfo.nSDelay = 0;
            SetDlgItemInt( hWndDlg, ID_DUR, nStageInfo.nDur, false )
            SetDlgItemInt( hWndDlg, ID_SHOTS, nStageInfo.nShots, fal
            SetDlgItemInt( hWndDlg, ID_STAGEDELAY, nStageInfo.nSDela
        }
    }
    /* position the active field back at the id */
    PostMessage( hWndDlg, WM_NEXTDLGCTL,
                 GetDlgItem( hWndDlg, ID_STAGE ), 1 );
    break;

case ID_NEW:
    /* clear the info */
    memset( &nStageInfo, 0, sizeof(struct tStage) );
    SendDlgItemMessage( hWndDlg, ID_STARTVOICE, CB_SETCURSEL,
                        nStageInfo.nBVoice, NULL);
    SendDlgItemMessage( hWndDlg, ID_STOPVOICE, CB_SETCURSEL,
                        nStageInfo.nEVoice, NULL);
    SetDlgItemText( hWndDlg, ID_STAGE, nStageInfo.nName );
    SetDlgItemText( hWndDlg, ID_STAGEDESC, nStageInfo.nDescrip );
    nStageInfo.nDur = 10;
    nStageInfo.nShots = 1;
    nStageInfo.nSDelay = 0;
    SetDlgItemInt( hWndDlg, ID_DUR, nStageInfo.nDur, false );
    SetDlgItemInt( hWndDlg, ID_SHOTS, nStageInfo.nShots, false );
    SetDlgItemInt( hWndDlg, ID_STAGEDELAY, nStageInfo.nSDelay, false
    /* position the active field back at the id */
    PostMessage( hWndDlg, WM_NEXTDLGCTL,
                 GetDlgItem( hWndDlg, ID_STAGE ), 1 );
    break;

case ID_STAGE:
    /* combobox selected */
    if( HIWORD(lParam) == CBN_SELCHANGE )
    {
        /* clear out the template */
        memset( &nStageInfo, 0, sizeof(struct tStage) );
        /* get the selected entry */
        nSendRet = SendDlgItemMessage( hWndDlg, ID_STAGE, CB_GETCURS
        if( nSendRet != CB_ERR )
        {
            nSendRet = SendDlgItemMessage( hWndDlg, ID_STAGE, CB_GET
                                    (WORD)nSendRet, (LONG)(LPS
        }
        /* find the information */
        if( nSendRet != CB_ERR )
        {
            nStageInfo.nName[20] = 0;
            nFile = FindStageEntry( nTempName, ID_Search, &nStageInf
            if( !nFile )
            {
                /* clear out the template */
                memset( &nStageInfo, 0, sizeof(struct tStage) );
            }
        }
        /* display the new information */
```

```
        SendDlgItemMessage( hWndDlg, ID_STARTVOICE, CB_SETCURSEL,
                            nStageInfo.nBVoice, NULL);
        SendDlgItemMessage( hWndDlg, ID_STOPVOICE, CB_SETCURSEL,
                            nStageInfo.nEVoice, NULL);
        SetDlgItemText( hWndDlg, ID_STAGE, nStageInfo.nName );
        SetDlgItemText( hWndDlg, ID_STAGEDESC, nStageInfo.nDescrip )
        SetDlgItemInt( hWndDlg, ID_DUR, nStageInfo.nDur, false );
        SetDlgItemInt( hWndDlg, ID_SHOTS, nStageInfo.nShots, false )
        SetDlgItemInt( hWndDlg, ID_STAGEDELAY, nStageInfo.nSDelay, f
        /* position the active field back at the id */
        PostMessage( hWndDlg, WM_NEXTDLGCTL,
                     GetDlgItem( hWndDlg, ID_STAGE ), 1 );
    } else {
        return (FALSE);
    }
    break;

case IDOK:
    /* return the currently selected course and stage identifiers */
    memset( &nCurCourse, 0, sizeof( struct tCourse ) );
    nCurStage = nStageInfo;
    EndDialog( hWndDlg, true );
    break;

case IDYES:
    /* get the current stage name */
    GetDlgItemText( hWndDlg, ID_STAGE, nStageInfo.nName, 21 );
    nStageInfo.nName[20] = 0;
    /* check for blank name */
    if( strlen( nStageInfo.nName) == 0 )
    {
        /* position the active field back at the id */
        PostMessage( hWndDlg, WM_NEXTDLGCTL,
                     GetDlgItem( hWndDlg, ID_STAGE ), 1 );
        break;
    }
    /* only change the following items if the instructuor mode is se
    if( nStudRecord.nInstructor )
    {
        /* get the list box positions */
        nStageInfo.nBVoice = (unsigned char)SendDlgItemMessage( hWnd
        if( nStageInfo.nBVoice > nNumSounds ) nStageInfo.nBVoice = d
        nStageInfo.nEVoice = (unsigned char)SendDlgItemMessage( hWnd
        if( nStageInfo.nEVoice > nNumSounds ) nStageInfo.nEVoice = d

        /* get the current delays */
        nStageInfo.nSDelay = GetDlgItemInt( hWndDlg, ID_STAGEDELAY,
        nStageInfo.nShots = GetDlgItemInt( hWndDlg, ID_SHOTS, NULL,
        nStageInfo.nDur = GetDlgItemInt( hWndDlg, ID_DUR, NULL, fals
        GetDlgItemText( hWndDlg, ID_STAGEDESC, nStageInfo.nDescrip,

        /* save the information */
        nFile = SaveStageEntry( &nStageInfo, true );
        if( nFile )
        {
            /* find the info in the list */
            nSendRet = SendDlgItemMessage( hWndDlg, ID_STAGE, CB_FIN
                                           -1, (LONG)(LPSTR)nStageIn
            if( nSendRet == CB_ERR )
            {
                nSendRet = SendDlgItemMessage( hWndDlg, ID_STAGE, CB
                                               NULL, (LONG)(LPSTR)nS
            }
        }
    }

    /* position the active field back at the id */
    PostMessage( hWndDlg, WM_NEXTDLGCTL,
                 GetDlgItem( hWndDlg, ID_STAGE ), 1 );
    break;

case IDCANCEL:
    CloseStageFile();
    EndDialog( hWndDlg, FALSE );
    break;
}
```

```
        break;

    default:
        return FALSE;
}
return TRUE;
}


/*************************************************************************/
/*                                                                       */
/* Dialog Window Procedure                                               */
/*                                                                       */
/*************************************************************************/

BOOL FAR PASCAL FISINSTCourseMsgProc(HWND hWndDlg, WORD Message, WORD wParam, LO
{
unsigned int i;
DWORD nSendRet;
BOOL nFile;
static struct tCourse nCourseInfo;
struct tStage nStageInfo;
unsigned char nTempName[21];

 switch(Message)
   {
    case WM_INITDIALOG:
        cwCenter(hWndDlg, 0);
        LoadCursor( NULL, IDC_ARROW );
        SetDlgItemText( hWndDlg, ID_TEXT0, nRTTitle[nRTLanguage][140] );
        SetDlgItemText( hWndDlg, ID_TEXT1, nRTTitle[nRTLanguage][141] );
        SetDlgItemText( hWndDlg, ID_TEXT2, nRTTitle[nRTLanguage][142] );
        SetDlgItemText( hWndDlg, ID_TEXT3, nRTTitle[nRTLanguage][143] );
        SetDlgItemText( hWndDlg, ID_TEXT4, nRTTitle[nRTLanguage][144] );
        SetDlgItemText( hWndDlg, ID_TEXT5, nRTTitle[nRTLanguage][145] );
        SetDlgItemText( hWndDlg, ID_TEXT6, nRTTitle[nRTLanguage][146] );
        SetDlgItemText( hWndDlg, ID_TEXT7, nRTTitle[nRTLanguage][147] );

        SetDlgItemText( hWndDlg, IDOK, nRTTitle[nRTLanguage][150] );
        SetDlgItemText( hWndDlg, IDCANCEL, nRTTitle[nRTLanguage][105] );
        SetDlgItemText( hWndDlg, ID_NEW, nRTTitle[nRTLanguage][136] );
        SetDlgItemText( hWndDlg, ID_DELETE, nRTTitle[nRTLanguage][137] );
        SetDlgItemText( hWndDlg, ID_REMOVE, nRTTitle[nRTLanguage][148] );
        SetDlgItemText( hWndDlg, ID_ADD, nRTTitle[nRTLanguage][149] );
        SetDlgItemText( hWndDlg, IDYES, nRTTitle[nRTLanguage][112] );
        SetWindowText( hWndDlg, nRTTitle[nRTLanguage][176] );
        /* load the sound names */
        memset( &nCourseInfo, 0, sizeof(struct tCourse) );
        for (i=0;i<nNumSounds;i++)
        {
            nSendRet = SendDlgItemMessage( hWndDlg, ID_CRSSTART, CB_ADDSTRING,
                                           NULL, (LONG)(LPSTR)cSound[i] );
            nSendRet = SendDlgItemMessage( hWndDlg, ID_CRSSTOP, CB_ADDSTRING,
                                           NULL, (LONG)(LPSTR)cSound[i] );
        }
        SendDlgItemMessage( hWndDlg, ID_CRSSTART, CB_SETCURSEL,
                            nCourseInfo.nBVoice, NULL);
        SendDlgItemMessage( hWndDlg, ID_CRSSTOP, CB_SETCURSEL,
                            nCourseInfo.nEVoice, NULL);
        /* initialize the rest of the variables */
        nCourseInfo.nInter = 10;
        nCourseInfo.nSDelay = 0;
        SetDlgItemInt( hWndDlg, ID_INTERDELAY, nCourseInfo.nInter, false );
        SetDlgItemInt( hWndDlg, ID_CRSDELAY, nCourseInfo.nSDelay, false );
        SetDlgItemText( hWndDlg, ID_CRSDESC, nCourseInfo.nDescrip );
        /* list all of the available Courses */
        nFile = OpenCourseFile();
        nFile = FindCourseEntry( NULL, FirstCourse, &nCourseInfo );
        while( nFile )
        {
            /* don't include the blank entries */
            if( strlen( nCourseInfo.nName) != 0)
            {
                nSendRet = SendDlgItemMessage( hWndDlg, ID_COURSE, CB_ADDSTRING,
                                               NULL, (LONG)(LPSTR)nCourseInf
            }
```

```
        /* get the next entry */
        nFile = FindCourseEntry( NULL, NextCourse, &nCourseInfo );
    }
    /* list all of the available stages */
    nFile = OpenStageFile();
    nFile = FindStageEntry( NULL, FirstStage, &nStageInfo );
    while( nFile )
    {
        /* don't include the blank entries */
        if( strlen( nStageInfo.nName) != 0)
        {
            nSendRet = SendDlgItemMessage( hWndDlg, ID_LIST, CB_ADDSTRING,
                                           NULL, (LONG)(LPSTR)nStageInfo.nNa
        }
        /* get the next entry */
        nFile = FindStageEntry( NULL, NextStage, &nStageInfo );
    }
    SendDlgItemMessage( hWndDlg, ID_STAGE, CB_SETCURSEL, -1, NULL);
    SendDlgItemMessage( hWndDlg, ID_LIST, CB_SETCURSEL, -1, NULL);

    /* position the active field back at the id */
    PostMessage( hWndDlg, WM_NEXTDLGCTL,
                 GetDlgItem( hWndDlg, ID_COURSE ), 1 );
    break;

case WM_CLOSE:
     PostMessage(hWndDlg, WM_COMMAND, IDCANCEL, 0L);
     break;

case WM_COMMAND:
    switch(wParam)
    {
        case ID_DELETE:
            if( nStudRecord.nInstructor )
            {
                GetDlgItemText( hWndDlg, ID_COURSE, nCourseInfo.nName, 21 );
                nCourseInfo.nName[20] = 0;
                /* delete the information */
                nFile = SaveCourseEntry( &nCourseInfo, false );
                /* remove the entry from the list box */
                if( nFile )
                {
                    /* find the info in the list */
                    nSendRet = SendDlgItemMessage( hWndDlg, ID_COURSE, CB_FI
                                                   -1, (LONG)(LPSTR)nCourseIn
                    if( nSendRet != CB_ERR )
                    {
                        nSendRet = SendDlgItemMessage( hWndDlg, ID_COURSE, C
                                                       (WORD)nSendRet, NULL )
                    }
                    /* clear the info */
                    memset( &nCourseInfo, 0, sizeof(struct tCourse) );
                    SendDlgItemMessage( hWndDlg, ID_CRSSTART, CB_SETCURSEL,
                                        nCourseInfo.nBVoice, NULL);
                    SendDlgItemMessage( hWndDlg, ID_CRSSTOP, CB_SETCURSEL,
                                        nCourseInfo.nEVoice, NULL);
                    SetDlgItemText( hWndDlg, ID_COURSE, nCourseInfo.nName );
                    SetDlgItemText( hWndDlg, ID_CRSDESC, nCourseInfo.nDescri
                    nCourseInfo.nInter = 10;
                    nCourseInfo.nSDelay = 0;
                    SetDlgItemInt( hWndDlg, ID_INTERDELAY, nCourseInfo.nInte
                    SetDlgItemInt( hWndDlg, ID_CRSDELAY, nCourseInfo.nSDelay
                    SendDlgItemMessage( hWndDlg, ID_STAGE, CB_RESETCONTENT,
                    SendDlgItemMessage( hWndDlg, ID_LIST, CB_SETCURSEL, -1,
                }
            }
            /* position the active field back at the id */
            PostMessage( hWndDlg, WM_NEXTDLGCTL,
                         GetDlgItem( hWndDlg, ID_COURSE ), 1 );
            break;

        case ID_NEW:
            /* clear the info */
            memset( &nCourseInfo, 0, sizeof(struct tCourse) );
```

```
    SendDlgItemMessage( hWndDlg, ID_CRSSTART, CB_SETCURSEL,
                        nCourseInfo.nBVoice, NULL);
    SendDlgItemMessage( hWndDlg, ID_CRSSTOP, CB_SETCURSEL,
                        nCourseInfo.nEVoice, NULL);
    SetDlgItemText( hWndDlg, ID_COURSE, nCourseInfo.nName );
    SetDlgItemText( hWndDlg, ID_CRSDESC, nCourseInfo.nDescrip );
    nCourseInfo.nInter = 10;
    nCourseInfo.nSDelay = 0;
    SetDlgItemInt( hWndDlg, ID_INTERDELAY, nCourseInfo.nInter, false
    SetDlgItemInt( hWndDlg, ID_CRSDELAY, nCourseInfo.nSDelay, false
    SendDlgItemMessage( hWndDlg, ID_STAGE, CB_RESETCONTENT, 0, NULL)
    SendDlgItemMessage( hWndDlg, ID_LIST, CB_SETCURSEL, -1, NULL);
    /* position the active field back at the id */
    PostMessage( hWndDlg, WM_NEXTDLGCTL,
                 GetDlgItem( hWndDlg, ID_COURSE ), 1 );
    break;

case ID_COURSE:
    /* combobox selected */
    if( HIWORD(lParam) == CBN_SELCHANGE )
    {
        /* clear out the template */
        memset( &nCourseInfo, 0, sizeof(struct tCourse) );
        /* get the selected entry */
        nSendRet = SendDlgItemMessage( hWndDlg, ID_COURSE, CB_GETCUR
        if( nSendRet != CB_ERR )
        {
            nSendRet = SendDlgItemMessage( hWndDlg, ID_COURSE, CB_GE
                                           (WORD)nSendRet, (LONG)(LPS
        }
        /* find the information */
        if( nSendRet != CB_ERR )
        {
            nCourseInfo.nName[20] = 0;
            nFile = FindCourseEntry( nTempName, ID_Search, &nCourseI
            if( !nFile )
            {
                /* clear out the template */
                memset( &nCourseInfo, 0, sizeof(struct tCourse) );
            }
        }
        /* display the new information */
        SendDlgItemMessage( hWndDlg, ID_CRSSTART, CB_SETCURSEL,
                            nCourseInfo.nBVoice, NULL);
        SendDlgItemMessage( hWndDlg, ID_CRSSTOP, CB_SETCURSEL,
                            nCourseInfo.nEVoice, NULL);
        SetDlgItemText( hWndDlg, ID_COURSE, nCourseInfo.nName );
        SetDlgItemText( hWndDlg, ID_CRSDESC, nCourseInfo.nDescrip );
        SetDlgItemInt( hWndDlg, ID_INTERDELAY, nCourseInfo.nInter, f
        SetDlgItemInt( hWndDlg, ID_CRSDELAY, nCourseInfo.nSDelay, fa
        /* list the included stages */
        SendDlgItemMessage( hWndDlg, ID_STAGE, CB_RESETCONTENT, 0, N
        for( i=0;i<10;i++)
        {
            if( strlen( nCourseInfo.nStages[i] ) > 0 )
            {
                SendDlgItemMessage( hWndDlg, ID_STAGE, CB_ADDSTRING,
                                    NULL, (LONG)(LPSTR)nCourseInfo.n
            }
        }
        SendDlgItemMessage( hWndDlg, ID_STAGE, CB_SETCURSEL, 0, NULL
        /* position the active field back at the id */
        PostMessage( hWndDlg, WM_NEXTDLGCTL,
                     GetDlgItem( hWndDlg, ID_COURSE ), 1 );
    } else {
        return (FALSE);
    }
    break;

case ID_ADD:
    GetDlgItemText( hWndDlg, ID_LIST, nTempName, 21 );
    nTempName[20] = 0;
    /* check for blank */
    if( strlen( nTempName) != 0 )
    {
```

```
        /* check how many already in the list */
        nSendRet = SendDlgItemMessage( hWndDlg, ID_STAGE, CB_GETCOUN
        if( (WORD)nSendRet < 10 )
        {
            /* find the info in the list */
            nSendRet = SendDlgItemMessage( hWndDlg, ID_STAGE, CB_FIN
                                            -1, (LONG)(LPSTR)nTempNam
            if( nSendRet == CB_ERR )
            {
                SendDlgItemMessage( hWndDlg, ID_STAGE, CB_ADDSTRING,
                                    NULL, (LONG)(LPSTR)nTempName );

                /* find a blank in the stage list and add */
                for (i=0;i<10;i++)
                {
                    if( strlen( nCourseInfo.nStages[i] ) ==0 )
                    {
                        strcpy( nCourseInfo.nStages[i], nTempName );
                    }
                }
            }
        }
    }
    SendDlgItemMessage( hWndDlg, ID_STAGE, CB_SETCURSEL, -1, NULL);
    /* position the active field back at the list */
    PostMessage( hWndDlg, WM_NEXTDLGCTL,
                 GetDlgItem( hWndDlg, ID_STAGE ), 1 );
    break;

case ID_REMOVE:
    GetDlgItemText( hWndDlg, ID_STAGE, nTempName, 21 );
    nTempName[20] = 0;
    /* check for blank */
    if( strlen( nTempName) != 0 )
    {
        /* find the info in the list */
        nSendRet = SendDlgItemMessage( hWndDlg, ID_STAGE, CB_FINDSTR
                                        -1, (LONG)(LPSTR)nTempName );
        if( nSendRet != CB_ERR )
        {
            SendDlgItemMessage( hWndDlg, ID_STAGE, CB_DELETESTRING,
                                (WORD)nSendRet, NULL );

            /* find the item in the stage list and remove */
            for (i=0;i<10;i++)
            {
                if( strcmp( nCourseInfo.nStages[i], nTempName) == 0
                {
                    strcpy( nCourseInfo.nStages[i], "" );
                }
            }
        }
    }
    SendDlgItemMessage( hWndDlg, ID_STAGE, CB_SETCURSEL, -1, NULL);
    /* position the active field back at the list */
    PostMessage( hWndDlg, WM_NEXTDLGCTL,
                 GetDlgItem( hWndDlg, ID_STAGE ), 1 );
    break;

case IDOK:
    /* return the currently selected course and Course identifiers *
    nCurCourse = nCourseInfo;
    memset( &nCurStage, 0, sizeof( struct tStage ) );
    EndDialog( hWndDlg, true );
    break;
case IDYES:
    /* get the current Course name */
    GetDlgItemText( hWndDlg, ID_COURSE, nCourseInfo.nName, 21 );
    nCourseInfo.nName[20] = 0;
    /* check for blank name */
    if( strlen( nCourseInfo.nName) == 0 )
    {
        /* position the active field back at the id */
        PostMessage( hWndDlg, WM_NEXTDLGCTL,
                     GetDlgItem( hWndDlg, ID_COURSE ), 1 );
```

```
                break;
            }
            /* only change the following items if the instructuor mode is se
            if( nStudRecord.nInstructor )
            {
                /* get the list box positions */
                nCourseInfo.nBVoice = (unsigned char)SendDlgItemMessage( hWn
                if( nCourseInfo.nBVoice > nNumSounds ) nCourseInfo.nBVoice =
                nCourseInfo.nEVoice = (unsigned char)SendDlgItemMessage( hWn
                if( nCourseInfo.nEVoice > nNumSounds ) nCourseInfo.nEVoice =

                /* get the current delays */
                nCourseInfo.nSDelay = GetDlgItemInt( hWndDlg, ID_CRSDELAY, N
                nCourseInfo.nInter = GetDlgItemInt( hWndDlg, ID_INTERDELAY,
                GetDlgItemText( hWndDlg, ID_CRSDESC, nCourseInfo.nDescrip, 1

                /* get the items in the stage list */
                memset( nCourseInfo.nStages, 0, 210 );
                nSendRet = SendDlgItemMessage( hWndDlg, ID_STAGE, CB_GETCOUN
                if( (WORD)nSendRet <= 0 ) break;
                for( i=0;i<(unsigned int)nSendRet;i++)
                {
                    SendDlgItemMessage( hWndDlg, ID_STAGE, CB_GETLBTEXT,
                                        i, (LONG)(LPSTR)nCourseInfo.nStages[
                }
                /* save the information */
                nFile = SaveCourseEntry( &nCourseInfo, true );
                if( nFile )
                {
                    /* find the info in the list */
                    nSendRet = SendDlgItemMessage( hWndDlg, ID_COURSE, CB_FI
                                                   -1, (LONG)(LPSTR)nCourseI
                    if( nSendRet == CB_ERR )
                    {
                        nSendRet = SendDlgItemMessage( hWndDlg, ID_COURSE, C
                                                       NULL, (LONG)(LPSTR)nC
                    }
                }
            }
            /* position the active field back at the id */
            PostMessage( hWndDlg, WM_NEXTDLGCTL,
                         GetDlgItem( hWndDlg, ID_COURSE ), 1 );
            break;

        case IDCANCEL:
            CloseStageFile();
            CloseCourseFile();
            EndDialog( hWndDlg, FALSE );
            break;
        }
    break;

  default:
    return FALSE;
}
return TRUE;
}

/*************************************************************************/
/*                                                                       */
/* Dialog Window Procedure                                               */
/*                                                                       */
/*************************************************************************/

BOOL FAR PASCAL FISLOGINMsgProc(HWND hWndDlg, WORD Message, WORD wParam, LONG lP
{
unsigned char nID[13];
unsigned char nPass[13];
unsigned char nRc;

 switch(Message)
   {
    case WM_INITDIALOG:
        cwCenter(hWndDlg, 0);
        LoadCursor( NULL, IDC_ARROW );
```

```
        /* zero the edit fields */
        memset( nID, 0, 13 );
        memset( nPass, 0, 13 );
        SetDlgItemText( hWndDlg, ID_FID, nID );
        SetDlgItemText( hWndDlg, ID_NAMES, nPass );
        break;

    case WM_CLOSE:
         PostMessage(hWndDlg, WM_COMMAND, IDCANCEL, 0L);
         break;

    case WM_COMMAND:
        switch(wParam)
        {
            case IDOK:
                GetDlgItemText( hWndDlg, ID_FID, nID, 13 );
                nID[12] = 0;
                GetDlgItemText( hWndDlg, ID_NAMES, nPass, 13 );
                nPass[12] = 0;
                if( CheckLogin( nID, nPass ) )
                {
                    EndDialog( hWndDlg, IDOK );
                } else {
                    /* zero the edit fields */
                    memset( nID, 0, 13 );
                    memset( nPass, 0, 13 );
                    SetDlgItemText( hWndDlg, ID_NAMES, nPass );
                    SetDlgItemText( hWndDlg, ID_FID, nID );
                    /* position the active field back at the id */
                    PostMessage( hWndDlg, WM_NEXTDLGCTL,
                                 GetDlgItem( hWndDlg, ID_FID ), 1 );
                }
                break;
            case IDCANCEL:
                EndDialog( hWndDlg, IDCANCEL );
                break;

            default:
                return FALSE;
                break;
            }
        break;

    default:
        return FALSE;
}
return TRUE;
}


/*************************************************************************/
/*                                                                       */
/* Dialog Window Procedure                                               */
/*                                                                       */
/*************************************************************************/
BOOL FAR PASCAL FISWELCOMEMsgProc(HWND hWndDlg, WORD Message, WORD wParam, LONG
{
unsigned char nTempStr[80];
unsigned char nWelStr[800];
unsigned int i, nRc;
FILE * nFileID;
char * nFileName;
DWORD nSendRet;
DRAWITEMSTRUCT nDrawItem;

switch(Message)
{
    case WM_INITDIALOG:
        cwCenter(hWndDlg, 0);
        LoadCursor( NULL, IDC_ARROW );
        /* display the first element in the welcome information array */
        if( nNumLang == 0 )
        {
            /* nothing in the language file or not found ID_EDIT, ID_LANG*/
```

```
        SetDlgItemText( hWndDlg, ID_EDIT, "No Welcome Message Available" );
    } else {
        /* display the requested welcome message */
        nFileName = &nLangs[nRTLanguage].cWelcome[0];
        if( (nFileID = fopen( nFileName, "r" )) != NULL )
        {
            nWelStr[0] = NULL;
            while ( true )
            {
                /* get each line in the file */
                if ( fgets( nTempStr, 100, nFileID ) == NULL ) break;
                strcat( nWelStr, nTempStr );
            }
            SetDlgItemText( hWndDlg, ID_EDIT, nWelStr );
            fclose( nFileID );

        } else {
            SetDlgItemText( hWndDlg, ID_EDIT, "Welcome Message not Found" );

        }
    }
    /* set the information for the different languages */
    CheckRadioButton( hWndDlg, ID_LANG, ID_LANG+5, (ID_LANG+nRTLanguage) );
    for (i=0;i<nNumLang;i++)
    {
        SetDlgItemText( hWndDlg, (ID_LANG+i), nLangs[i].cLang );
    }
    break;

case WM_CLOSE:
     PostMessage(hWndDlg, WM_COMMAND, IDCANCEL, 0L);
     break;

case WM_COMMAND:
    switch(wParam)
    {
        case ID_LANG:
        case ID_LANG+1:
        case ID_LANG+2:
        case ID_LANG+3:
        case ID_LANG+4:
        case ID_LANG+5:
            if( HIWORD(lParam) == BN_CLICKED )
            {
                /* check if this language is available */
                if( (wParam-ID_LANG) >= nNumLang ) break;

                /* display the welcome message */
                nFileName = &nLangs[wParam-ID_LANG].cWelcome[0];
                /* update the selected language */
                nRTLanguage = (unsigned char)(wParam-ID_LANG);
                if( (nFileID = fopen( nFileName, "r" )) != NULL )
                {
                    nWelStr[0] = NULL;
                    while ( true )
                    {
                        /* get each line in the file */
                        if ( fgets( nTempStr, 100, nFileID ) == NULL ) break
                        strcat( nWelStr, nTempStr );
                    }
                    SetDlgItemText( hWndDlg, ID_EDIT, nWelStr );
                    fclose( nFileID );

                } else {
                    SetDlgItemText( hWndDlg, ID_EDIT, "Welcome Message not F
                }
            } else {
                return FALSE;
            }
            break;

        case IDOK:
            InvalidateRect( hWndMain, NULL, true );
            EndDialog( hWndDlg, IDOK );
            break;
```

```
            case IDCANCEL:
                InvalidateRect( hWndMain, NULL, true );
                EndDialog( hWndDlg, IDCANCEL );
               break;

           default:
               return FALSE;
               break;
           }
        break;

    default:
        return FALSE;
}
return TRUE;
}


/*********************************************************************/
/*                                                                   */
/* Dialog Window Procedure                                           */
/*                                                                   */
/*********************************************************************/

BOOL FAR PASCAL FISSYSADVANCEMsgProc(HWND hWndDlg, WORD Message, WORD wParam, LO
{
unsigned int i;
static unsigned int nOption;
static struct tUserLog nTempRec;        /* temporary data area */

 switch(Message)
   {
    case WM_INITDIALOG:
        cwCenter(hWndDlg, 0);
        LoadCursor( NULL, IDC_ARROW );
        /* set the titles to indicate the approprite language */
        SetDlgItemText( hWndDlg, ID_TEXT0, nRTTitle[nRTLanguage][90] );
        SetDlgItemText( hWndDlg, ID_TEXT1, nRTTitle[nRTLanguage][91] );
        SetDlgItemText( hWndDlg, ID_TEXT2, nRTTitle[nRTLanguage][92] );
        SetDlgItemText( hWndDlg, ID_TEXT3, nRTTitle[nRTLanguage][93] );
        SetDlgItemText( hWndDlg, ID_TEXT4, nRTTitle[nRTLanguage][94] );
        SetDlgItemText( hWndDlg, ID_TEXT5, nRTTitle[nRTLanguage][95] );
        SetDlgItemText( hWndDlg, ID_TEXT6, nRTTitle[nRTLanguage][96] );
        SetDlgItemText( hWndDlg, ID_TEXT7, nRTTitle[nRTLanguage][97] );
        SetDlgItemText( hWndDlg, ID_TEXT8, nRTTitle[nRTLanguage][98] );
        SetDlgItemText( hWndDlg, ID_TEXT9, nRTTitle[nRTLanguage][99] );
        SetDlgItemText( hWndDlg, ID_TEXT10, nRTTitle[nRTLanguage][100] );

        SetDlgItemText( hWndDlg, ID_TEMPLATE, nRTTitle[nRTLanguage][101] );
        SetDlgItemText( hWndDlg, ID_DESIRED, nRTTitle[nRTLanguage][102] );
        SetDlgItemText( hWndDlg, ID_DRAWSHOT, nRTTitle[nRTLanguage][103] );

        SetDlgItemText( hWndDlg, IDOK, nRTTitle[nRTLanguage][104] );
        SetDlgItemText( hWndDlg, IDCANCEL, nRTTitle[nRTLanguage][105] );
        SetDlgItemText( hWndDlg, IDRETRY, nRTTitle[nRTLanguage][106] );
        /* check if this is the advanced or student options */
        if( lParam == ID_ADVANCED )
        {
            SetWindowText( hWndDlg, nRTTitle[nRTLanguage][73] );
            nOption = ID_ADVANCED;
            /* initialize data */
            memcpy( nTempRec.nSensors, nSenThresh, (nNumSensors*2) );
            nTempRec.nStudGun = dGunType;
            nTempRec.nTemplateShot = nTemplateShot;
            nTempRec.nShotStats = nShotStats;
            nTempRec.nDrawShot = nDrawShot;
        } else {
            SetWindowText( hWndDlg, nRTTitle[nRTLanguage][74] );
            nOption = ID_STUDENT;
            /* initialize data */
            nTempRec = nStudRecord;
        }
        /* set the radio button to its initial value */
        switch ( nTempRec.nStudGun )
        {
```

```
        case dGunSig:
            CheckRadioButton( hWndDlg, ID_GUN_SWM10, ID_GUN_BHI,
            ID_GUN_SIG );
            break;

        case dGunSW10:
            CheckRadioButton( hWndDlg, ID_GUN_SWM10, ID_GUN_BHI,
             ID_GUN_SWM10 );
            break;

        case dGunGlock:
            CheckRadioButton( hWndDlg, ID_GUN_SWM10, ID_GUN_BHI,
             ID_GUN_GM17 );
            break;

        case dGunBHI:
            CheckRadioButton( hWndDlg, ID_GUN_SWM10, ID_GUN_BHI,
             ID_GUN_BHI );
            break;
    }
    /* display the sensor thresholds */
    for (i=0;i<nNumSensors;i++)
    {
        SetDlgItemInt( hWndDlg, (ID_GRIPLOW+i), ((unsigned int)nTempRec.nSen
        SetDlgItemInt( hWndDlg, (ID_GRIPHIGH+i), ((unsigned int)nTempRec.nSe
    }

    /* set the template shot button to its initial value */
    CheckDlgButton( hWndDlg, ID_TEMPLATE, nTempRec.nTemplateShot );
    CheckDlgButton( hWndDlg, ID_DESIRED, nTempRec.nShotStats );
    CheckDlgButton( hWndDlg, ID_DRAWSHOT, nTempRec.nDrawShot );
    break;

case WM_CLOSE:
     PostMessage(hWndDlg, WM_COMMAND, IDCANCEL, 0L);
     break;

case WM_COMMAND:
    switch(wParam)
    {
        case ID_GUN_SIG:
            CheckRadioButton( hWndDlg, ID_GUN_SWM10, ID_GUN_BHI,
            ID_GUN_SIG );
            nTempRec.nStudGun = dGunSig;
            break;

        case ID_GUN_SWM10:
            CheckRadioButton( hWndDlg, ID_GUN_SWM10, ID_GUN_BHI,
             ID_GUN_SWM10 );
            nTempRec.nStudGun = dGunSW10;
            break;

        case ID_GUN_GM17:
            CheckRadioButton( hWndDlg, ID_GUN_SWM10, ID_GUN_BHI,
            ID_GUN_GM17 );
            nTempRec.nStudGun = dGunGlock;
            break;

        case ID_GUN_BHI:
            CheckRadioButton( hWndDlg, ID_GUN_SWM10, ID_GUN_BHI,
            ID_GUN_BHI );
            nTempRec.nStudGun = dGunBHI;
            break;

        case ID_GUN_SW669:
            CheckRadioButton( hWndDlg, ID_GUN_SWM10, ID_GUN_BHI,
            ID_GUN_SWM10 );
            nTempRec.nStudGun = dGunSW10;
            break;

        case IDOK:
            /* get the current values */
            for( i=0;i<nNumSensors;i++)
            {
                nTempRec.nSensors[i][0] = (unsigned char)(GetDlgItemInt( hWn
                                        *nMaxValue/100);
```

```
                nTempRec.nSensors[i][1] = (unsigned char)(GetDlgItemInt( hWn
                                    *nMaxValue/100);
            }
            /* get all the newly set values */
            nTempRec.nTemplateShot = (unsigned char)IsDlgButtonChecked(hWndD
            nTempRec.nDrawShot = (unsigned char)IsDlgButtonChecked(hWndDlg,
            nTempRec.nShotStats = (unsigned char)IsDlgButtonChecked(hWndDlg,
            /* set the appropriate values to the edited values */
            if( nOption == ID_STUDENT )
            {
                nStudRecord = nTempRec;
            } else {
                dGunType = nTempRec.nStudGun;
                memcpy( nSenThresh, nTempRec.nSensors, (nNumSensors*2) );
                nTemplateShot = nTempRec.nTemplateShot;
                nDrawShot = nTempRec.nDrawShot;
                nShotStats = nTempRec.nShotStats;
            }
            EndDialog(hWndDlg, TRUE);
            break;

        case IDCANCEL:
            EndDialog( hWndDlg, FALSE );
            break;

        case IDRETRY:
            if( nOption == ID_STUDENT )
            {
                /* set all variables to system defaults */
                memcpy( nTempRec.nSensors, nSenThresh, (nNumSensors*2) );
                nTempRec.nStudGun = dGunType;
                nTempRec.nTemplateShot = nTemplateShot;
                nTempRec.nShotStats = nShotStats;
                nTempRec.nDrawShot = nDrawShot;
            }
            /* set the radio button to its initial value */
            switch ( nTempRec.nStudGun )
            {
                case dGunSig:
                    CheckRadioButton( hWndDlg, ID_GUN_SWM10, ID_GUN_BHI,
                    ID_GUN_SIG );
                    break;

                case dGunSW10:
                    CheckRadioButton( hWndDlg, ID_GUN_SWM10, ID_GUN_BHI,
                     ID_GUN_SWM10 );
                    break;

                case dGunGlock:
                    CheckRadioButton( hWndDlg, ID_GUN_SWM10, ID_GUN_BHI,
                     ID_GUN_GM17 );
                    break;

                case dGunBHI:
                    CheckRadioButton( hWndDlg, ID_GUN_SWM10, ID_GUN_BHI,
                     ID_GUN_BHI );
                    break;
            }
            /* display the sensor thresholds */
            for (i=0;i<nNumSensors;i++)
            {
                SetDlgItemInt( hWndDlg, (ID_GRIPLOW+i), ((unsigned int)nTemp
                SetDlgItemInt( hWndDlg, (ID_GRIPHIGH+i), ((unsigned int)nTem
            }

            /* set the template shot button to its initial value */
            CheckDlgButton( hWndDlg, ID_TEMPLATE, nTempRec.nTemplateShot );
            CheckDlgButton( hWndDlg, ID_DESIRED, nTempRec.nShotStats );
            CheckDlgButton( hWndDlg, ID_DRAWSHOT, nTempRec.nDrawShot );
            break;
        }
    break;

default:
    return FALSE;
```

```
}
return TRUE;
}
```

Windows Include Files

```
#include <windows.h>
#include <string.h>
#include <stdlib.h>

#define nPlotX 0
#define nRealY 0                /* starting location of Realtime display */
#define nSingleY 105            /* starting location of Single Shot display */
#define nRealSizeX 320
#define nRealSizeY 105          /* starting size of windows */
#define nSingleSizeY 118        /* starting size of windows */
#define nFullSizeY 223

#define nNormalX 0              /* accessory window position definitions */
#define nNormalY 0
#define nDoubleX 160
#define nTripleX1 105
#define nTripleX2 210
#define nFullY 123

#define nNormalSizeX 150
#define nNormalSizeY 150                /* starting size of windows */
#define nDoubleSizeX 150
#define nDoubleSizeY 150
#define nTripleSizeX 100
#define nTripleSizeY 100

#define n10mil 3                /* timer id for 10 millisecond timer */
#define n10milTicks 10          /* number of milliseconds to wait */
#define n10TickSec 100          /* number of ticks per second */

#define n100mil 1               /* timer id for 100 millisecond timer */
#define n100milTicks 100        /* number of milliseconds to wait */
#define n100TickSec 10          /* number of ticks per second */

#define n500mil 2               /* timer id for 30 millisecond timer */
#define n500milTicks 500        /* number of milliseconds to wait */
#define n500TickSec 2           /* number of ticks per second */

#define seen_true 3
#define true 1
#define seen_false 2
#define false 0

#define FIS_HELPONHELP 0x2000

/* text and label colors */
#define rGreen RGB(0,255,0)
#define rRed   RGB(255,0,0)
#define rYellow RGB(255,130,0)
#define rBlue  RGB(0,0,255)
#define rBlack RGB(0,0,0)
#define rWhite RGB(255,255,255)
#define rPlotBack RGB(192,192,192)

/* main window menu options */
#define IDM_F_EXIT      1000

#define IDM_OPTIONS     2000
#define IDM_O_REALTIME          2050
#define IDM_O_ADVANCED          2100
#define IDM_O_ACTIVITY          2125
#define IDM_O_ONESHOT           2150
#define IDM_O_NAMES             2200
#define IDM_O_SEQUENCE          2250
#define IDM_O_SENSORS           2300
#define IDM_O_SENSET            2350
#define IDM_O_STUDENT           2400
```

```
#define IDM_O_CALIB             2450
#define IDM_O_DISPLAY           2500
#define IDM_O_INSTRUCT          2550
#define IDM_O_TOOLS             2600
#define IDM_O_FOCUS             2650
#define IDM_O_LOGIN             2700
#define IDM_O_STAGE1            2750
#define IDM_O_STAGE2            2800
#define IDM_O_STAGE3            2850
#define IDM_O_STAGE4            2900
#define IDM_O_STAGE5            2950

#define IDM_HELP        3000
#define IDM_H_ICONIFY           3050
#define IDM_H_ABOUT             3200
#define IDM_H_REPAINT           3250
#define IDM_H_ROTDOWN           3300
#define IDM_H_HELP              3350
#define IDM_H_CONTENTS          3400
#define IDM_H_HELPONHELP        3450
#define FIS_HELPONHELP          0x2000

/* realtime window menu options */
#define IDM_REALTIME    4000
#define IDM_R_NEW               4025
#define IDM_R_START             4050
#define IDM_R_STOP              4100
#define IDM_R_SAVE              4125
#define IDM_R_OPEN              4135
#define IDM_R_CLEAR             4150
#define IDM_R_EXIT              4200
#define IDM_R_ABOUT             4250
#define IDM_R_HOME              4260
#define IDM_R_END               4265
#define IDM_R_WAYBACK           4275
#define IDM_R_BACK              4300
#define IDM_R_NEXT              4350
#define IDM_R_WAYNEXT           4400
#define IDM_R_OPTION            4450
#define IDM_R_CALIBRATE         4500
#define IDM_R_ZERO              4525
#define IDM_R_LEGEND            4550
#define IDM_R_NEXTGROUP         4600
#define IDM_R_PREVGROUP         4650

#define IDM_DISPLAY     7000
#define IDM_D_ZERO              7100
#define IDM_D_ONE               7101
#define IDM_D_TWO               7102
#define IDM_D_THREE             7103
#define IDM_D_FOUR              7104
#define IDM_D_FIVE              7105
#define IDM_D_SIX               7106
#define IDM_D_SEVEN             7107
#define IDM_D_ALLON             7108
#define IDM_D_ALLOFF            7109

#define IDM_C_SAVE      8000
#define IDM_C_OPEN              8050

#define IDM_PAINT       9000
#define IDM_PRINT               9050
#define IDM_PRINTSETUP          0xEF10
#define IDM_SYS_ABOUT           0xEF20
#define IDM_SYS_COLOR           0xEF30

/* single shot window menu options */
#define IDM_SINGLESHOT  6000
#define IDM_S_FOLLOW            6050
#define IDM_S_OPEN              6100
#define IDM_S_EXIT              6200
#define IDM_S_ABOUT             6250
#define IDM_S_SHOT              6300
#define IDM_S_PLAYBACK          6350
#define IDM_S_INC               6400
```

```
#define IDM_S_DEC                6450
#define IDM_S_POSITION           6500
#define IDM_S_GRIPFORCE          6550
#define IDM_S_TRIGGER            6600

/* error symbols */
#define IDS_ERR_REGISTER_CLASS    1
#define IDS_ERR_CREATE_WINDOW     2

/* dialog labels */
#define ID_ABOUT                 100
#define ID_EXIT                  101
#define ID_ABOUT_REAL            102
#define ID_ABOUT_VIDEO           103
#define ID_ABOUT_SINGLE          104
#define ID_CLOSE                 105
#define ID_COUNT                 106
#define ID_OPTION                107
#define ID_SHOTINFO              108
#define ID_NAMES                 109
#define ID_POSITION              110
#define ID_GRIPFORCE             111
#define ID_TRIGGER               112
#define ID_GRIPTRIG              113
#define ID_ASKSAVE               114
#define ID_SENSET                115
#define ID_SAVEREST              116
#define ID_LOPEN                 117
#define ID_LSAVE                 118
#define ID_SENSORS               119
#define ID_MAXVALUE              120
#define ID_ASKCONF               121
#define ID_SAVECONF              122
#define ID_STUDENT               123
#define ID_CALIB                 124
#define ID_LEDIT                 125
#define ID_DISPLAY               126
#define ID_INSTRUCT              127
#define ID_LOGIN                 128
#define ID_TOOLBOX               129
#define ID_WELCOME               130
#define ID_ADVANCED              131
#define ID_LEGEND                132
#define ID_SEQUENCE              133

/* dialog control specifiers */
#define ID_DUR                   200
#define ID_SHOTS                 201
#define ID_THRESH                202
#define ID_GUN_SWM10             203
#define ID_GUN_GM17              204
#define ID_GUN_SIG               205
#define ID_GUN_SW669             206
#define ID_GUN_BHI               207
#define ID_SAMPLES               208
#define ID_SETSHOT               209
#define ID_ONESCROLL             210
#define ID_DESIRED               211
#define ID_DIR                   212
#define ID_FID                   213
#define ID_DRIVE                 214
#define ID_TRIGSTART             215
#define ID_SHOTDET               216
#define ID_DRAWSHOT              217
#define ID_TRIGSEN               218
#define ID_FRONTSEN              219
#define ID_SIDESEN               220
#define ID_STUDNAME              221
#define ID_STUDNUM               222
#define ID_STUDFORC              223
#define ID_FORCNUM               224
#define ID_STUDINST              225
#define ID_PASSWORD              226
#define ID_TEMPLATE              227
#define ID_EDIT                  228
```

```
#define ID_WINDOW          229
#define ID_LANG            230     /* leave 230-239 for languages */
#define ID_NEXT            240
#define ID_PREV            241
#define ID_NEW             242
#define ID_DELETE          243
#define ID_COURSE          244
#define ID_GRIPHIGH        250     /* leave 250-270 for other sensors */
#define ID_GRIPLOW         260
#define ID_STAGE           271
#define ID_STARTVOICE      272
#define ID_STOPVOICE       273
#define ID_CRSSTART        274
#define ID_CRSSTOP         275
#define ID_STAGEDELAY      276
#define ID_CRSDELAY        277
#define ID_INTERDELAY      278
#define ID_STAGEDESC       279
#define ID_CRSDESC         280
#define ID_LIST            281
#define ID_REMOVE          282
#define ID_ADD             283
#define ID_TEXT0           300
#define ID_TEXT1           301
#define ID_TEXT2           302
#define ID_TEXT3           303
#define ID_TEXT4           304
#define ID_TEXT5           305
#define ID_TEXT6           306
#define ID_TEXT7           307
#define ID_TEXT8           308
#define ID_TEXT9           309
#define ID_TEXT10          310

/* icon symbols */
#define ICON_MAIN          3000
#define ICON_REAL          3001
#define ICON_WAIT          3002
#define ICON_VIDEO         3003
#define ICON_SINGLE        3004
#define ICON_SENSOR        3005
#define ICON_FORCE         3006
#define ICON_TRIGGER       3007

/* enumerated types */
#define dSampleSize 1000
#define dSetSize    200
#define nNumSensors 4
enum eGunType {dGunSW10=0, dGunSig, dGunGlock, dGunBHI};
#define nNumSounds 3
enum eSound { dBeep=0, dChime, dBell };

#define ID_Search      0
#define NextPass       1
#define PrevPass       2
#define FirstPass      3
#define LastPass       4
#define NextStage      5
#define PrevStage      6
#define FirstStage     7
#define LastStage      8
#define NextCourse     9
#define PrevCourse     10
#define FirstCourse    11
#define LastCourse     12
#define NextShot       13
#define PrevShot       14
#define FirstShot      15
#define LastShot       16

/* assignment variables */
#define nTrigSen 0
#define nLSideSen 1
#define nRSideSen 2
#define nFrontSen 3
```

```
/* macros */
#define WIDTHBYTES(bits)        (((bits) + 31) / 32 * 4)

/* structures */
/* Single point structure */
struct tShotData
{
  unsigned long nTimeStamp;
  unsigned char nSensors[nNumSensors];
};

/* data collection structure */
struct tShotSet;
struct tShotSet
{
  struct tShotData sShots[dSetSize];
  HANDLE hSetHand;
  struct tShotSet * pNextSet;
  struct tShotSet * pPrevSet;
  struct tShotSet * pNextGroup;
  struct tShotSet * pPrevGroup;
  unsigned long nSamples;
};

/* language text structure */
struct tRTLang
{
  unsigned char cLang[20];              /* language title */
  unsigned char cWelcome[100];          /* welcome message file */
  unsigned char cText[100];             /* language specific text file */
  unsigned int nDialIndex;              /* dialog box index */
};

/* login information structure */
struct tUserLog
{
  unsigned char nID[13];
  unsigned char nPass[13];
  unsigned char nInstID[33];
  unsigned char nStudName[33];
  unsigned char nStudInst[33];
  unsigned char nLanguage;
  unsigned char nInstructor;
  unsigned char nFileOver;
  unsigned char nFileDir[51];
  unsigned char nSensors[nNumSensors][2];
  enum eGunType nStudGun;
  unsigned char nTemplateShot;
  unsigned char nShotStats;
  unsigned char nDrawShot;
};

/* stage information */
struct tStage
{
  unsigned char nName[21];
  unsigned int nSDelay;
  enum eSound nBVoice;
  unsigned int nShots;
  unsigned int nDur;
  enum eSound nEVoice;
  unsigned char nDescrip[101];
};

/* course of fire information */
struct tCourse
{
  unsigned char nName[21];
  unsigned int nSDelay;
  enum eSound nBVoice;
  unsigned char nStages[10][21];
  enum eSound nEVoice;
  unsigned int nInter;
  unsigned char nDescrip[101];
};
```

```
typedef struct
{
   BOOL bGraphics;
   BOOL bText;
   RECT GraphicsRect;
} BANDINFOSTRUCT;

struct tRealData
{
    struct tShotData nData[2000];
    unsigned int nNum;
};

/* system includes */
#include <time.h>
#include <stdlib.h>
#include <stdio.h>
#include <memory.h>
#if _MSC_VER == 700
#include <commdlg.h>
#endif

/* FIS Version */
float nFISVersion = (float)2.01;
char szString[128];   /* variable to load resource strings        */
char szAppName[20];   /* class name for the main window */
char szForceString[128];   /* variable to load resource strings        */
char szForceName[20];   /* class name for the window                */
char szLegendString[128];   /* variable to load resource strings        */
char szLegendName[20];   /* class name for the window                */
char szSingleString[128];   /* variable to load resource strings        */
char szSingleName[20];   /* class name for the window                */
char szRealString[128];   /* variable to load resource strings        */
char szRealName[20];   /* class name for the window                */
char szToolBoxString[128];   /* variable to load resource strings        */
char szToolBoxName[20];   /* class name for the window                */
char szTriggerString[128];   /* variable to load resource strings        */
char szTriggerName[20];   /* class name for the window                */

/* main window bits */
HBITMAP hBitMain;

HWND hInstMain,hInstForce,hInstLegend,hInstSingle,hInstReal,hInstToolBox,hInstTr
HWND hWndMain,hWndForce,hWndLegend,hWndSingle,hWndReal,hWndToolBox,hWndTrigger;
HDC  hDCMain,hDCForce,hDCLegend,hDCSingle,hDCReal,hDCToolBox,hDCTrigger;
RECT nForceRect,nLegendSize,nOneSize,nRealSize,nToolSize,nTriggerRect;
HMENU hMainMenu;

/* globals for window creation and manipulation */
unsigned char cReal = false;
unsigned char cSingle = false;
unsigned char cVideo = false;
unsigned char cShot = false;
unsigned char cPosition = false;
unsigned char cForce = false;
unsigned char cTrigger = false;
HANDLE hAccToolBox, hAccel, hAccReal, hAccSingle, hAccForce, hAccTrigger;
HWND hTopWnd=NULL;

/* serial port data collection */
WORD nSerialTimer;
FARPROC lpSerialFunc;
int nSerialPos=0;
BOOL nSerTimeInit=true;
unsigned char nSerOffset=0;
unsigned long nSerTime=0;
unsigned char nLastTime=0;
unsigned int nSerialDelta=6;
int nFISComm;

/* toolbox variables */
HWND hPrevTool = NULL;
```

```
/* realtime specific variable */
int nRealTimer;
int nRealDur=0;
int nRealStart=0;     /* time offset to start of data */
BOOL nRealOn=false;
BOOL nPlotShot=false;
FARPROC         FISADProcInst;  /* procedure instance for timer */

/* shot collection variables */
struct tRealData nRealData;
unsigned int nRealOff=0;
struct tShotSet * nRealPtr = NULL;
unsigned long nSysStart=0;
unsigned int cSamples[nNumSensors][4];

/* data collection globals */
unsigned int nADHead = 0;
unsigned int nRealTail=0;
unsigned int nOneTail = 0;

/* colors and pens for plotting */
HPEN pSensor[nNumSensors][3];
/* sensor line colors */
COLORREF cSensor[nNumSensors] =
{
        RGB( 0, 0, 0  ),
        RGB( 255, 0, 0 ),
        RGB( 0, 0, 255 ),
        RGB( 0, 255, 0 ),
};
/* realtime specific variable */
unsigned int nOneDur=3;
unsigned int nOneStart=0;     /* time offset to start of data */
unsigned int nOneData=0;                /* number of points collected */
unsigned long nOnePoints;
unsigned long nOneSync;
unsigned long nSysSingle;

/* collection variables */
unsigned int sSamples[nNumSensors+1][4];
unsigned long nCurOffSet = 0;
struct tShotSet * nCurData = NULL;
struct tShotSet * nCurSet = NULL;
struct tShotSet * nGroupSet = NULL;
time_t nCollectTime;

/* threshold checking information */
unsigned char nPlotSaved = true;
unsigned char nPlotOn = false;
unsigned int nCurGroup = 0;
unsigned int nGroups = 0;
unsigned int nOneShots = 0;
unsigned char nDrawShot=true;
unsigned char nTemplateShot=true;
unsigned char nShotStats=true;
unsigned char nDrawAvg=true;

/* scaling information */
unsigned char nInvertY[nNumSensors] = {false,true,true,false};
unsigned char cCollect[nNumSensors] = {true,true,true,true};            /* turn
unsigned char cNames[nNumSensors][33] = {"Trigger Position(d)\0",
                                         "Left Side Grip(d)  \0",
                                         "Right Side Grip(d) \0",
                                         "Front Side Grip(d) \0"};
unsigned char nMaxValue = 0xff;

/* sensor thresholds */
unsigned char nSenThresh[nNumSensors][2] =
              { 245,64,                 /* shot level and start */
                60,100,                 /* front grip force low, high */
                60,100,                 /* left grip force low, high */
                60,100};                        /* right grip force low, high */

/* sample collection array */
unsigned char rawSamples[nNumSensors][dSampleSize];
```

```
unsigned long rawTime[dSampleSize];

/* student information */
struct tUserLog nStudRecord;
/* grip force monitoring parameters */
unsigned int nPrevLSide, nPrevRSide;
unsigned int nPrevFront;

/* login variables */
unsigned char FISLogged = false;

/* file storage and retrieval variables */
unsigned long nOpenSave = ID_LSAVE;
unsigned char nDefPath[100] = { "." };
unsigned char nFilePath[100] = { "\\*.*" };
unsigned char nNewDisk = false;
enum eGunType dGunType = dGunSig;

/* login / administration varaibles */
unsigned char nLogEnable = false;
unsigned char nPassEnable = false;
unsigned char nFileProt = false;
unsigned char nLangFile[100] = { ".\\rtlang.txt" };

/* course/stage variables */
unsigned char cSound[nNumSounds][20] = { "Beep", "Chime", "Bell" };
struct tStage nCurStage;
struct tCourse nCurCourse;
unsigned char nStageFile[100] = { "\\rtstage.ini" };
unsigned char nCourseFile[100] = { "\\rtcourse.ini" };

/* language definition array */
unsigned char nNumLang = 0;
unsigned char nRTLanguage = 0;
struct tRTLang nLangs[2];
unsigned char nRTTitle[2][200][50];

/* toolbox flags */
unsigned int tReal = 0x83ff;
unsigned int tSingle = 0x73ff;
unsigned int tMain = 0x0000;
unsigned int tTrigger = 0x03cf;
unsigned int tGForce = 0x03cf;

/* global pen, brush and font declarations*/
```

```
HFONT   hFontX,hFontY,hOrgFont;
HPEN    hPenRed,hPenYellow,hPenGreen,hPenBlue,hOrgPen,hPenBlack,hPenWhite;
HBRUSH  hBrushYellow, hBrushRed, hBrushGreen, hBrushBlue, hBrushBlack, hBrushWhi

/* initialize the font to use */
LOGFONT lFisFont;
LPLOGFONT lpFisFont = &lFisFont;
LOGBRUSH lBlackBrush, lWhiteBrush, lYellowBrush, lRedBrush, lGreenBrush, lBlueBr
LPLOGBRUSH lpBlackBrush = &lBlackBrush;
LPLOGBRUSH lpWhiteBrush = &lWhiteBrush;
LPLOGBRUSH lpRedBrush = &lRedBrush;
LPLOGBRUSH lpGreenBrush = &lGreenBrush;
LPLOGBRUSH lpBlueBrush = &lBlueBrush;
LPLOGBRUSH lpYellowBrush = &lYellowBrush;

/* routine declarations */
LONG FAR PASCAL FISMAINWndProc(HWND, WORD, WORD, LONG);
int             nCwRegMainClass(void);
void            CwUnRegisterClasses(void);
void            cwCenter(HWND, int);

int FAR         CreateForce( HANDLE , HWND );
LONG FAR PASCAL ForceWndProc(HWND, WORD, WORD, LONG);
int             nCwRegForceClasses(void);

int FAR         CreateLegend( HANDLE , HWND );
LONG FAR PASCAL LegendWndProc(HWND, WORD, WORD, LONG);
int             nCwRegLegendClasses(void);

int FAR         CreateOneShot( HANDLE, HWND );
LONG FAR PASCAL OneShotWndProc(HWND, WORD, WORD, LONG);
int             nCwRegSingleClass(void);

int FAR         CreateRealtime( HANDLE, HWND );
LONG FAR PASCAL RealTimeWndProc(HWND, WORD, WORD, LONG);
int             nCwRegRealClass(void);

int FAR         CreateToolBox( HANDLE , HWND );
LONG FAR PASCAL ToolBoxWndProc(HWND, WORD, WORD, LONG);
int             nCwRegToolBoxClasses(void);

int FAR         CreateTrigger( HANDLE , HWND );
LONG FAR PASCAL TriggerWndProc(HWND, WORD, WORD, LONG);
int             nCwRegTriggerClasses(void);

/* system includes */
#include <time.h>

/* FIS Version */
float nFISVersion = (float)2.01;
char szString[128];   /* variable to load resource strings         */
char szAppName[20];   /* class name for the main window */
char szForceString[128];   /* variable to load resource strings         */
char szForceName[20];   /* class name for the window                */
char szLegendString[128];   /* variable to load resource strings         */
char szLegendName[20];   /* class name for the window                */
char szSingleString[128];   /* variable to load resource strings         */
char szSingleName[20];   /* class name for the window                */
char szRealString[128];   /* variable to load resource strings         */
char szRealName[20];   /* class name for the window                */
char szToolBoxString[128];   /* variable to load resource strings         */
char szToolBoxName[20];   /* class name for the window                */
char szTriggerString[128];   /* variable to load resource strings         */
char szTriggerName[20];   /* class name for the window                */

/* main window bits */
HBITMAP hBitMain;

HWND hInstMain,hInstForce,hInstLegend,hInstSingle,hInstReal,hInstToolBox,hInstTr
HWND hWndMain,hWndForce,hWndLegend,hWndSingle,hWndReal,hWndToolBox,hWndTrigger;
HDC  hDCMain,hDCForce,hDCLegend,hDCSingle,hDCReal,hDCToolBox,hDCTrigger;
RECT nForceRect,nLegendSize,nOneSize,nRealSize,nToolSize,nTriggerRect;
HMENU hMainMenu;

/* globals for window creation and manipulation */
```

```
unsigned char cReal = false;
unsigned char cSingle = false;
unsigned char cVideo = false;
unsigned char cShot = false;
unsigned char cPosition = false;
unsigned char cForce = false;
unsigned char cTrigger = false;
HANDLE hAccToolBox, hAccel, hAccReal, hAccSingle, hAccForce, hAccTrigger;
HWND hTopWnd=NULL;

/* serial port data collection */
WORD nSerialTimer;
FARPROC lpSerialFunc;
int nSerialPos=0;
BOOL nSerTimeInit=true;
unsigned char nSerOffset=0;
unsigned long nSerTime=0;
unsigned char nLastTime=0;
unsigned int nSerialDelta=6;
int nFISComm;

/* toolbox variables */
HWND hPrevTool = NULL;

/* realtime specific variable */
int nRealTimer;
int nRealDur=0;
int nRealStart=0;     /* time offset to start of data */
BOOL nRealOn=false;
BOOL nPlotShot=false;

FARPROC         FISADProcInst;  /* procedure instance for timer */

/* shot collection variables */
struct tRealData nRealData;
unsigned int nRealOff=0;
struct tShotSet * nRealPtr = NULL;
unsigned long nSysStart=0;
unsigned int cSamples[nNumSensors][4];

/* data collection globals */
unsigned int nADHead = 0;
unsigned int nRealTail=0;
unsigned int nOneTail = 0;

/* colors and pens for plotting */
HPEN pSensor[nNumSensors][3];
/* sensor line colors */
COLORREF cSensor[nNumSensors] =
{
        RGB( 0, 0, 0  ),
        RGB( 255, 0, 0 ),
        RGB( 0, 0, 255 ),
        RGB( 0, 255, 0 ),
};
/* realtime specific variable */
unsigned int nOneDur=3;
unsigned int nOneStart=0;     /* time offset to start of data */
unsigned int nOneData=0;                /* number of points collected */
unsigned long nOnePoints;
unsigned long nOneSync;
unsigned long nSysSingle;

/* collection variables */
unsigned int sSamples[nNumSensors+1][4];
unsigned long nCurOffSet = 0;
struct tShotSet * nCurData = NULL;
struct tShotSet * nCurSet = NULL;
struct tShotSet * nGroupSet = NULL;
time_t nCollectTime;

/* threshold checking information */
unsigned char nPlotSaved = true;
unsigned char nPlotOn = false;
unsigned int nCurGroup = 0;
```

```
unsigned int nGroups = 0;
unsigned int nOneShots = 0;
unsigned char nDrawShot=true;
unsigned char nTemplateShot=true;
unsigned char nShotStats=true;
unsigned char nDrawAvg=true;

/* scaling information */
unsigned char nInvertY[nNumSensors] = {false,true,true,false};
unsigned char cCollect[nNumSensors] = {true,true,true,true};            /* turn
unsigned char cNames[nNumSensors][33] = {"Trigger Position(d)\0",
                                         "Left Side Grip(d)  \0",
                                         "Right Side Grip(d) \0",
                                         "Front Side Grip(d) \0"};

unsigned char nMaxValue = 0xff;

/* sensor thresholds */
unsigned char nSenThresh[nNumSensors][2] =
              { 245,64,                 /* shot level and start */
                60,100,                 /* front grip force low, high */
                60,100,                 /* left grip force low, high */
                60,100};                        /* right grip force low, high */

/* sample collection array */
unsigned char rawSamples[nNumSensors][dSampleSize];
unsigned long rawTime[dSampleSize];

/* student information */
struct tUserLog nStudRecord;
/* grip force monitoring parameters */
unsigned int nPrevLSide, nPrevRSide;
unsigned int nPrevFront;

/* login variables */
unsigned char FISLogged = false;

/* file storage and retrieval variables */
unsigned long nOpenSave = ID_LSAVE;
unsigned char nDefPath[100] = { "." };
unsigned char nFilePath[100] = { "\\*.*" };
unsigned char nNewDisk = false;
enum eGunType dGunType = dGunSig;

/* login / administration varaibles */
unsigned char nLogEnable = false;
unsigned char nPassEnable = false;
unsigned char nFileProt = false;
unsigned char nLangFile[100] = { ".\\rtlang.txt" };

/* course/stage variables */
unsigned char cSound[nNumSounds][20] = { "Beep", "Chime", "Bell" };
struct tStage nCurStage;
struct tCourse nCurCourse;
unsigned char nStageFile[100] = { "\\rtstage.ini" };
unsigned char nCourseFile[100] = { "\\rtcourse.ini" };

/* language definition array */
unsigned char nNumLang = 0;
unsigned char nRTLanguage = 0;
struct tRTLang nLangs[2];
unsigned char nRTTitle[2][200][50];

/* toolbox flags */
unsigned int tReal = 0x83ff;
unsigned int tSingle = 0x73ff;
unsigned int tMain = 0x0000;
unsigned int tTrigger = 0x03cf;
unsigned int tGForce = 0x03cf;

/* global pen, brush and font declarations*/
HFONT   hFontX,hFontY,hOrgFont;
HPEN    hPenRed,hPenYellow,hPenGreen,hPenBlue,hOrgPen,hPenBlack,hPenWhite;
HBRUSH  hBrushYellow, hBrushRed, hBrushGreen, hBrushBlue, hBrushBlack, hBrushWhi

/* initialize the font to use */
LOGFONT lFisFont;
```

```
LPLOGFONT lpFisFont = &lFisFont;
LOGBRUSH lBlackBrush, lWhiteBrush, lYellowBrush, lRedBrush, lGreenBrush, lBlueBr
LPLOGBRUSH lpBlackBrush = &lBlackBrush;
LPLOGBRUSH lpWhiteBrush = &lWhiteBrush;
LPLOGBRUSH lpRedBrush = &lRedBrush;
LPLOGBRUSH lpGreenBrush = &lGreenBrush;
LPLOGBRUSH lpBlueBrush = &lBlueBrush;
LPLOGBRUSH lpYellowBrush = &lYellowBrush;

/* routine declarations */
LONG FAR PASCAL FISMAINWndProc(HWND, WORD, WORD, LONG);
int             nCwRegMainClass(void);
void            CwUnRegisterClasses(void);
void            cwCenter(HWND, int);

int FAR         CreateForce( HANDLE , HWND );
LONG FAR PASCAL ForceWndProc(HWND, WORD, WORD, LONG);
int             nCwRegForceClasses(void);

int FAR         CreateLegend( HANDLE , HWND );
LONG FAR PASCAL LegendWndProc(HWND, WORD, WORD, LONG);
int             nCwRegLegendClasses(void);

int FAR         CreateOneShot( HANDLE, HWND );
LONG FAR PASCAL OneShotWndProc(HWND, WORD, WORD, LONG);
int             nCwRegSingleClass(void);

int FAR         CreateRealtime( HANDLE, HWND );
LONG FAR PASCAL RealTimeWndProc(HWND, WORD, WORD, LONG);
int             nCwRegRealClass(void);

int FAR         CreateToolBox( HANDLE , HWND );
LONG FAR PASCAL ToolBoxWndProc(HWND, WORD, WORD, LONG);
int             nCwRegToolBoxClasses(void);

int FAR         CreateTrigger( HANDLE , HWND );
LONG FAR PASCAL TriggerWndProc(HWND, WORD, WORD, LONG);
int             nCwRegTriggerClasses(void);
```

Windows Resource Files

```
#include "c:\source\rtv2.0\include\global.h"

RTMAIN MENU
  BEGIN
    POPUP "E&xit"
      BEGIN
        MENUITEM "&Log In ...", IDM_O_LOGIN
        MENUITEM "E&xit RangeTutor...", IDM_R_EXIT
      END
    POPUP "&Activities"
      BEGIN
        MENUITEM "&Grip Force", IDM_S_GRIPFORCE, GRAYED
        MENUITEM "&Trigger Control", IDM_S_TRIGGER, GRAYED
        MENUITEM "&Single Shot Analysis", IDM_O_REALTIME, GRAYED
        MENUITEM "&Multi Shot Analysis", IDM_O_ONESHOT, GRAYED
        MENUITEM "&Stages", IDM_O_INSTRUCT, GRAYED
        MENUITEM "&Courses", IDM_O_SEQUENCE, GRAYED
      END
    POPUP "&Setup"
      BEGIN
        MENUITEM "&Student Information ...", IDM_O_STUDENT, GRAYED
        MENUITEM SEPARATOR
        MENUITEM "&Legend", IDM_R_LEGEND, GRAYED
      END
    POPUP "A&dministration"
      BEGIN
        MENUITEM "&Activity Options ...", IDM_O_ACTIVITY, GRAYED
        MENUITEM "&System Options ...", IDM_O_ADVANCED, GRAYED
        MENUITEM SEPARATOR
        MENUITEM "S&tore Setup ...", IDM_C_SAVE, GRAYED
        MENUITEM "&Recall Setup ...", IDM_C_OPEN, GRAYED
      END
    MENUITEM "\a&Help", IDM_H_CONTENTS
  END
```

```
#include "oneshot.dlg"
#include "realtime.dlg"
#include "gforce.dlg"
#include "trigger.dlg"
#include "toolbox.dlg"

#include "ABTSINGL.DLG"
#include "ABTREAL.DLG"
#include "ABTFORCE.DLG"
#include "ABTTRIG.DLG"
#include "abttool.dlg"
#include "RTABOUT.DLG"

#include "RTEXIT.DLG"
#include "RTCLOSE.DLG"

#include "ASKSAVE.DLG"
#include "senseset.dlg"
#include "saverest.dlg"
#include "SAVECONF.dlg"
#include "studinfo.dlg"
#include "instruct.dlg"
#include "sequenc.dlg"
#include "login.dlg"
#include "welcome.dlg"
#include "advance.dlg"
#include "calib.dlg"
#include "legend.dlg"

RTMAIN ACCELERATORS
BEGIN
    VK_F7, IDM_PRINT, VIRTKEY
    VK_F8, IDM_H_REPAINT, VIRTKEY
    VK_F9, IDM_H_ROTDOWN, VIRTKEY
    "1", IDM_S_GRIPFORCE
    "2", IDM_S_TRIGGER
    "3", IDM_O_REALTIME
    "4", IDM_O_ONESHOT
END

STRINGTABLE
BEGIN
  IDS_ERR_CREATE_WINDOW,     "Window creation failed!"
  IDS_ERR_REGISTER_CLASS,    "Error registering window class"
END

?¼?±?½Ì?½?Ì±???¼??¼?¼½?±?½Ì½?½?±?±½?±±Ì½±Ì½½±±½ÌÌÌÌGRIPFORCE ICON LOADONCALL C:\
FORCEWIN CURSOR LOADONCALL C:\SOURCE\rtv2.0\BITMAPS\GFORCE.CUR

ID_GRIPFORCE DIALOG 69, 42, 147, 100
STYLE DS_SYSMODAL | WS_POPUP | WS_VISIBLE | WS_CAPTION
CAPTION "About Grip Force ..."
FONT 8, "Helv"
BEGIN
    ICON            "GRIPFORCE", ICON_SENSOR, 62, 32, 18, 20
    CTEXT           "Grip Force Display", 103, 24, 10, 95, 8
    DEFPUSHBUTTON   "OK", IDOK, 30, 74, 40, 14
    PUSHBUTTON      "Help On ...", IDM_HELP, 80, 74, 50, 14
END

REALTIME ICON  LOADONCALL C:\SOURCE\rtv2.0\BITMAPS\REALTIME.ICO
REAL_CUR CURSOR LOADONCALL C:\SOURCE\rtv2.0\BITMAPS\REALTIME.CUR

ID_ABOUT_REAL DIALOG 69, 42, 147, 100
STYLE DS_SYSMODAL | WS_POPUP | WS_VISIBLE | WS_CAPTION
CAPTION "About Single Shot Analysis ..."
FONT 8, "Helv"
BEGIN
    ICON            "REALTIME", ICON_REAL, 62, 32, 18, 20
    CTEXT           "Single Shot Analysis Display", 103, 24, 10, 95, 8
    DEFPUSHBUTTON   "OK", IDOK, 30, 74, 40, 14
    PUSHBUTTON      "Help On ...", IDM_HELP, 80, 74, 50, 14
END
```

```
ONESHOT ICON LOADONCALL C:\SOURCE\rtv2.0\BITMAPS\ONESHOT.ICO
SINGLE_CUR CURSOR LOADONCALL C:\SOURCE\rtv2.0\BITMAPS\ONESHOT.CUR

ID_ABOUT_SINGLE DIALOG 69, 42, 147, 100
STYLE DS_SYSMODAL | WS_POPUP | WS_VISIBLE | WS_CAPTION
CAPTION "About Multi-Shot Analysis ..."
FONT 8, "Helv"
BEGIN
    ICON            "ONESHOT", ICON_SINGLE, 62, 32, 18, 20
    CTEXT           "Nuliple Shot Analysis", 103, 24, 10, 95, 8
    DEFPUSHBUTTON   "OK", IDOK, 30, 74, 40, 14
    PUSHBUTTON      "Help On ...", IDM_HELP, 80, 74, 50, 14
END

TRIGGER ICON LOADONCALL C:\SOURCE\rtv2.0\BITMAPS\TRIGGER.ICO
TRIGWIN CURSOR LOADONCALL C:\SOURCE\rtv2.0\BITMAPS\TRIGGER.CUR

ID_TRIGGER DIALOG 69, 42, 147, 100
STYLE DS_SYSMODAL | WS_POPUP | WS_VISIBLE | WS_CAPTION
CAPTION "About Trigger Timing ..."
FONT 8, "Helv"
BEGIN
    ICON            "TRIGGER", ICON_TRIGGER, 62, 32, 18, 20
    CTEXT           "Trigger Timing Display", 103, 24, 10, 95, 8
    DEFPUSHBUTTON   "OK", IDOK, 30, 74, 40, 14
    PUSHBUTTON      "Help On ...", IDM_HELP, 80, 74, 50, 14
END

Disk_File ICON LOADONCALL C:\SOURCE\rtv2.0\BITMAPS\DISKFILE.ICO

ID_ASKSAVE DIALOG 135, 47, 142, 102
STYLE DS_SYSMODAL | WS_POPUP | WS_VISIBLE | WS_CAPTION
CAPTION "Save Data ?"
FONT 8, "Helv"
BEGIN
    DEFPUSHBUTTON   "DISCARD", IDNO, 50, 81, 40, 14
    PUSHBUTTON      "Save ...", IDOK, 4, 81, 40, 14
    PUSHBUTTON      "Cancel", IDCANCEL, 96, 81, 40, 14
    CTEXT           "Data Collected but not SAVED !",
                    ID_TEXT0, 19, 26, 112, 18, NOT WS_GROUP
    CTEXT            "Do you wish to Save ??", ID_TEXT1, 24, 60, 98, 8
    CTEXT            "or Discard data ??", ID_TEXT2, 19, 68, 113, 8
    ICON            "Disk_File", -1, 65, 3, 18, 20
END

TOOLBOX ICON LOADONCALL C:\SOURCE\rtv2.0\BITMAPS\TOOLBOX.ICO
TOOLCUR CURSOR LOADONCALL C:\SOURCE\rtv2.0\BITMAPS\TOOLBOX.CUR

ID_TOOLBOX DIALOG 69, 42, 147, 100
STYLE DS_SYSMODAL | WS_POPUP | WS_VISIBLE | WS_CAPTION
CAPTION "About ToolBox ..."
FONT 8, "Helv"
BEGIN
    ICON            "TOOLBOX", ICON_SENSOR, 62, 32, 18, 20
    CTEXT           "Range-Tutor ToolBox", 103, 24, 10, 95, 8
    DEFPUSHBUTTON   "OK", IDOK, 30, 74, 40, 14
    PUSHBUTTON      "Help On ...", IDM_HELP, 80, 74, 50, 14
END

ID_ADVANCED DIALOG 59, 15, 241, 198
STYLE DS_SYSMODAL | WS_POPUP | WS_VISIBLE | WS_CAPTION
CAPTION "Advanced Options"
FONT 8, "MS Sans Serif"
BEGIN
    GROUPBOX        "Gun Type", ID_TEXT0, 144, 94, 81, 73, WS_GROUP
    CONTROL         "S&&W Model 10",    ID_GUN_SWM10, "Button", BS_AUTORADIOBUTT
                    WS_TABSTOP, 147, 104, 70, 10
    CONTROL         "Sig Sauer P226",   ID_GUN_SIG, "Button", BS_AUTORADIOBUTTON
                    116, 70, 10
    CONTROL         "Glock Model 17",   ID_GUN_GM17, "Button", BS_AUTORADIOBUTTO
                    128, 70, 10
    CONTROL         "Browning HiPower", ID_GUN_BHI, "Button", BS_AUTORADIOBUTTON
                    148, 140, 70, 10
    CONTROL         "S&&Weston 669",    ID_GUN_SW669, "Button", BS_AUTORADIOBUTT
                    152, 70, 10
```

```
    GROUPBOX        "Shot Thresholds", ID_TEXT1, 3, 1, 233, 29, WS_GROUP
    LTEXT           "Shot Detection", ID_TEXT2, 27, 12, 54, 8, NOT WS_GROUP
    EDITTEXT        ID_GRIPLOW, 84, 10, 32, 12, WS_TABSTOP
    LTEXT           "Minimum Trigger Movement", ID_TEXT3, 141, 7, 56, 18, NOT
                    WS_GROUP
    EDITTEXT        ID_GRIPHIGH, 200, 10, 26, 12

    GROUPBOX        "Grip Thresholds", ID_TEXT4, 2, 34, 233, 54, WS_GROUP
    CTEXT           "Minimum Pressure", ID_TEXT5, 82, 39, 61, 8, NOT WS_GROUP
    LTEXT           "Maximum Pressure", ID_TEXT6, 167, 39, 63, 8, NOT WS_GROUP
    LTEXT           "Front Side Grip", ID_TEXT7, 8, 51, 51, 8, NOT WS_GROUP
    EDITTEXT        (ID_GRIPLOW+1), 95, 49, 32, 12, WS_TABSTOP
    EDITTEXT        (ID_GRIPHIGH+1), 183, 49, 32, 12
    LTEXT           "Left Side Grip",  ID_TEXT8, 8, 63, 49, 8, NOT WS_GROUP
    EDITTEXT        (ID_GRIPLOW+2), 95, 61, 32, 12
    EDITTEXT        (ID_GRIPHIGH+2), 183, 61, 32, 12
    LTEXT           "Right Side Grip", ID_TEXT9, 8, 75, 55, 8, NOT WS_GROUP
    EDITTEXT        (ID_GRIPLOW+3), 95, 73, 32, 12
    EDITTEXT        (ID_GRIPHIGH+3), 183, 73, 32, 12

    GROUPBOX        "Display Options", ID_TEXT10, 27, 99, 88, 63, WS_GROUP
    CONTROL         "Show Shot Template", ID_TEMPLATE, "Button", BS_AUTOCHECKBOX
                    WS_TABSTOP, 30, 110, 83, 10
    CONTROL         "Display Shot Stats", ID_DESIRED, "Button", BS_AUTOCHECKBOX,
                    30, 122, 83, 10
    CONTROL         "Draw Shot Position", ID_DRAWSHOT, "Button", BS_AUTOCHECKBOX
    CONTROL         "", -1, "Button", BS_AUTOCHECKBOX | NOT WS_GROUP, 30, 146, 8

    DEFPUSHBUTTON   "OK", IDOK,         72, 178, 40, 14, WS_GROUP | WS_TABSTOP
    PUSHBUTTON      "Cancel", IDCANCEL, 128, 178, 40, 14
    PUSHBUTTON      "Default!", IDRETRY, 190, 178, 40, 14, WS_GROUP | WS_TABSTOP
END

Conf_File ICON LOADONCALL C:\SOURCE\rtv2.0\BITMAPS\DISKFILE.ICO

ID_ASKCONF DIALOG 135, 47, 142, 102
STYLE DS_SYSMODAL | WS_POPUP | WS_VISIBLE | WS_CAPTION
CAPTION "Save ? ..."
FONT 8, "Helv"
BEGIN
    DEFPUSHBUTTON   "Temp Info!", IDCANCEL, 96, 81, 40, 14
    PUSHBUTTON      "Save ...", IDOK, 4, 81, 40, 14
    CTEXT           "Configuation Information Changed!!!",
                    ID_TEXT0, 19, 26, 112, 18, NOT WS_GROUP
    CTEXT            "Do you wish to Save ... ??", ID_TEXT1, 24, 60, 98, 8
    ICON            "Conf_File", -1, 65, 3, 18, 20
END

ID_SAVECONF DIALOG 116, 41, 160, 100
STYLE DS_SYSMODAL | WS_POPUP | WS_VISIBLE | WS_CAPTION
CAPTION "Save or Restore Configuration"
FONT 8, "Helv"
BEGIN
    COMBOBOX        ID_FID, 5, 14, 70, 74, CBS_SIMPLE | WS_VSCROLL |
                    WS_TABSTOP | LBS_NOTIFY | CBS_SORT
    PUSHBUTTON      "OK", IDOK, 113, 55, 40, 14
    PUSHBUTTON      "Cancel", IDCANCEL, 113, 76, 40, 14
    LTEXT           "c:\\", ID_DIR, 85, 13, 100, 13
    LTEXT           "Directory", ID_TEXT0, 85, 2, 37, 8
    LTEXT           "File Name", ID_TEXT1, 15, 3, 37, 8
END

ID_SAVEREST DIALOG 116, 41, 160, 100
STYLE DS_SYSMODAL | WS_POPUP | WS_VISIBLE | WS_CAPTION
CAPTION "Save or Restore Data"
FONT 8, "Helv"
BEGIN
    COMBOBOX        ID_FID, 5, 14, 70, 74, CBS_SIMPLE | WS_VSCROLL |
                    WS_TABSTOP | LBS_NOTIFY | CBS_SORT
    PUSHBUTTON      "OK", IDOK, 113, 55, 40, 14
    PUSHBUTTON      "Cancel", IDCANCEL, 113, 76, 40, 14
    LTEXT           "c:\\", ID_DIR, 85, 13, 100, 13
    LTEXT           "Directory", ID_TEXT0, 85, 2, 37, 8
    LTEXT           "File Name", ID_TEXT1, 15, 3, 37, 8
END
```

```
ID_SENSET DIALOG 125, 43, 160, 119
STYLE DS_SYSMODAL | WS_POPUP | WS_VISIBLE | WS_CAPTION | WS_SYSMENU
CAPTION "Grip/Trigger Options"
FONT 8, "Helv"
BEGIN
    CTEXT           "Sensor Thresholds", 109, 71, 63, 84, 8, NOT
                    WS_GROUP

    LTEXT           "Trigger Start", 107, 77, 5, 50, 10, NOT WS_GROUP
    EDITTEXT        ID_TRIGSTART, 131, 4, 25, 12, ES_AUTOHSCROLL | WS_GROUP

    LTEXT           "Shot Detect", 110, 77, 19, 54, 9, NOT WS_GROUP
    EDITTEXT        ID_SHOTDET, 131, 16, 25, 12, ES_AUTOHSCROLL

    LTEXT           "Grip Minimum", 112, 77, 30, 54, 9, NOT WS_GROUP
    EDITTEXT        ID_GRIPLOW, 131, 28, 25, 12, ES_AUTOHSCROLL

    LTEXT           "Grip Maximum", 114, 77, 41, 50, 10
    EDITTEXT        ID_GRIPHIGH, 131, 40, 25, 12, ES_AUTOHSCROLL

    PUSHBUTTON      "OK", IDOK, 87, 95, 23, 14
    PUSHBUTTON      "Cancel", IDCANCEL, 114, 95, 40, 14
END

ID_SENSORS DIALOG 188, 73, 80, 170
STYLE DS_SYSMODAL | WS_POPUP | WS_VISIBLE | WS_CAPTION
CAPTION "Enable Sensors"
FONT 8, "Helv"
BEGIN
    CONTROL         "Sensor Zero", IDM_D_ZERO, "Button", BS_AUTOCHECKBOX |
                    WS_GROUP | WS_TABSTOP, 6, 4, 70, 10
    CONTROL         "Sensor One", IDM_D_ONE, "Button", BS_AUTOCHECKBOX |
                    WS_TABSTOP, 6, 14, 70, 10
    CONTROL         "Sensor Two", IDM_D_TWO, "Button", BS_AUTOCHECKBOX |
                    WS_TABSTOP, 6, 24, 70, 10
    CONTROL         "Sensor Three", IDM_D_THREE, "Button", BS_AUTOCHECKBOX |
                    WS_TABSTOP, 6, 34, 70, 10
    CONTROL         "Sensor Four", IDM_D_FOUR, "Button", BS_AUTOCHECKBOX |
                    WS_TABSTOP, 6, 44, 70, 10
    CONTROL         "Sensor Five", IDM_D_FIVE, "Button", BS_AUTOCHECKBOX |
                    WS_TABSTOP, 6, 54, 70, 10
    CONTROL         "Sensor Six", IDM_D_SIX, "Button", BS_AUTOCHECKBOX |
                    WS_TABSTOP, 6, 64, 70, 10
    CONTROL         "Sensor Seven", IDM_D_SEVEN, "Button", BS_AUTOCHECKBOX |
                    WS_TABSTOP, 6, 74, 70, 10
    CONTROL         "", 109, "Static", SS_BLACKRECT, 2, 87, 60, 1
    CONTROL         "", 110, "Static", SS_BLACKRECT, 2, 140, 60, 1
    PUSHBUTTON      "Clear All", IDM_D_ALLOFF, 12, 92, 40, 11, WS_GROUP
    PUSHBUTTON      "Set All", IDM_D_ALLON, 12, 108, 40, 11
    DEFPUSHBUTTON   "OK", IDOK, 23, 145, 19, 14, WS_GROUP
END

ID_STUDENT DIALOG 65, 15, 336, 190
STYLE DS_SYSMODAL | WS_POPUP | WS_VISIBLE | WS_CAPTION
CAPTION "Student Information"
FONT 8, "MS Sans Serif"
BEGIN
    LTEXT           "Login ID",        ID_TEXT0, 10, 0, 37, 8, NOT WS_GROUP
    RTEXT           "Password",        ID_TEXT1, 116, 25, 34, 8, NOT WS_GROUP
    RTEXT           "Student ID",      ID_TEXT2, 112, 39, 38, 8, NOT WS_GROUP
    RTEXT           "Name",            ID_TEXT3, 128, 53, 22, 8, NOT WS_GROUP
    RTEXT           "Institution",     ID_TEXT4, 112, 67, 38, 8, NOT WS_GROUP
    RTEXT           "Data Directory", ID_TEXT5, 101, 177, 49, 8, NOT WS_GROUP

    COMBOBOX        ID_TEMPLATE, 10, 10, 90, 175, CBS_SORT |
                    CBS_SIMPLE | WS_VSCROLL | WS_TABSTOP | WS_GROUP
    EDITTEXT        ID_PASSWORD, 155, 23,  54, 12
    EDITTEXT        ID_STUDNUM,  155, 37,  134, 12
    EDITTEXT        ID_STUDNAME, 155, 51,  134, 12
    EDITTEXT        ID_STUDFORC, 155, 65,  136, 12

    CTEXT           "Language", ID_TEXT6, 115, 80, 35, 8, NOT WS_GROUP
    CONTROL         "English", ID_LANG,     "Button", BS_AUTORADIOBUTTON | WS_GR
    CONTROL                "", (ID_LANG+1), "Button", BS_AUTORADIOBUTTON, 155, 9
    CONTROL                "", (ID_LANG+2), "Button", BS_AUTORADIOBUTTON, 155, 1
```

```
    CONTROL                 "", (ID_LANG+3), "Button", BS_AUTORADIOBUTTON, 155, 1
    CONTROL                 "", (ID_LANG+4), "Button", BS_AUTORADIOBUTTON, 155, 1
    CONTROL                 "", (ID_LANG+5), "Button", BS_AUTORADIOBUTTON, 155, 1

    CONTROL           "Instructor Mode ?", ID_STUDINST, "Button",
                      BS_AUTOCHECKBOX | WS_GROUP | WS_TABSTOP, 155, 151, 73, 10
    CONTROL           "File Overwrite ?",  ID_FID,      "Button",
                      BS_AUTOCHECKBOX, 155, 163, 64, 10

    EDITTEXT          ID_DIR, 155, 175, 181, 12, WS_GROUP | WS_TABSTOP

    PUSHBUTTON        "New",    ID_NEW,    313, 42, 23, 14, WS_GROUP
    PUSHBUTTON        "Delete", ID_DELETE, 313, 57, 23, 14

    DEFPUSHBUTTON     "Save",   IDOK,     266, 114, 40, 14, WS_GROUP
    PUSHBUTTON        "Done",   IDCANCEL, 266, 128, 40, 14
    PUSHBUTTON        "Advanced ...", IDYES, 266, 142, 60, 14
END

ID_SEQUENCE DIALOG 69, 16, 234, 228
STYLE WS_POPUP | WS_VISIBLE | WS_CAPTION
CAPTION "Available Courses"
FONT 8, "MS Sans Serif"
BEGIN
    LTEXT             "Available Courses", ID_TEXT0, 20, 9, 61, 8
    COMBOBOX          ID_COURSE, 8, 20, 84, 139, CBS_SIMPLE | CBS_SORT |
                      WS_VSCROLL | WS_TABSTOP

    LTEXT             "Course Start Delay", ID_TEXT1, 122, 4, 64, 8
    EDITTEXT          ID_CRSDELAY, 191, 4, 40, 12, ES_AUTOHSCROLL
    LTEXT             "Inter-Stage Delay", ID_TEXT2, 125, 18, 61, 8, NOT WS_GROUP
    EDITTEXT          ID_INTERDELAY, 191, 18, 40, 12, ES_AUTOHSCROLL
    LTEXT             "Course Start Indicator", ID_TEXT3, 113, 34, 73, 8, NOT
                      WS_GROUP
    COMBOBOX          ID_CRSSTART, 191, 34, 40, 35, CBS_DROPDOWNLIST | CBS_SORT |
                      WS_VSCROLL | WS_TABSTOP
    LTEXT             "Course Stop Indicator", ID_TEXT4, 113, 51, 73, 8, NOT
                      WS_GROUP
    COMBOBOX          ID_CRSSTOP, 191, 51, 40, 35, CBS_DROPDOWNLIST |
                      CBS_SORT | WS_VSCROLL | WS_TABSTOP
    LTEXT             "Course Description", ID_TEXT5, 132, 72, 64, 8, NOT WS_GROUP
    EDITTEXT          ID_CRSDESC, 98, 82, 131, 33, ES_MULTILINE

    LTEXT             "Stages in Course", ID_TEXT6, 106, 124, 57, 8
    COMBOBOX          ID_STAGE, 104, 132, 59, 82, CBS_SIMPLE |
                      WS_VSCROLL | WS_TABSTOP
    PUSHBUTTON        "Remove Stage", ID_REMOVE, 109, 211, 53, 10
    LTEXT             "Available Stages", ID_TEXT7, 171, 124, 61, 8, NOT WS_GROUP
    COMBOBOX          ID_LIST, 171, 132, 58, 82, CBS_SIMPLE | CBS_SORT |
                      WS_VSCROLL | WS_TABSTOP
    PUSHBUTTON        "Add Stage", ID_ADD, 176, 212, 53, 10


    DEFPUSHBUTTON     "Run Course", IDOK, 3, 169, 43, 14, WS_GROUP
    PUSHBUTTON        "Cancel", IDCANCEL, 50, 169, 43, 14
    PUSHBUTTON        "Save", IDYES, 24, 191, 58, 11
    PUSHBUTTON        "New", ID_NEW, 24, 204, 58, 11
    PUSHBUTTON        "Delete", ID_DELETE, 24, 217, 58, 11
END

CLOSEWAIT ICON LOADONCALL C:\SOURCE\rtv2.0\BITMAPS\CLOSWAIT.ICO

ID_CLOSE DIALOG 59, 54, 160, 100
STYLE DS_SYSMODAL | WS_POPUP | WS_VISIBLE | WS_CAPTION
CAPTION "Close Window FIS ?"
FONT 8, "Helv"
BEGIN
    CTEXT             "Close Application Window ... ?", ID_ABOUT_REAL, 11, 17,
                      144, 8
    PUSHBUTTON        "OK", IDS_ERR_REGISTER_CLASS, 24, 67, 40, 14
    PUSHBUTTON        "Cancel", IDS_ERR_CREATE_WINDOW, 88, 68, 40, 14
    ICON              "CLOSEWAIT", ICON_WAIT, 69, 37, 18, 20
END
```

```
EXITWAIT ICON LOADONCALL C:\SOURCE\rtv2.0\BITMAPS\STOPWAIT.ICO

ID_EXIT DIALOG 59, 54, 160, 100
STYLE DS_SYSMODAL | WS_POPUP | WS_VISIBLE | WS_CAPTION
CAPTION "Exit FIS ?"
FONT 8, "Helv"
BEGIN
    CTEXT           "Are You Sure You Want to Quit ?", ID_ABOUT_REAL, 11, 17,
                    144, 8
    PUSHBUTTON      "OK", IDS_ERR_REGISTER_CLASS, 24, 67, 40, 14
    PUSHBUTTON      "Cancel", IDS_ERR_CREATE_WINDOW, 88, 68, 40, 14
    ICON            "EXITWAIT", ICON_WAIT, 69, 37, 18, 20
END

ID_OPTION DIALOG 35, 21, 90, 80
STYLE DS_SYSMODAL | WS_POPUP | WS_VISIBLE | WS_CAPTION
CAPTION "Gun Type Selection"
FONT 8, "Helv"
BEGIN
    RADIOBUTTON     "Smith&Weston M10", ID_GUN_SWM10, 3, 5,  70, 12, WS_GROUP
    RADIOBUTTON     "Sig Sauer P226",   ID_GUN_SIG,   3, 20, 70, 12
    RADIOBUTTON     "Glock Model 17",   ID_GUN_GM17,  3, 35, 70, 12
    RADIOBUTTON     "Browning HiPower", ID_GUN_BHI,   3, 50, 70, 12

    PUSHBUTTON      "OK", IDOK, 60, 65, 21, 12, WS_GROUP

END


RTMAIN ICON  LOADONCALL C:\SOURCE\rtv2.0\BITMAPS\RTMAIN.ICO
RT_CUR CURSOR LOADONCALL C:\SOURCE\rtv2.0\BITMAPS\RTMAIN.CUR

ID_ABOUT DIALOG FIXED 78, 30, 160, 106
STYLE DS_SYSMODAL | WS_POPUP | WS_VISIBLE | WS_CAPTION
CAPTION "About FIS ..."
FONT 8, "Helv"
BEGIN
    CTEXT           "Firearm Instrumentation System",      102, 20, 2, 128, 8
    CTEXT           "Version 2.01",                        100, 29, 11, 90, 8
    CTEXT           "@ Copyright in Canada  Febuary 1992", 103, 3, 20, 155, 8
    LTEXT           "by",                                  104, 74, 32, 11, 8
    CTEXT           "W.R. Davis Engineering Ltd.",              101, 38, 42, 92,
    ICON            "RTMAIN", ICON_MAIN, 72, 59, 18, 20
    DEFPUSHBUTTON   "OK", IDOK, 30, 89, 40, 14
    PUSHBUTTON      "Help On ...", IDM_HELP, 80, 89, 50, 14
END

REALTIME ACCELERATORS
  BEGIN
    VK_HOME, IDM_R_HOME, VIRTKEY
    VK_END, IDM_R_END, VIRTKEY
    VK_LEFT, IDM_R_BACK, VIRTKEY
    VK_RIGHT, IDM_R_NEXT, VIRTKEY
    VK_INSERT, IDM_S_INC, VIRTKEY
    VK_DELETE, IDM_S_DEC, VIRTKEY
    VK_F1, IDM_R_START, VIRTKEY
    VK_F2, IDM_R_STOP, VIRTKEY
    VK_F3, IDM_R_CLEAR, VIRTKEY
    VK_F4, IDM_R_EXIT, VIRTKEY
    VK_F5, IDM_R_SAVE, VIRTKEY
    VK_F6, IDM_R_OPEN, VIRTKEY
    VK_F10, IDM_HELP, VIRTKEY
  END

ID_CALIB DIALOG 64, 36, 175, 186
STYLE DS_SYSMODAL | WS_POPUP | WS_VISIBLE | WS_CAPTION
CAPTION "Sensor Calibration"
FONT 8, "Helv"
BEGIN
    CTEXT           "Name",     -1, 5, 6, 45, 8, NOT WS_GROUP
    CTEXT           "Max.",     -1, 70, 6, 15, 8, NOT WS_GROUP
    CTEXT           "Invert", -1, 90, 6, 25, 8, NOT WS_GROUP

    LTEXT           "Sensor Zero",  IDM_D_ZERO,  2, 23, 61, 8, NOT WS_GROUP
    LTEXT           "Sensor One",   IDM_D_ONE,   2, 38, 63, 8, NOT WS_GROUP
```

```
    LTEXT           "Sensor Two",   IDM_D_TWO,   2, 55, 62, 8, NOT WS_GROUP
    LTEXT           "Sensor Three", IDM_D_THREE, 2, 73, 63, 7, NOT WS_GROUP
    LTEXT           "Sensor Four",  IDM_D_FOUR,  2, 88, 62, 8, NOT WS_GROUP
    LTEXT           "Sensor Five",  IDM_D_FIVE,  2, 107, 63, 8, NOT WS_GROUP
    LTEXT           "Sensor Six",   IDM_D_SIX,   2, 121, 61, 8, NOT WS_GROUP
    LTEXT           "Sensor Seven", IDM_D_SEVEN, 2, 138, 62, 8, NOT WS_GROUP

    EDITTEXT        (IDM_D_ZERO+100),  70, 21, 20, 12, ES_AUTOHSCROLL | WS_GROUP


    CONTROL         "", (IDM_D_ZERO+200), "Button", BS_AUTOCHECKBOX | WS_GROUP |
                    WS_TABSTOP, 95, 22, 12, 10
    CONTROL         "", (IDM_D_ONE+200), "Button", BS_AUTOCHECKBOX |
                    WS_TABSTOP, 95, 37, 12, 10
    CONTROL         "", (IDM_D_TWO+200), "Button", BS_AUTOCHECKBOX |
                    WS_TABSTOP, 95, 54, 12, 10
    CONTROL         "", (IDM_D_THREE+200), "Button", BS_AUTOCHECKBOX |
                    WS_TABSTOP, 95, 71, 12, 10
    CONTROL         "", (IDM_D_FOUR+200), "Button", BS_AUTOCHECKBOX |
                    WS_TABSTOP, 95, 87, 12, 10
    CONTROL         "", (IDM_D_FIVE+200), "Button", BS_AUTOCHECKBOX |
                    WS_TABSTOP, 95, 106, 12, 10
    CONTROL         "", (IDM_D_SIX+200), "Button", BS_AUTOCHECKBOX |
                    WS_TABSTOP, 95, 120, 12, 10
    CONTROL         "", (IDM_D_SEVEN+200), "Button", BS_AUTOCHECKBOX |
                    WS_TABSTOP, 95, 137, 12, 10

    PUSHBUTTON      "OK", IDOK, 24, 166, 40, 14
    PUSHBUTTON      "Cancel", IDCANCEL, 80, 166, 40, 14
END


ID_DISPLAY DIALOG 188, 73, 100, 70
STYLE DS_SYSMODAL | WS_DLGFRAME WS_POPUP | WS_VISIBLE
FONT 8, "Helv"
BEGIN
    CONTROL         "Display Shot Template", ID_TEMPLATE, "Button", BS_AUTOCHECK
                    WS_TABSTOP, 6, 14, 90, 10
    DEFPUSHBUTTON   "OK", IDOK, 40, 45, 20, 14, WS_GROUP
END


ID_LOGIN DIALOG 98, 53, 156, 98
STYLE WS_VISIBLE | WS_CAPTION
CAPTION "User Login"
FONT 8, "MS Sans Serif"
BEGIN
    LTEXT           "User ID :", -1, 32, 14, 32, 8
    EDITTEXT                ID_FID, 69, 12, 63, 12, ES_AUTOHSCROLL | WS_GROUP
    LTEXT           "Password :", -1, 25, 35, 39, 8
    EDITTEXT                ID_NAMES, 69, 33, 63, 12, ES_AUTOHSCROLL | ES_PASSWO

    PUSHBUTTON      "OK", IDOK, 23, 73, 40, 14, WS_GROUP
    PUSHBUTTON      "Exit", IDCANCEL, 92, 73, 40, 14,
END


ID_INSTRUCT DIALOG 70, 26, 183, 218
STYLE WS_POPUP | WS_VISIBLE | WS_CAPTION
CAPTION "Available Stages"
FONT 8, "MS Sans Serif"
BEGIN
    LTEXT           "List of Stages",    ID_TEXT0, 16, 165, 48, 8, NOT WS_GROUP
    COMBOBOX        ID_STAGE, 4, 6, 73, 150, CBS_SIMPLE | WS_VSCROLL | WS_GROUP
                    WS_TABSTOP

    LTEXT           "Start Delay (sec)", ID_TEXT1, 87, 6, 56, 8, NOT WS_GROUP
    EDITTEXT        ID_STAGEDELAY, 146, 4, 32, 12, WS_TABSTOP | WS_GROUP
    LTEXT           "Start Indicator",   ID_TEXT2, 94, 25, 49, 8, NOT WS_GROUP
    COMBOBOX        ID_STARTVOICE, 146, 23, 32, 50, CBS_DROPDOWNLIST | WS_VSCROL
    LTEXT           "Shot Count",        ID_TEXT3, 104, 43, 39, 8, NOT WS_GROUP
    EDITTEXT        ID_SHOTS, 146, 41, 32, 12, WS_TABSTOP
    LTEXT           "Stage Duration",    ID_TEXT4, 92, 59, 51, 8, NOT WS_GROUP
    EDITTEXT        ID_DUR, 146, 57, 32, 12, WS_TABSTOP
    LTEXT           "Stop Indicator",    ID_TEXT5, 95, 80, 48, 8, NOT WS_GROUP
    COMBOBOX        ID_STOPVOICE, 146, 78, 32, 50,  CBS_DROPDOWNLIST | WS_VSCROL
```

```
    LTEXT           "Stage Description", ID_TEXT6, 97, 165, 65, 8, NOT WS_GROUP
    EDITTEXT        ID_STAGEDESC, 87, 105, 91, 51, ES_MULTILINE | WS_TABSTOP

    DEFPUSHBUTTON   "Run Stage", IDOK,      40, 186, 55, 14, WS_TABSTOP | WS_GRO
    PUSHBUTTON      "Cancel", IDCANCEL,     101, 186, 40, 14, WS_TABSTOP

    PUSHBUTTON      "New", ID_NEW,        15, 206, 45, 10, WS_TABSTOP | WS_GROUP
    PUSHBUTTON      "Delete", ID_DELETE,  71, 206, 40, 10, WS_TABSTOP
    PUSHBUTTON      "Save", IDYES,       122, 206, 45, 10, WS_TABSTOP

END


ID_WELCOME DIALOG FIXED 103, 17, 160, 216
STYLE DS_MODALFRAME | WS_POPUP | WS_VISIBLE | WS_CAPTION
CAPTION "Range-Tutor"
FONT 8, "MS Sans Serif"
BEGIN
    CONTROL         "", ID_LANG,      "Button", BS_AUTORADIOBUTTON | WS_GROUP, 7,
    CONTROL         "", (ID_LANG+1), "Button", BS_AUTORADIOBUTTON, 7, 167, 68, 1
    CONTROL         "", (ID_LANG+2), "Button", BS_AUTORADIOBUTTON, 7, 177, 68, 1
    CONTROL         "", (ID_LANG+3), "Button", BS_AUTORADIOBUTTON, 83, 157, 68,
    CONTROL         "", (ID_LANG+4), "Button", BS_AUTORADIOBUTTON, 83, 167, 68,
    CONTROL         "", (ID_LANG+5), "Button", BS_AUTORADIOBUTTON, 83, 177, 68,
    PUSHBUTTON      "Done", n100mil, 58, 200, 40, 14, WS_GROUP
    CTEXT           "Welcome Text", ID_EDIT, 17, 10, 126, 135, NOT WS_GROUP
END


100 DIALOG 104, 58, 160, 100
STYLE DS_MODALFRAME | WS_POPUP | WS_VISIBLE | WS_CAPTION | WS_SYSMENU
CAPTION "Dialog Title"
FONT 8, "MS Sans Serif"
BEGIN
    COMBOBOX        101, 33, 8, 83, 71, CBS_DROPDOWN | CBS_OWNERDRAWFIXED |
                    CBS_HASSTRINGS | WS_VSCROLL | WS_TABSTOP
END


ID_LEGEND DIALOG 0, 0, 81, 66
STYLE WS_CHILD | WS_VISIBLE | WS_CAPTION
CAPTION "Graph Legend"
FONT 8, "MS Sans Serif"
BEGIN
    LTEXT           "Sensor Name Number 1", ID_SENSORS, 2, 2, 79, 8, NOT WS_GROU
    LTEXT           "Sensor Name Number 2", (ID_SENSORS+1), 2, 12, 79, 8, NOT WS
    LTEXT           "Sensor Name Number 3", (ID_SENSORS+2), 2, 22, 79, 8, NOT WS
    LTEXT           "Sensor Name Number 4", (ID_SENSORS+3), 2, 32, 79, 8, NOT WS
    CONTROL         "", -1, "Static", SS_BLACKRECT, 0, 44, 81, 1
    LTEXT           "Group # :",  -1, 2, 47, 32, 8, NOT WS_GROUP
    LTEXT           "0000", ID_GROUP, 56, 48, 20, 8, NOT WS_GROUP
    LTEXT           "Shot #   :", -1, 2, 57, 32, 8, NOT WS_GROUP
    LTEXT           "0000", ID_SHOTS, 56, 55, 20, 8, NOT WS_GROUP
END


ID_CALIB DIALOG 93, 47, 160, 100
STYLE DS_SYSMODAL | WS_POPUP | WS_VISIBLE | WS_CAPTION
CAPTION "Grip Force Calibration"
FONT 8, "MS Sans Serif"
BEGIN
    CTEXT           "Left Side",  ID_TEXT0, 42, 63, 31, 8, NOT WS_GROUP
    CTEXT           "Front",      ID_TEXT1, 83, 62, 34, 8, NOT WS_GROUP
    CTEXT           "Right Side", ID_TEXT2, 124, 63, 36, 8, NOT WS_GROUP

    CTEXT           "Upper Limit", ID_TEXT3, 2, 2, 20, 17, NOT WS_GROUP
    EDITTEXT        (ID_GRIPHIGH+1), 41, 4, 32, 12, ES_AUTOHSCROLL | WS_GROUP
    EDITTEXT        ID_GRIPHIGH,     84, 4, 32, 12, ES_AUTOHSCROLL
    EDITTEXT        (ID_GRIPHIGH+2), 125, 4, 32, 12, ES_AUTOHSCROLL

    CTEXT           "Lower Limit", ID_TEXT4, 3, 40, 23, 15, NOT WS_GROUP
    EDITTEXT        (ID_GRIPLOW+1), 41, 41, 32, 12, ES_AUTOHSCROLL | WS_GROUP
    EDITTEXT        ID_GRIPLOW,     84, 41, 32, 12, ES_AUTOHSCROLL
    EDITTEXT        (ID_GRIPLOW+2), 125, 41, 32, 12, ES_AUTOHSCROLL
```

```
    CTEXT           "Current Value", ID_TEXT5, 1, 19, 27, 18, NOT WS_GROUP
    LTEXT           "000", (ID_THRESH+1), 48, 24, 17, 8, WS_GROUP
    LTEXT           "000", ID_THRESH,     90, 24, 16, 8
    LTEXT           "000", (ID_THRESH+2), 131, 24, 16, 8

    DEFPUSHBUTTON   "OK",     IDOK, 32, 86, 40, 14, WS_GROUP
    PUSHBUTTON      "Cancel", IDCANCEL, 85, 86, 40, 14
END


LEGEND ICON LOADONCALL C:\source\rtv2.0\bitmaps\legend.ico

GUN_SIG BITMAP LOADONCALL C:\SOURCE\rtv2.0\BITMAPS\sig.BMP
GUN_GLOCK BITMAP LOADONCALL C:\SOURCE\rtv2.0\BITMAPS\glock.BMP
GUN_BHI BITMAP LOADONCALL C:\SOURCE\rtv2.0\BITMAPS\browning.BMP
GUN_SW10 BITMAP LOADONCALL C:\SOURCE\rtv2.0\BITMAPS\swm10.BMP

GRIPFORCE ACCELERATORS
  BEGIN
    VK_F11, IDM_R_CALIBRATE, VIRTKEY
    VK_F12, IDM_R_ZERO, VIRTKEY
    VK_F1, IDM_R_START, VIRTKEY
    VK_F2, IDM_R_STOP, VIRTKEY
    VK_F3, IDM_R_CLEAR, VIRTKEY
    VK_F4, IDM_R_EXIT, VIRTKEY
    VK_F10, IDM_HELP, VIRTKEY
  END


TRIGGER ACCELERATORS
  BEGIN
    VK_F1, IDM_R_START, VIRTKEY
    VK_F2, IDM_R_STOP, VIRTKEY
    VK_F3, IDM_R_CLEAR, VIRTKEY
    VK_F4, IDM_R_EXIT, VIRTKEY
    VK_F10, IDM_HELP, VIRTKEY
  END


ONESHOT ACCELERATORS
  BEGIN
    VK_HOME, IDM_R_HOME, VIRTKEY
    VK_END, IDM_R_END, VIRTKEY
    VK_LEFT, IDM_R_BACK, VIRTKEY
    VK_RIGHT, IDM_R_NEXT, VIRTKEY
    VK_DOWN, IDM_R_WAYBACK, VIRTKEY
    VK_UP, IDM_R_WAYNEXT, VIRTKEY
    VK_DOWN, IDM_R_PREVGROUP, VIRTKEY, SHIFT
    VK_UP, IDM_R_NEXTGROUP, VIRTKEY, SHIFT
    VK_INSERT, IDM_S_INC, VIRTKEY
    VK_DELETE, IDM_S_DEC, VIRTKEY
    VK_F1, IDM_R_START, VIRTKEY
    VK_F2, IDM_R_STOP, VIRTKEY
    VK_F3, IDM_R_CLEAR, VIRTKEY
    VK_F4, IDM_R_EXIT, VIRTKEY
    VK_F5, IDM_R_SAVE, VIRTKEY
    VK_F6, IDM_R_OPEN, VIRTKEY
    VK_F10, IDM_HELP, VIRTKEY
  END

START_F1 BITMAP LOADONCALL  C:\SOURCE\rtv2.0\BITMAPS\F1.BMP
PUSH_F1 BITMAP LOADONCALL  C:\SOURCE\rtv2.0\BITMAPS\F1PUSH.BMP

STOP_F2 BITMAP LOADONCALL  C:\SOURCE\rtv2.0\BITMAPS\F2.BMP
PUSH_F2 BITMAP LOADONCALL  C:\SOURCE\rtv2.0\BITMAPS\F2PUSH.BMP

CLEAR_F3 BITMAP LOADONCALL  C:\SOURCE\rtv2.0\BITMAPS\F3.BMP
PUSH_F3 BITMAP LOADONCALL  C:\SOURCE\rtv2.0\BITMAPS\F3PUSH.BMP

CLOSE_F4 BITMAP LOADONCALL      C:\SOURCE\rtv2.0\BITMAPS\F4.BMP
PUSH_F4 BITMAP LOADONCALL  C:\SOURCE\rtv2.0\BITMAPS\F4PUSH.BMP

SAVE_F5 BITMAP LOADONCALL       C:\SOURCE\rtv2.0\BITMAPS\F5.BMP
PUSH_F5 BITMAP LOADONCALL  C:\SOURCE\rtv2.0\BITMAPS\F5PUSH.BMP
```

```
RECALL_F6 BITMAP LOADONCALL      C:\SOURCE\rtv2.0\BITMAPS\F6.BMP
PUSH_F6 BITMAP LOADONCALL  C:\SOURCE\rtv2.0\BITMAPS\F6PUSH.BMP

PRINT_F7 BITMAP LOADONCALL       C:\SOURCE\rtv2.0\BITMAPS\F7.BMP
PUSH_F7 BITMAP LOADONCALL  C:\SOURCE\rtv2.0\BITMAPS\F7PUSH.BMP

DRAW_F8 BITMAP LOADONCALL        C:\SOURCE\rtv2.0\BITMAPS\F8.BMP
PUSH_F8 BITMAP LOADONCALL  C:\SOURCE\rtv2.0\BITMAPS\F8PUSH.BMP

NEXT_F9 BITMAP LOADONCALL  C:\SOURCE\rtv2.0\BITMAPS\F9.BMP
PUSH_F9 BITMAP LOADONCALL  C:\SOURCE\rtv2.0\BITMAPS\F9PUSH.BMP

HELP_F10 BITMAP LOADONCALL       C:\SOURCE\rtv2.0\BITMAPS\F10.BMP
PUSH_F10 BITMAP LOADONCALL  C:\SOURCE\rtv2.0\BITMAPS\F10PUSH.BMP

GRIP_1 BITMAP LOADONCALL  C:\SOURCE\rtv2.0\BITMAPS\K1.BMP
PUSH_1 BITMAP LOADONCALL  C:\SOURCE\rtv2.0\BITMAPS\K1PUSH.BMP

TRIG_2 BITMAP LOADONCALL  C:\SOURCE\rtv2.0\BITMAPS\K2.BMP
PUSH_2 BITMAP LOADONCALL  C:\SOURCE\rtv2.0\BITMAPS\K2PUSH.BMP

SINGLE_3 BITMAP LOADONCALL  C:\SOURCE\rtv2.0\BITMAPS\K3.BMP
PUSH_3 BITMAP LOADONCALL  C:\SOURCE\rtv2.0\BITMAPS\K3PUSH.BMP

MULTI_4 BITMAP LOADONCALL  C:\SOURCE\rtv2.0\BITMAPS\K4.BMP
PUSH_4 BITMAP LOADONCALL  C:\SOURCE\rtv2.0\BITMAPS\K4PUSH.BMP

NULL_KEY BITMAP LOADONCALL  C:\SOURCE\rtv2.0\BITMAPS\key_nll.bmp
```

Windows Definition File

```
NAME            FIS_MAIN
EXETYPE         WINDOWS
STUB            'WINSTUB.EXE'
CODE            PRELOAD FIXED
DATA            PRELOAD FIXED MULTIPLE
HEAPSIZE        10240
STACKSIZE       20480
EXPORTS         FISMAINWndProc          @1
                RealTimeWndProc         @2
                OneShotWndProc          @3
                ForceWndProc            @5
                TriggerWndProc          @6
                FISABOUTMsgProc         @7 NODATA 0
                FISEXITMsgProc          @8 NODATA 0
                FISASKSAVEMsgProc       @9 NODATA 0
                FISSAVERESTMsgProc      @10
                FISCollectSerial        @11
                FISSAVECONFMsgProc      @12
                FISSTUDENTINFOMsgProc   @13
                FISLOGINMsgProc         @14
                FISINSTStageMsgProc     @15
                ToolBoxWndProc          @16
                FISWELCOMEMsgProc       @17
                FISSYSADVANCEMsgProc    @18
                LegendWndProc           @19
                FISCALIBRATEMsgProc     @20
                FISINSTCourseMsgProc    @21
```

We claim:

1. A firearm training system for use in combination with a firearm having a grip and a trigger, comprising:

force transducing means for detecting a hand grip force pattern applied to the grip of the firearm by a weapon hand of a shooter and a relative position of the trigger; wherein the grip force pattern consists of a side grip force and a front-to-back grip force applied by the weapon hand to a side surface and at least one of the front and back surfaces of the grip respectively, and the force transducing means separately detects the side grip force, the front-to-back grip force and the relative position of the trigger; and display means for separately displaying as a function of time a relative value of the respective front-to-back grip force, side grip force and the relative position of the trigger.

2. A firearm training system as defined in claim 1, wherein the transducing means comprises position sensing means for sensing the relative position of the trigger.

3. A firearm training system as defined in claim 1, wherein the transducing means comprises position sensing means for sensing the relative position of the trigger, and the system having a single display means for displaying both the relative values of the hand grip forces and the relative position of the trigger as a function of time.

4. A firearm training system as defined in claim 3, wherein the relative values of the hand grip forces and the relative position of the trigger are measured for the same period of time, the time period being a shot cycle including a firing of the firearm.

5. A firearm training system as defined in claim 4, wherein the measured relative values of the hand grip forces and the relative position of the trigger are simultaneously individually displayed as a function of time by the display means.

6. A firearm training system as defined in claim 1, wherein the transducing means has a pair of side force transducers and a front-to-back force transducer for respectively detecting side grip forces applied to opposite side surfaces of the grip and a front-to-back force applied to at least one of front and back surfaces of the grip by the weapon hand.

7. A firearm training system as defined in claim 6, wherein the display means includes a power supply for supplying operating power to the transducers, an analog-to-digital convertor for converting analog signals produced by the transducers to digital signals, the analog signals being a function of the hand grip forces detected by the transducers, a computerized module for storing the digital signals, and a display module for displaying for each of the transducers a grip force graph representing a relative value of the respective side and front-to-back grip forces as a function of time, the display module being driven by the computerized module.

8. A firearm training system as defined in claim 7, wherein the transducing means further includes a trigger position sensor for sensing a relative position of the trigger, the trigger position sensor receiving power from the power supply and providing to the analog-to-digital convertor analog signals which are a function of the trigger position, the analog-to-digital convertor providing separate digital signals to the computerized module for each of the transducers and the sensor, and the display module displaying corresponding separate graphs representing a relative value of the side and front-to-back grip forces as a function of time and a relative position of the trigger as a function of time.

9. A firearm training system as defined in claim 8, wherein the separate graphs are simultaneously displayed on the display module.

10. A firearm training system as defined in claim 6, 7, 8, or 10, wherein the transducing means is incorporated into the grip of the firearm.

11. A firearm training system as defined in claim 6, wherein the front-to-back and side force transducers and the position sensor are non-contact type variable resistance transducers.

12. A firearm training system as defined in claim 11, wherein the analog signals produced by the transducing means are provided to the display means by way of a flexible cable.

13. A firearm training system as defined in claim 12, wherein the analog-to-digital convertor is a PC compatible convertor, the computerized module is a personal computer (PC) using one of an Intel 80386 and 80486 processor, having a hard drive, a serial port and a parallel printer port, and the display module is one of a monochrome cathode ray monitor, a colour cathode ray monitor and a printer.

14. A firearm training system as defined in claim 13, wherein the display module is a colour cathode ray monitor (VGA), permitting the display of each of the grip force graphs and the trigger pull graph in a different colour.

15. In combination, a firearm having a grip and a trigger and a firearm training system comprising:

force transducing means for detecting a hand grip force pattern applied to the grip of the firearm by a weapon hand of a shooter; wherein the grip force pattern consists of a side grip force and a front-to-back grip force applied by the weapon hand to a side surface and at least one of the front and back surfaces of the grip respectively, and the force transducing means comprising a side force transducer and a front-to-back transducer for respectively detecting the side and front-to-back grip force applied to a side surface and at least one of the front and back surfaces of the grip respectively; and display means for separately displaying as a function of time a relative value of the respective front-to-back grip force, side grip force.

16. A combination as defined in claim 15, further comprising position sensing means for detecting a relative position of the trigger, and a display means for displaying as a function of time the relative position of the trigger detected by the sensing means.

17. A combination as defined in claim 16, wherein the display means includes a power supply for supplying operating power to the transducers, an analog-to-digital convertor for converting analog signals produced by the transducers to digital signals, the analog signals being a function of the hand grip forces detected by the transducers, a computerized module for storing the digital data, and a display module for displaying for each of the transducers a graph representing a relative value of the respective side and front-to-back grip forces as a function of time.

18. A combination as defined in claim 17, wherein the trigger position sensor receiving power from the power supply and providing to the analog-to-digital convertor, an analog signal which is a function of the position of the trigger, the analog-to-digital convertor providing separate digital signals to the computerized module for each of the transducers and the sensor, and the display module displaying separate graphs for each of the side and front-to-back grip forces respectively and a trigger pull graph representing the relative position of the trigger as a function of time.

19. A method of training a shooter by determining the grip pattern of a weapon hand of the shooter on a firearm having a grip and a trigger, comprising the step of:

detecting a front-to-back grip force and a side grip force applied by the weapon hand to at least one of the front and back surfaces and a side surface of the grip respectively;

detecting a relative trigger position of the trigger; and graphically displaying a relative value of the front-to-back grip force, the side grip force and the relative position of the trigger respectively as a function of time.

20. A method of training a shooter by determining the grip pattern and trigger pull of a weapon hand operating a firearm having a grip and a trigger, comprising the step of:

detecting simultaneously a front-to-back grip force and a side grip force applied by the weapon hand of the shooter to at least one of the front and back surfaces and a side surface of the grip respectively and a relative position of the trigger; and graphically and separately displaying as a function of time the relative values of the front-to-back grip force and the side grip force respectively and a relative position of the trigger for a selectively time period including a firing of the firearm.

21. A method as defined in claim 19 or 20, the front-to-back and side forces and the trigger position being measured under one of dry and live firing conditions.

* * * * *

UNITED STATES PATENT AND TRADEMARK OFFICE

CERTIFICATE OF CORRECTION

PATENT NO. : 5,316,479

DATED : May 31, 1994

INVENTOR(S) : Wong et al

It is certified that error appears in the above-identified patent and that said Letters Patent is hereby corrected as shown below:

Column 294, Line 2, Claim 10, delete "10" and substitute therefor ---9---; Column 294, Lines 15-16, Claim 13, delete "using one of an Intel 80386 and 80486 processor".

Signed and Sealed this

First Day of November, 1994

*Attest:*

*Attesting Officer*

Bruce Lehman

BRUCE LEHMAN

*Commissioner of Patents and Trademarks*